US009765768B2

(12) United States Patent
Priddy

(10) Patent No.: US 9,765,768 B2
(45) Date of Patent: Sep. 19, 2017

(54) CONCRETE PUMP SYSTEM AND METHOD

(71) Applicant: Francis Wayne Priddy, Bartonville, TX (US)

(72) Inventor: Francis Wayne Priddy, Bartonville, TX (US)

( * ) Notice: Subject to any disclaimer, the term of this patent is extended or adjusted under 35 U.S.C. 154(b) by 480 days.

(21) Appl. No.: 14/339,189

(22) Filed: Jul. 23, 2014

(65) Prior Publication Data

US 2015/0198181 A1 Jul. 16, 2015

Related U.S. Application Data

(63) Continuation-in-part of application No. 14/155,812, filed on Jan. 15, 2014, now Pat. No. 8,827,657.

(60) Provisional application No. 61/933,929, filed on Jan. 31, 2014.

(51) Int. Cl.
*F04B 39/10* (2006.01)
*F04B 15/02* (2006.01)

(52) U.S. Cl.
CPC ..... *F04B 39/1006* (2013.01); *F04B 15/02* (2013.01); *Y10T 137/87804* (2015.04)

(58) Field of Classification Search
CPC ..... F04B 39/1006; F04B 15/02; Y10T 137/87804
See application file for complete search history.

(56) References Cited

U.S. PATENT DOCUMENTS 3,298,322 A 1/1967 Sherrod
3,639,086 A 2/1972 Robbins
4,953,595 A 9/1990 Kotlyar
5,141,408 A 8/1992 Conrad et al.
5,380,174 A 1/1995 Schwing
5,993,181 A * 11/1999 Hudelmaier ..... F04B 7/0034 417/519
8,827,651 B2 * 9/2014 Bottome ..... F01D 11/008 416/193 R

OTHER PUBLICATIONS

PCT International Searching Authority, International Search Report and Written Opinion of the counterpart international application of this application, Apr. 29, 2015.

* cited by examiner

*Primary Examiner* — Charles Freay
(74) *Attorney, Agent, or Firm* — Kevin M. Klughart; David W. Carstens; Carstens & Cahoon, LLP

(57) ABSTRACT

A pump system/method configured to provide substantially constant flow of concrete, cement, or other material is disclosed. The system integrates a trapezoidal cutting ring and spectacle plate in conjunction with lofted transitional interfaces to the hydraulic pump cylinder rams and output ejection port to ensure that pressurized discharge concrete material is not allowed to be relaxed nor backflow into the material sourcing hopper. The trapezoidal cutting ring is configured to completely seal off the trapezoidal spectacle ports as it smoothly transitions between the hydraulic pump input ports during cycle changes thus generating a more uniform output flow of concrete while eliminating hopper backflow and hydraulic fluid shock. A control system is configured to coordinate operation of the hydraulic pump cylinder rams and cutting ring to ensure that output ejection port pressure and material flow is maintained at a relatively constant level throughout all portions of the pumping cycle.

10 Claims, 192 Drawing Sheets

2400

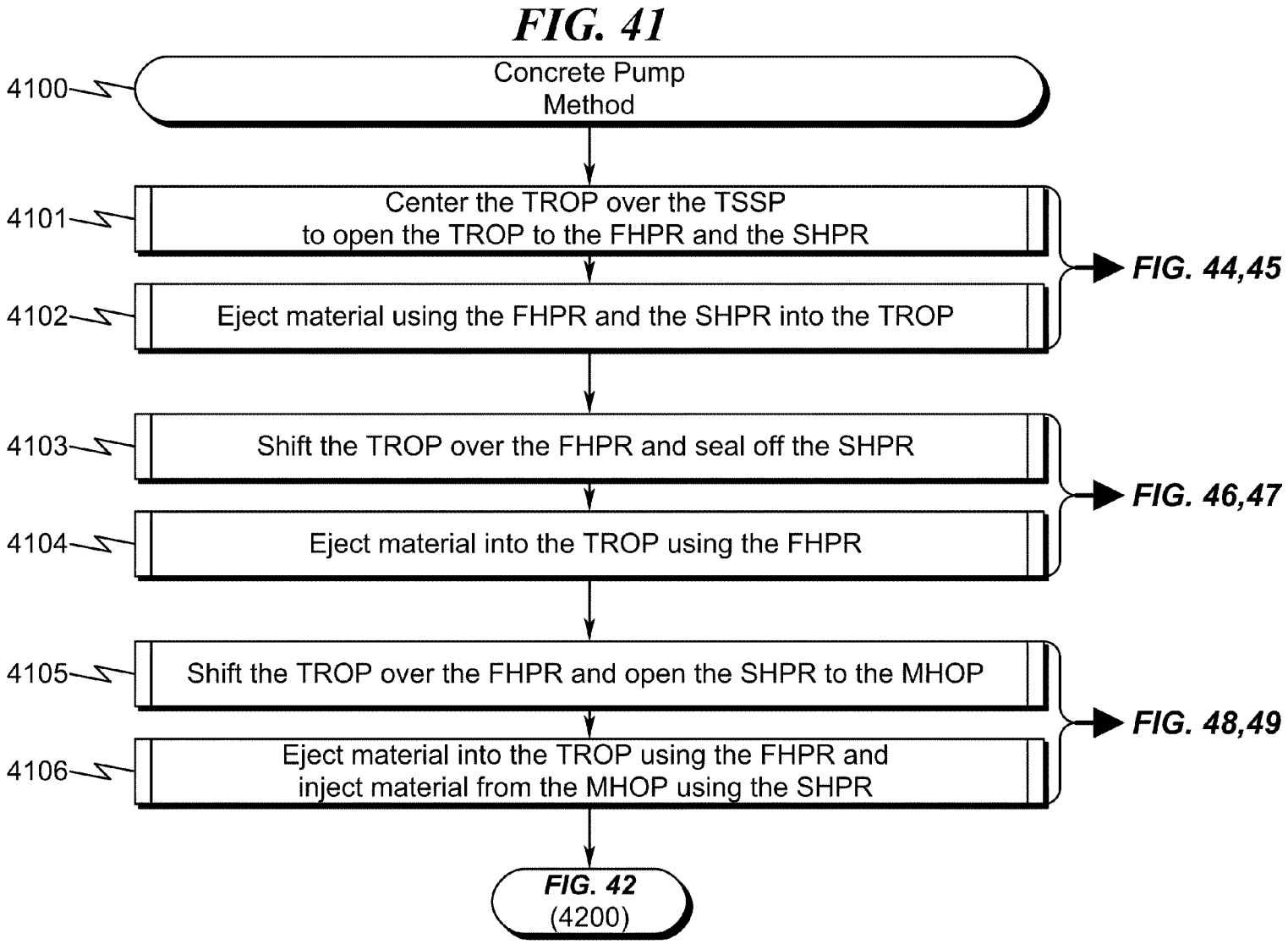
FIG. 41
Concrete Pump Method
4100
Center the TROP over the TSSP to open the TROP to the FHPR and the SHPR
4101
FIG. 44,45
Eject material using the FHPR and the SHPR into the TROP
4102
Shift the TROP over the FHPR and seal off the SHPR
4103
FIG. 46,47
Eject material into the TROP using the FHPR
4104
Shift the TROP over the FHPR and open the SHPR to the MHOP
4105
FIG. 48,49
Eject material into the TROP using the FHPR and inject material from the MHOP using the SHPR
4106
FIG. 42 (4200)

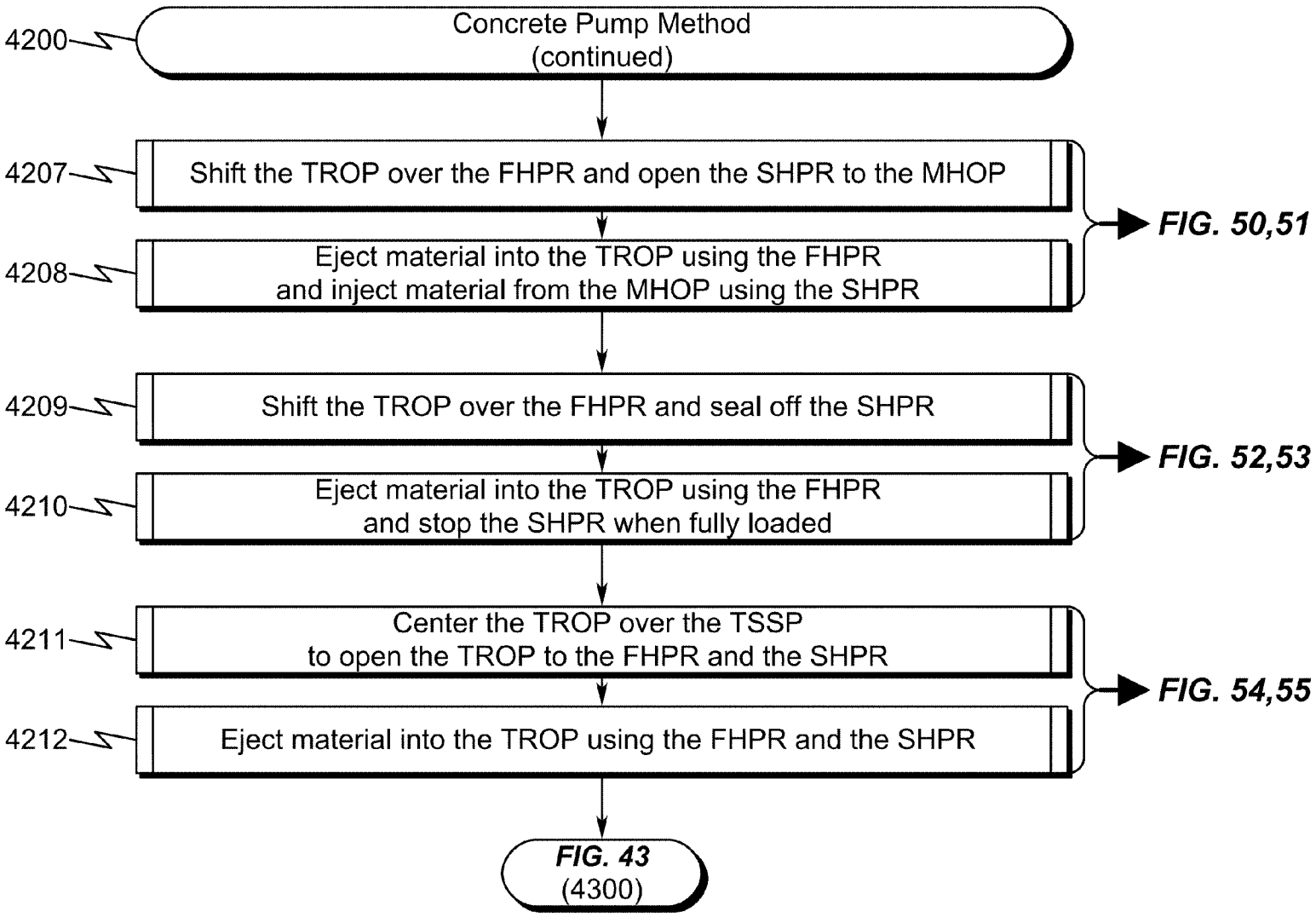
FIG. 42
Concrete Pump Method (continued)
4200
Shift the TROP over the FHPR and open the SHPR to the MHOP
4207
FIG. 50,51
Eject material into the TROP using the FHPR and inject material from the MHOP using the SHPR
4208
Shift the TROP over the FHPR and seal off the SHPR
4209
FIG. 52,53
Eject material into the TROP using the FHPR and stop the SHPR when fully loaded
4210
Center the TROP over the TSSP to open the TROP to the FHPR and the SHPR
4211
FIG. 54,55
Eject material into the TROP using the FHPR and the SHPR
4212
FIG. 43 (4300)

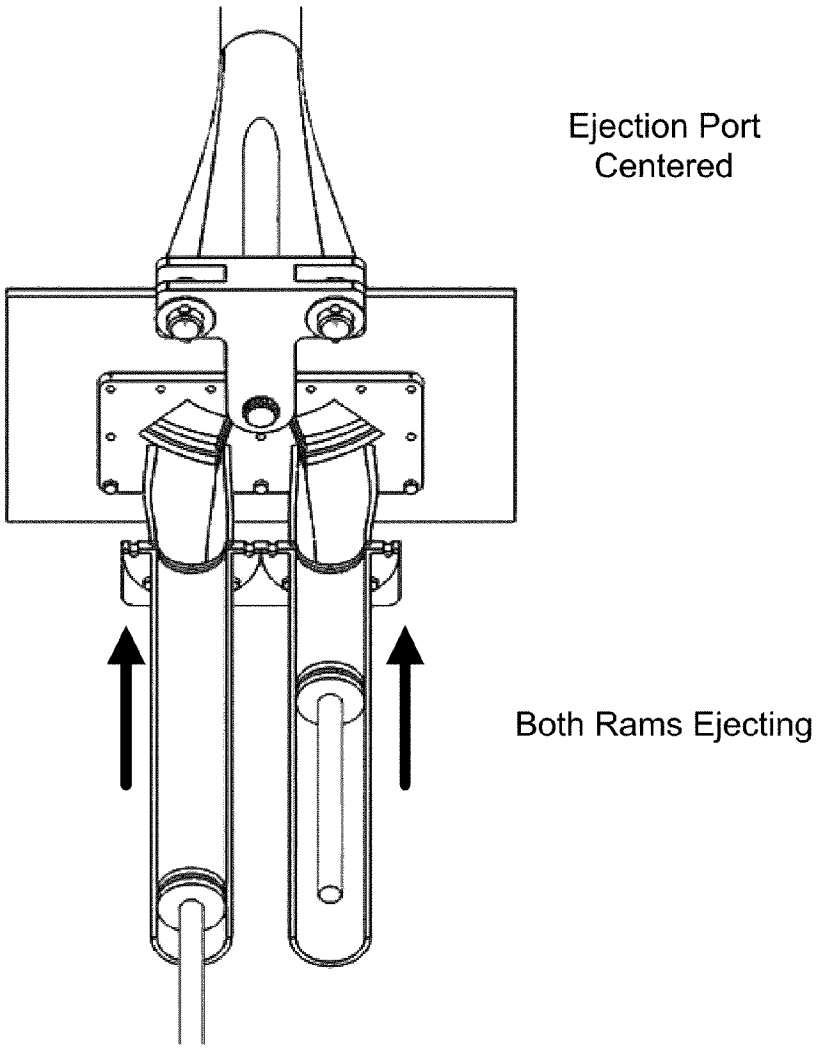
FIG. 44
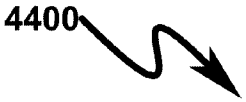

Prior Art

10000

10900

11400

12100

13000

13100

13200

13300

13400

13500

13600

13700

14000

14200

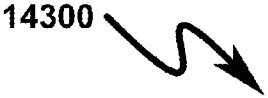
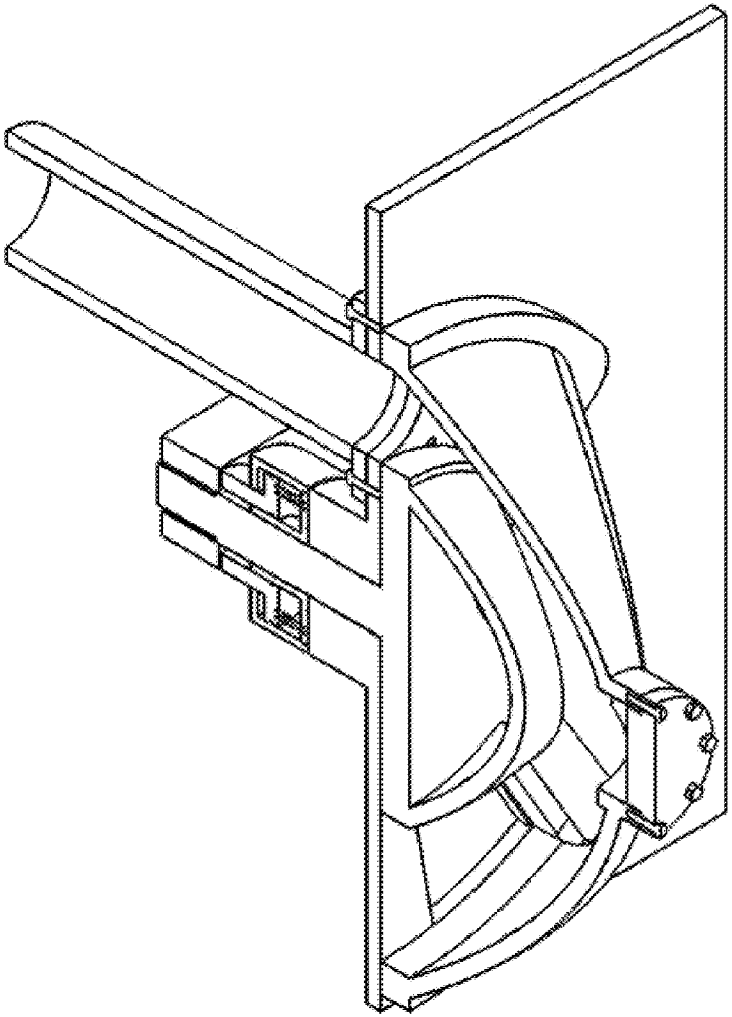
FIG. 143

14500

14600

15000

15100

15800

16200

CONCRETE PUMP SYSTEM AND METHOD

CROSS REFERENCE TO RELATED APPLICATIONS

U.S. Utility Patent Applications

This is a Continuation-In-Part patent application of United States Utility Patent Application for CONCRETE PUMP SYSTEM AND METHOD by inventor Francis Wayne Priddy, filed electronically with the USPTO on Jan. 15, 2014, with Ser. No. 14/155,812.

U.S. Utility Patent Applications

This application claims benefit under 35 U.S.C. §120 and incorporates by reference United States Utility Patent Application for CONCRETE PUMP SYSTEM AND METHOD by inventor Francis Wayne Priddy, filed electronically with the USPTO on Jan. 15, 2014, with Ser. No. 14/155,812.

U.S. Provisional Patent Applications

This application claims benefit under 35 U.S.C. §119 and incorporates by reference United States Provisional Patent Application for CONCRETE PUMP SYSTEM AND METHOD by inventor Francis Wayne Priddy, filed electronically with the USPTO on Jan. 31, 2014, with Ser. No. 61/933,929.

PARTIAL WAIVER OF COPYRIGHT

All of the material in this patent application is subject to copyright protection under the copyright laws of the United States and of other countries. As of the first effective filing date of the present application, this material is protected as unpublished material.

However, permission to copy this material is hereby granted to the extent that the copyright owner has no objection to the facsimile reproduction by anyone of the patent documentation or patent disclosure, as it appears in the United States Patent and Trademark Office patent file or records, but otherwise reserves all copyright rights whatsoever.

STATEMENT REGARDING FEDERALLY SPONSORED RESEARCH OR DEVELOPMENT

Not Applicable

REFERENCE TO A MICROFICHE APPENDIX

Not Applicable

FIELD OF THE INVENTION

The present invention generally relates to systems and methods for pumping concrete and/or cement. Specifically, the present invention in many preferred embodiments has application to situations in which concrete/cement must be pumped with a uniform flow rate.

Without limiting the scope of the present invention, the general field of invention scope may fall into one or more U.S. patent classifications including 417/532; 417/900; 417/531; 417/248; 417/254; 417/258; 417/265; 417/267; 417/532; 417/437; 251/356; 92/169.1; and 91/138.

PRIOR ART AND BACKGROUND OF THE INVENTION

Background (0100)-(0400)

Conventional concrete pumps are typically configured in functional construction as depicted in FIG. 1 (0100)-FIG. 4 (0400). As illustrated in FIG. 1 (0100), it can be seen that a material hopper (MHOP) (0101) is filled with concrete/cement or other material that is to be pumped through an ejection port (0102) to a construction jobsite for delivery to a concrete form or other containment structure. Hydraulic pumps (0103, 0104) alternately are filled with material from the hopper (0101) using hydraulic pump rams (0105, 0106), and these same hydraulic pump rams (0105, 0106) are activated to push the material into the ejection port (0102) to the jobsite. The ejection port (0102) articulates between each hydraulic pump cylinder (0103, 0104) and their corresponding hydraulic pump ram (0105, 0106) by virtue of a driveshaft (0107) linked to a positioning means (0108) that is rotated by virtue of hydraulic positioning drivers (0109, 0110). Hydraulic pressure driving the hydraulic pump rams (0105, 0106) and the hydraulic positioning drivers (0109, 0110) is coordinated so that the material in the hopper is injected into a loading pump cylinder (0103, 0104) when the cylinder input port is open to the material hopper (0101) and transmitted to the ejection port (0102) when the other hydraulic pump ram (0105, 0106) is activated. The cycle alternates between injection in one pump cylinder port and ejection from the other pump cylinder port. As depicted in FIG. 4 (0400), a spectacle plate (0411) mates with the articulating ejection port (0102) based on the activation state of each hydraulic pump cylinder and corresponding hydraulic pump ram.

As depicted in the diagrams within FIG. 1 (0100)-FIG. 4 (0400), the spectacle plate (0411) and articulating ejection port (0102) typically operate in a two-state left/right operational mode and are configured such that there is a center transition region between the two cylinder ports in which no flow occurs from the pump cylinders (0103, 0104) to the articulating ejection port (0102). In this transition region, the flow through the articulating ejection port (0102) will be abruptly stopped and started with backflow into the material hopper (0101), resulting in heightened stresses within the pump cylinders (0103, 0104) and piping/hoses connected to the articulating ejection port (0102). These heightened stresses can cause premature wear and/or failure of the pumping system as well as make manipulation of the hoses distributing the concrete difficult at the terminal job site. While some prior art configurations may utilize a pressurized pneumatic ballast (low pressure accumulator) connected to the articulating ejection port (0102) (not shown) to modulate the impulse pressure differentials associated with this operation, this workaround is not entirely successful in forcing a uniform material flow through the articulating ejection port (0102). Furthermore, this approach does not improve the wear and stress associated with the pump cylinders (0103, 0104) which may in some circumstances incorporate internal piston springs (not shown) or other modifications to limit the impulse pressure loads on the hydraulic drivers (0105, 0106).

One skilled in the art will recognize that the articulation of the driveshaft (0107) and positioning means (0108) may be accomplished using the hydraulic drivers (0109, 0110) as depicted or by using a wide variety of other mechanical means. The illustration of the hydraulic drivers (0109, 0110)

in this context is only exemplary of a wide variety of methodologies to articulate the position of the material ejection port (0102).

Typical Pump Cycle (0500)-(1900)

To better understand the benefits of the present invention, a detailed review of conventional prior art concrete pumping systems is warranted. A typical method associated with a prior art concrete pumping cycle is depicted in the flowchart of FIG. 5 (0500) with supporting drawings illustrating the various steps depicted in FIG. 6 (0600)-FIG. 19 (1900). The typical pumping method includes the following steps:

(1) As depicted in FIG. 6 (0600) and FIG. 7 (0700), suspending pumping operations during the transition of the cutting plate/ejection port from the left to the right hydraulic pump ram (0501);

(2) As depicted in FIG. 8 (0800) and FIG. 9 (0900), repositioning the cutting plate/ejection port from the left to the right hydraulic pump ram (0502);

(3) As depicted in FIG. 10 (1000) and FIG. 12 (1200), receiving concrete from the material hopper into the first (left) hydraulic pump ram via the first (left) spectacle plate port in conjunction with step (4) (0503);

(4) As depicted in FIG. 11 (1100) and FIG. 12 (1200), activating the second hydraulic pump ram to eject concrete through the second spectacle plate port and into the ejection port in conjunction with step (3) (0504);

(5) As depicted in FIG. 13 (1300) and FIG. 14 (1400), suspending pumping operations during the transition of the cutting plate/ejection port from the right to the left hydraulic pump ram (0505);

(6) As depicted in FIG. 15 (1500) and FIG. 16 (1600), repositioning the cutting plate/ejection port from the right to the left hydraulic pump ram (0506);

(7) As depicted in FIG. 17 (1700) and FIG. 19 (1900), receiving concrete from the material hopper into the second (right) hydraulic pump ram via the second (right) spectacle plate port in conjunction with step (8) (0507);

(8) As depicted in FIG. 18 (1800) and FIG. 19 (1900), activating the first hydraulic pump ram to eject concrete through the first spectacle plate port and into the ejection port in conjunction with step (7) (0508); and (9) Proceeding to step (1) to repeat the pumping cycle.

As depicted in these steps and diagrams, the prior art concrete pumping method incurs suspended pumping operating when transitioning the ejection port from the left-to-right (0501, 0600, 0700) and right-to-left (0505, 1300, 1400) hydraulic pumping cylinders. Furthermore, as the ejection port moves over the spectacle plate, there may be regions of operation where material from the ejection port may reflow/backflow into the material hopper (see detail in FIG. 6 (0600), FIG. 7 (0700), FIG. 13 (1300) and FIG. 14 (1400)), thus reducing the overall flow rate of concrete to the jobsite.

Typical Pump Cycle Flow Inefficiencies (2000)-(2400)

Within the traditional pumping cycle depicted in FIG. 6 (0600)-FIG. 19 (1900), several inefficiencies exist. FIG. 20 (2000)-FIG. 24 (2400) are provided to illustrate these inefficiencies by depicting only the hydraulic pump rams, spectacle plate, and output ejection port. As generally depicted in FIG. 20 (2000) and FIG. 21 (2100), when the ejection port is fully covering one of the two hydraulic pump ram pumps, material may be ejected from the right hydraulic pump to the ejection port and injected into the left hydraulic pump ram from the material hopper. In this state the ejection port (and corresponding piping to the job site) is fully sealed with respect to the pumping operation.

However, as generally depicted in FIG. 22 (2200) and FIG. 23 (2300), when the ejection port is partially covering one of the two hydraulic pump rams, material may backflow from the ejection port to the material hopper because the system is no longer fully sealed by the right hydraulic pump ram. This typically results in a reduction of pumping pressure and overall reduction in material moved by the pumping operation.

Finally, as generally depicted in FIG. 24 (2400), as the ejection port transitions between the right and left hydraulic pump rams, there exists a "dead zone" where pumping operations are essentially suspended as neither hydraulic pump ram has access to the ejection port. This transition region results in an impulse reduction in pump flow that places stress on the ejection port and hydraulic pump rams. The reduction in pump flow during this transition period is an undesirable artifact of this conventional pump architecture.

Deficiencies in the Prior Art

The prior art as detailed above suffers from the following deficiencies:

- Prior art concrete pump systems and methods do not sustain a constant flow of material through the ejection port.
- Prior art concrete pump systems and methods due to their non-uniform material flow may result in difficulties placing concrete at the job site because of the impulse nature of material flow within piping at the job site.
- Prior art concrete pump systems and methods incur one or more portions of the pumping cycle wherein no material is pumped through the ejection port.
- Prior art concrete pump systems and methods may permit material to reflow from the ejection port to the material hopper during one or more portions of the pumping cycle.
- Prior art concrete pump systems and methods generally incur spikes in hydraulic pressure during the center transition region of the output port, resulting in significant wear and stress on the hydraulic pump.
- Prior art concrete pump systems and methods generally require an accumulator or other device connected to the output port to modulate spikes in output material flow pressure.

While some of the prior art may teach some solutions to several of these problems, the core issue of pumping concrete with a uniform delivery rate has not been solved by the prior art.

OBJECTIVES OF THE INVENTION

Accordingly, the objectives of the present invention are (among others) to circumvent the deficiencies in the prior art and affect the following objectives in the context of a concrete pump system and method:

(1) Provide for a concrete pump system and method that provides for a uniform material delivery rate.

(2) Provide for a concrete pump system and method that provides for an increased material delivery rate as compared to the prior art.

(3) Provide for a concrete pump system and method that minimizes or eliminates material reflow from the ejection port back into the material hopper.

(4) Provide for a concrete pump system and method that is easily retrofitted into existing concrete pump systems.

(5) Provide for a concrete pump system and method that does not require an accumulator or other devices to modulate impulse material flow.

(6) Provide for a concrete pump system and method that eases the placement of material at the job site by providing a uniform delivery flow through the output ejection port.

While these objectives should not be understood to limit the teachings of the present invention, in general these objectives are achieved in part or in whole by the disclosed invention that is discussed in the following sections. One skilled in the art will no doubt be able to select aspects of the present invention as disclosed to affect any combination of the objectives described above.

BRIEF SUMMARY OF THE INVENTION

The present invention as embodied in a system and method utilizes a trapezoidal-shaped spectacle plate and associated cutting ring in conjunction with coordination of hydraulic pump ram operation to ensure the following:

The flow path from each hydraulic pump ram is never obstructed when transferring material to the ejection port.

Each hydraulic pump ram is positively sealed off at the end of the pumping cycle to prevent material from reflowing from the ejection port back into the material hopper.

The trapezoidal-shaped spectacle plate is mated with a corresponding trapezoidal-shaped cutting ring that may be optionally fitted with sealing wings that ensure backflow from the ejection port is minimized or eliminated.

The system/method as described herein may be applied to conventional concrete pumping systems in which two hydraulic pump rams are used in a bipolar operation mode with a first hydraulic pump ram injecting material from the material hopper while the second hydraulic pump ram ejects material into the ejection port for delivery to the job site. In this configuration, the ejection port and associated cutting plate articulates between the first and second hydraulic pump rams. However, the present invention also anticipates that the ejection port and cutting ring may be configured to support multiple injecting/ejecting hydraulic pump rams and thus permit "ganged" pumping into a common ejection port assembly that rotates between the hydraulic pump ram input ports. This configuration may permit improved overall pumping rates as compared to existing prior art concrete pumps.

BRIEF DESCRIPTION OF THE DRAWINGS

For a fuller understanding of the advantages provided by the invention, reference should be made to the following detailed description together with the accompanying drawings wherein:

FIG. 41 illustrates a flowchart depicting a preferred exemplary invention method described in more detail in FIG. 44-FIG. 61;

FIG. 42 illustrates a flowchart depicting a preferred exemplary invention method described in more detail in FIG. 44-FIG. 61;

FIG. 44 illustrates a front perspective view of a preferred exemplary embodiment of the present invention utilizing a sectioned annular-ring-shaped spectacle plate configured with the ejection port centered and both rams ejecting;

FIG. 119 illustrates a side sectional perspective view of an alternate preferred exemplary embodiment of the present invention with TSCR positioned to cover both hydraulic ram input ports incorporating a YS tube and hopper with auto compensating cutting ring hydraulic tensioning;

FIG. 120 illustrates a side sectional perspective detail view of an alternate preferred exemplary embodiment of the present invention with TSCR positioned to cover both hydraulic ram input ports incorporating a YS tube and hopper with auto compensating cutting ring hydraulic tensioning;

FIG. 121 illustrates a right front perspective isolation view of an alternate preferred exemplary embodiment of a typical cast YS TSCR assembly;

FIG. 122 illustrates a right rear perspective isolation view of an alternate preferred exemplary embodiment of a typical cast YS TSCR assembly;

FIG. 123 illustrates a top view of an alternate preferred exemplary embodiment of a typical cast YS TSCR assembly;

FIG. 124 illustrates a bottom view of an alternate preferred exemplary embodiment of a typical cast YS TSCR assembly;

FIG. 125 illustrates a side view of an alternate preferred exemplary embodiment of a typical cast YS TSCR assembly;

FIG. 126 illustrates a side sectional view of an alternate preferred exemplary embodiment of a typical cast YS TSCR assembly;

FIG. 127 illustrates a side sectional perspective view of an alternate preferred exemplary embodiment of a typical cast YS TSCR assembly;

FIG. 128 illustrates a front and rear views of an alternate preferred exemplary embodiment of a typical cast YS TSCR assembly;

FIG. 129 illustrates a general side sectional view of a preferred exemplary embodiment of the present invention incorporating a YE tube and hopper with auto compensating cutting ring hydraulic tensioning;

FIG. 130 illustrates a right front perspective view of an alternate preferred exemplary embodiment of the present invention with TSCR positioned to cover both hydraulic ram input ports incorporating a YE tube and hopper with auto compensating cutting ring hydraulic tensioning;

Figure 131:
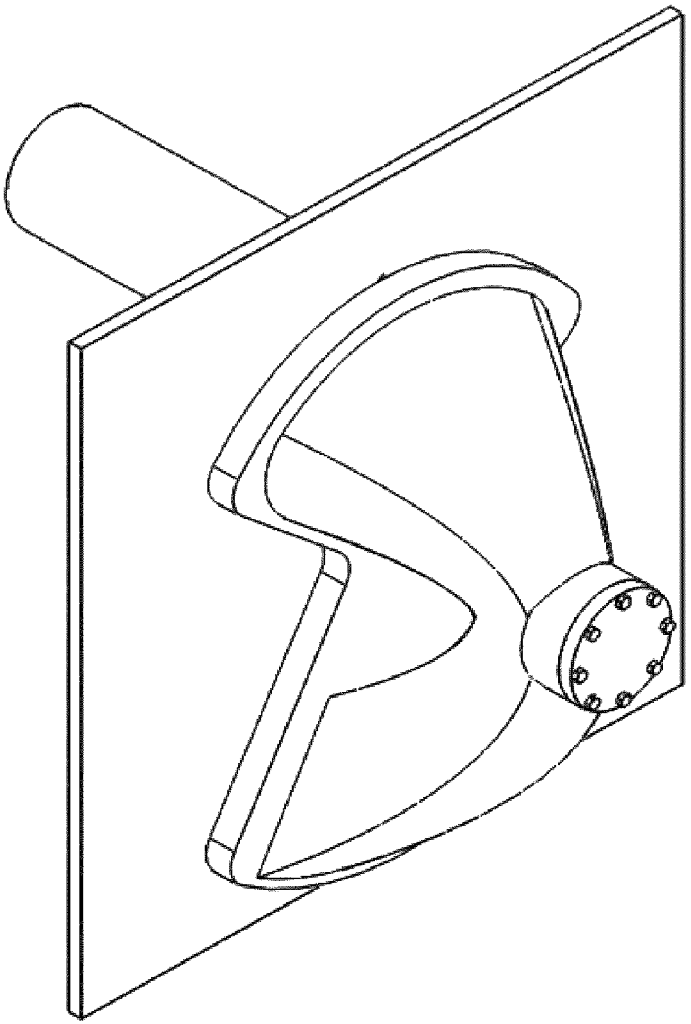
Figure 132:
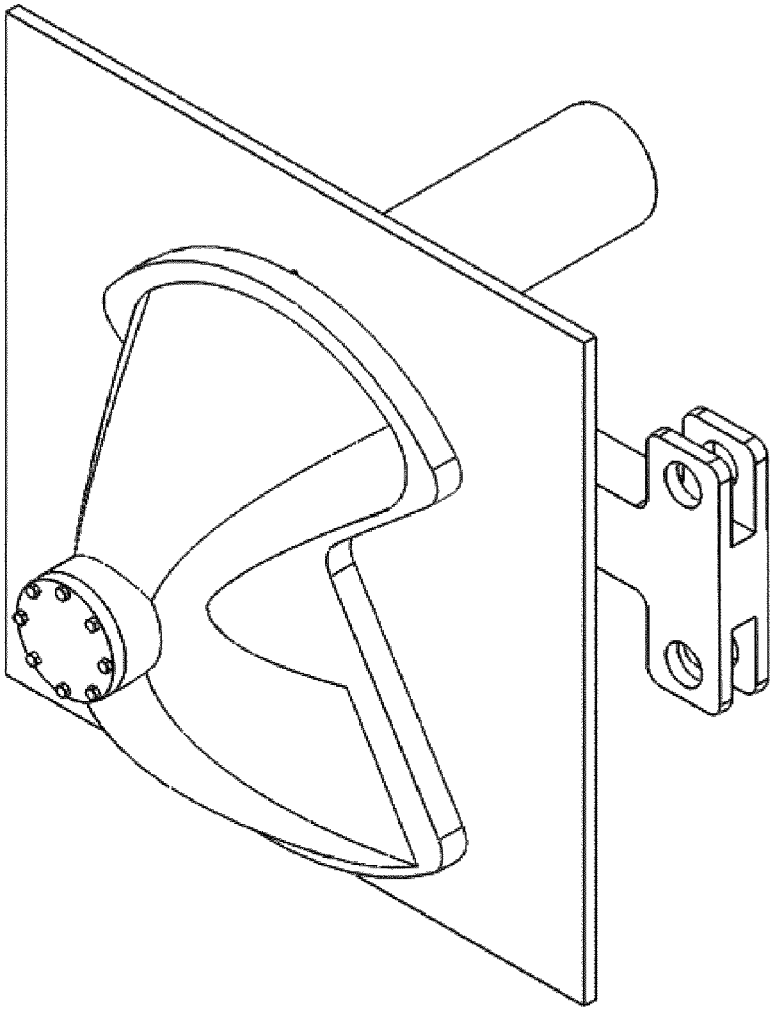
Figure 133:
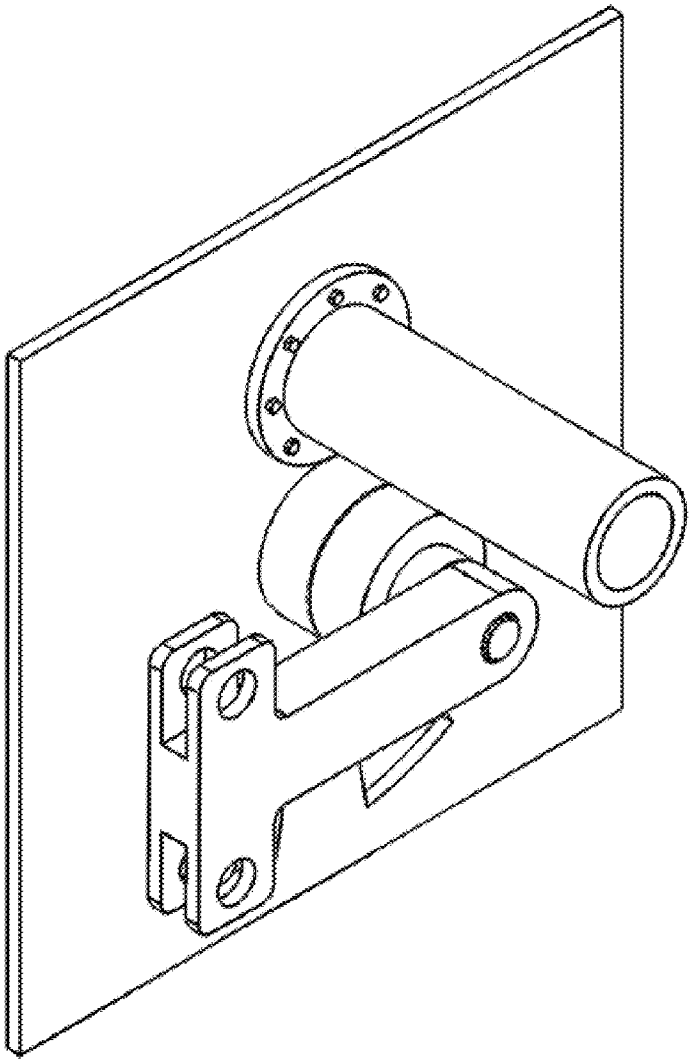
Figure 134:
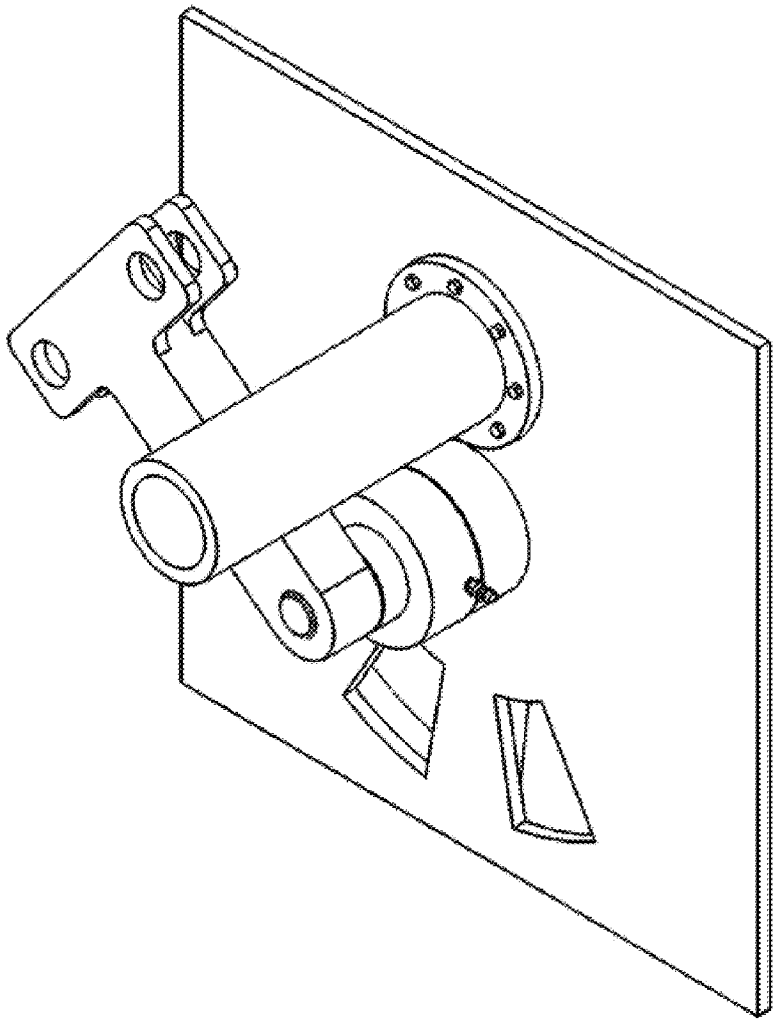
Figure 135:
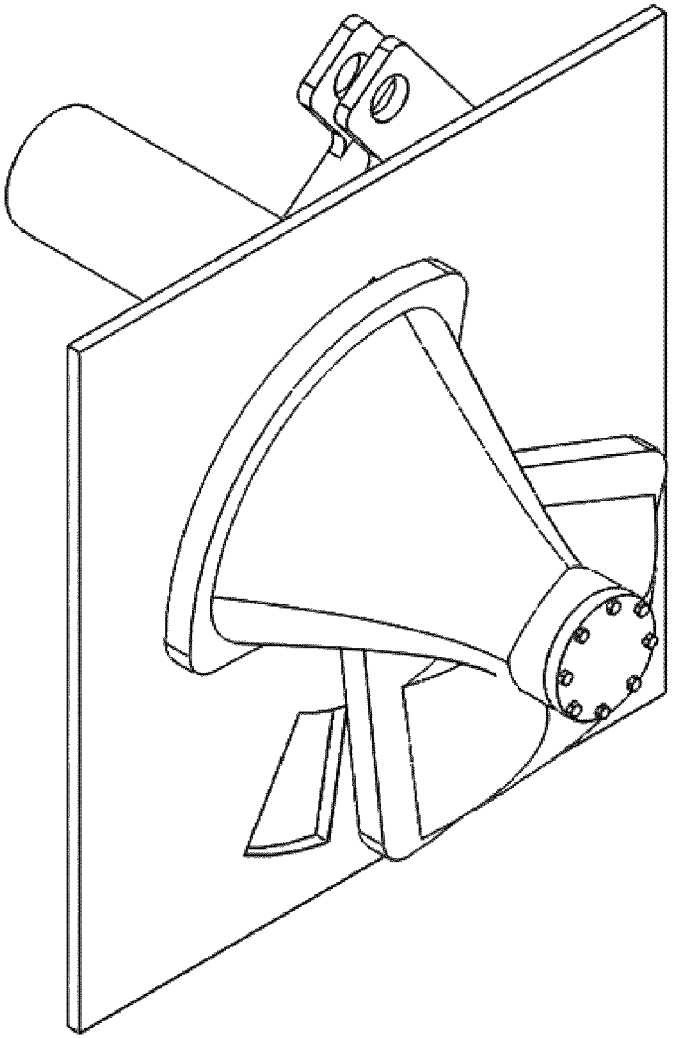
Figure 136:
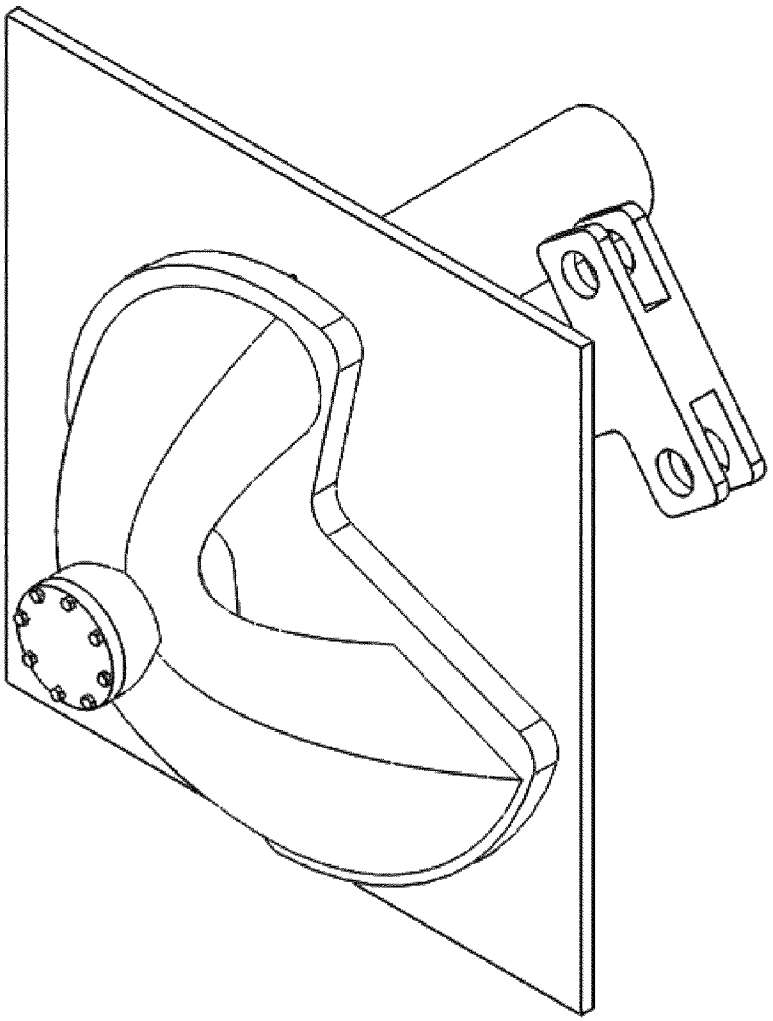
Figure 137:
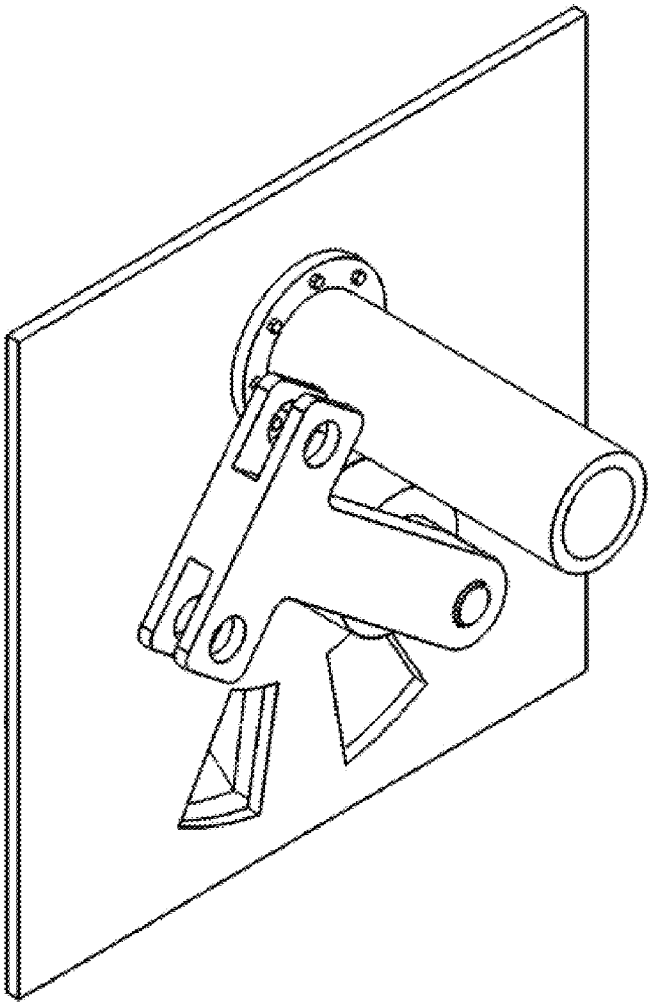
Figure 138:
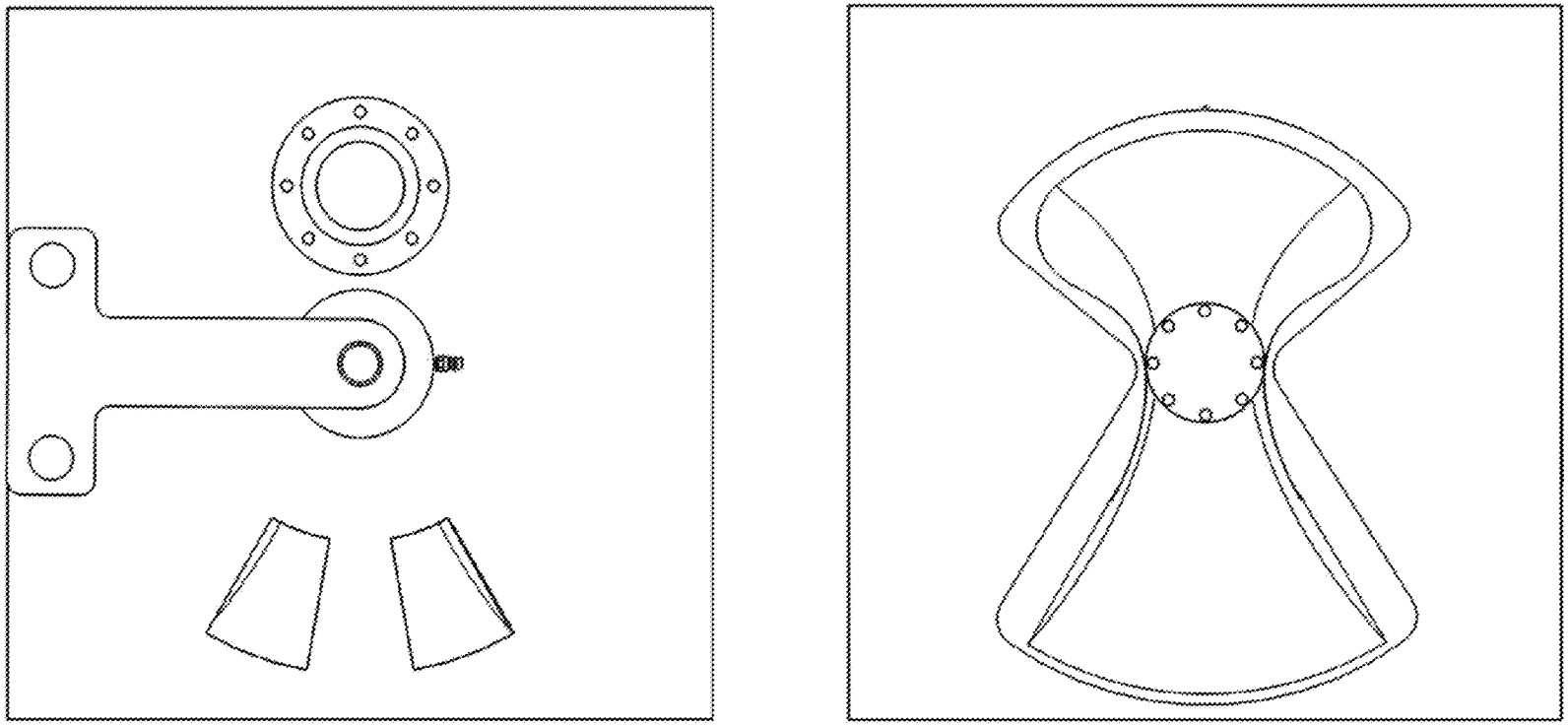
Figure 139:
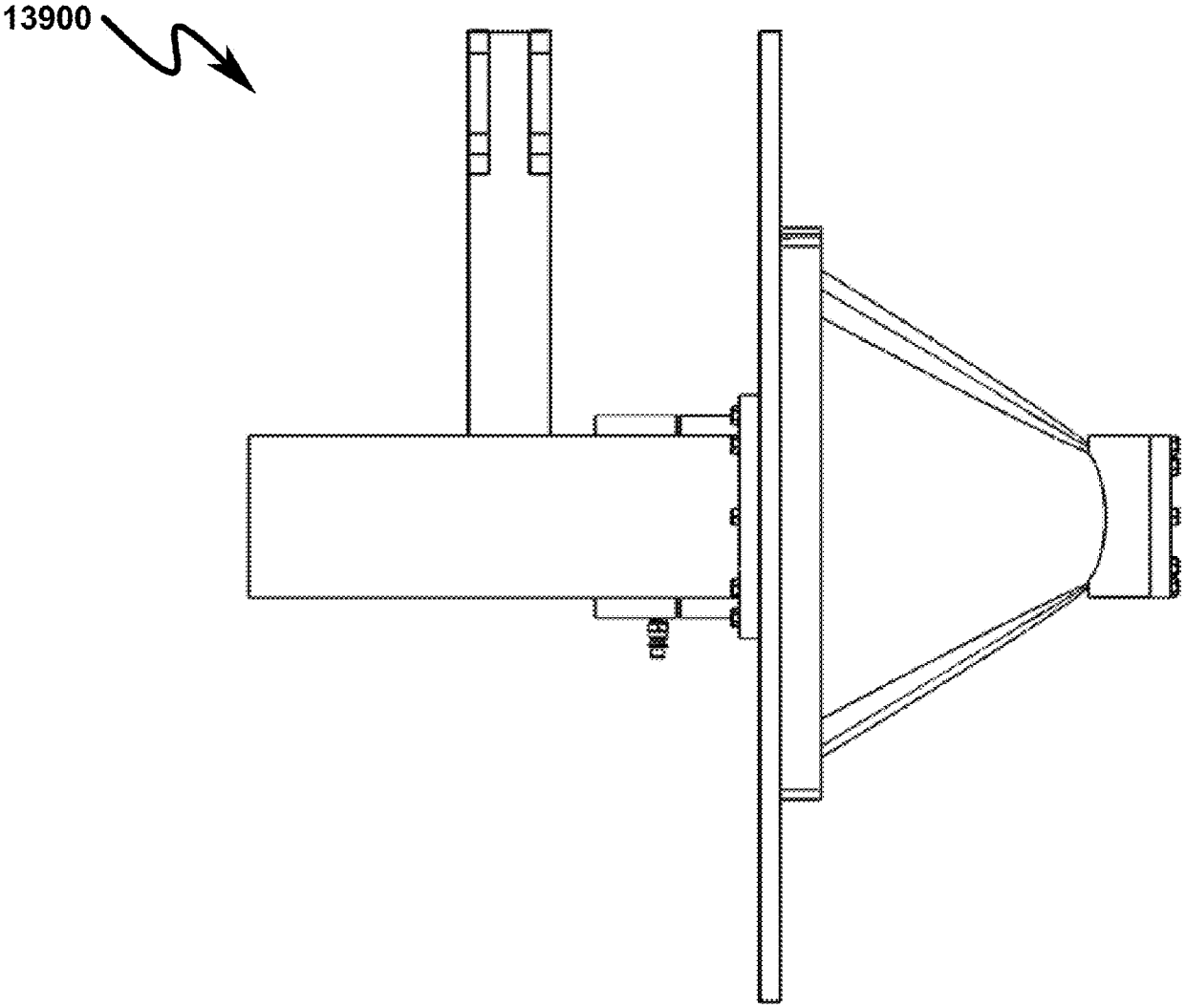
Figure 140:
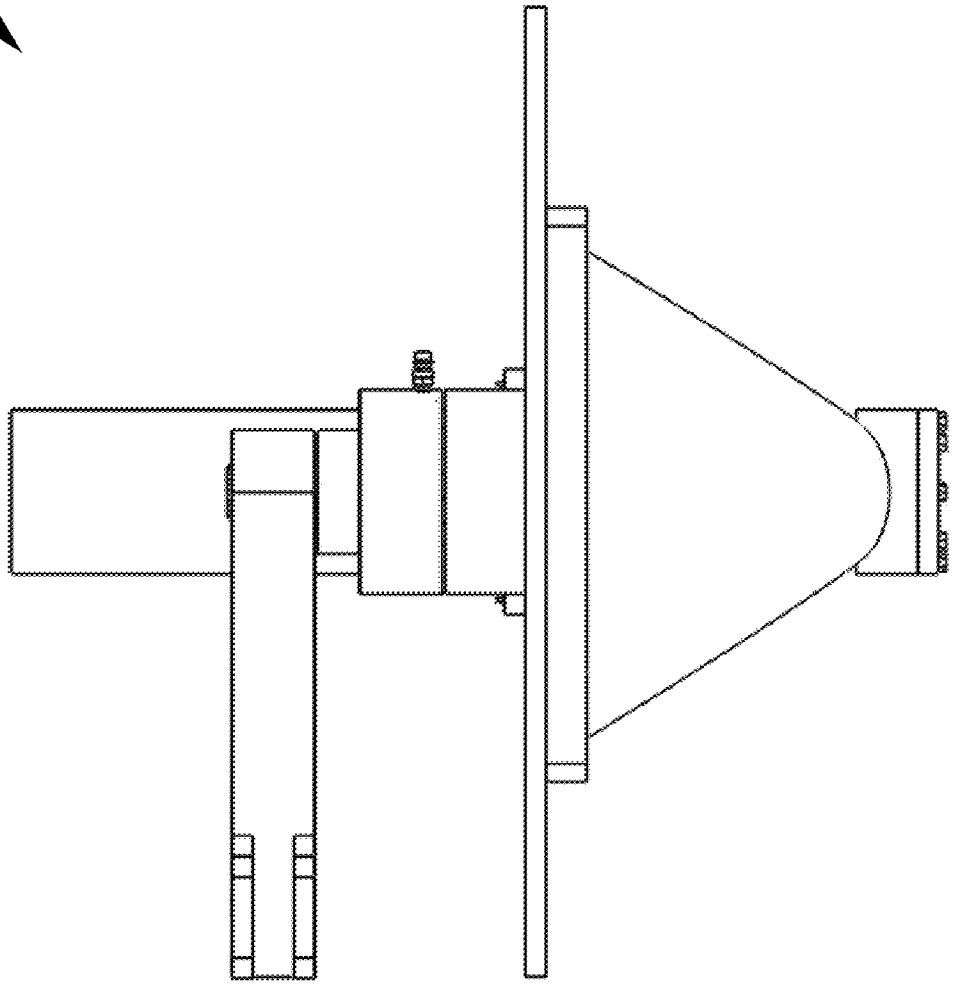
Figure 141:
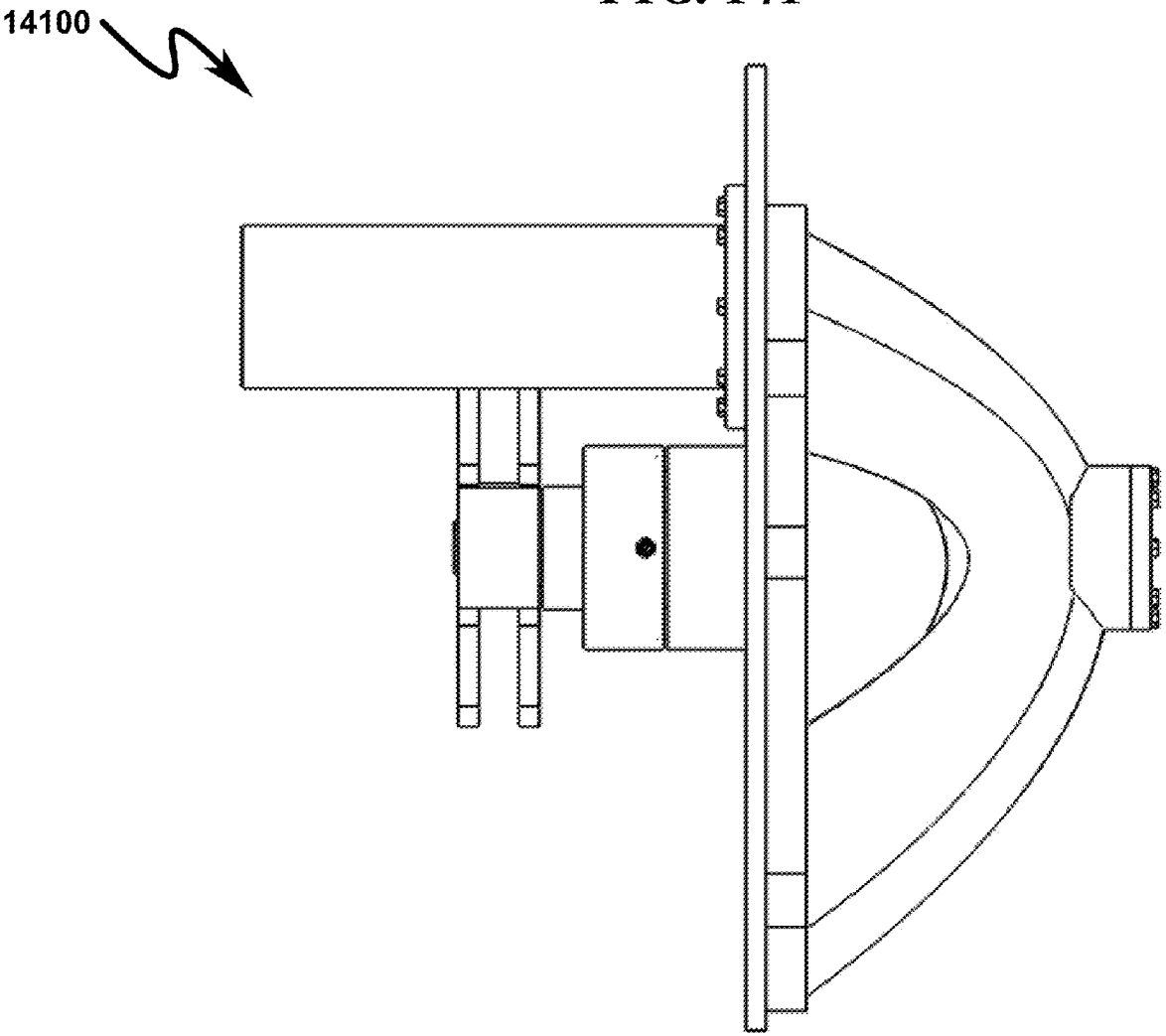
Figure 142:
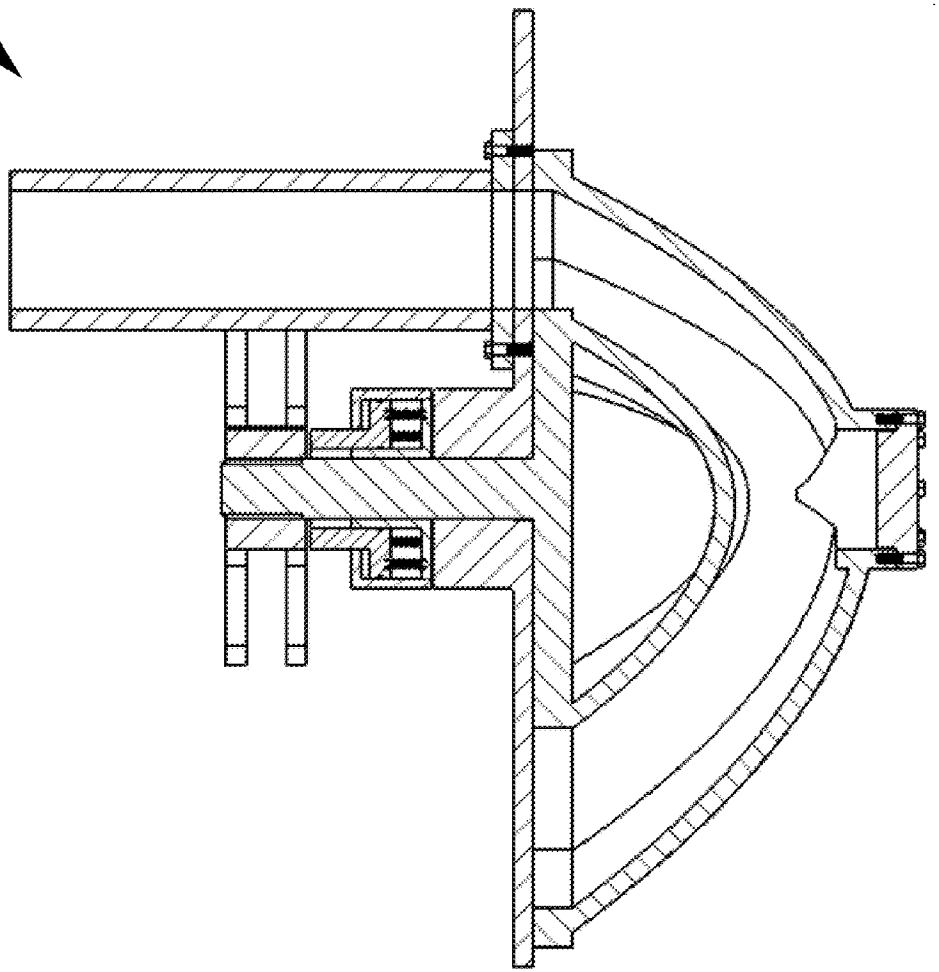
Figure 144:
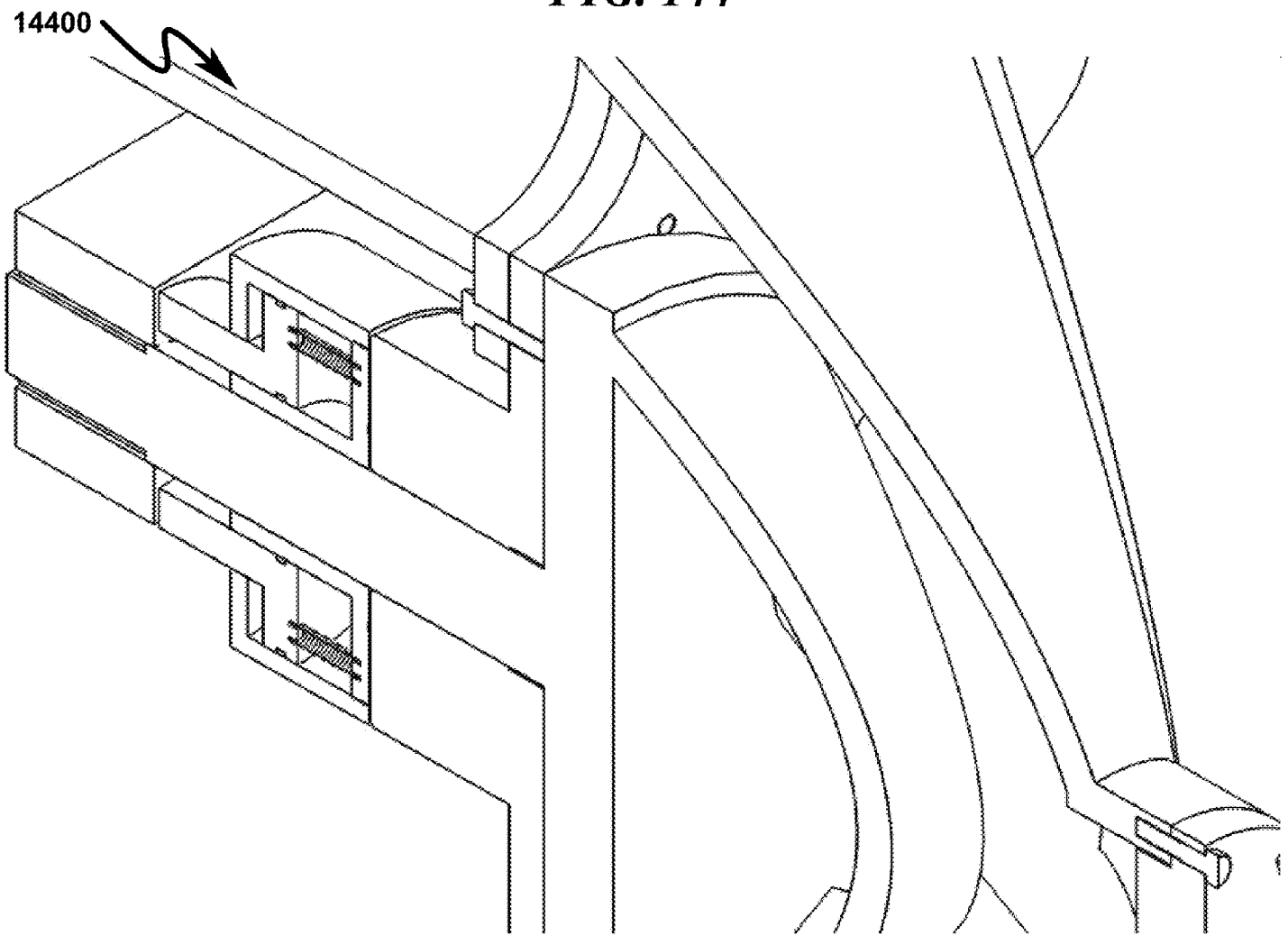
Figure 145:
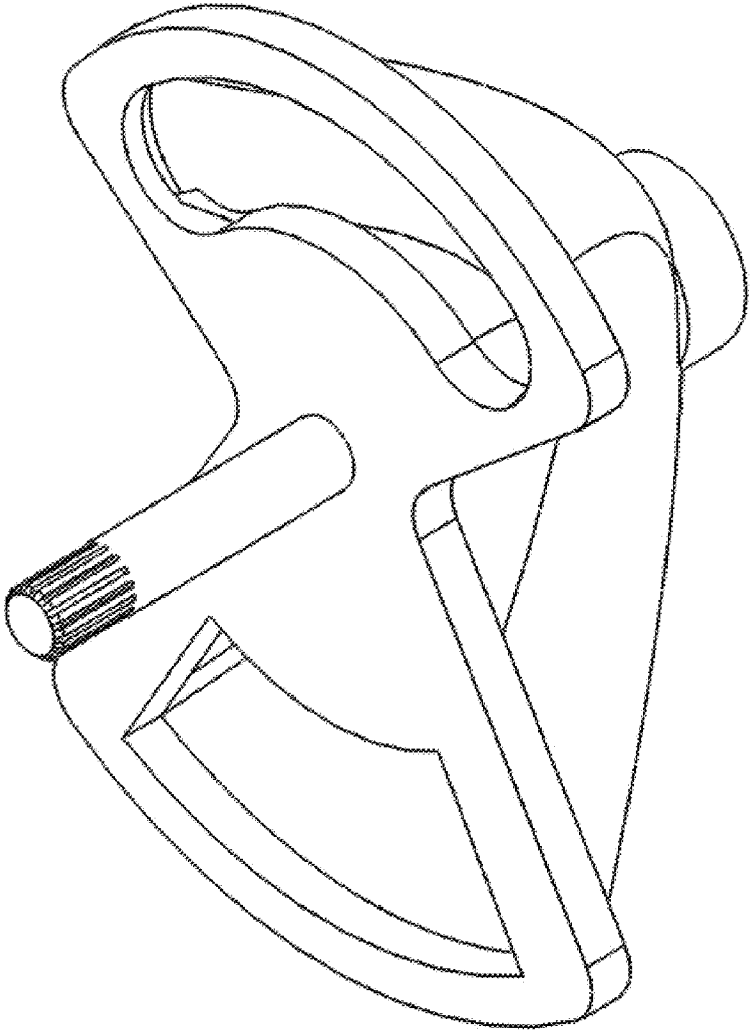
Figure 146:
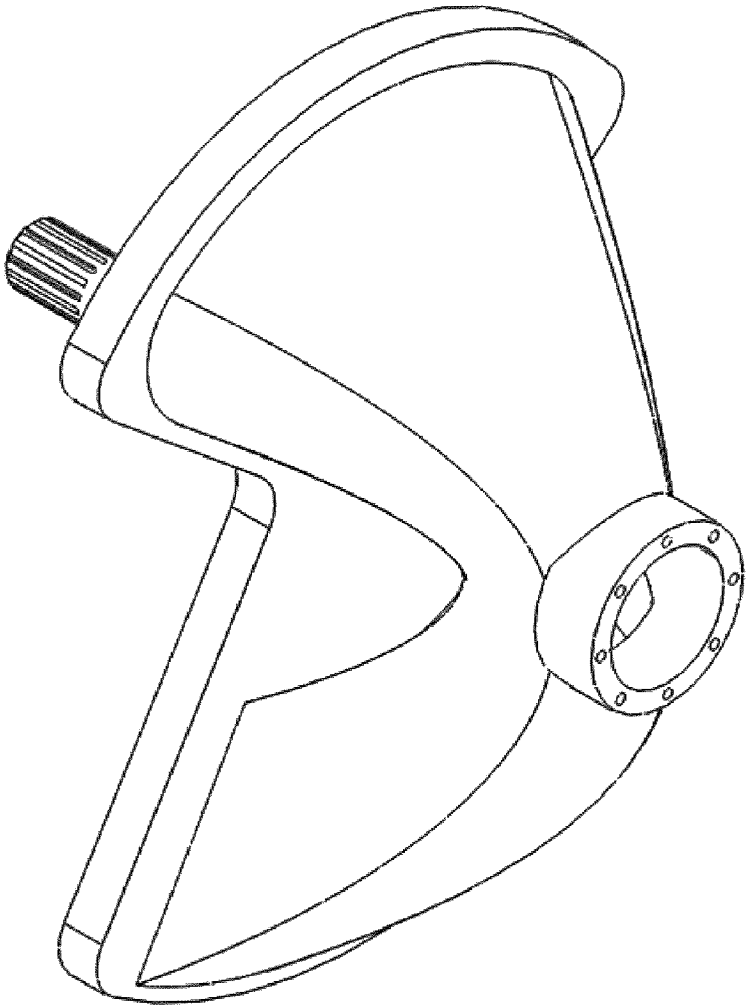
Figure 147:
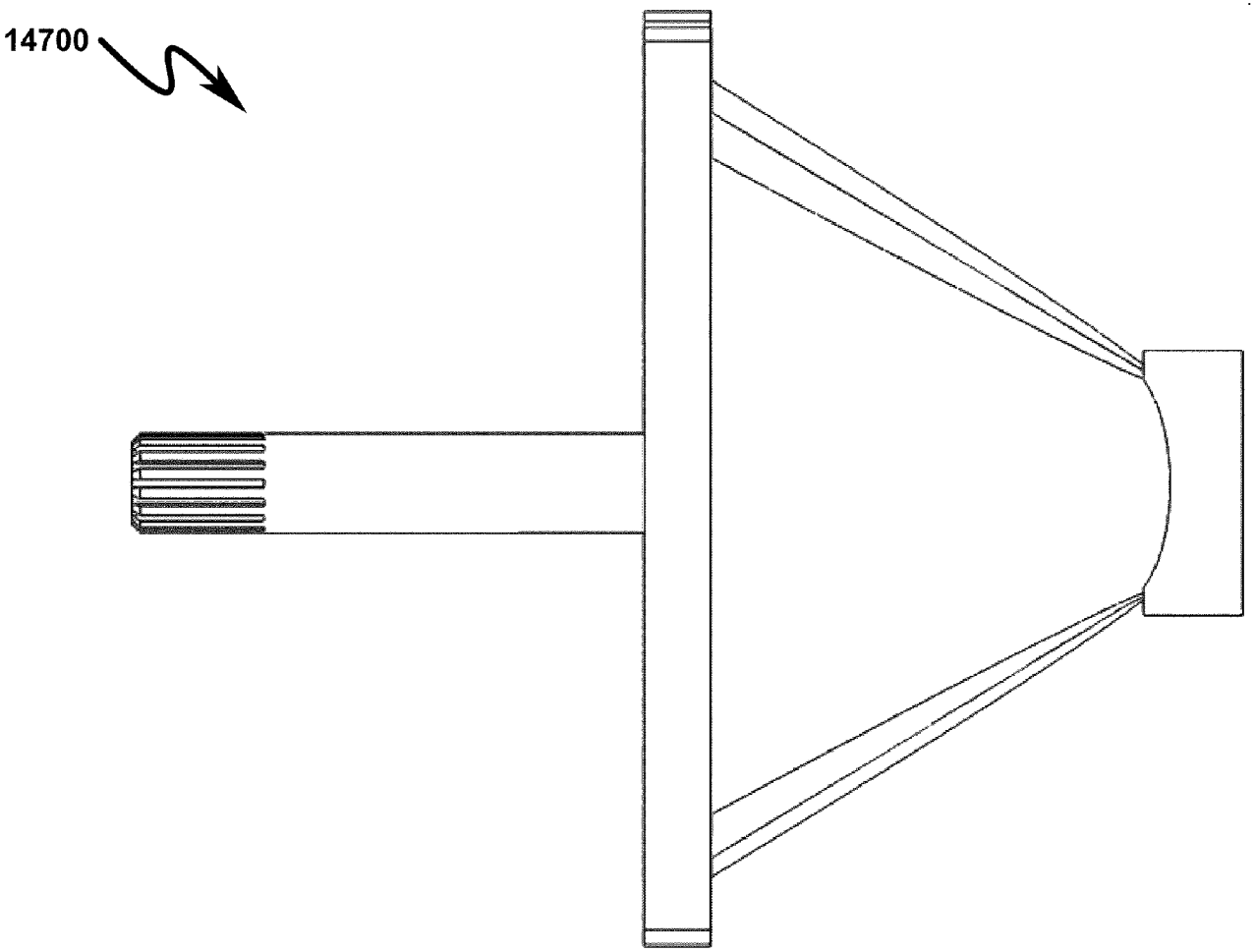
Figure 148:
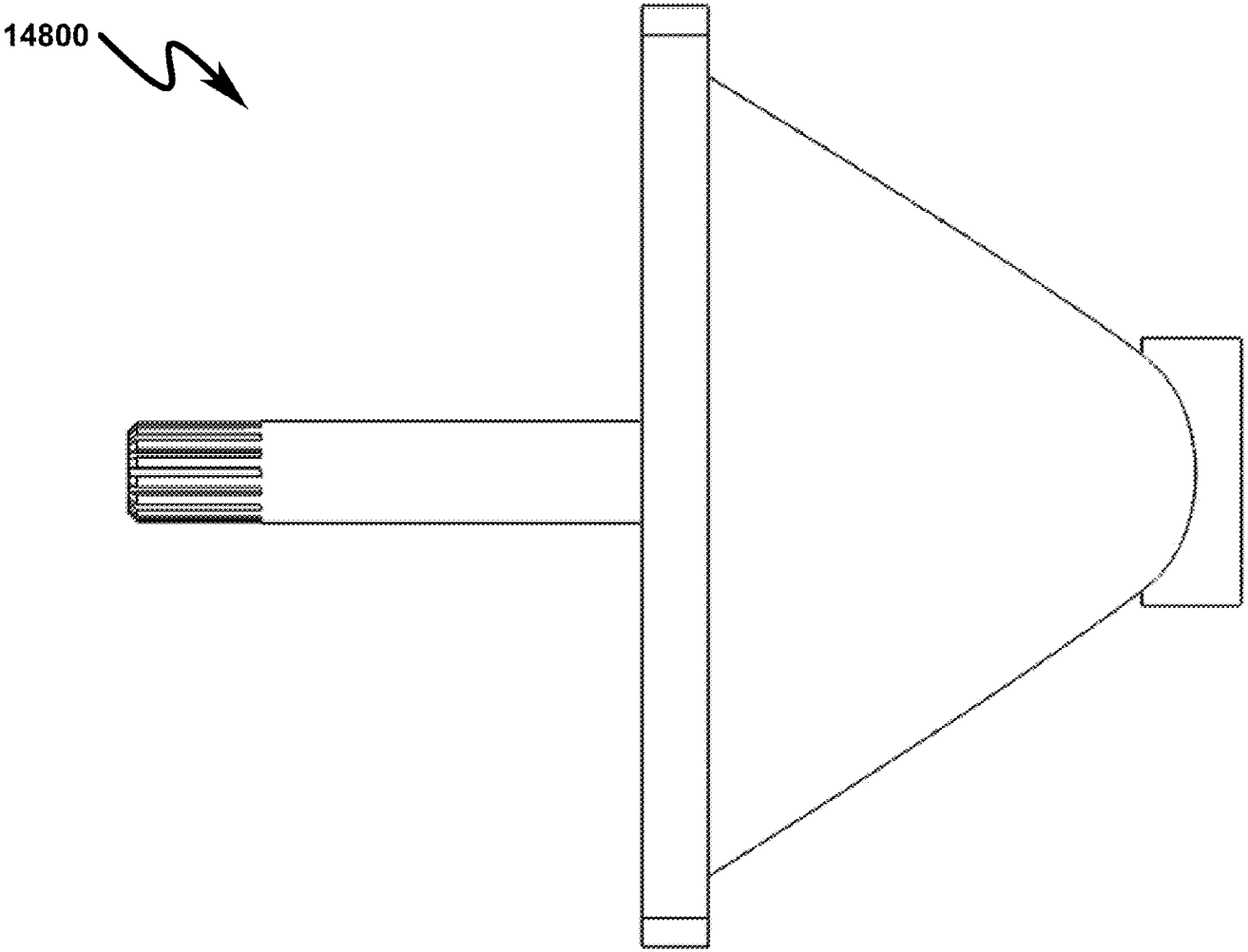
Figure 149:
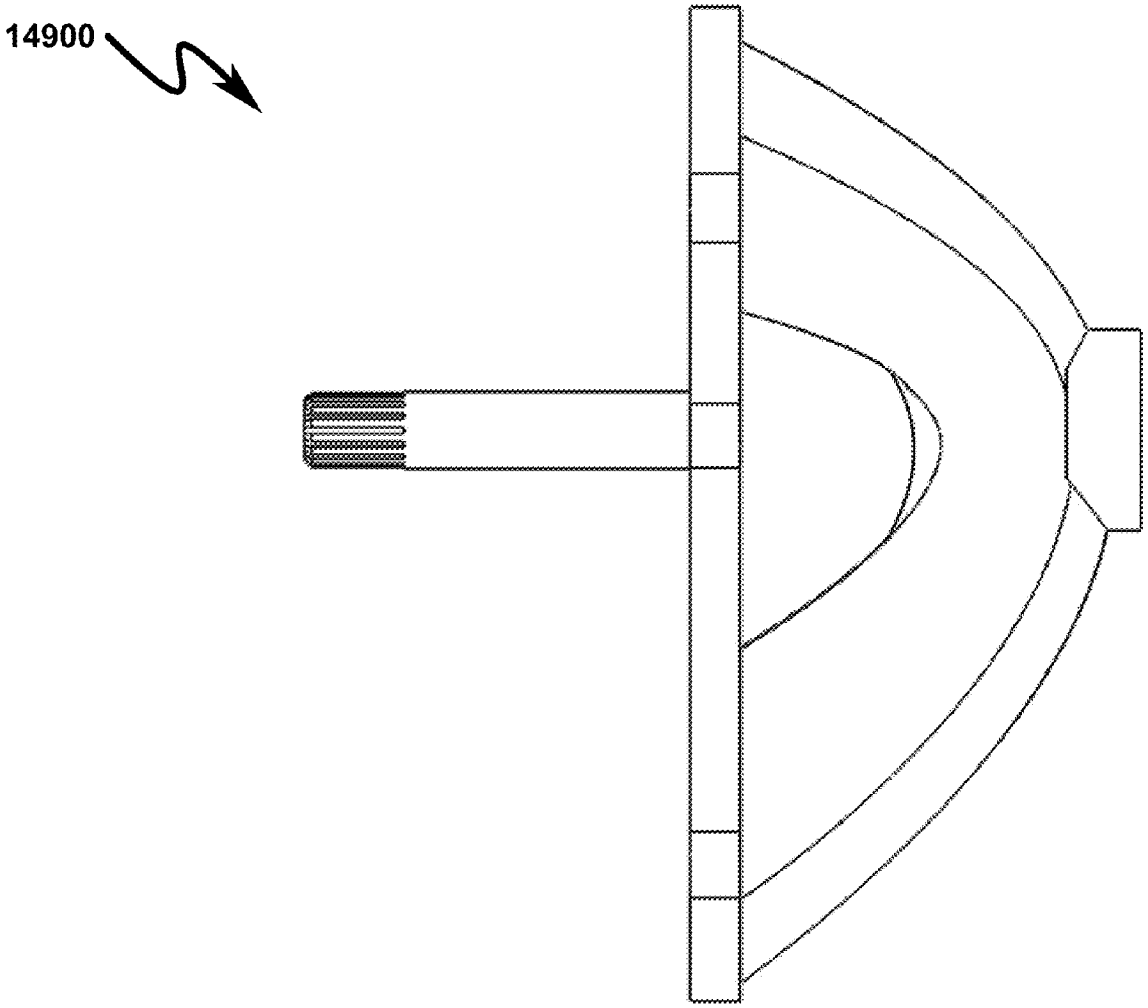
Figure 150:
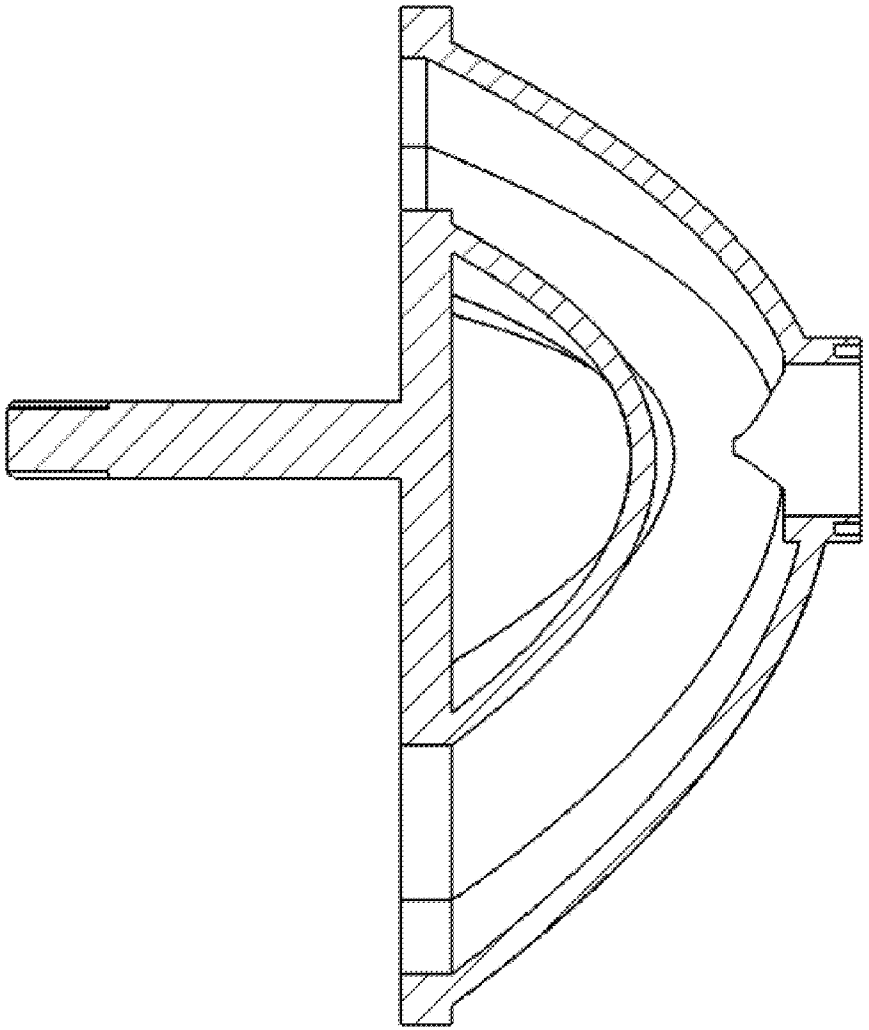
Figure 151:
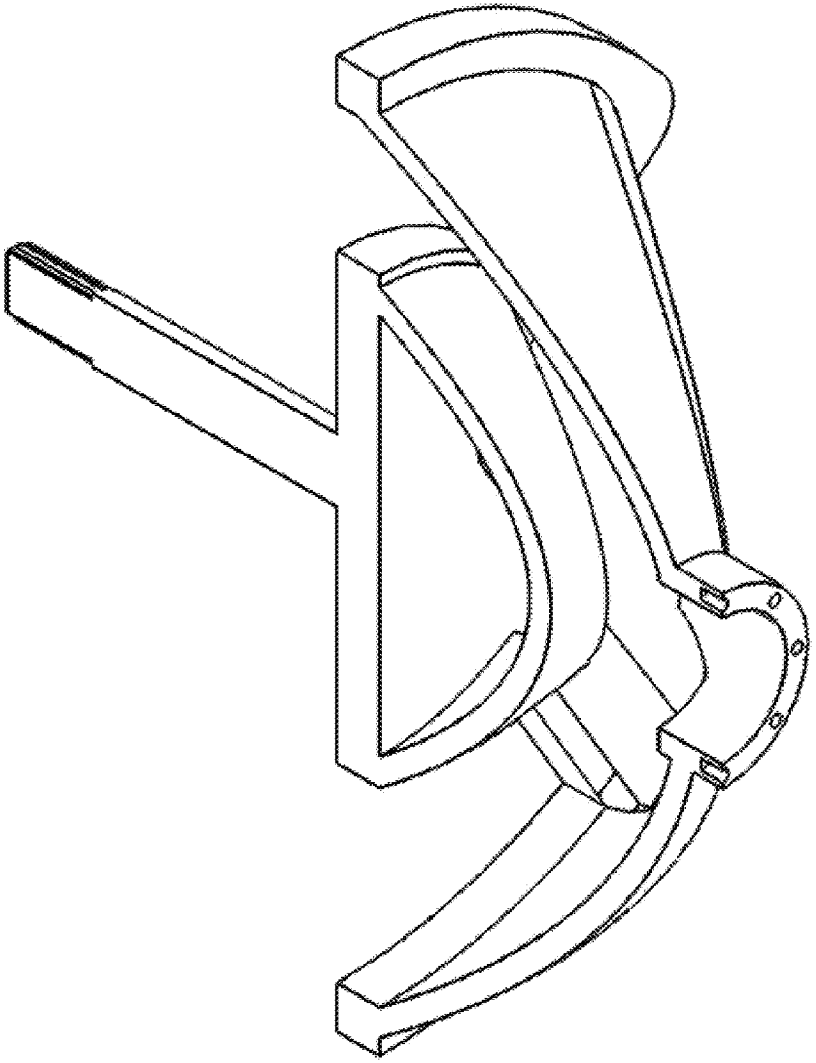
Figure 152:
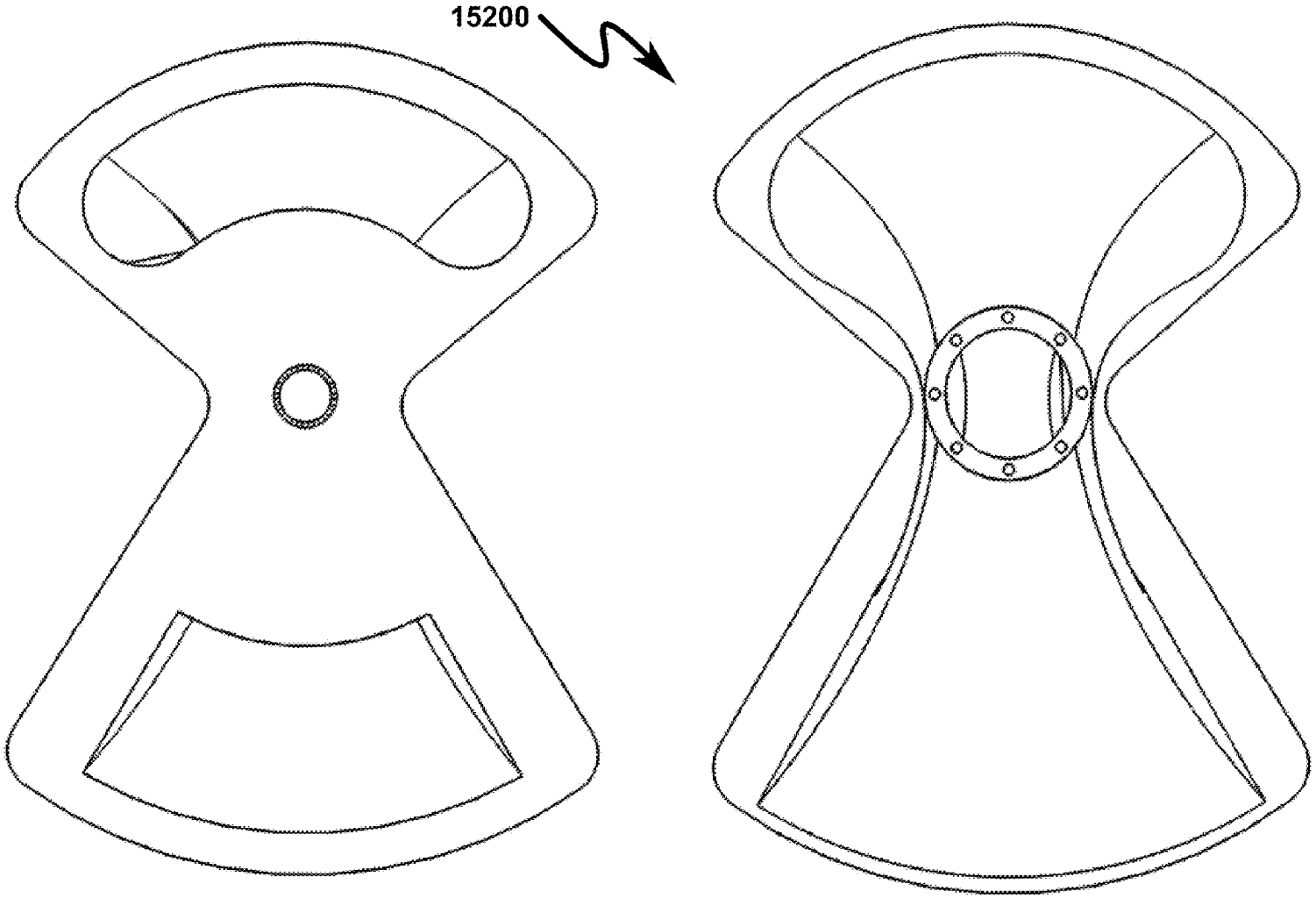
Figure 153:
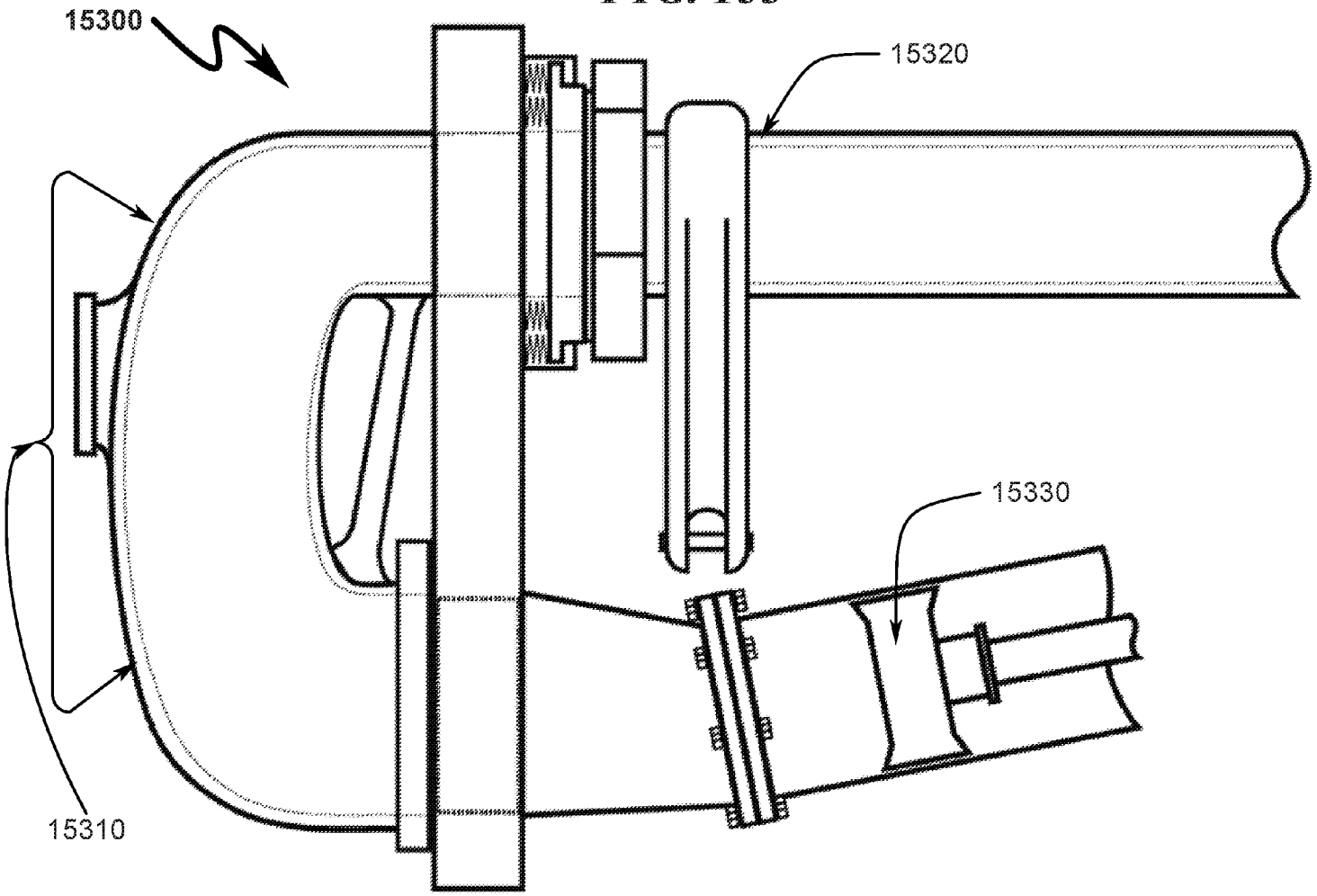
Figure 154:
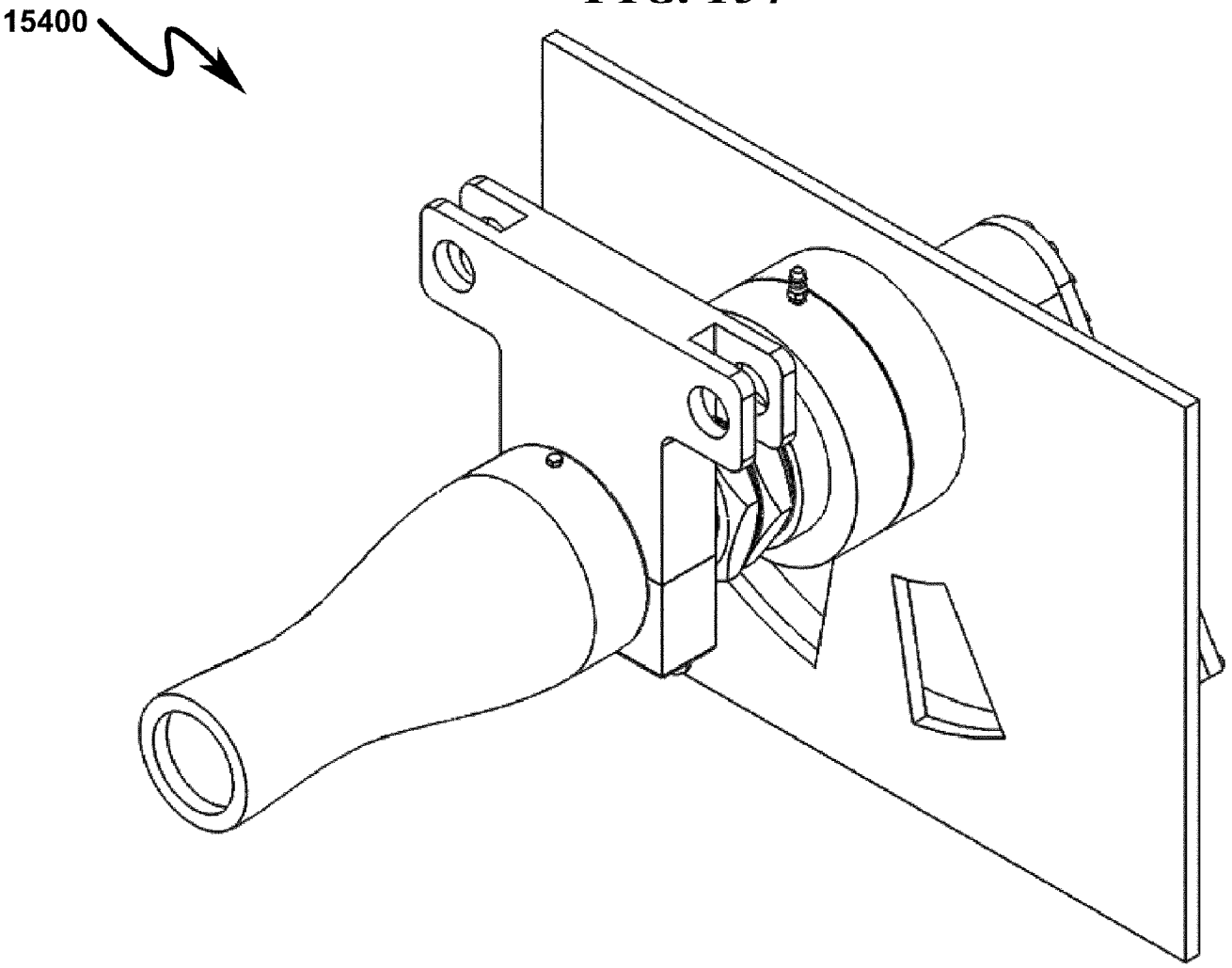
Figure 155:
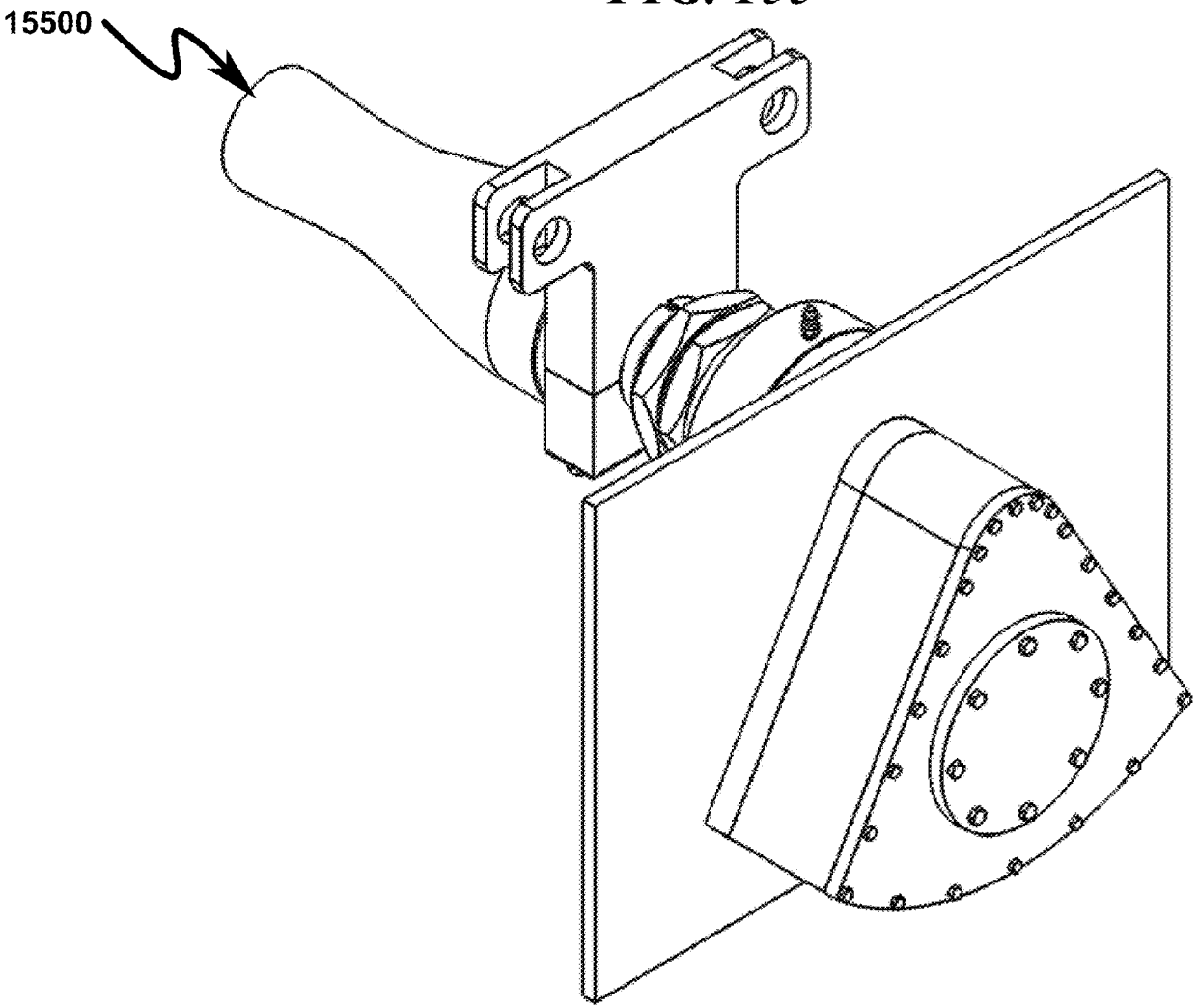
Figure 156:
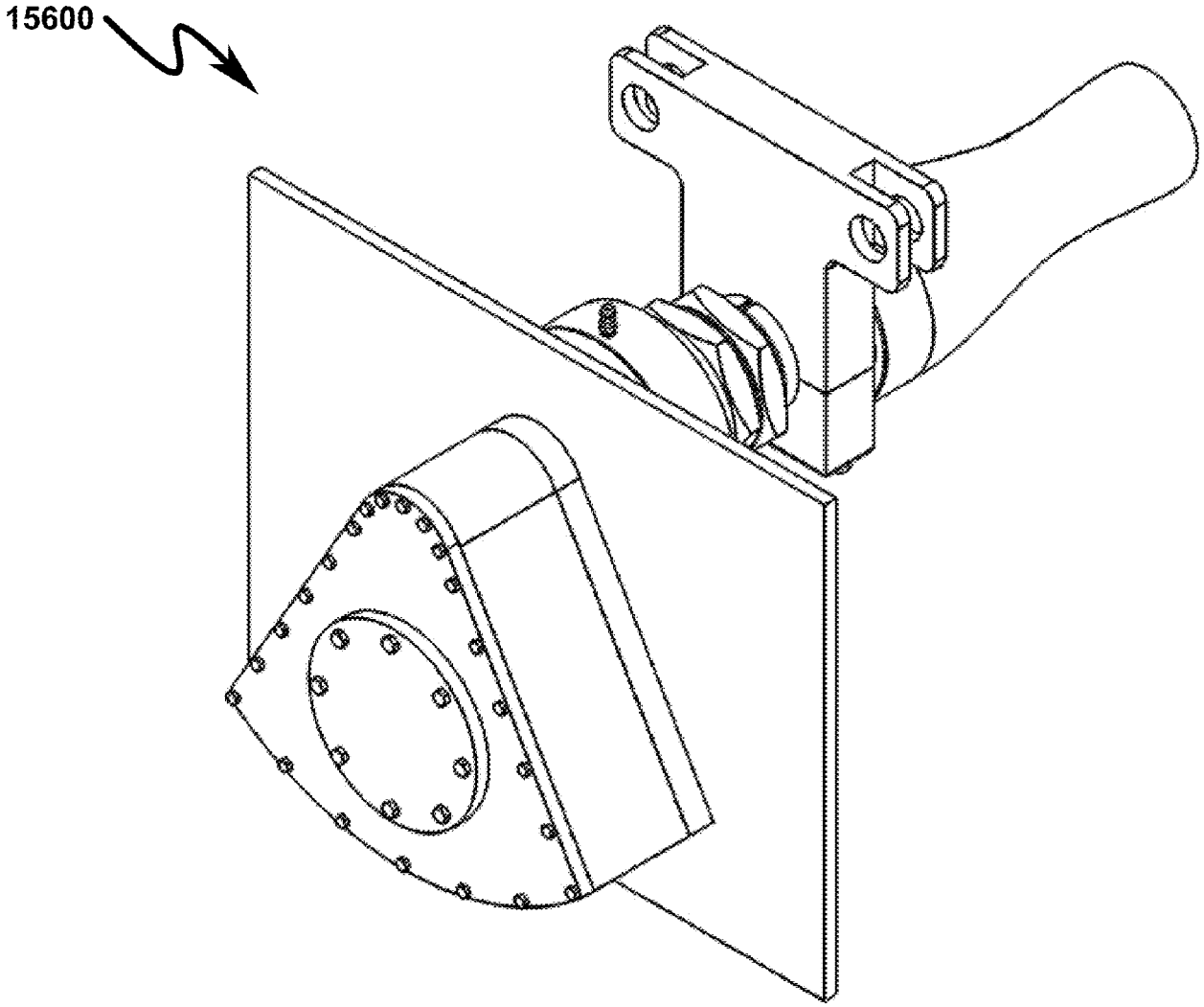
Figure 157:
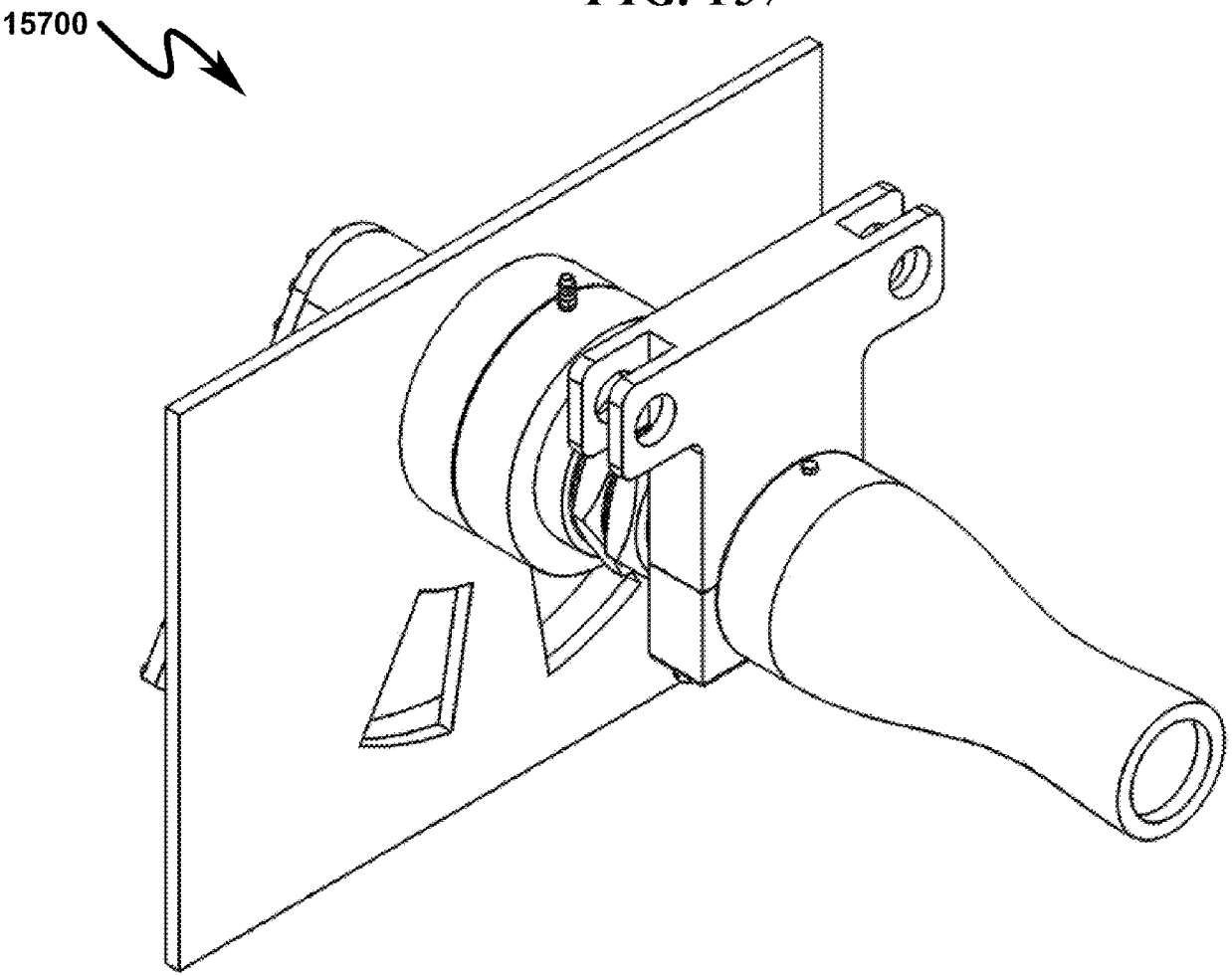
Figure 158:
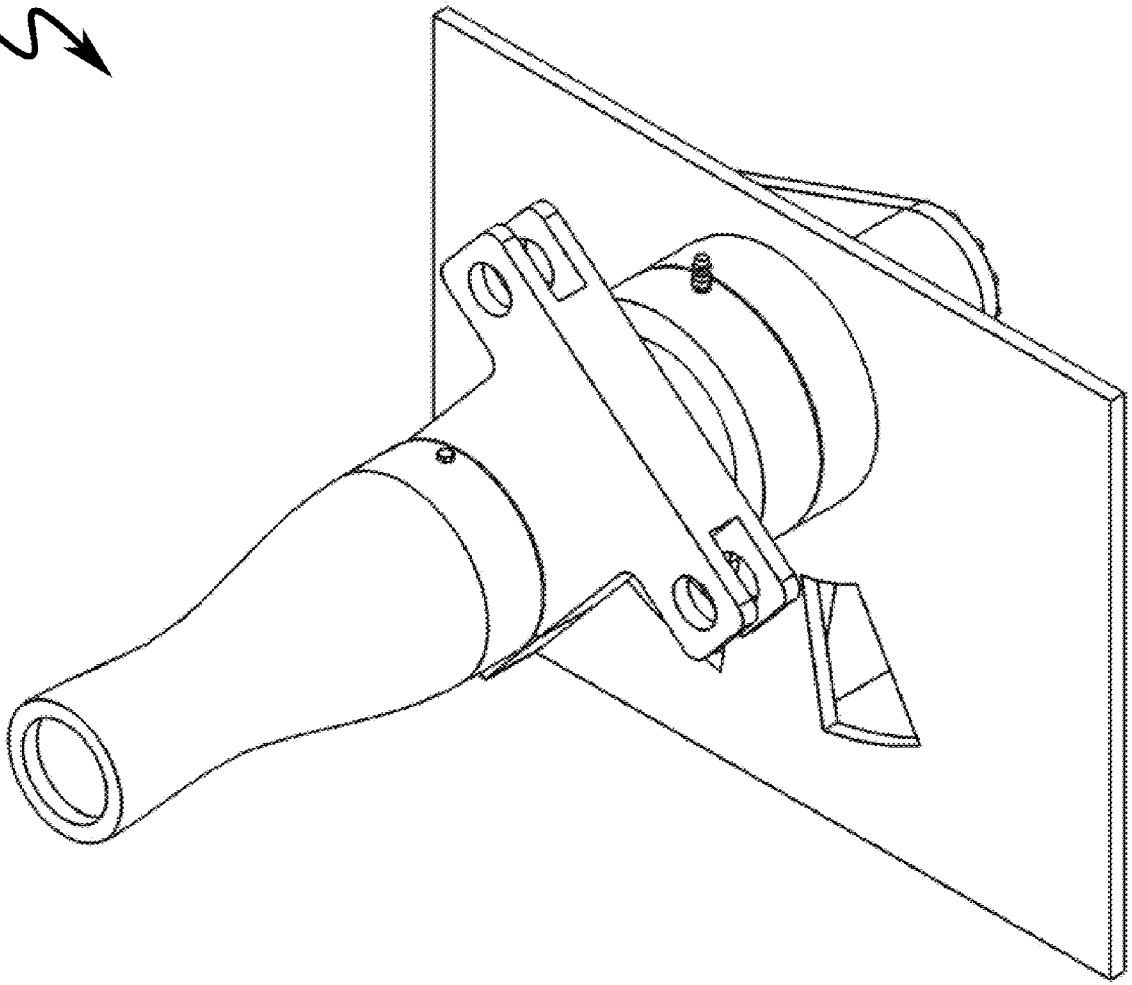
Figure 159:
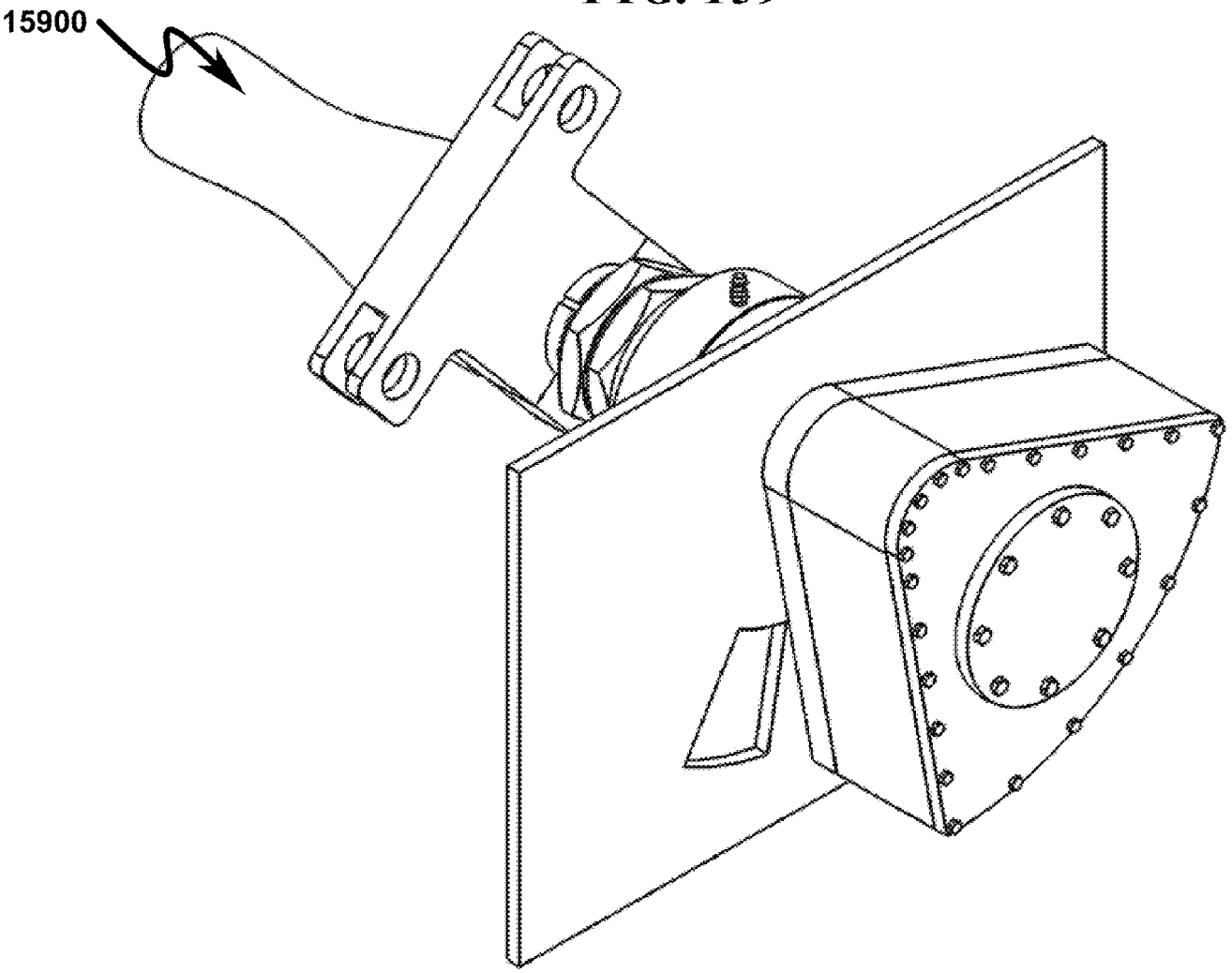
Figure 160:
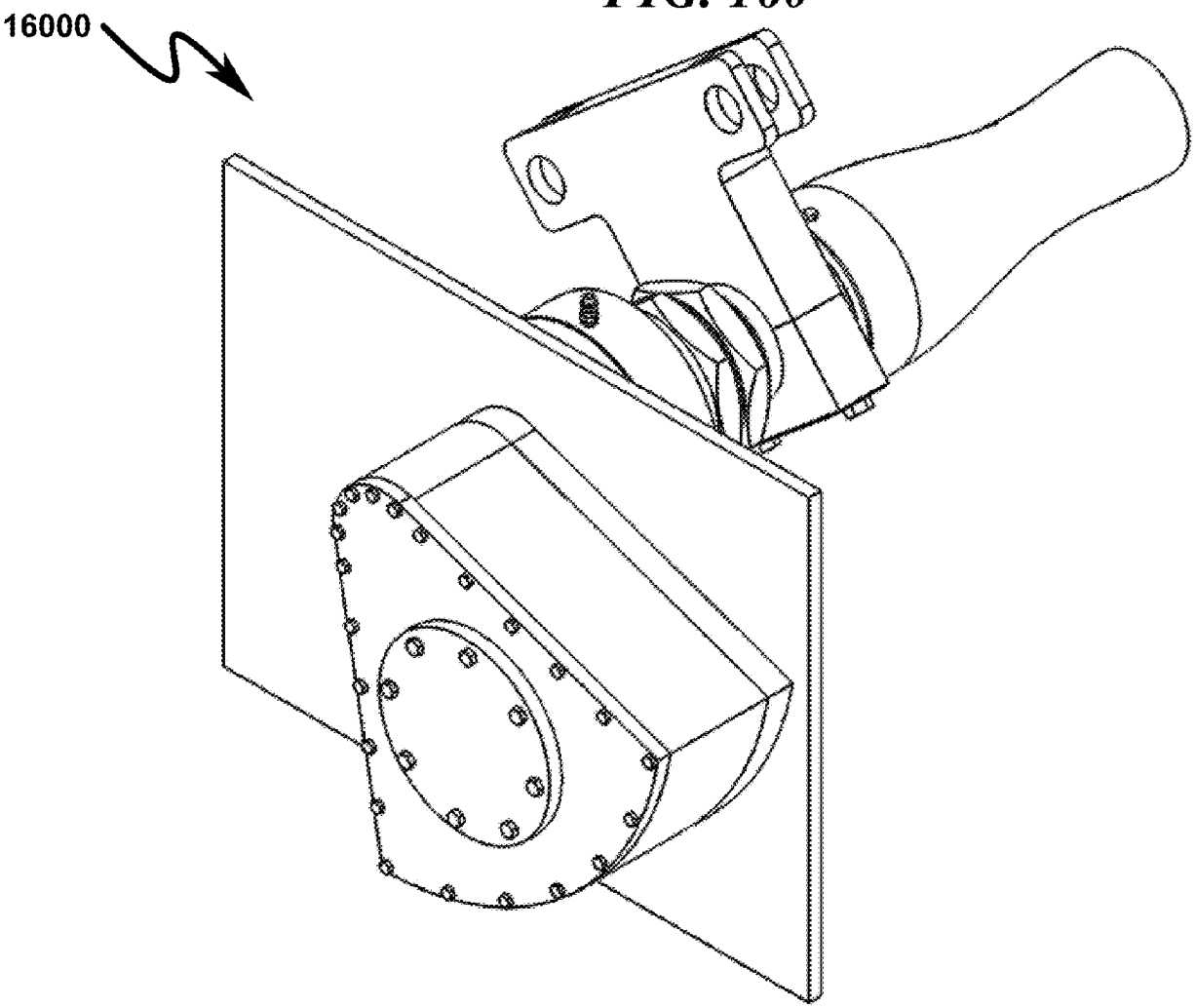
Figure 161:
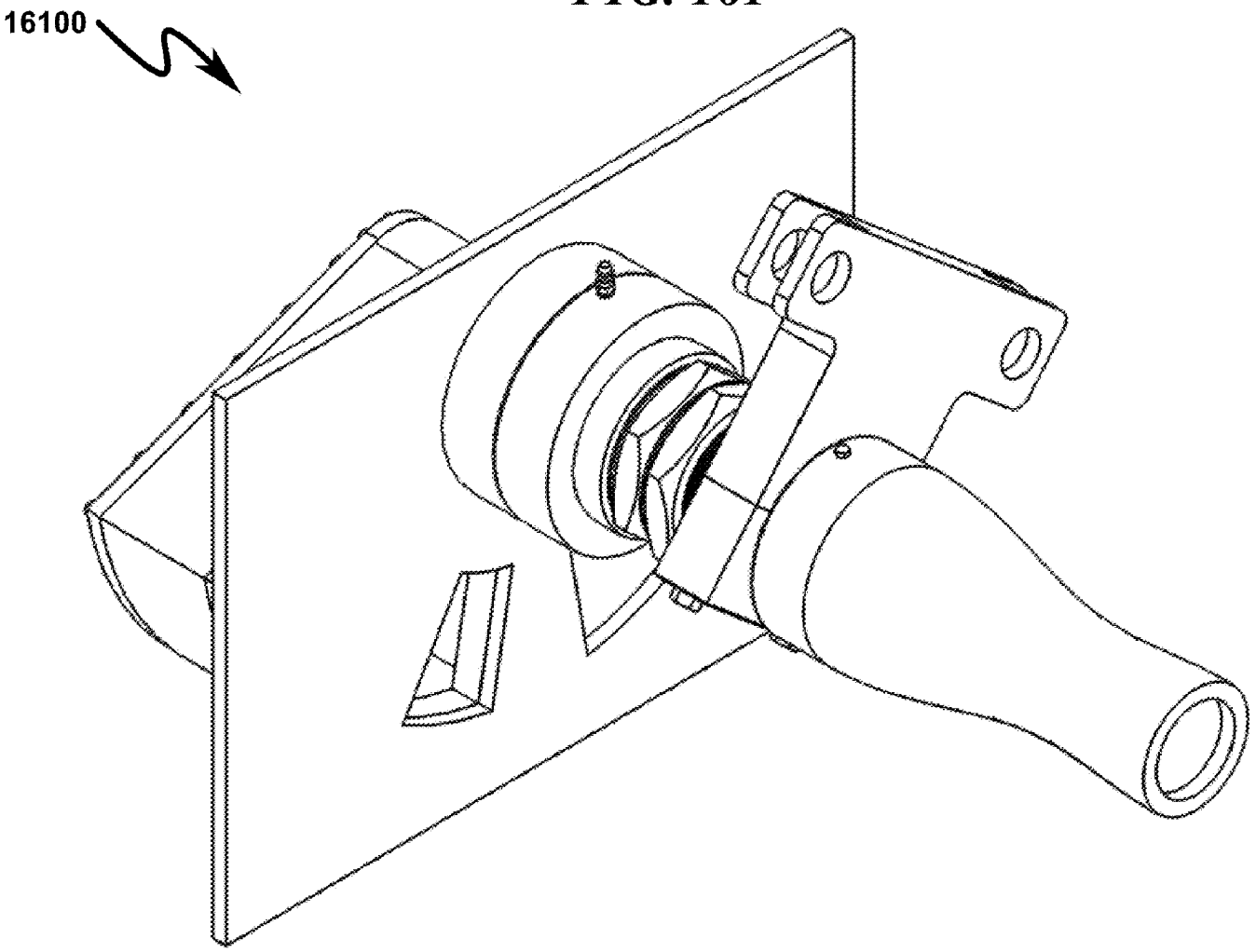
Figure 162:
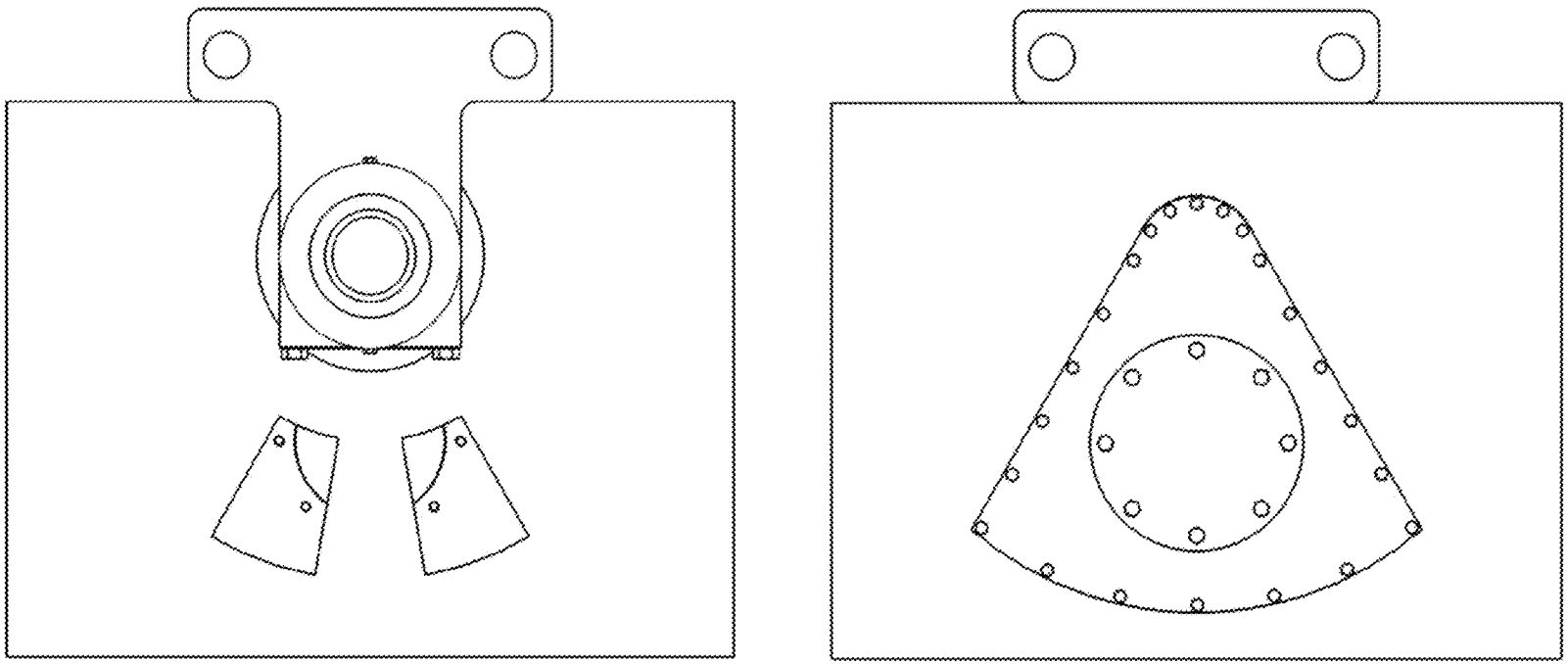
Figure 163:
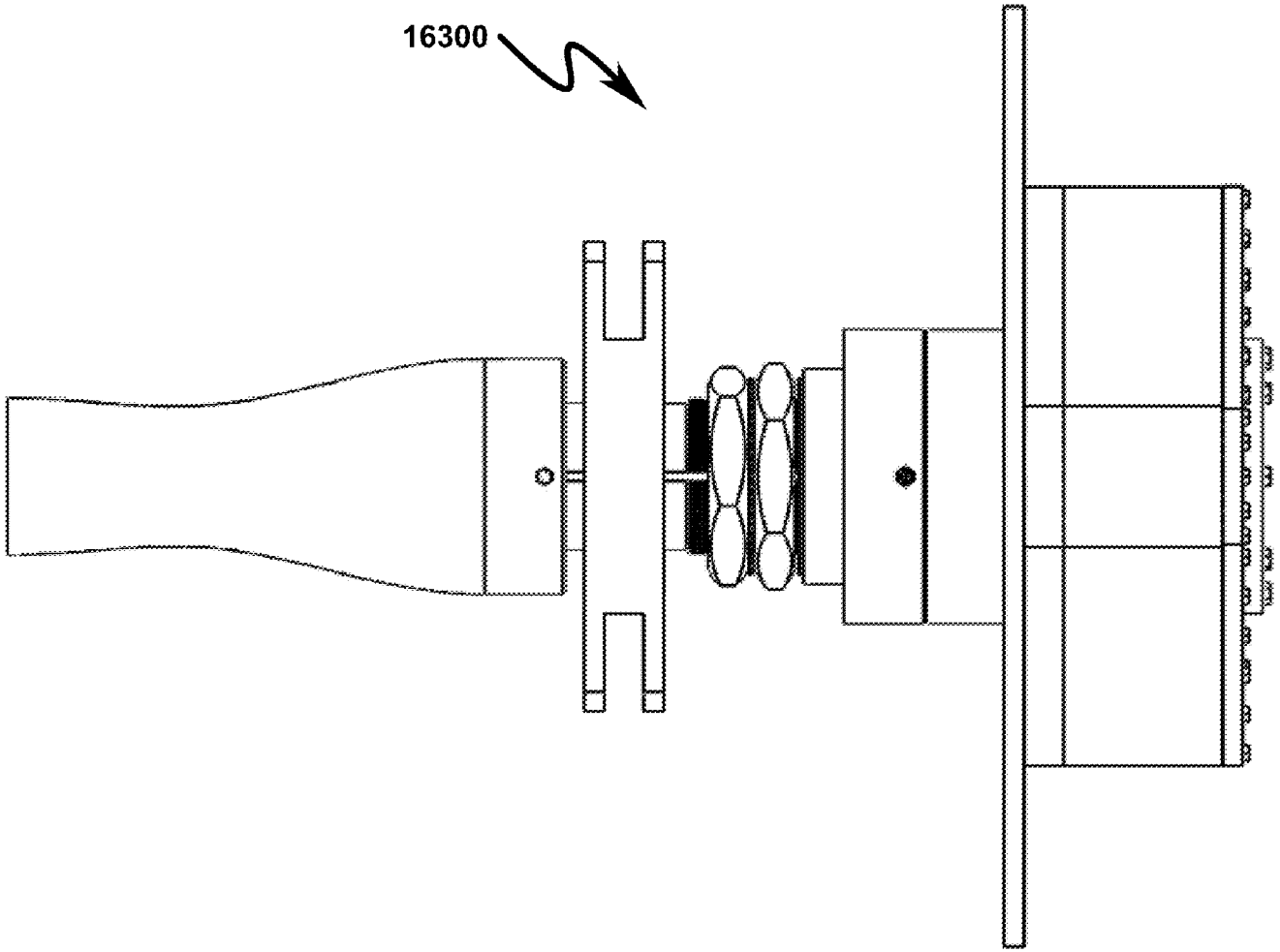
Figure 164:
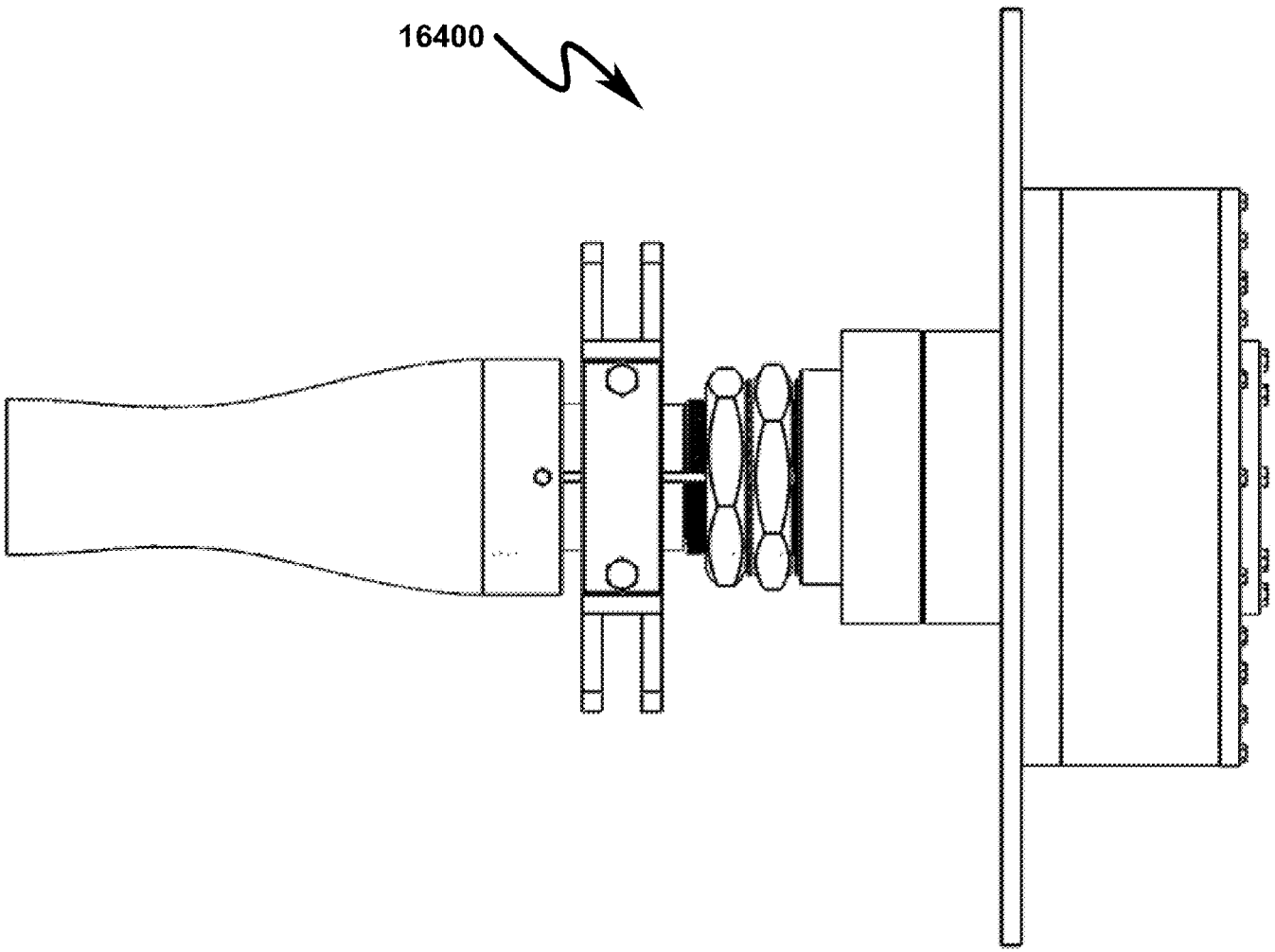
Figure 165:
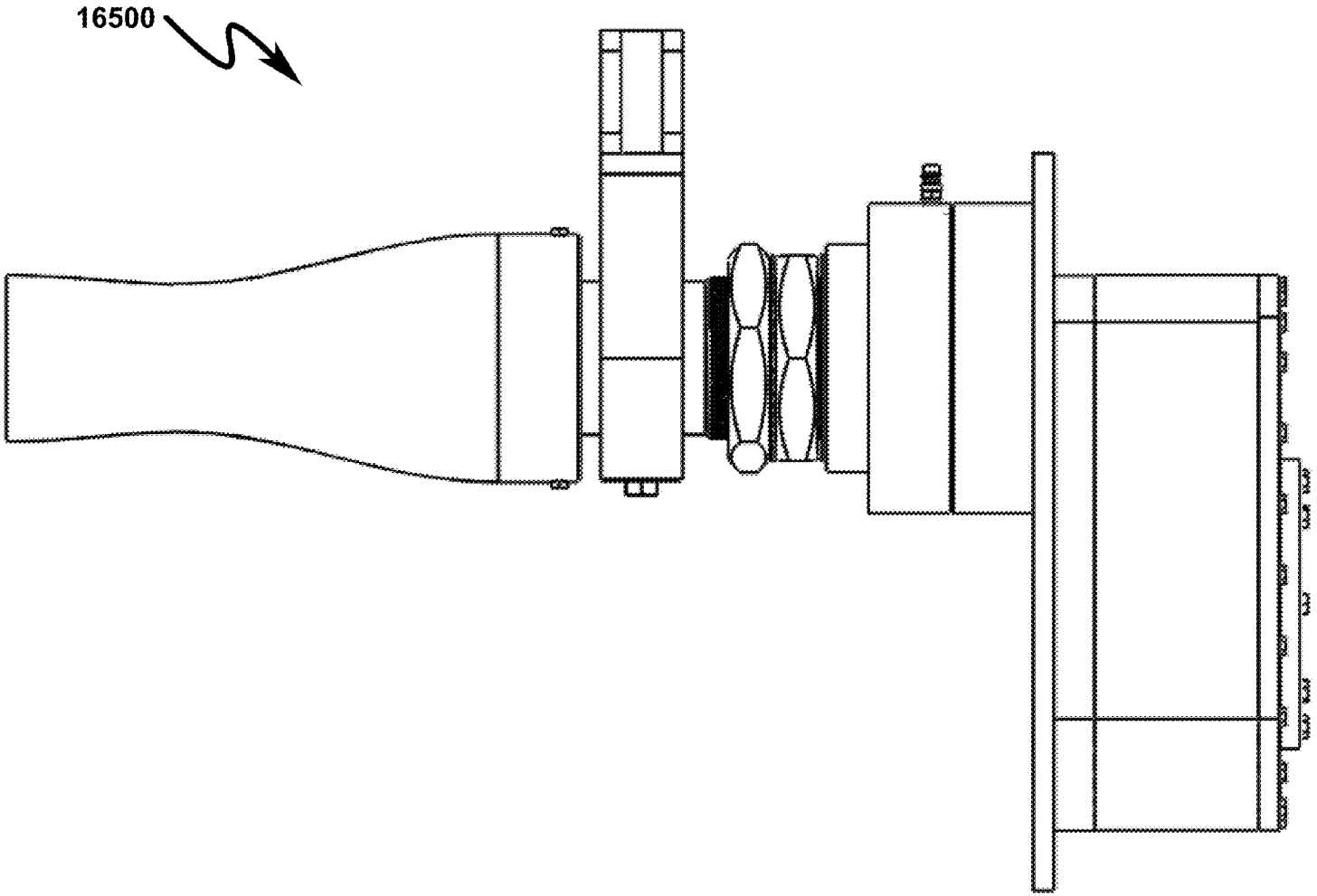
Figure 166:
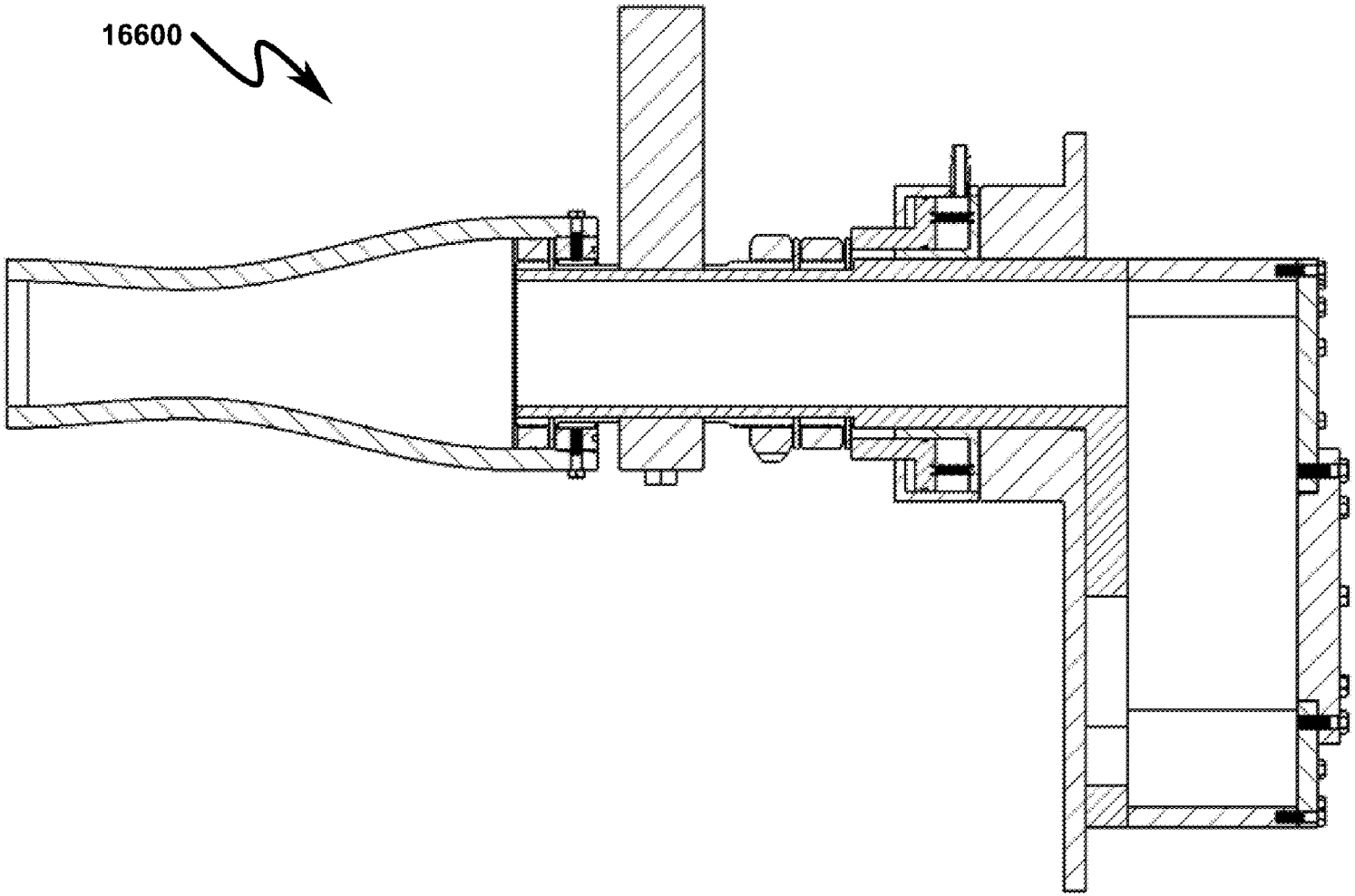
Figure 167:
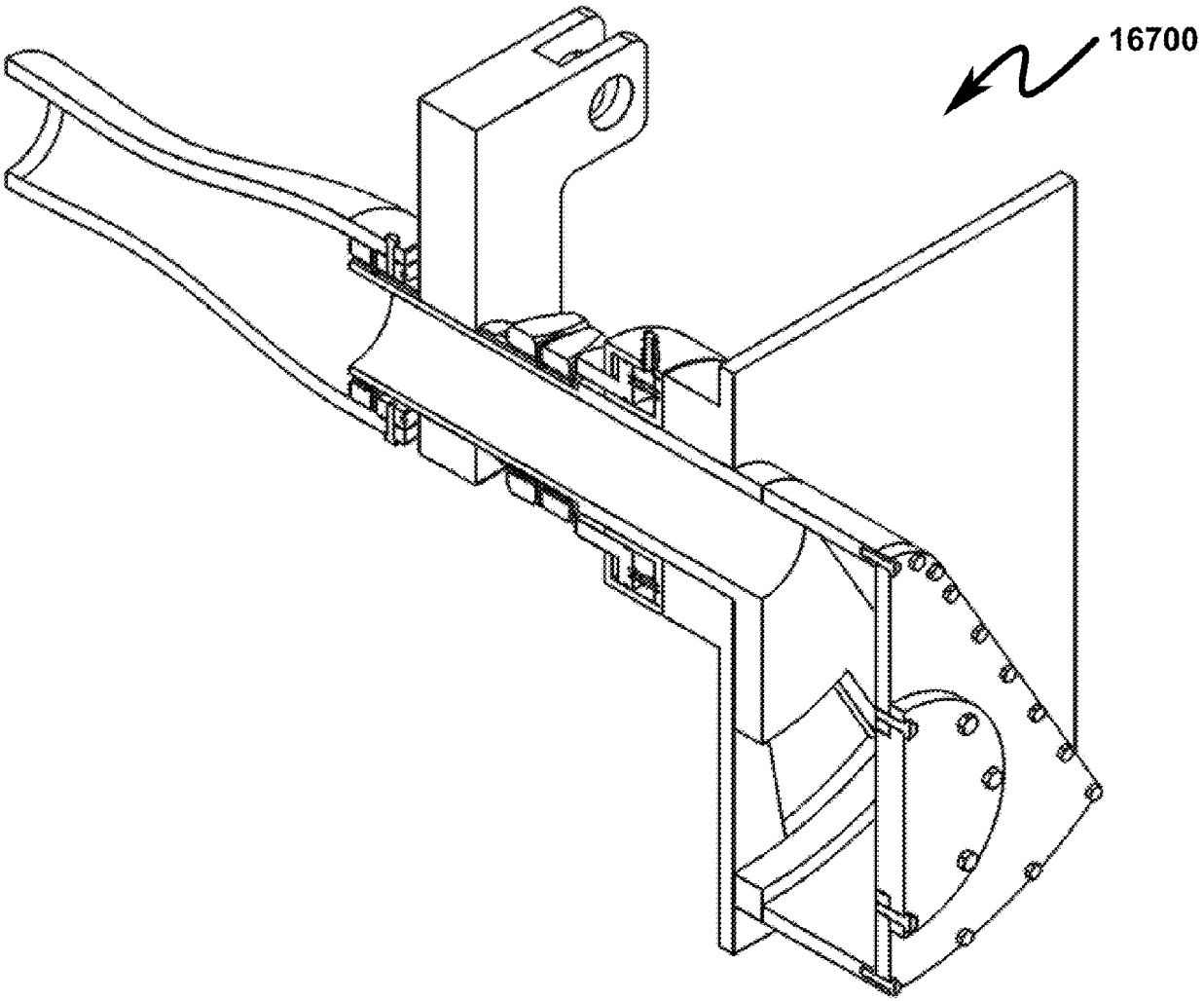
Figure 168:
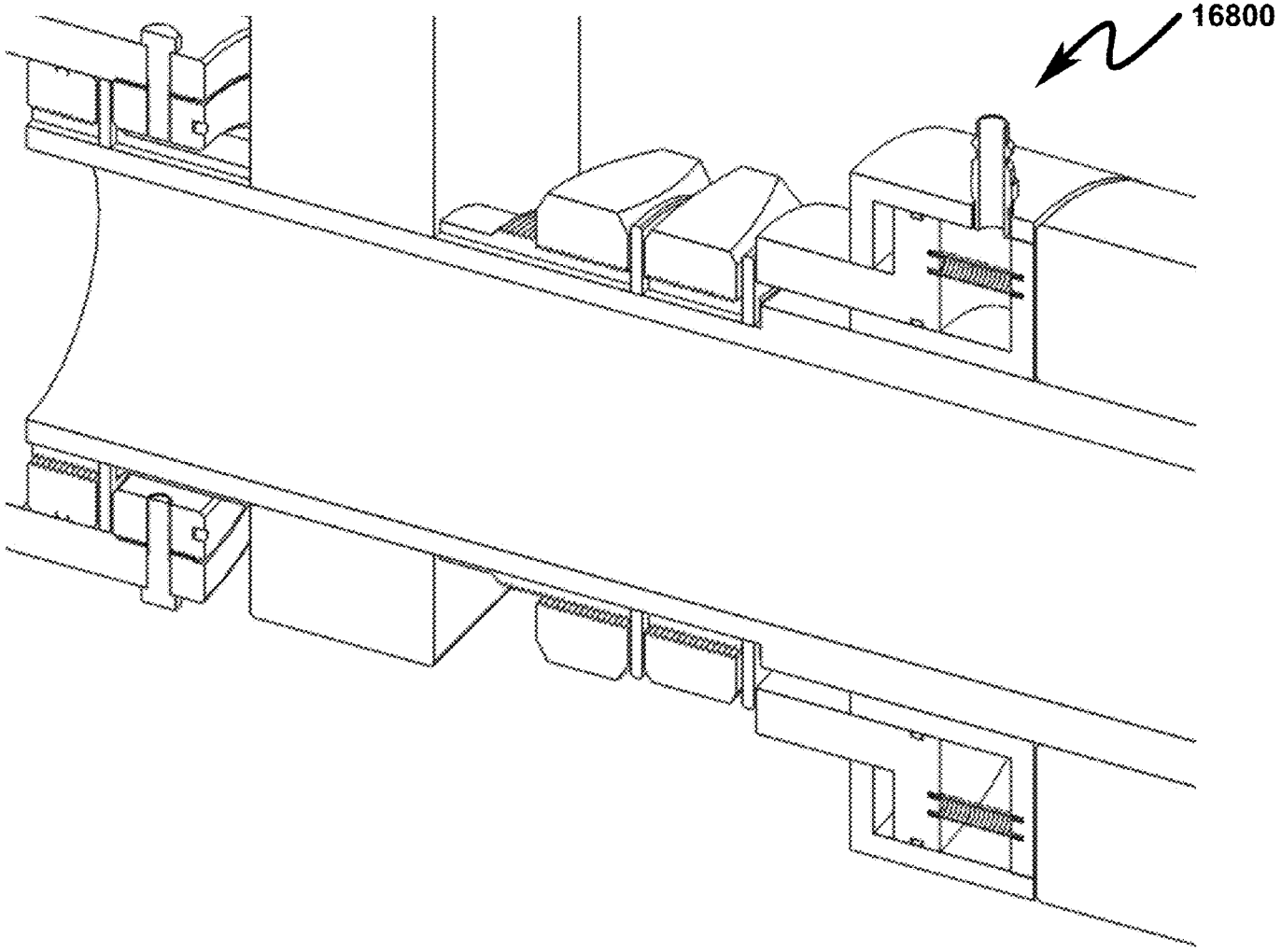
Figure 169:
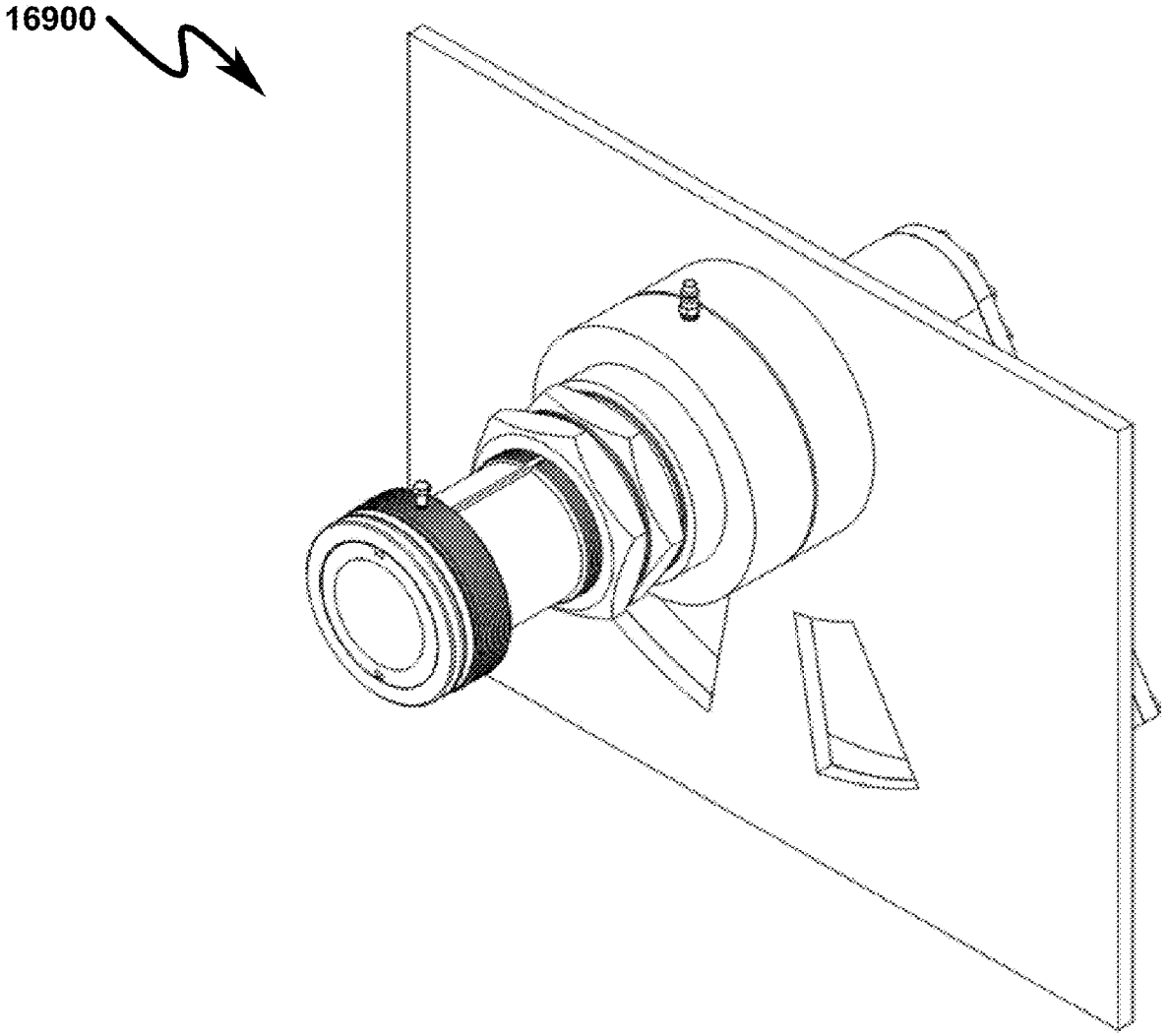
Figure 170:
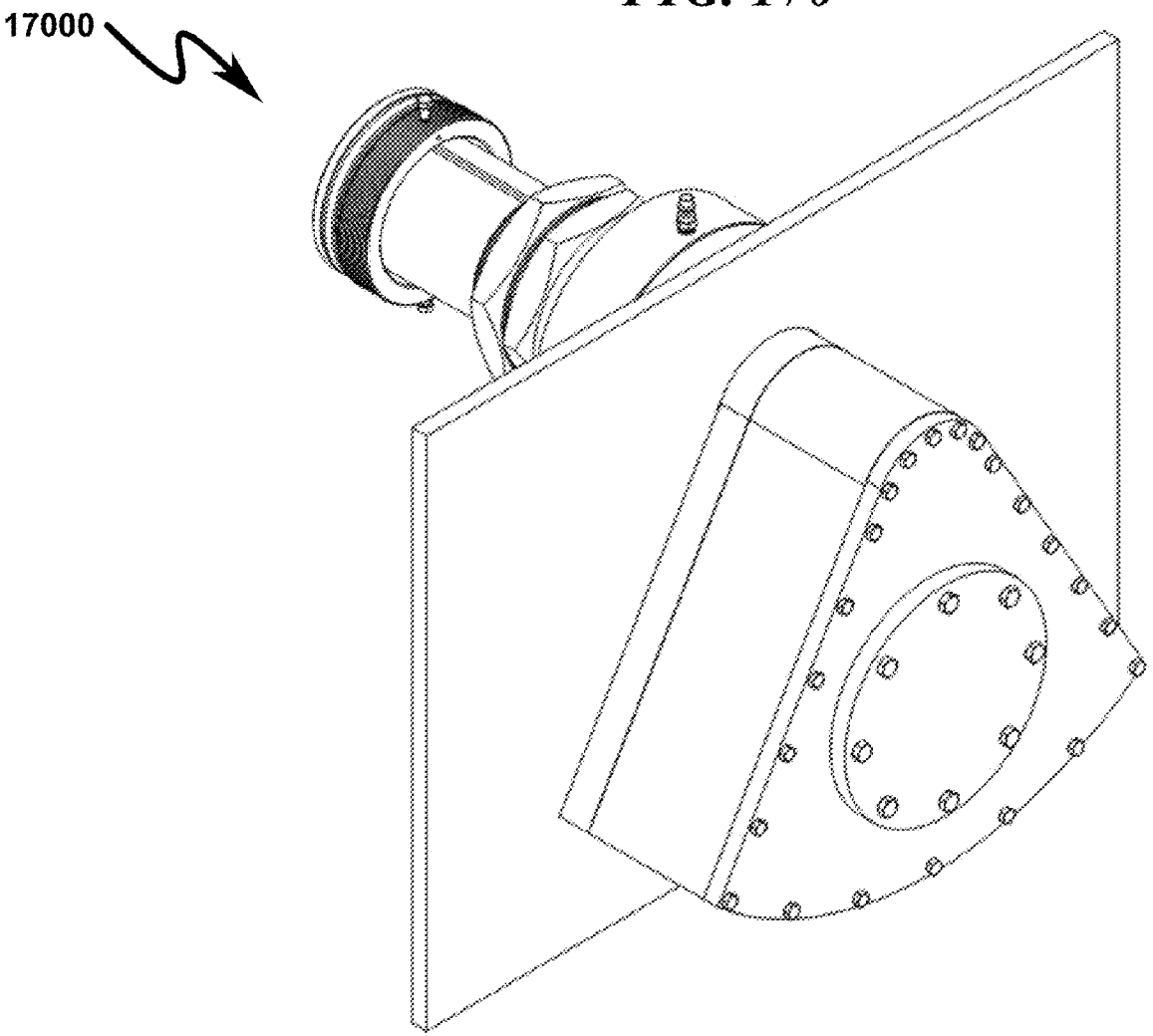
Figure 171:
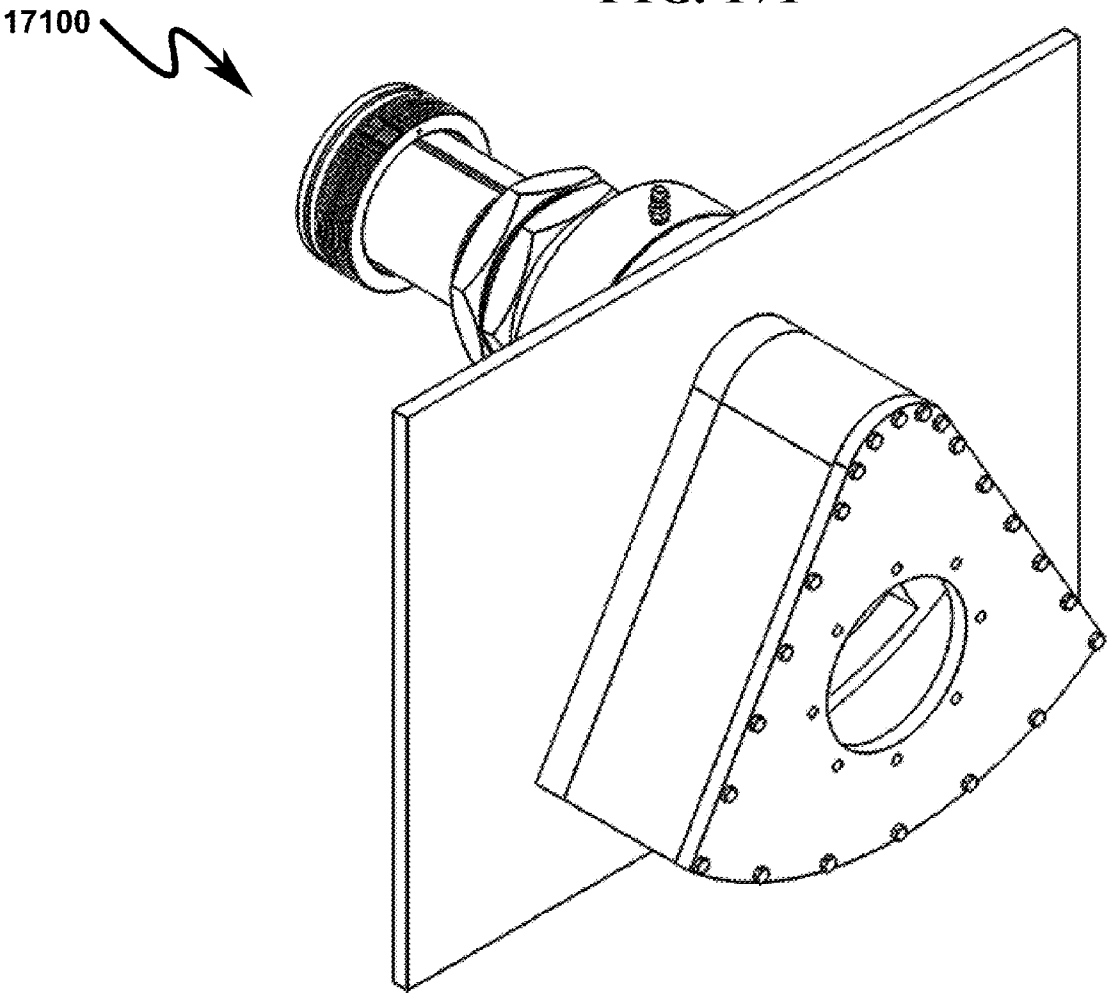
Figure 172:
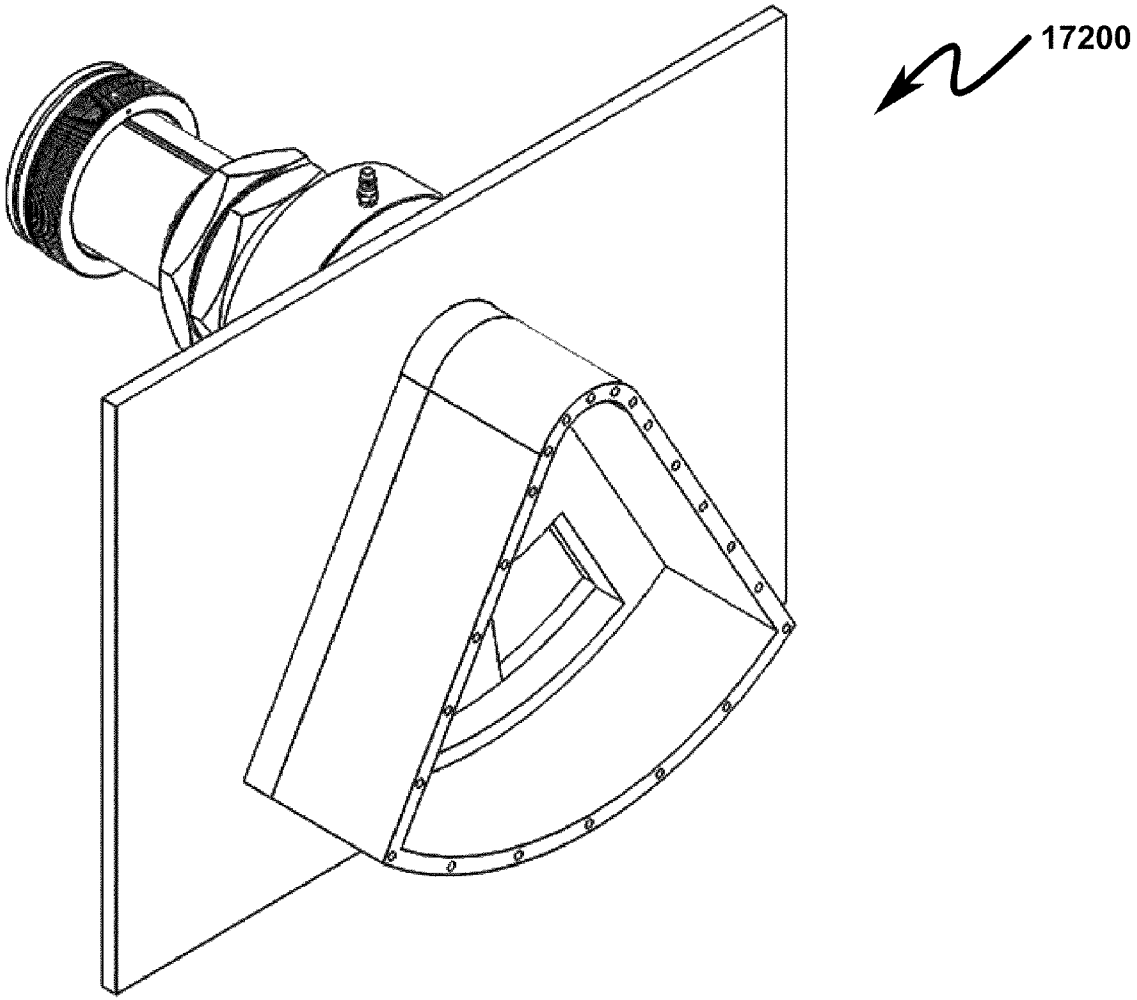
Figure 173:
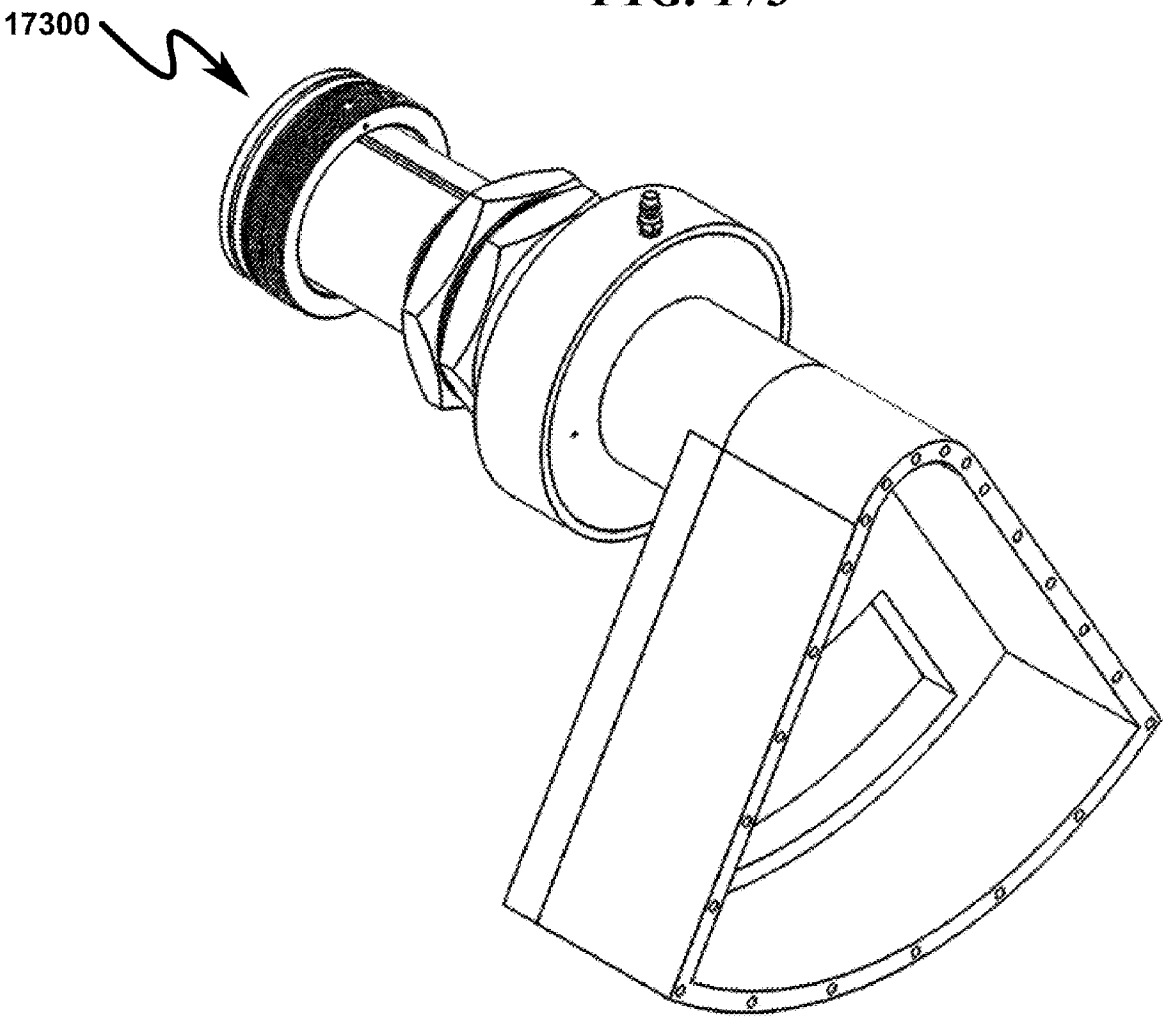
Figure 174:
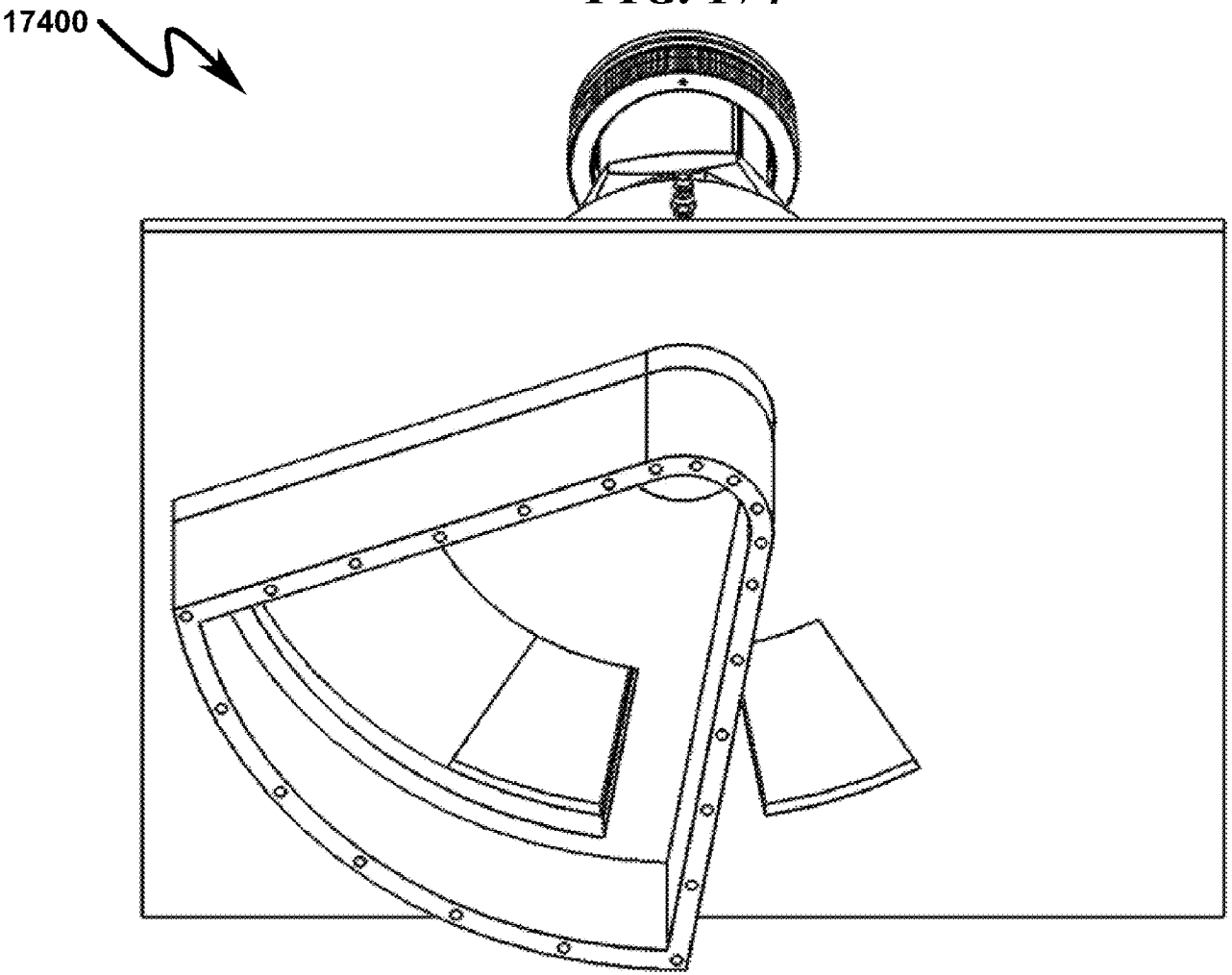
Figure 175:
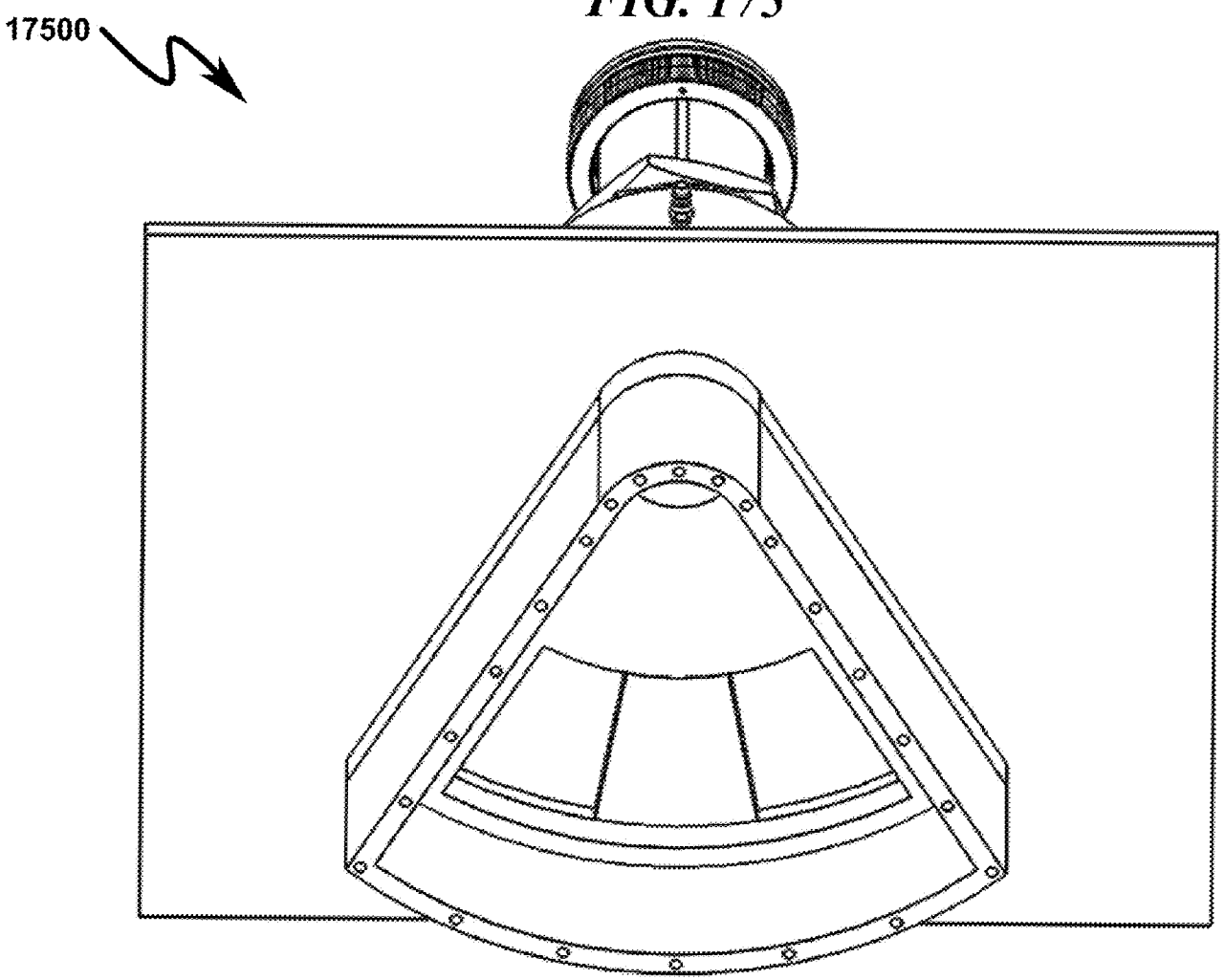
Figure 176:
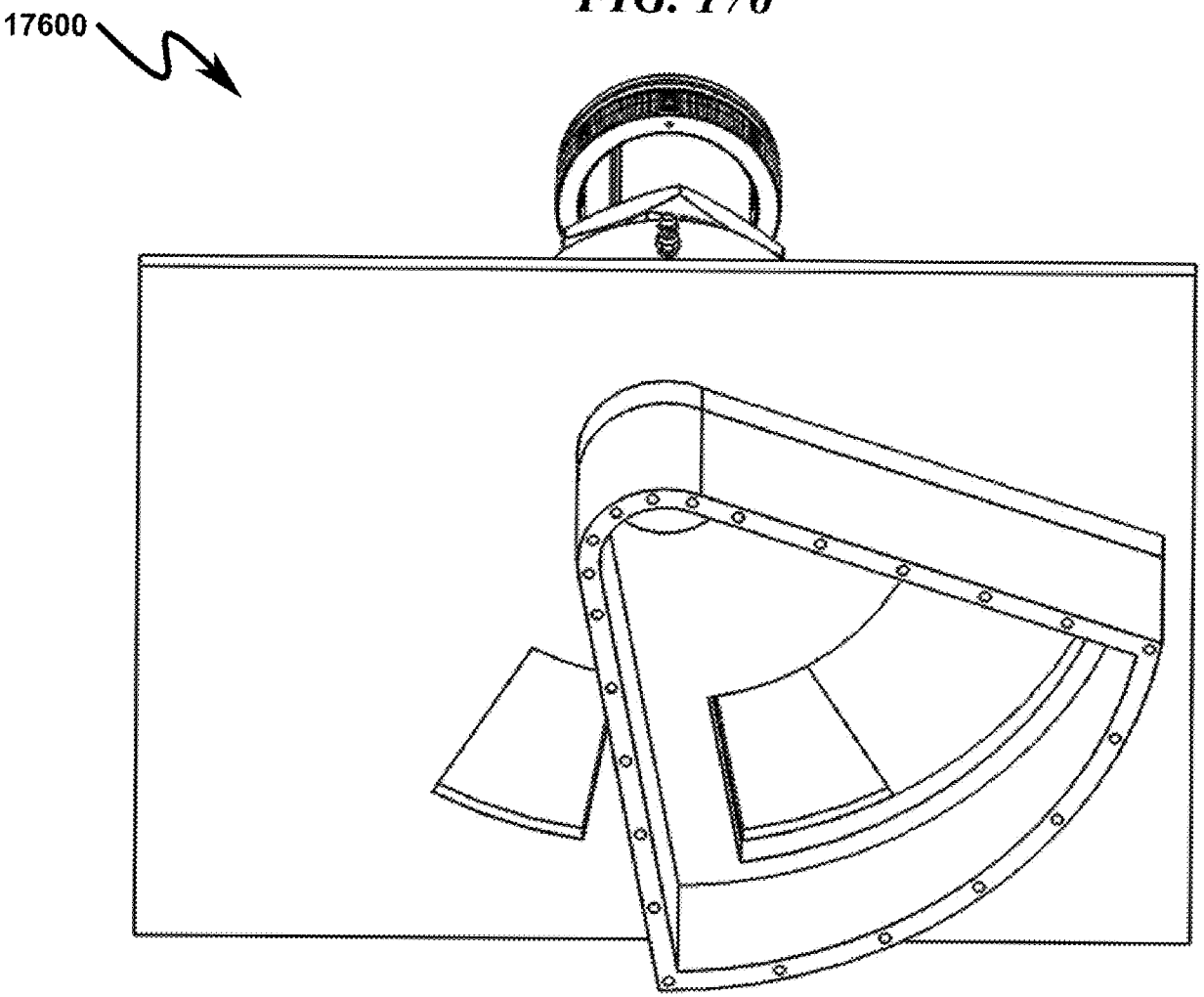
Figure 177:
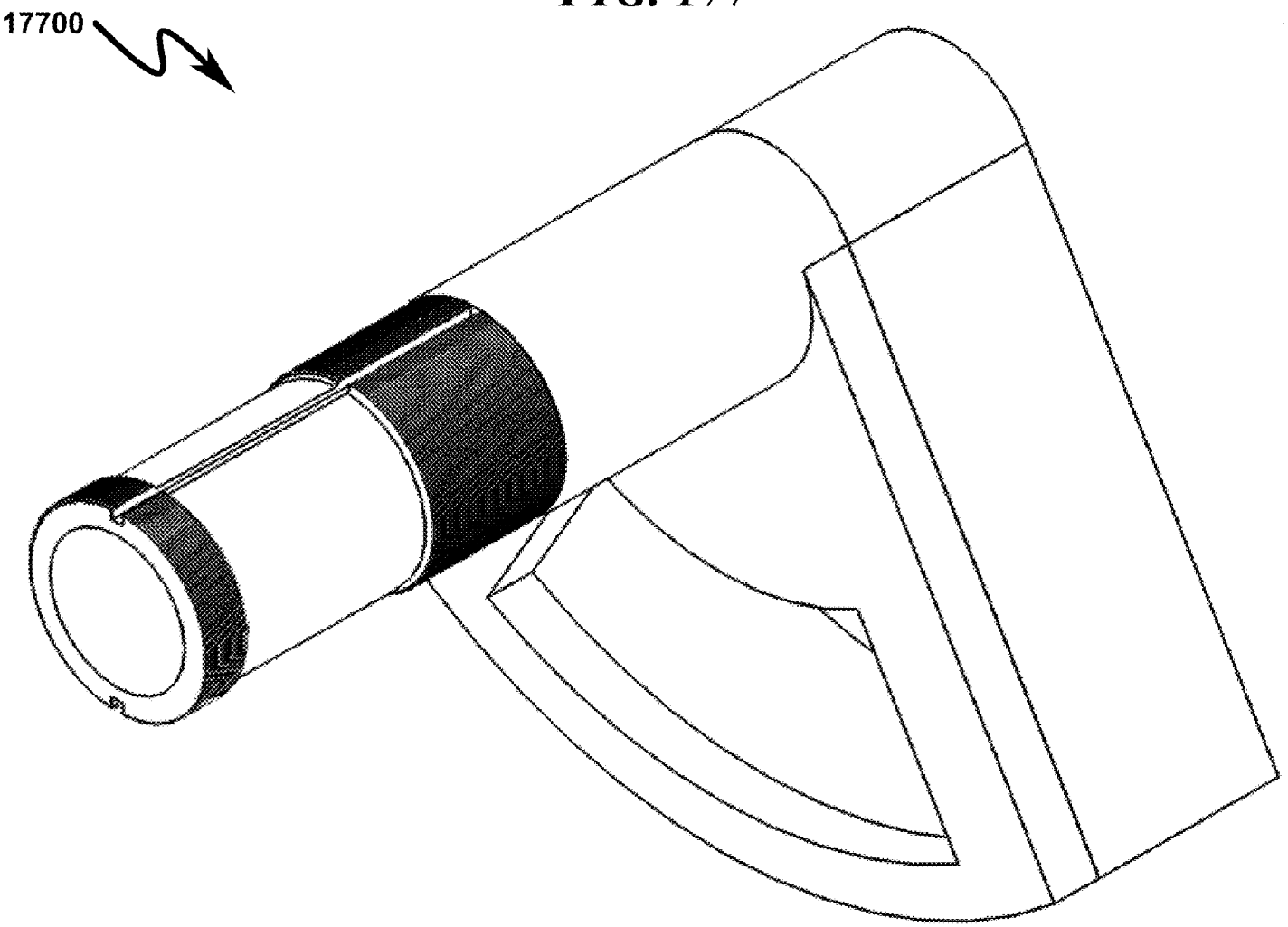
Figure 178:
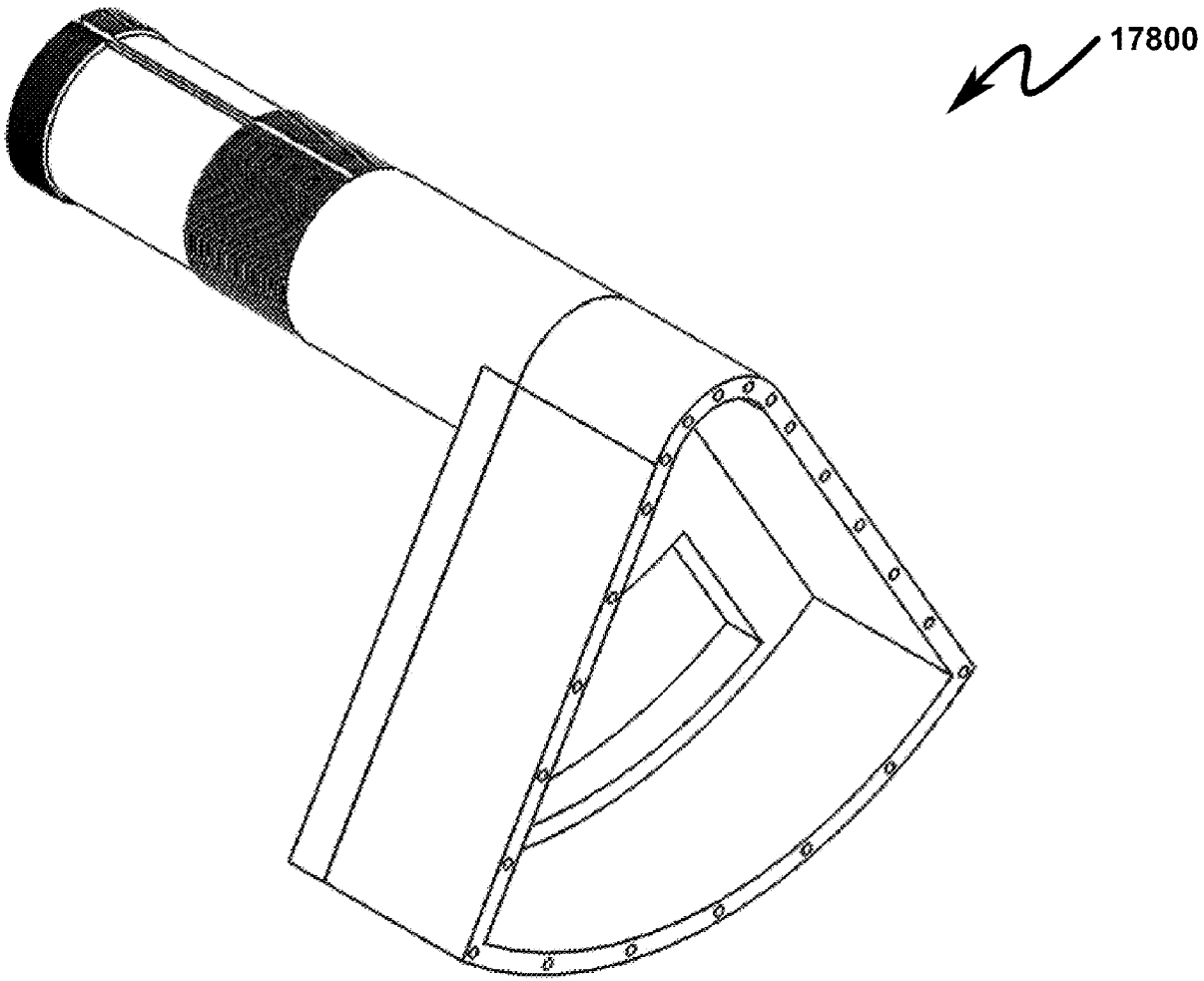
Figure 179:
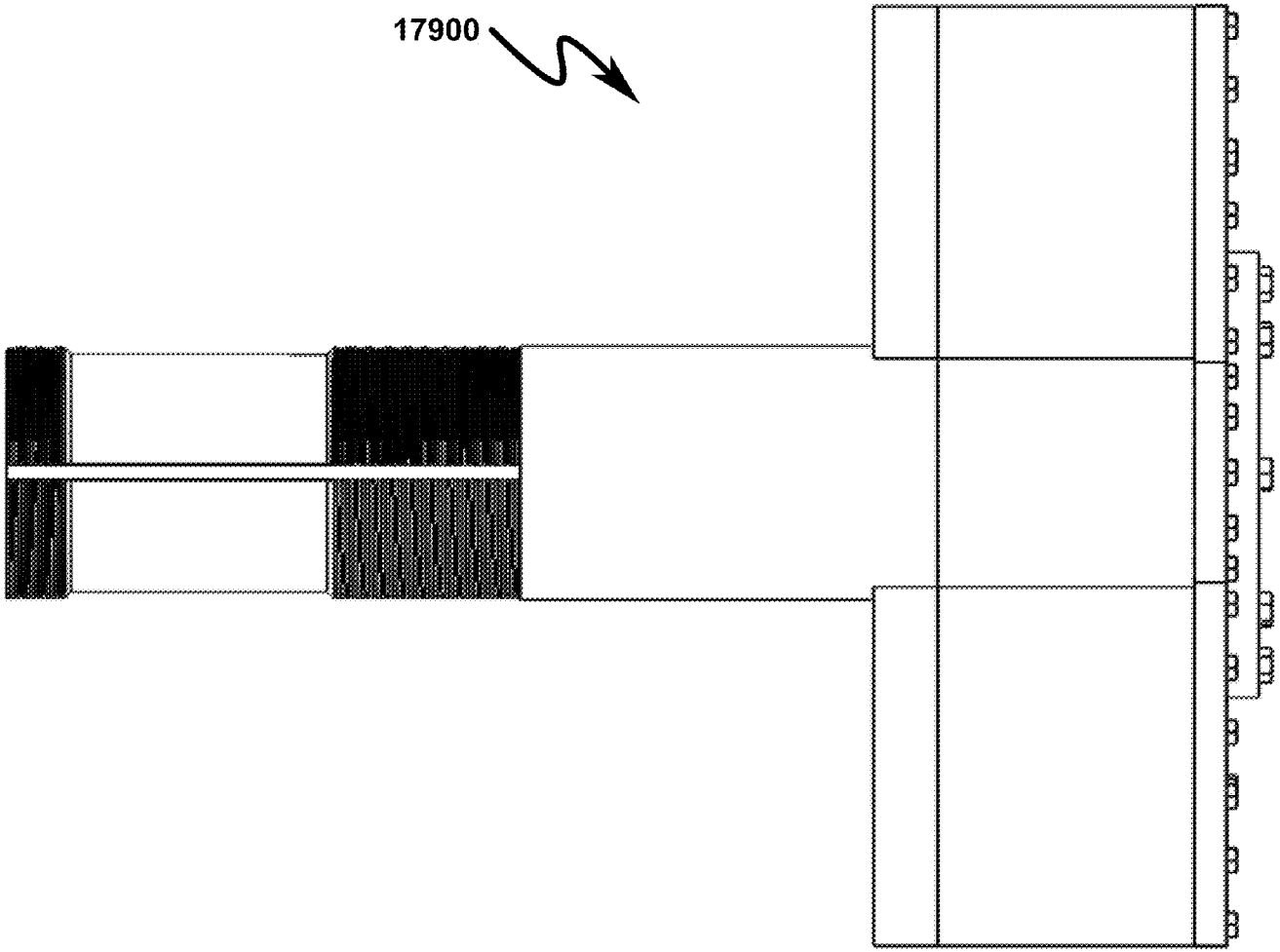
Figure 180:
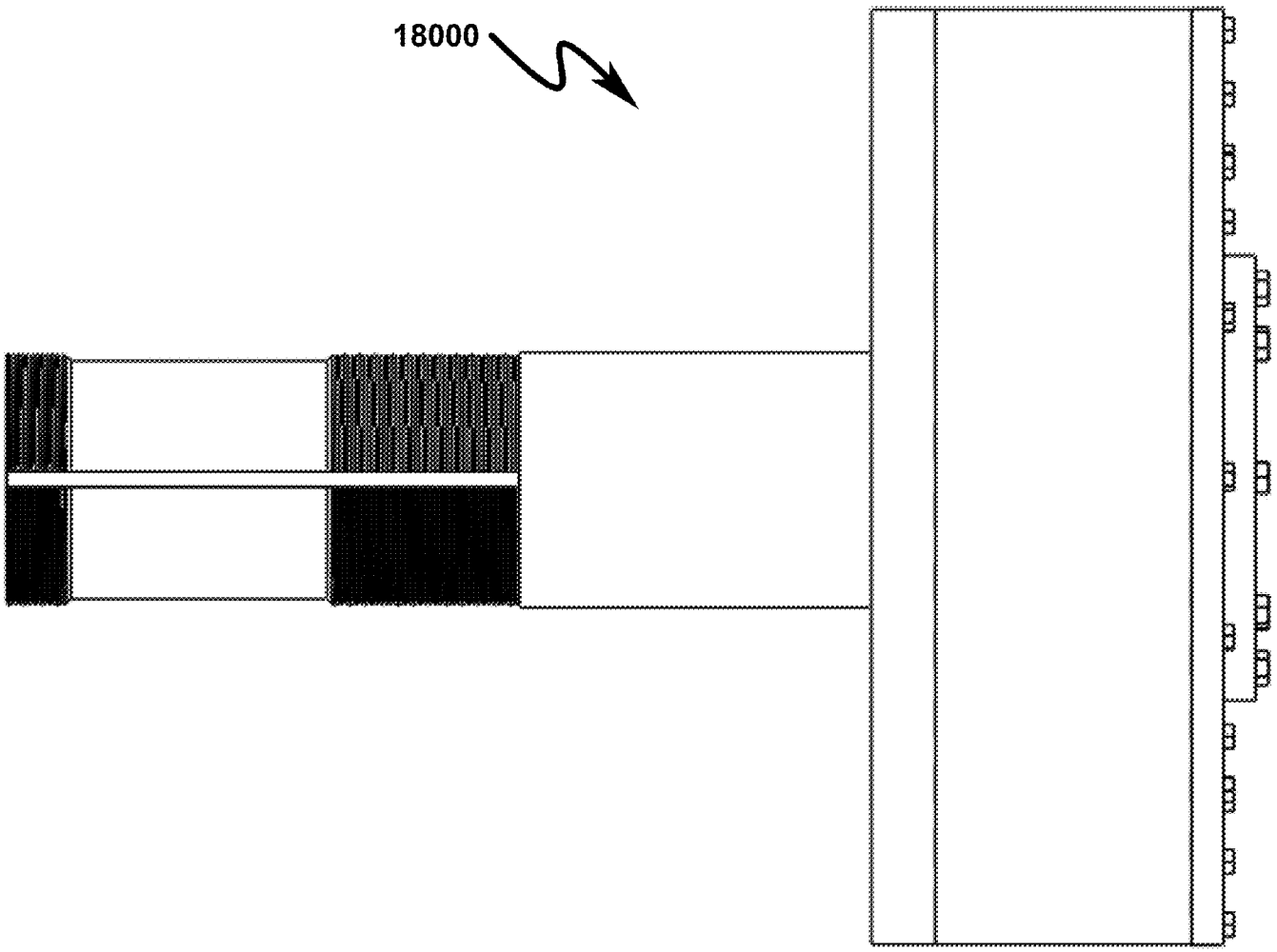
Figure 181:
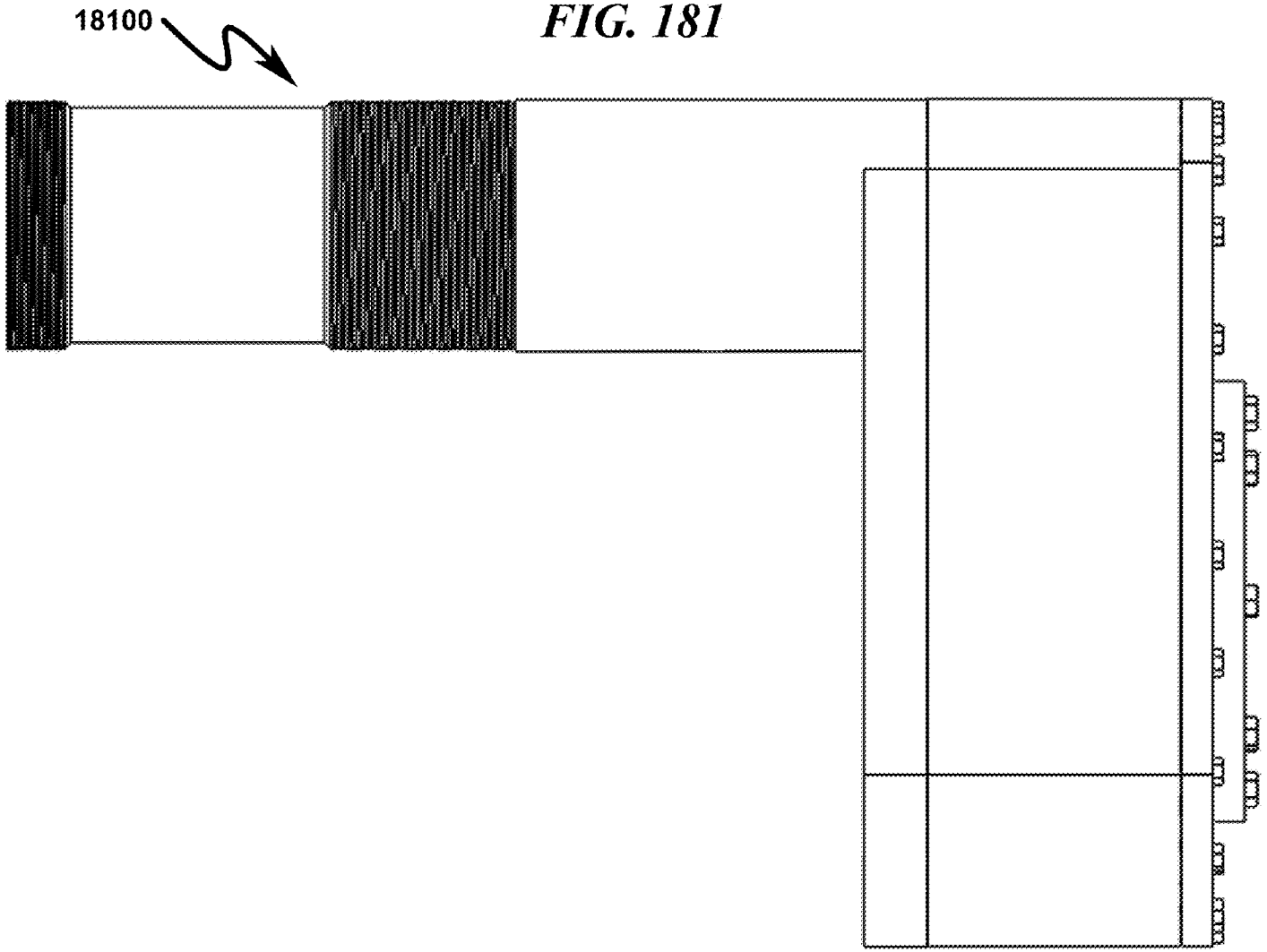
Figure 182:
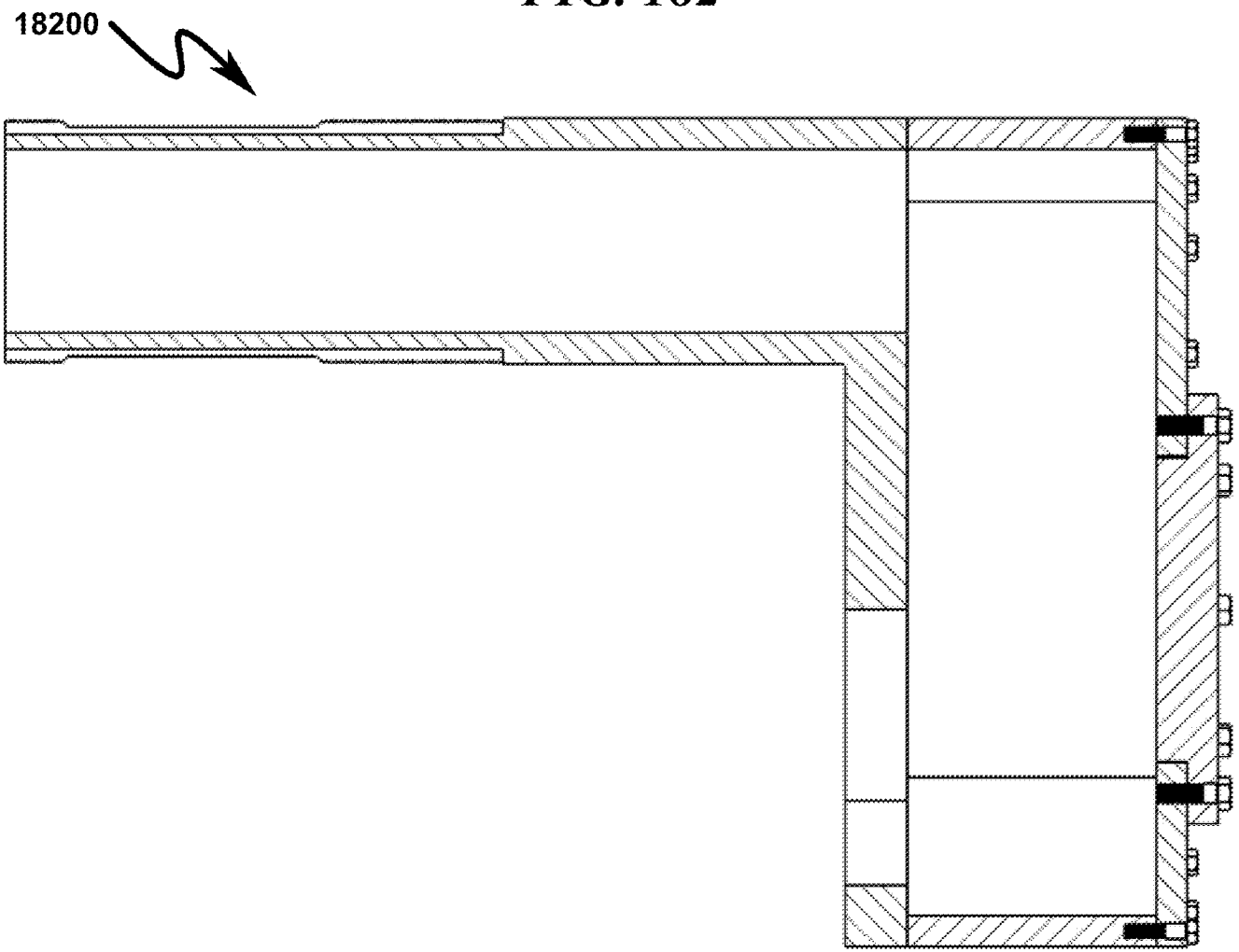
Figure 183:
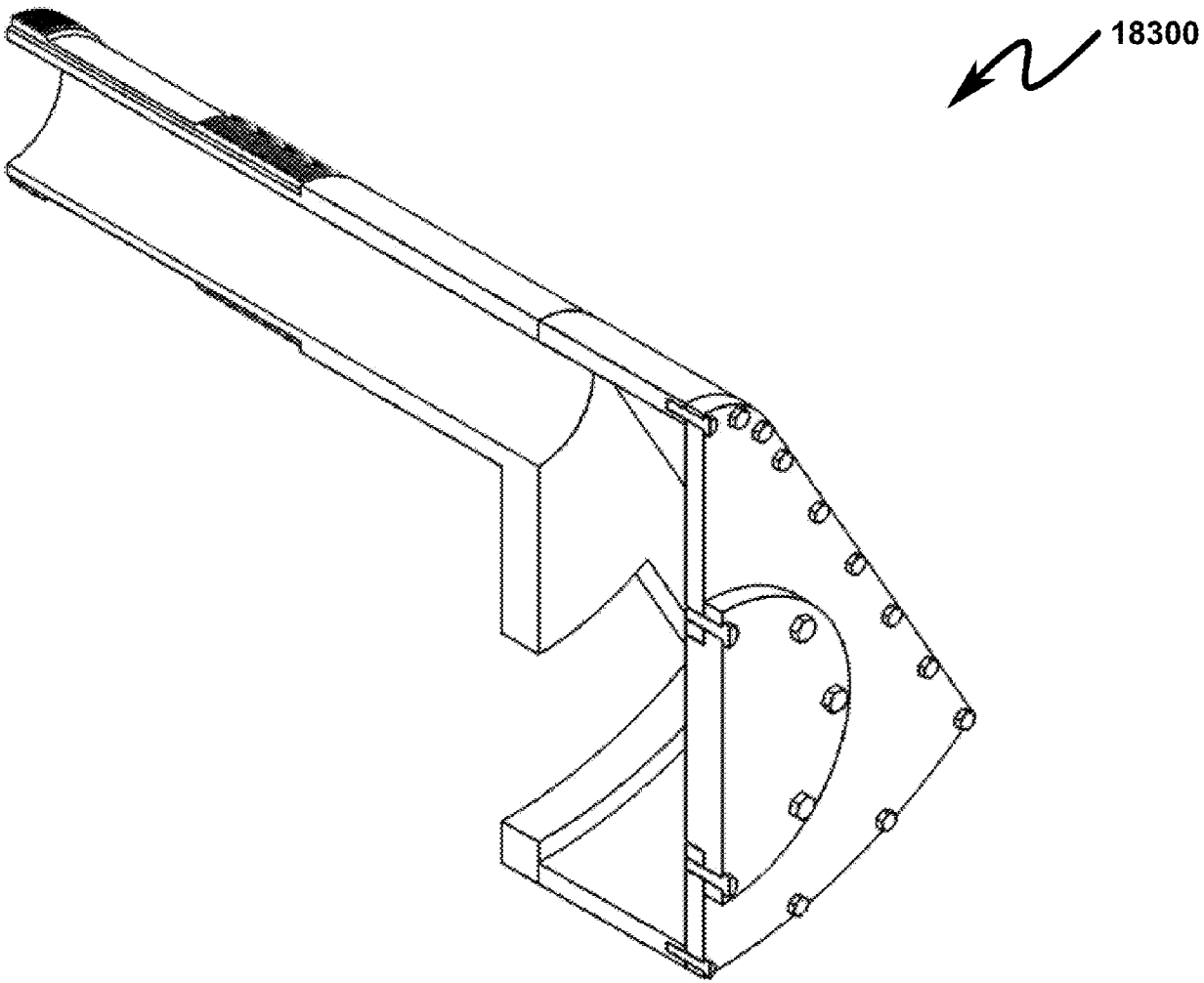
Figure 184:
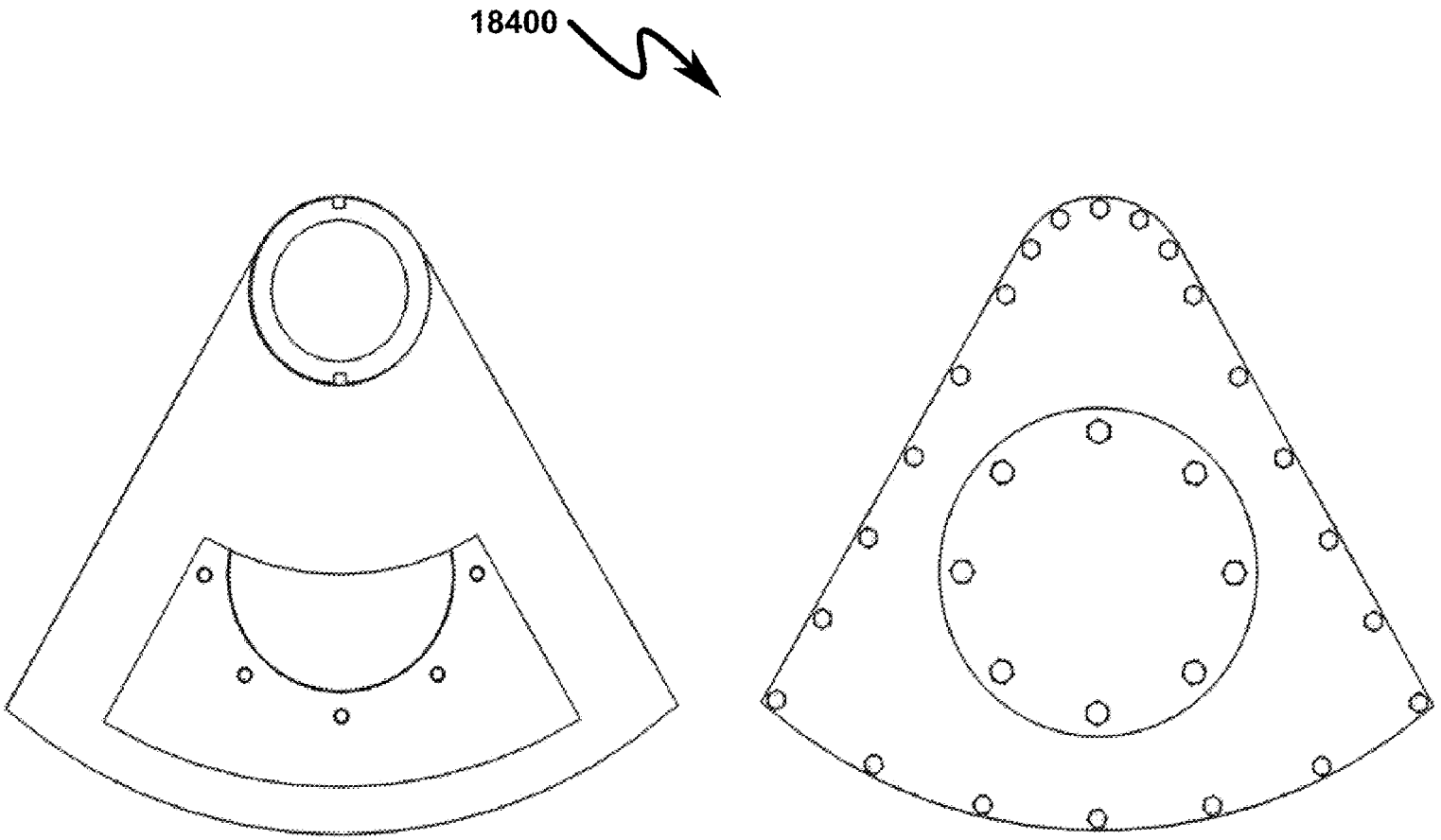
Figure 185:
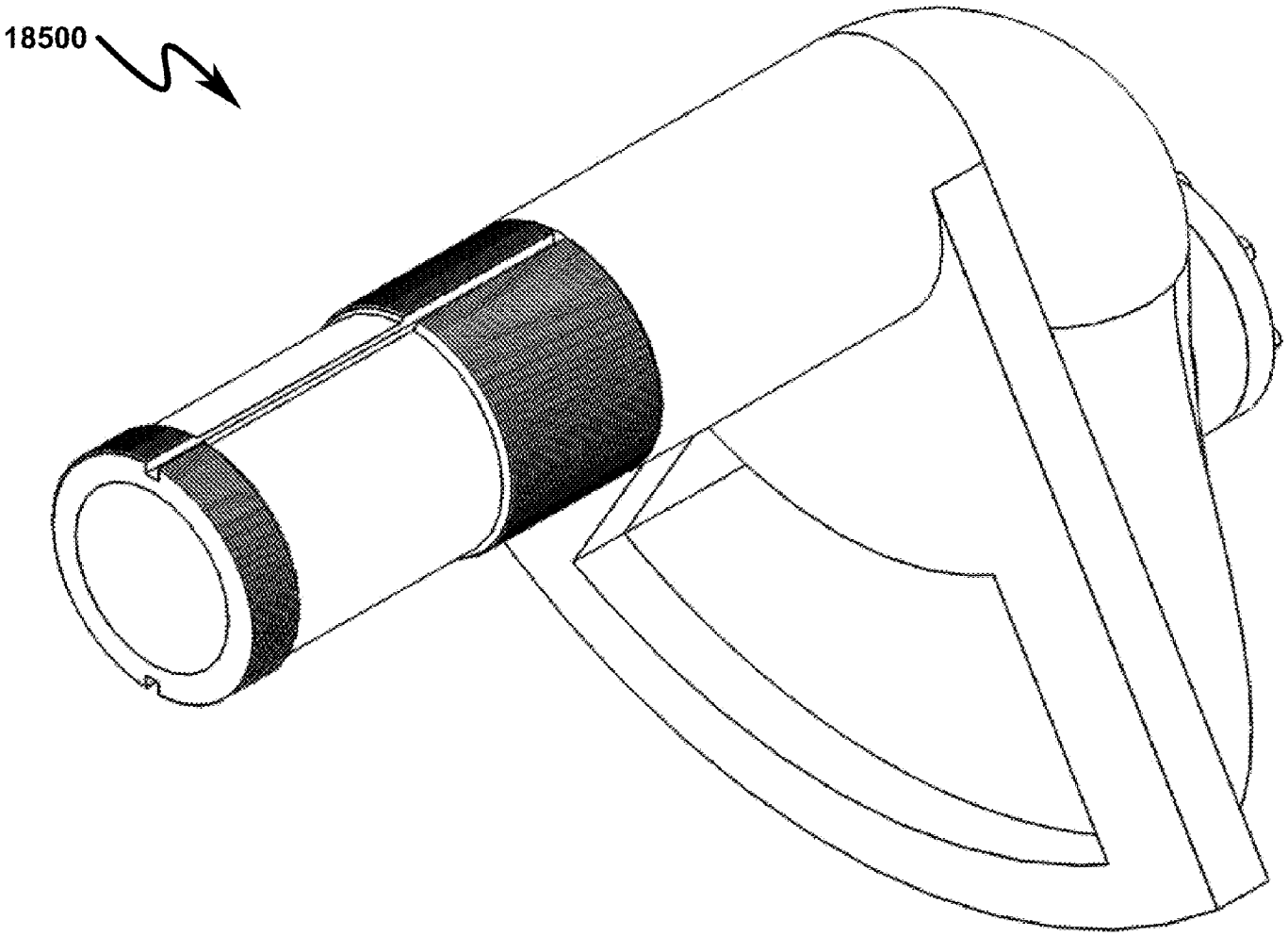
Figure 186:
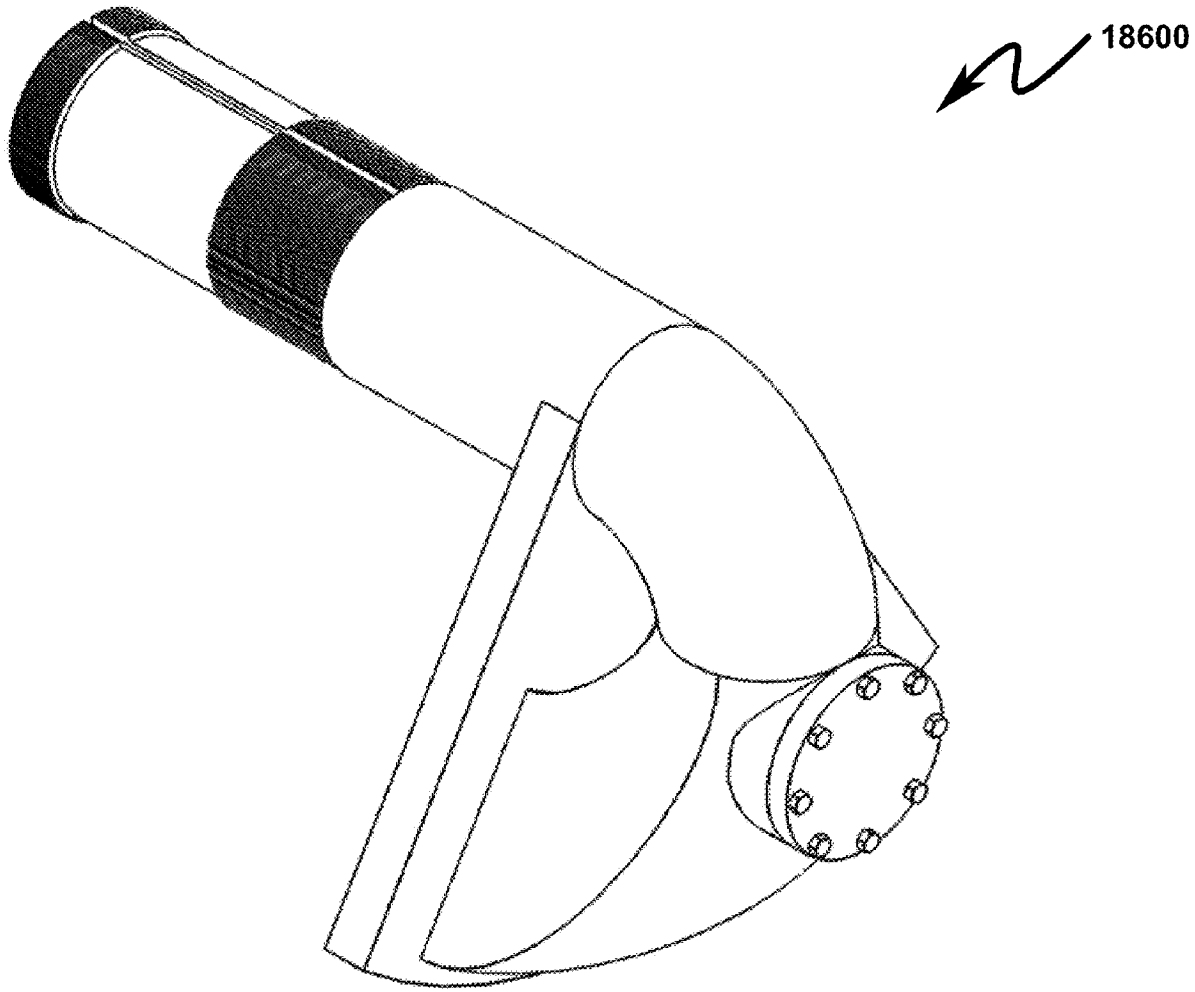
Figure 187:
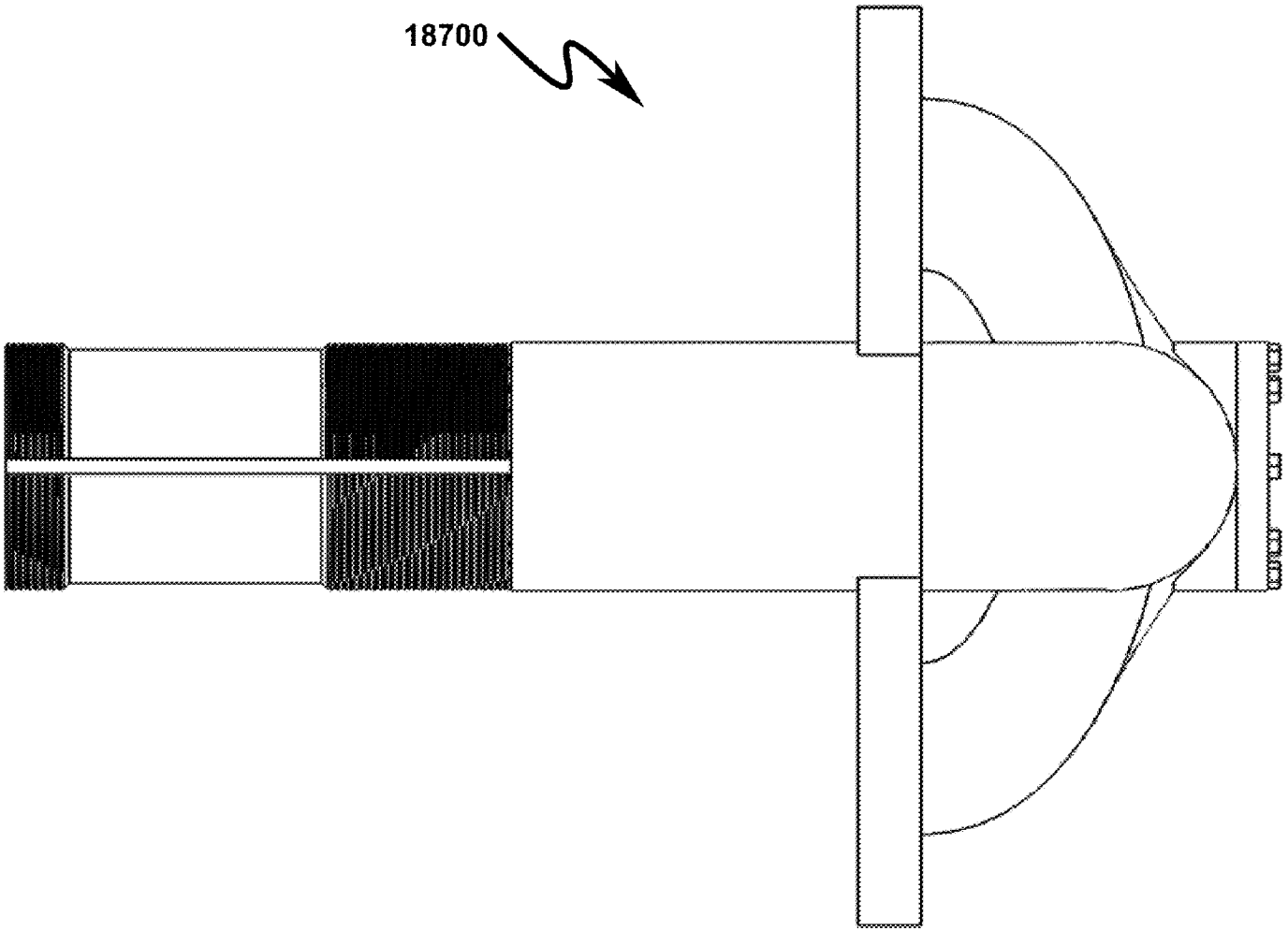
Figure 188:
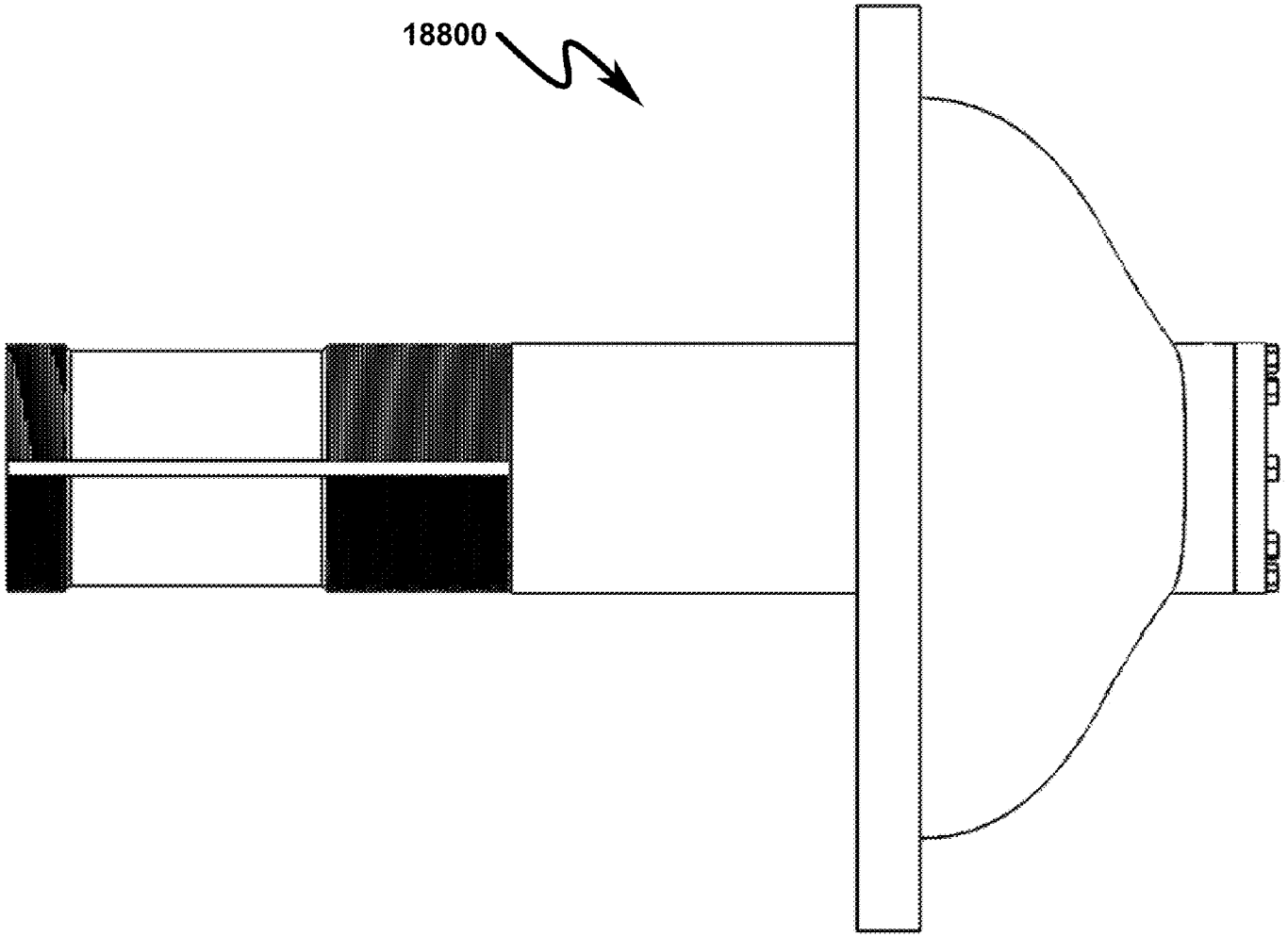
Figure 189:
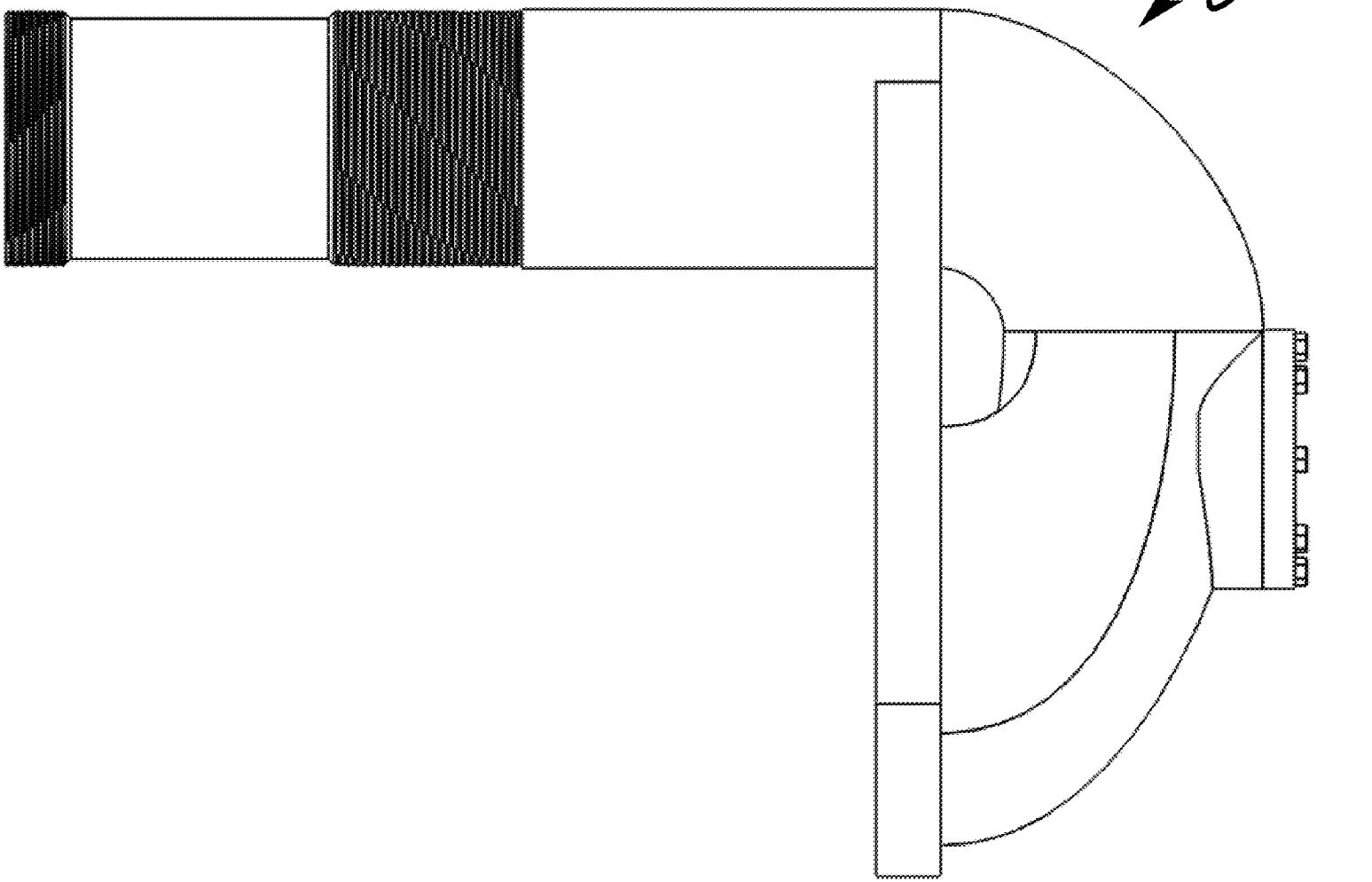
Figure 190:
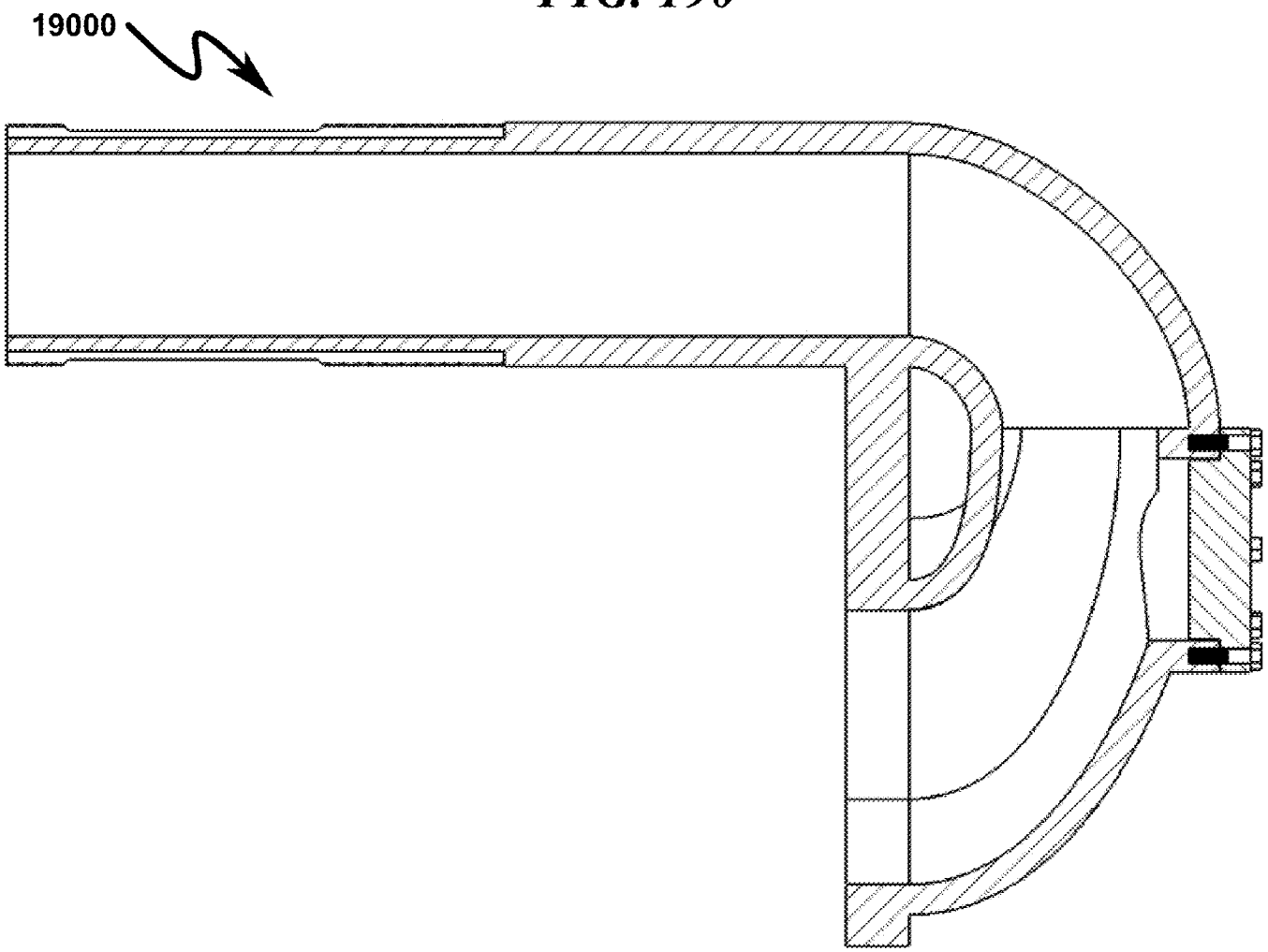
Figure 191:
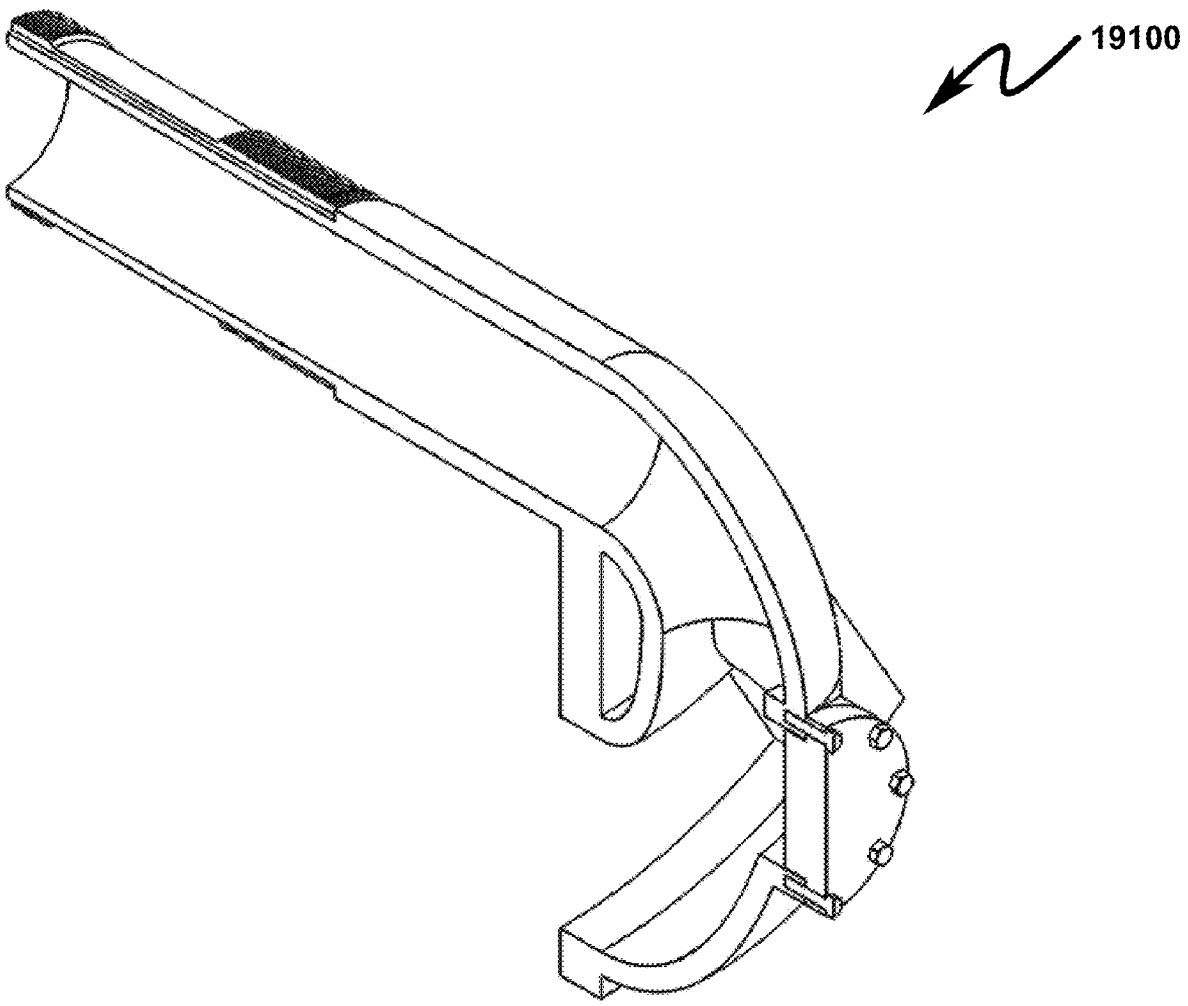
Figure 192:
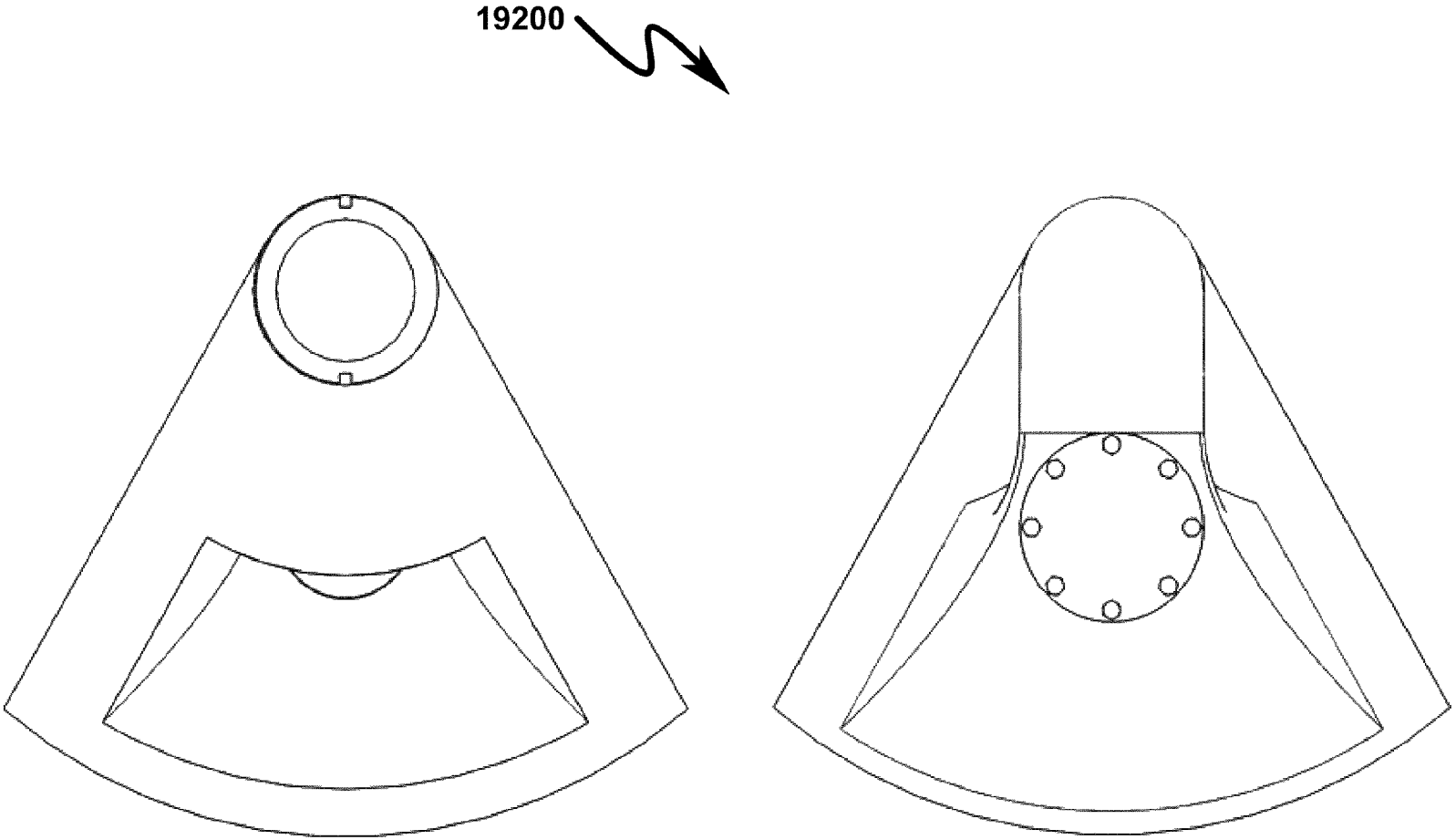

FIG. 131 illustrates a right rear perspective view of an alternate preferred exemplary embodiment of the present invention with TSCR positioned to cover both hydraulic ram input ports incorporating a YE tube and hopper with auto compensating cutting ring hydraulic tensioning;

FIG. 132 illustrates a left rear perspective view of an alternate preferred exemplary embodiment of the present invention with TSCR positioned to cover both hydraulic ram input ports incorporating a YE tube and hopper with auto compensating cutting ring hydraulic tensioning;

FIG. 133 illustrates a left front perspective view of an alternate preferred exemplary embodiment of the present invention with TSCR positioned to cover both hydraulic ram input ports incorporating a YE tube and hopper with auto compensating cutting ring hydraulic tensioning;

FIG. 134 illustrates a right front perspective view of an alternate preferred exemplary embodiment of the present invention with TSCR positioned to cover one hydraulic ram input port incorporating a YE tube and hopper with auto compensating cutting ring hydraulic tensioning;

FIG. 135 illustrates a right rear perspective view of an alternate preferred exemplary embodiment of the present invention with TSCR positioned to cover one hydraulic ram input port incorporating a YE tube and hopper with auto compensating cutting ring hydraulic tensioning;

FIG. 136 illustrates a left rear perspective view of an alternate preferred exemplary embodiment of the present invention with TSCR positioned to cover one hydraulic ram input port incorporating a YE tube and hopper with auto compensating cutting ring hydraulic tensioning;

FIG. 137 illustrates a left front perspective view of an alternate preferred exemplary embodiment of the present invention with TSCR positioned to cover one hydraulic ram input port incorporating a YE tube and hopper with auto compensating cutting ring hydraulic tensioning;

FIG. 138 illustrates front and rear views of an alternate preferred exemplary embodiment of the present invention with TSCR positioned to cover both hydraulic ram input ports incorporating a YE tube and hopper with auto compensating cutting ring hydraulic tensioning;

FIG. 139 illustrates a top view of an alternate preferred exemplary embodiment of the present invention with TSCR positioned to cover both hydraulic ram input ports incorporating a YE tube and hopper with auto compensating cutting ring hydraulic tensioning;

FIG. 140 illustrates a bottom view of an alternate preferred exemplary embodiment of the present invention with TSCR positioned to cover both hydraulic ram input ports incorporating a YE tube and hopper with auto compensating cutting ring hydraulic tensioning;

FIG. 141 illustrates a side view of an alternate preferred exemplary embodiment of the present invention with TSCR positioned to cover both hydraulic ram input ports incorporating a YE tube and hopper with auto compensating cutting ring hydraulic tensioning;

FIG. 142 illustrates a side sectional view of an alternate preferred exemplary embodiment of the present invention with TSCR positioned to cover both hydraulic ram input ports incorporating a YE tube and hopper with auto compensating cutting ring hydraulic tensioning;

FIG. 143 illustrates a side sectional perspective view of an alternate preferred exemplary embodiment of the present invention with TSCR positioned to cover both hydraulic ram input ports incorporating a YE tube and hopper with auto compensating cutting ring hydraulic tensioning;

FIG. 144 illustrates a side sectional perspective detail view of an alternate preferred exemplary embodiment of the present invention with TSCR positioned to cover both hydraulic ram input ports incorporating a YE tube and hopper with auto compensating cutting ring hydraulic tensioning;

FIG. 145 illustrates a right front perspective isolation view of an alternate preferred exemplary embodiment of a typical cast YE TSCR assembly;

FIG. 146 illustrates a right rear perspective isolation view of an alternate preferred exemplary embodiment of a typical cast YE TSCR assembly;

FIG. 147 illustrates a top view of an alternate preferred exemplary embodiment of a typical cast YE TSCR assembly;

FIG. 148 illustrates a bottom view of an alternate preferred exemplary embodiment of a typical cast YE TSCR assembly;

FIG. 149 illustrates a side view of an alternate preferred exemplary embodiment of a typical cast YE TSCR assembly;

FIG. 150 illustrates a side sectional view of an alternate preferred exemplary embodiment of a typical cast YE TSCR assembly;

FIG. 151 illustrates a side sectional perspective view of an alternate preferred exemplary embodiment of a typical cast YE TSCR assembly;

FIG. 152 illustrates a front and rear views of an alternate preferred exemplary embodiment of a typical cast YE TSCR assembly;

FIG. 153 illustrates a general side sectional view of a preferred exemplary embodiment of the present invention incorporating a YU tube and hopper with auto compensating cutting ring hydraulic tensioning;

FIG. 154 illustrates a right front perspective view of an alternate preferred exemplary embodiment of the present invention with TSCR positioned to cover both hydraulic ram input ports incorporating a YU tube and hopper with auto compensating cutting ring hydraulic tensioning;

FIG. 155 illustrates a right rear perspective view of an alternate preferred exemplary embodiment of the present invention with TSCR positioned to cover both hydraulic ram input ports incorporating a YU tube and hopper with auto compensating cutting ring hydraulic tensioning;

FIG. 156 illustrates a left rear perspective view of an alternate preferred exemplary embodiment of the present invention with TSCR positioned to cover both hydraulic ram input ports incorporating a YU tube and hopper with auto compensating cutting ring hydraulic tensioning;

FIG. 157 illustrates a left front perspective view of an alternate preferred exemplary embodiment of the present invention with TSCR positioned to cover both hydraulic ram input ports incorporating a YU tube and hopper with auto compensating cutting ring hydraulic tensioning;

FIG. 158 illustrates a right front perspective view of an alternate preferred exemplary embodiment of the present invention with TSCR positioned to cover one hydraulic ram input port incorporating a YU tube and hopper with auto compensating cutting ring hydraulic tensioning;

FIG. 159 illustrates a right rear perspective view of an alternate preferred exemplary embodiment of the present invention with TSCR positioned to cover one hydraulic ram input port incorporating a YU tube and hopper with auto compensating cutting ring hydraulic tensioning;

FIG. 160 illustrates a left rear perspective view of an alternate preferred exemplary embodiment of the present invention with TSCR positioned to cover one hydraulic ram input port incorporating a YU tube and hopper with auto compensating cutting ring hydraulic tensioning;

FIG. 161 illustrates a left front perspective view of an alternate preferred exemplary embodiment of the present invention with TSCR positioned to cover one hydraulic ram input port incorporating a YU tube and hopper with auto compensating cutting ring hydraulic tensioning;

FIG. 162 illustrates front and rear views of an alternate preferred exemplary embodiment of the present invention with TSCR positioned to cover both hydraulic ram input ports incorporating a YU tube and hopper with auto compensating cutting ring hydraulic tensioning;

FIG. 163 illustrates a top view of an alternate preferred exemplary embodiment of the present invention with TSCR positioned to cover both hydraulic ram input ports incorporating a YU tube and hopper with auto compensating cutting ring hydraulic tensioning;

FIG. 164 illustrates a bottom view of an alternate preferred exemplary embodiment of the present invention with TSCR positioned to cover both hydraulic ram input ports incorporating a YU tube and hopper with auto compensating cutting ring hydraulic tensioning;

FIG. 165 illustrates a side view of an alternate preferred exemplary embodiment of the present invention with TSCR positioned to cover both hydraulic ram input ports incorporating a YU tube and hopper with auto compensating cutting ring hydraulic tensioning;

FIG. 166 illustrates a side sectional view of an alternate preferred exemplary embodiment of the present invention with TSCR positioned to cover both hydraulic ram input ports incorporating a YU tube and hopper with auto compensating cutting ring hydraulic tensioning;

FIG. 167 illustrates a side sectional perspective view of an alternate preferred exemplary embodiment of the present invention with TSCR positioned to cover both hydraulic ram input ports incorporating a YU tube and hopper with auto compensating cutting ring hydraulic tensioning;

FIG. 168 illustrates a side sectional perspective detail view of an alternate preferred exemplary embodiment of the present invention with TSCR positioned to cover both hydraulic ram input ports incorporating a YU tube and hopper with auto compensating cutting ring hydraulic tensioning;

FIG. 169 illustrates a right front perspective view of an alternate preferred exemplary embodiment of the present invention with TSCR positioned to cover both hydraulic ram input ports incorporating a YU tube and hopper with auto compensating cutting ring hydraulic tensioning and output piping removed;

FIG. 170 illustrates a right rear perspective view of an alternate preferred exemplary embodiment of the present invention with TSCR positioned to cover both hydraulic ram input ports incorporating a YU tube and hopper with auto compensating cutting ring hydraulic tensioning and output piping removed;

FIG. 171 illustrates a right rear perspective view of an alternate preferred exemplary embodiment of the present invention with TSCR positioned to cover both hydraulic ram input ports incorporating a YU tube and hopper with auto compensating cutting ring hydraulic tensioning, and output piping and cleanout port removed;

FIG. 172 illustrates a right rear perspective view of an alternate preferred exemplary embodiment of the present invention with TSCR positioned to cover both hydraulic ram input ports incorporating a YU tube and hopper with auto compensating cutting ring hydraulic tensioning, and output piping and rear cleanout port removed;

FIG. 173 illustrates a right rear perspective view of an alternate preferred exemplary embodiment of the present invention with TSCR positioned to cover both hydraulic ram input ports incorporating a YU tube and hopper with auto compensating cutting ring hydraulic tensioning and output piping, rear cleanout port, and hopper removed;

FIG. 174 illustrates a top rear perspective view of an alternate preferred exemplary embodiment of the present invention with TSCR positioned to cover the right hydraulic ram input port incorporating a YU tube and hopper with auto compensating cutting ring hydraulic tensioning, and output piping and rear cleanout port removed;

FIG. 175 illustrates a top rear perspective view of an alternate preferred exemplary embodiment of the present invention with TSCR positioned to cover both hydraulic ram input ports incorporating a YU tube and hopper with auto compensating cutting ring hydraulic tensioning, and output piping and rear cleanout port removed;

FIG. 176 illustrates a top rear perspective view of an alternate preferred exemplary embodiment of the present invention with TSCR positioned to cover the left hydraulic ram input port incorporating a YU tube and hopper with auto compensating cutting ring hydraulic tensioning, and output piping and rear cleanout port removed;

FIG. 177 illustrates a right front perspective isolation view of an alternate preferred exemplary embodiment of a typical fabricated YU TSCR assembly;

FIG. 178 illustrates a right rear perspective isolation view of an alternate preferred exemplary embodiment of a typical fabricated YU TSCR assembly;

FIG. 179 illustrates a top view of an alternate preferred exemplary embodiment of a typical fabricated YU TSCR assembly;

FIG. 180 illustrates a bottom view of an alternate preferred exemplary embodiment of a typical fabricated YU TSCR assembly;

FIG. 181 illustrates a side view of an alternate preferred exemplary embodiment of a typical fabricated YU TSCR assembly;

FIG. 182 illustrates a side sectional view of an alternate preferred exemplary embodiment of a typical fabricated YU TSCR assembly;

FIG. 183 illustrates a side sectional perspective view of an alternate preferred exemplary embodiment of a typical fabricated YU TSCR assembly;

FIG. 184 illustrates front and rear views of an alternate preferred exemplary embodiment of a typical fabricated YU TSCR assembly;

FIG. 185 illustrates a right front perspective isolation view of an alternate preferred exemplary embodiment of a typical cast YU TSCR assembly;

FIG. 186 illustrates a right rear perspective isolation view of an alternate preferred exemplary embodiment of a typical cast YU TSCR assembly;

FIG. 187 illustrates a top view of an alternate preferred exemplary embodiment of a typical cast YU TSCR assembly;

FIG. 188 illustrates a bottom view of an alternate preferred exemplary embodiment of a typical cast YU TSCR assembly;

FIG. 189 illustrates a side view of an alternate preferred exemplary embodiment of a typical cast YU TSCR assembly;

FIG. 190 illustrates a side sectional view of an alternate preferred exemplary embodiment of a typical cast YU TSCR assembly;

FIG. 191 illustrates a side sectional perspective view of an alternate preferred exemplary embodiment of a typical cast YU TSCR assembly; and FIG. 192 illustrates a front and rear views of an alternate preferred exemplary embodiment of a typical cast YU TSCR assembly.

DESCRIPTION OF THE PRESENTLY PREFERRED EXEMPLARY EMBODIMENTS

While this invention is susceptible of embodiment in many different forms, there is shown in the drawings and will herein be described in detailed preferred embodiment of the invention with the understanding that the present disclosure is to be considered as an exemplification of the principles of the invention and is not intended to limit the broad aspect of the invention to the embodiment illustrated.

The numerous innovative teachings of the present application will be described with particular reference to the presently preferred embodiment, wherein these innovative teachings are advantageously applied to the particular problems of a CONCRETE POMP SYSTEM AND METHOD. However, it should be understood that this embodiment is only one example of the many advantageous uses of the innovative teachings herein. In general, statements made in the specification of the present application do not necessarily limit any of the various claimed inventions. Moreover, some statements may apply to some inventive features but not to others.

Trapezoid not Limitive

The present invention description herein makes general reference to the construction of portions of the invention as having the shape of a "trapezoid" or being "trapezoidal" in shape. However, this terminology may have a variety of definitions within the mathematical arts and as such should be broadly construed to include any of the following:

- four-sided polygons having exactly two sides that are parallel;
- four-sided polygons having two sets of sides that are parallel;
- four-sided polygons in which the legs on opposite sides of the polygon have the same length and the base angles have the same measure (isosceles trapezoid);
- four-sided polygons in which two adjacent angles are right angles (right trapezoid; also called right-angled trapezoid);
- four-sided polygons which have an inscribed circle (tangential trapezoid);
- four-sided parallelograms (including rhombuses, rectangles and squares); and
- annular sectors comprising one or more sectors of an annulus or annular ring that approximate an isosceles trapezoid.

One skilled in the art will recognize that the construction of the present invention may make use of a variety of geometric shapes (some of which may not be polygonal in shape) to accomplish the goal of providing substantially uniform material flow from the concrete pumping system.

Concrete Material not Limitive

While the present invention is termed a "concrete pump" within this disclosure, the present invention is not necessarily limited to pumping this particular material, and may be utilized to pump a wide variety of materials other than concrete. Some exemplary applications include other construction materials, waste products, and any material pumping context in which continuous flow is a desirable characteristic. One skilled in the art will be aware that "concrete pumps" are currently used in a wide variety of applications and that this terminology does not limit the application scope of these apparatuses.

Control System not Limitive

The present invention described herein makes use of coordinated operation of hydraulic pump rams to affect continuous flow of material from a hopper through an ejection port. The examples provided herein generally illustrate the use of mechanical control of this hydraulic coordination, as in many environments in which the invention is to be utilized the conditions are harsh and machine durability and reliability are important considerations. However, some preferred invention embodiments may utilize computer controlled hydraulic controls to affect the necessary overall system operation. In this situation, a computer control system executing instructions read from a tangible non-transitory computer readable medium may control hydraulic actuators and valves to coordinate the operation of hydraulic pump rams and affect uniform material flow. Thus, one skilled in the art will recognize that the present invention makes no limitation on the type of control used to affect operation of the hydraulic rams in the claimed invention.

Hydraulic Pump Ram Number not Limitive

While the present invention indicates a first and second hydraulic pump ram in the disclosed example embodiments, other preferred embodiments may make use of any number of hydraulic pump rams based on application context. Thus, the invention scope does not limit the number of hydraulic pump rams.

System Overview (2500)-(3200)

Figure 1:
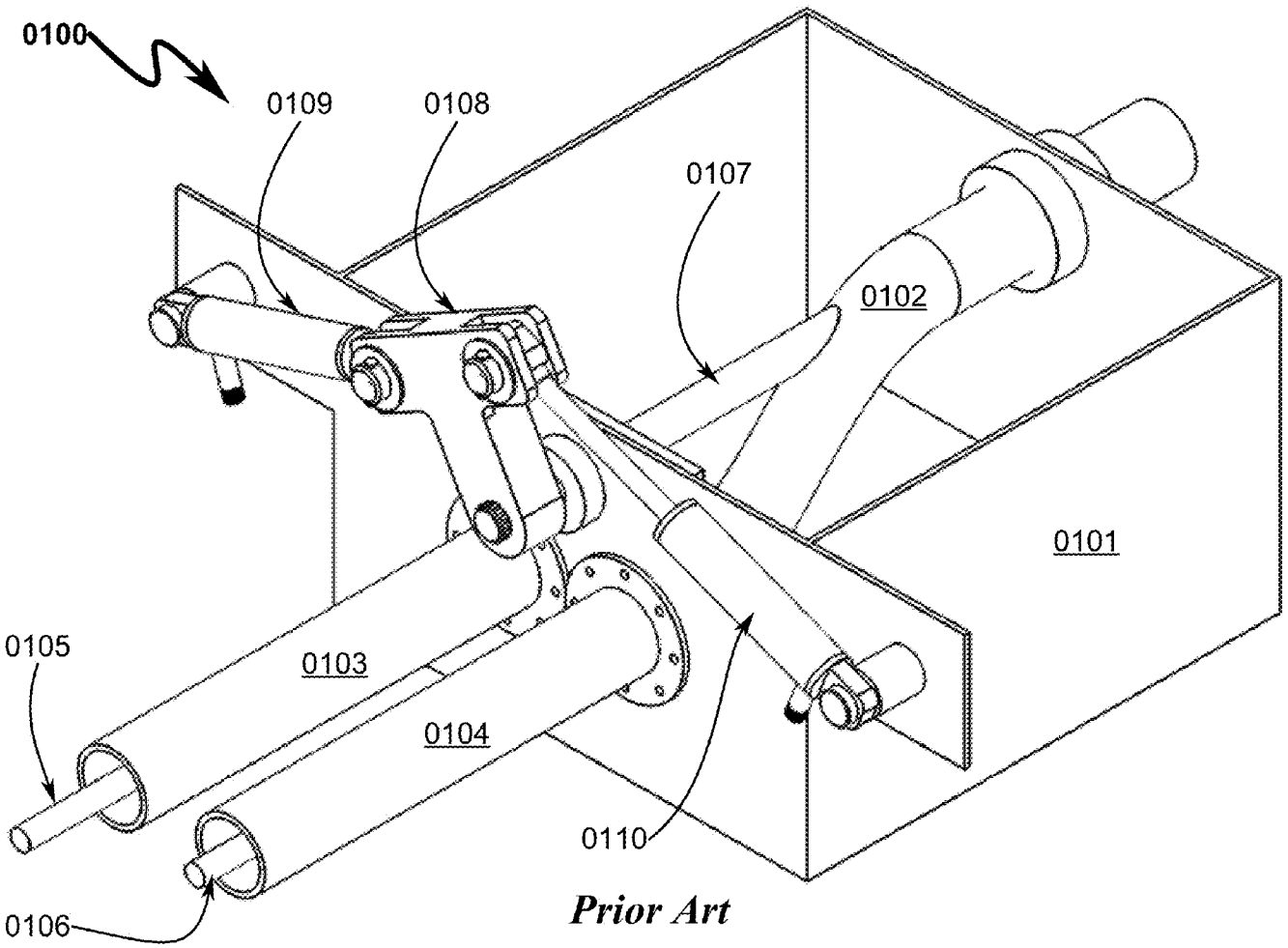
FIG. 1 Prior Art
FIG. 1 illustrates a front perspective view of a prior art concrete pump.
Figure 2:
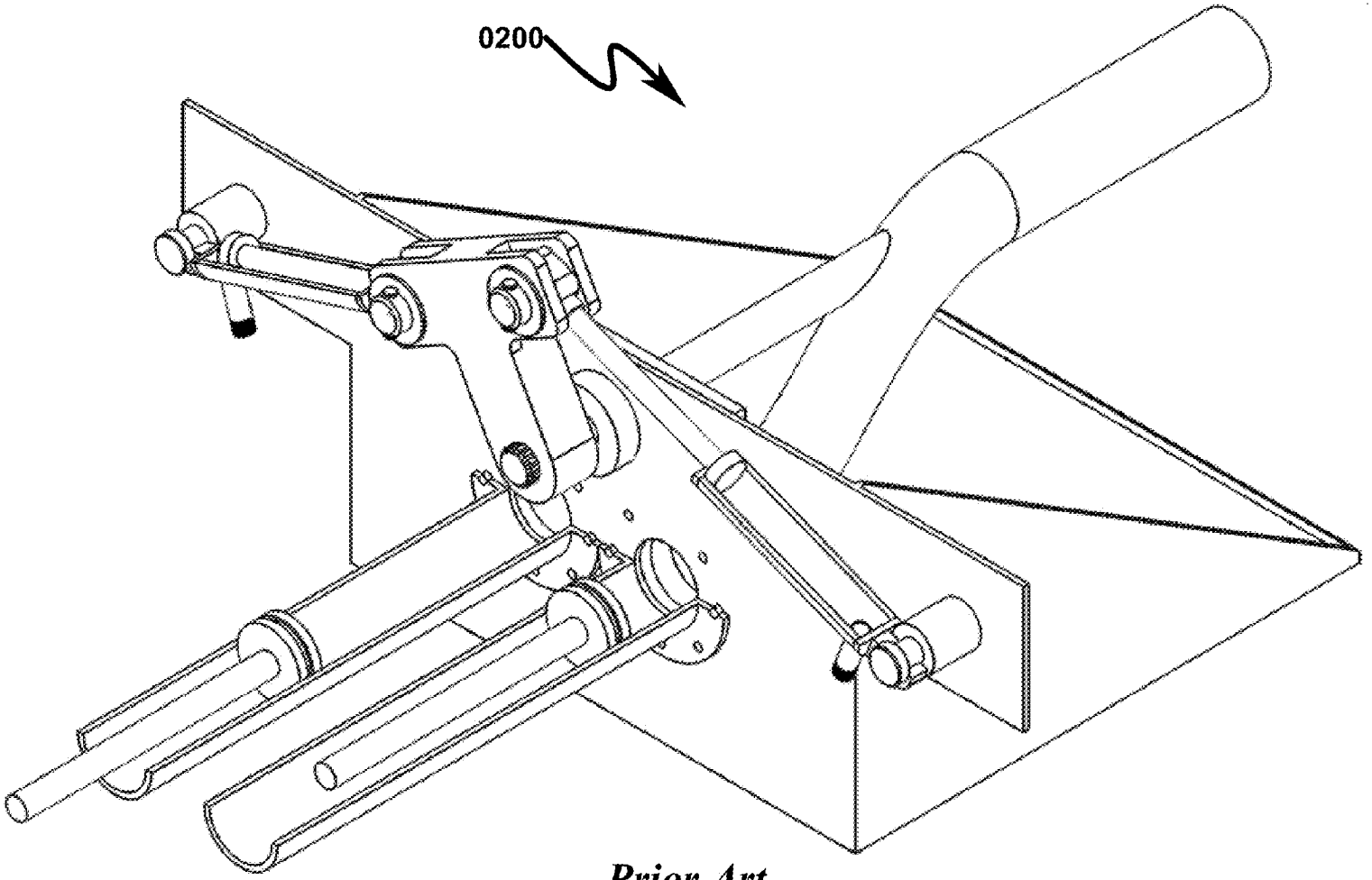
FIG. 2 Prior Art
FIG. 2 illustrates a front perspective sectional detail view of a prior art concrete pump.
Figure 3:
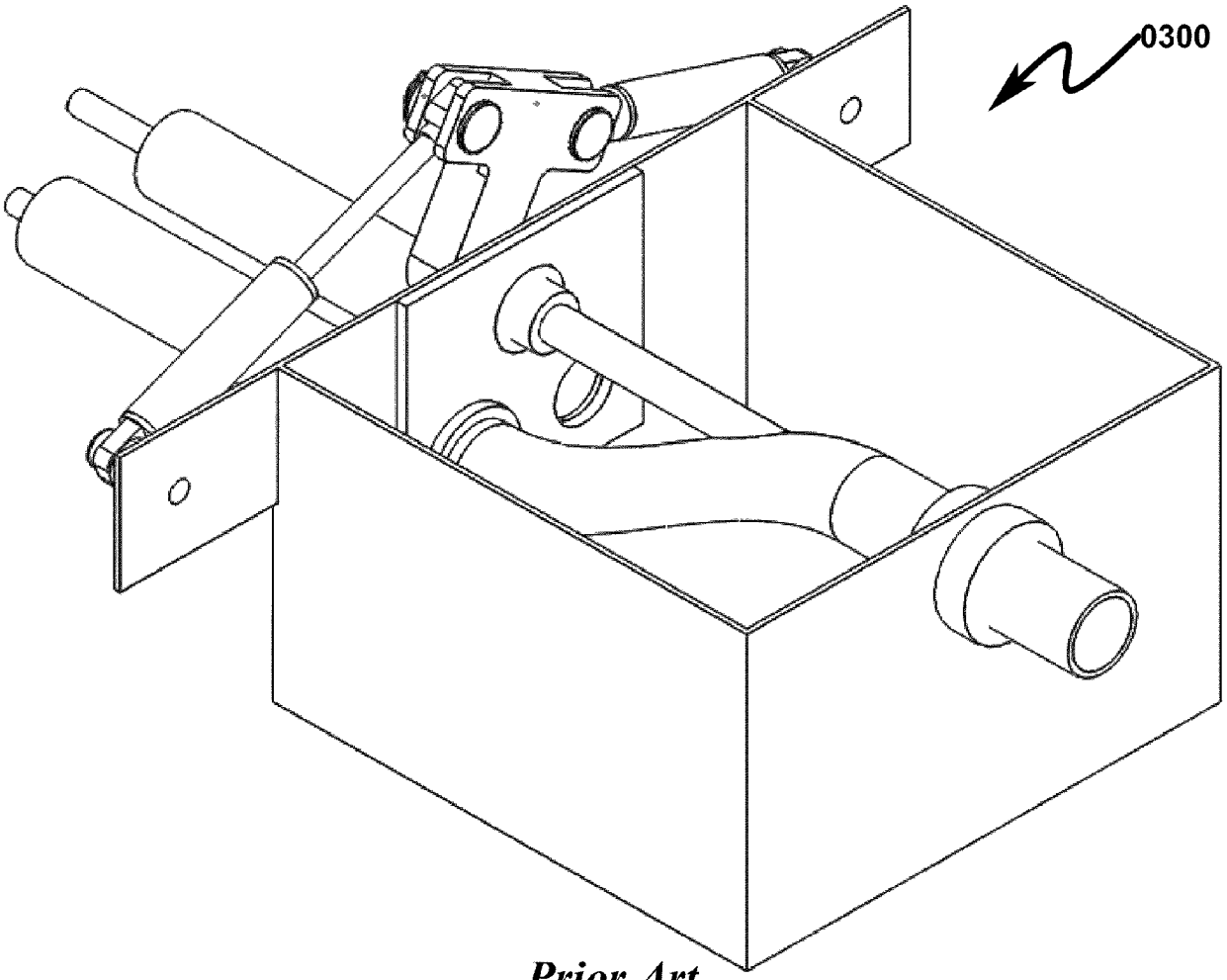
FIG. 3 Prior Art
FIG. 3 illustrates a rear perspective view of a prior art concrete pump.
Figure 4:
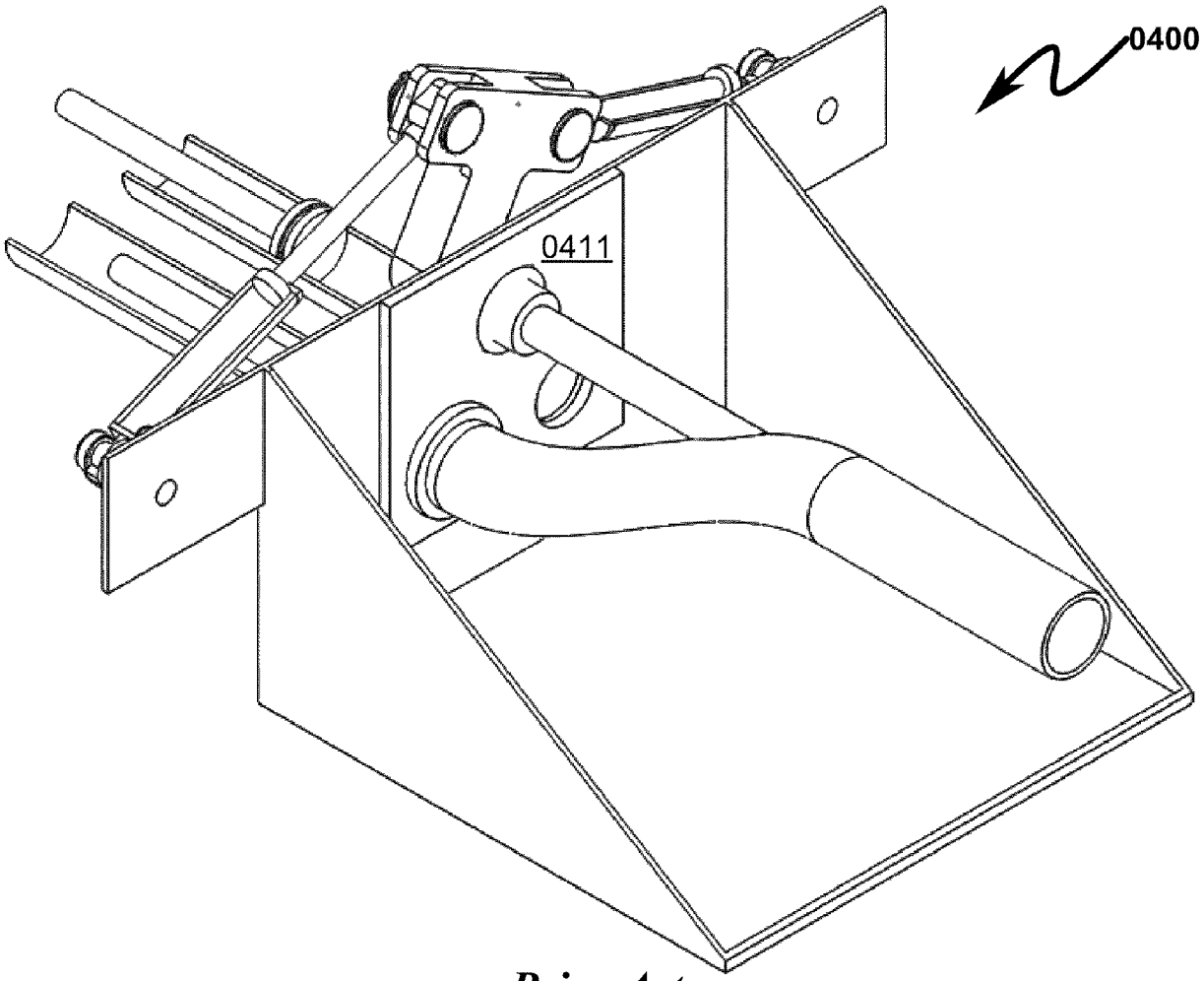
FIG. 4 Prior Art
FIG. 4 illustrates a rear perspective sectional detail view of a prior art concrete pump.
Figure 5:
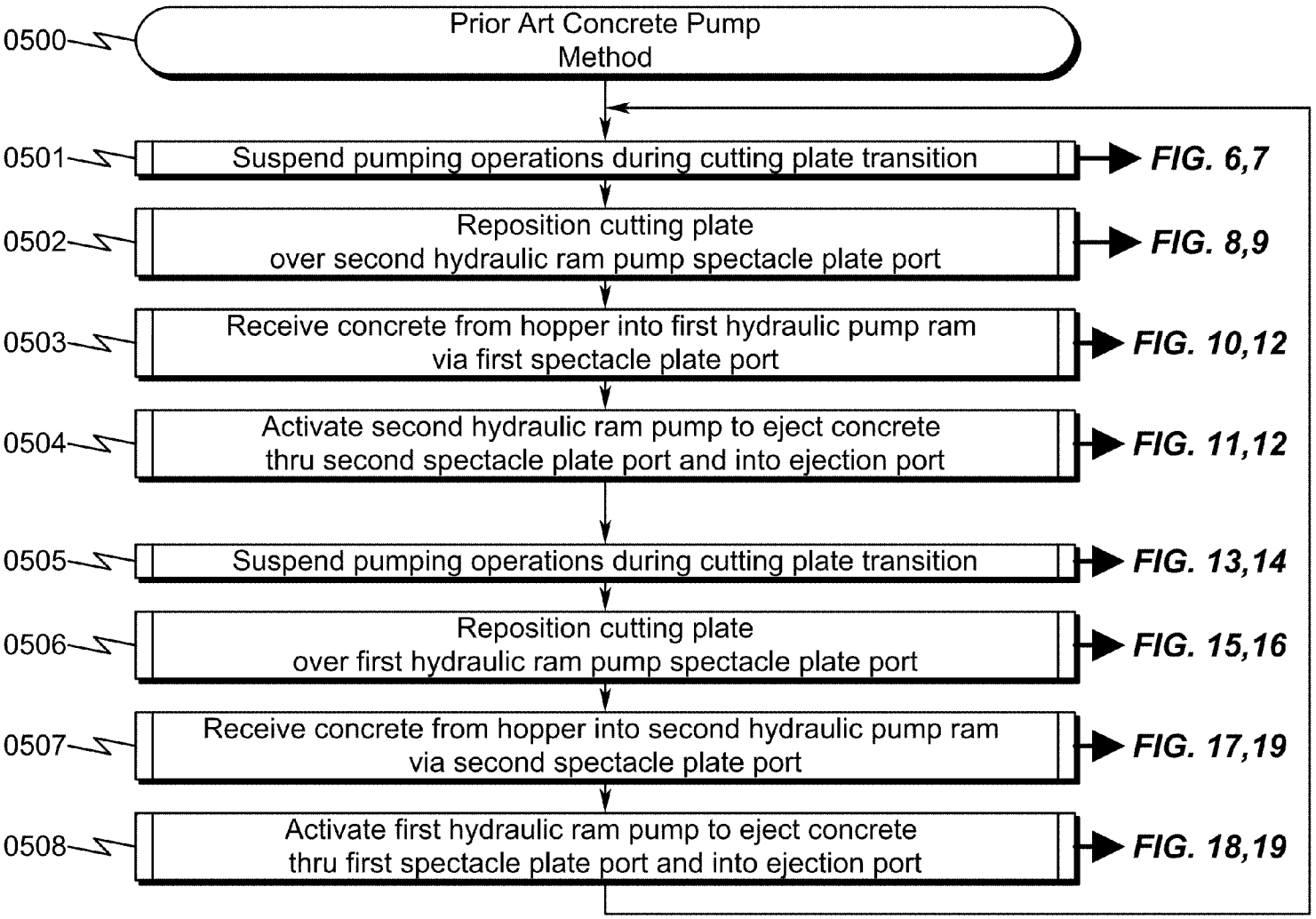
FIG. 5 illustrates a typical prior art pumping method depicted in more detail in FIG. 6-FIG. 19.
Figure 6:
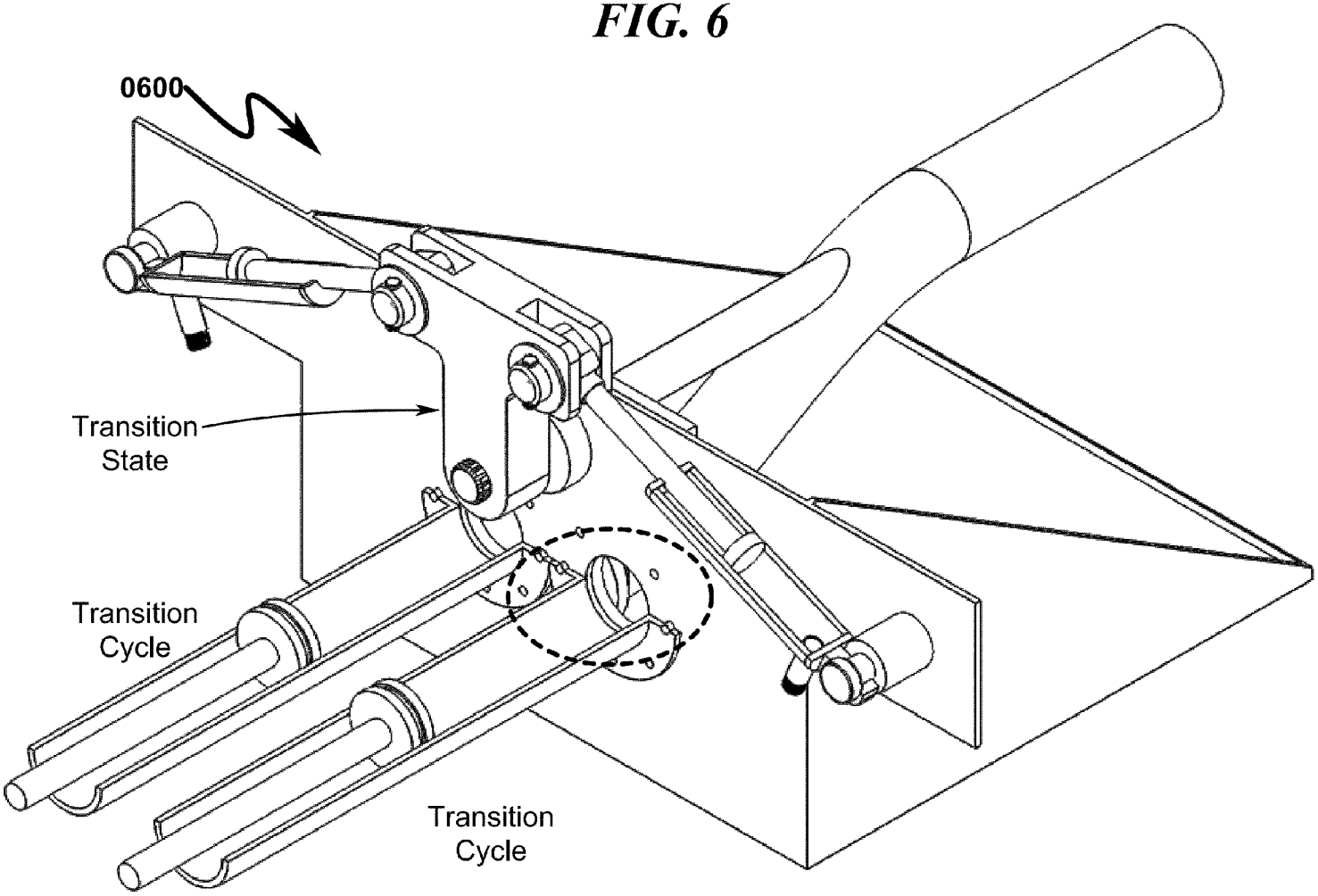
FIG. 6 Prior Art
FIG. 6 illustrates a front perspective sectional view of a prior art concrete pump in transition between left injection and right ejection cycles.
Figure 7:
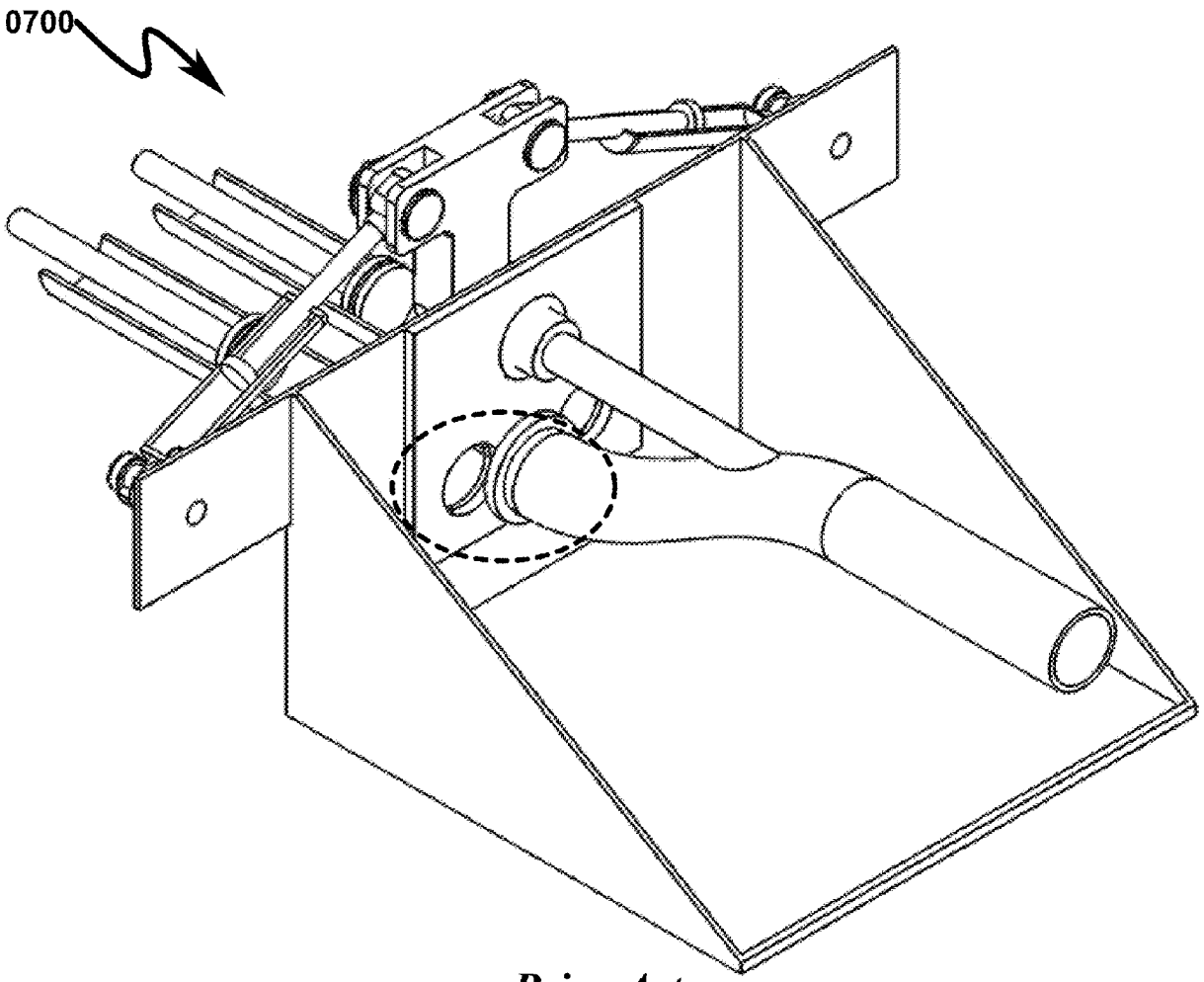
FIG. 7 Prior Art
FIG. 7 illustrates a rear perspective sectional view of a prior art concrete pump in transition between left injection and right ejection cycles.
Figure 8:
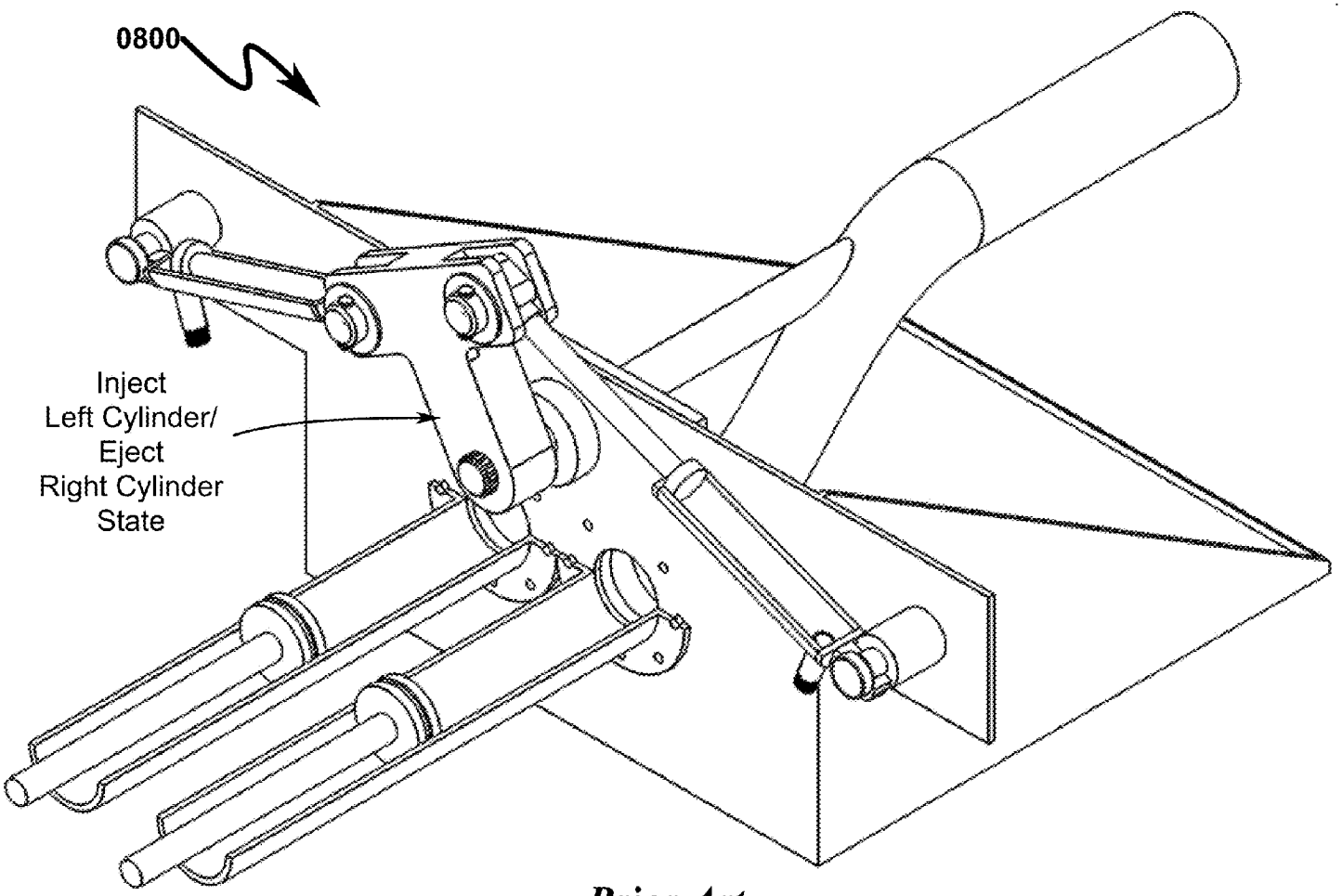
FIG. 8 Prior Art
FIG. 8 illustrates a front perspective sectional view of a prior art concrete pump positioned to inject material into the left pump cylinder and eject material from the right pump cylinder.
Figure 9:
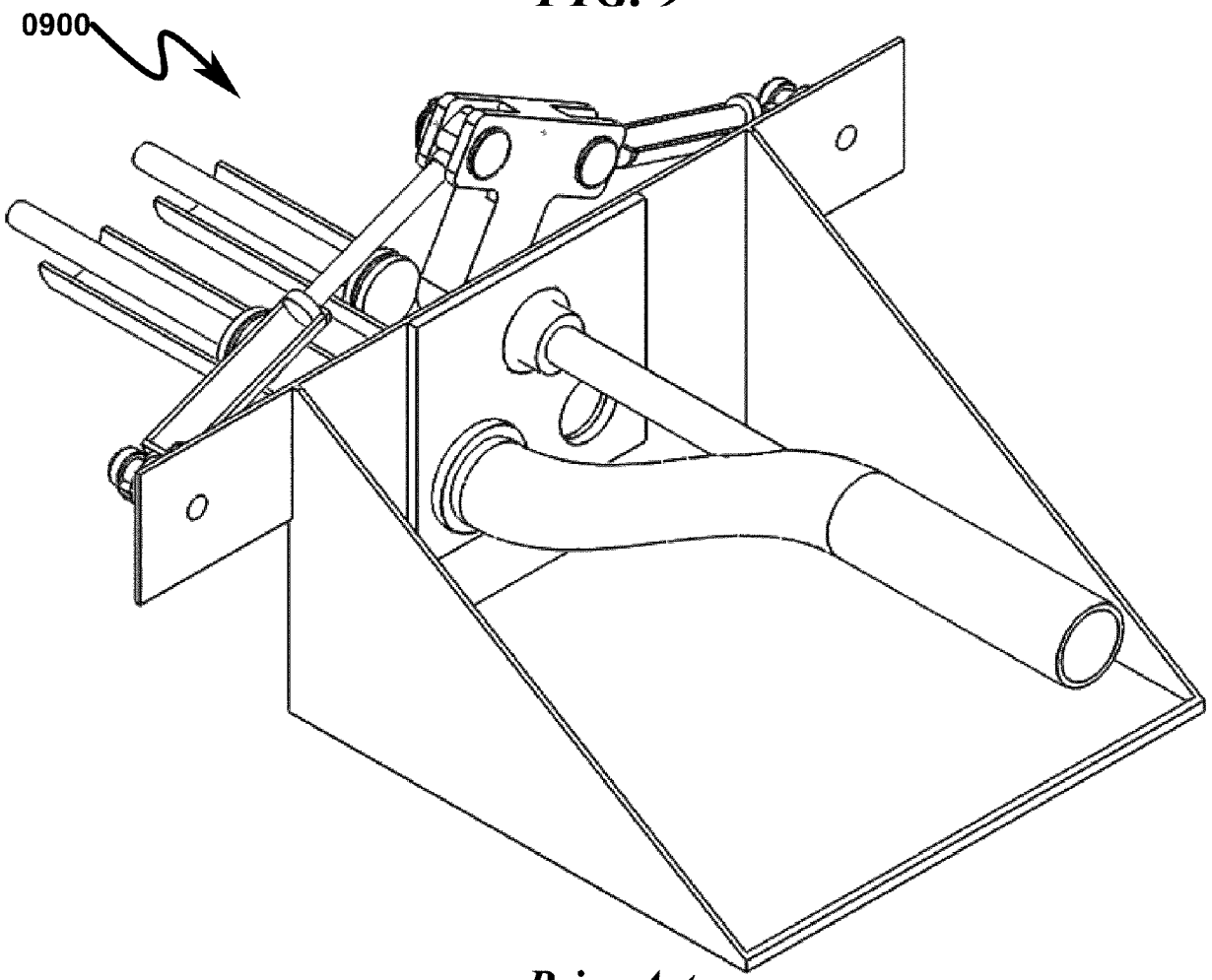
FIG. 9 Prior Art
FIG. 9 illustrates a front perspective sectional view of a prior art concrete pump positioned to inject material into the left pump cylinder and eject material from the right pump cylinder.
Figure 10:
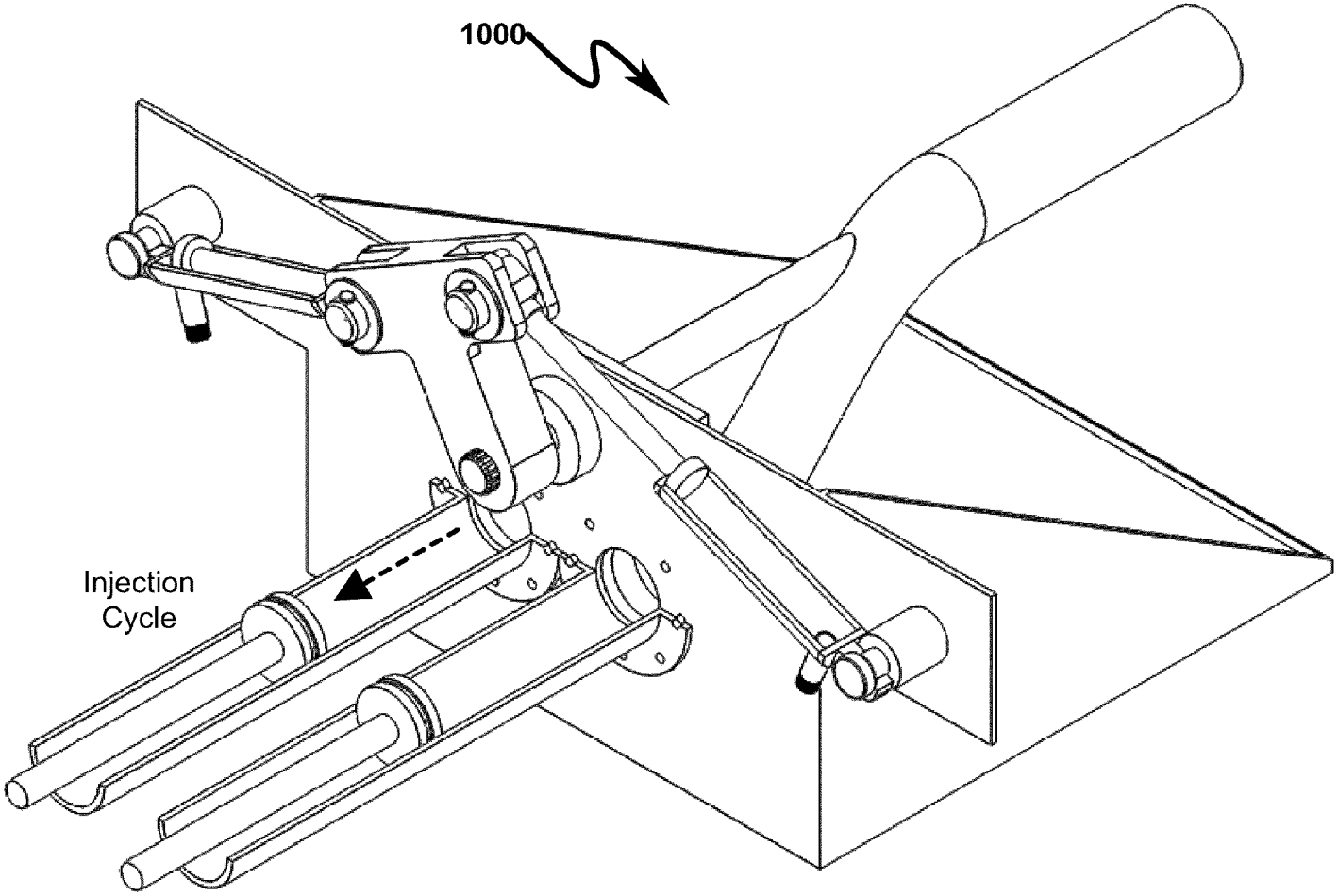
FIG. 10 Prior Art
FIG. 10 illustrates a front perspective sectional view of a prior art concrete pump injecting material into the left pump cylinder.
Figure 11:
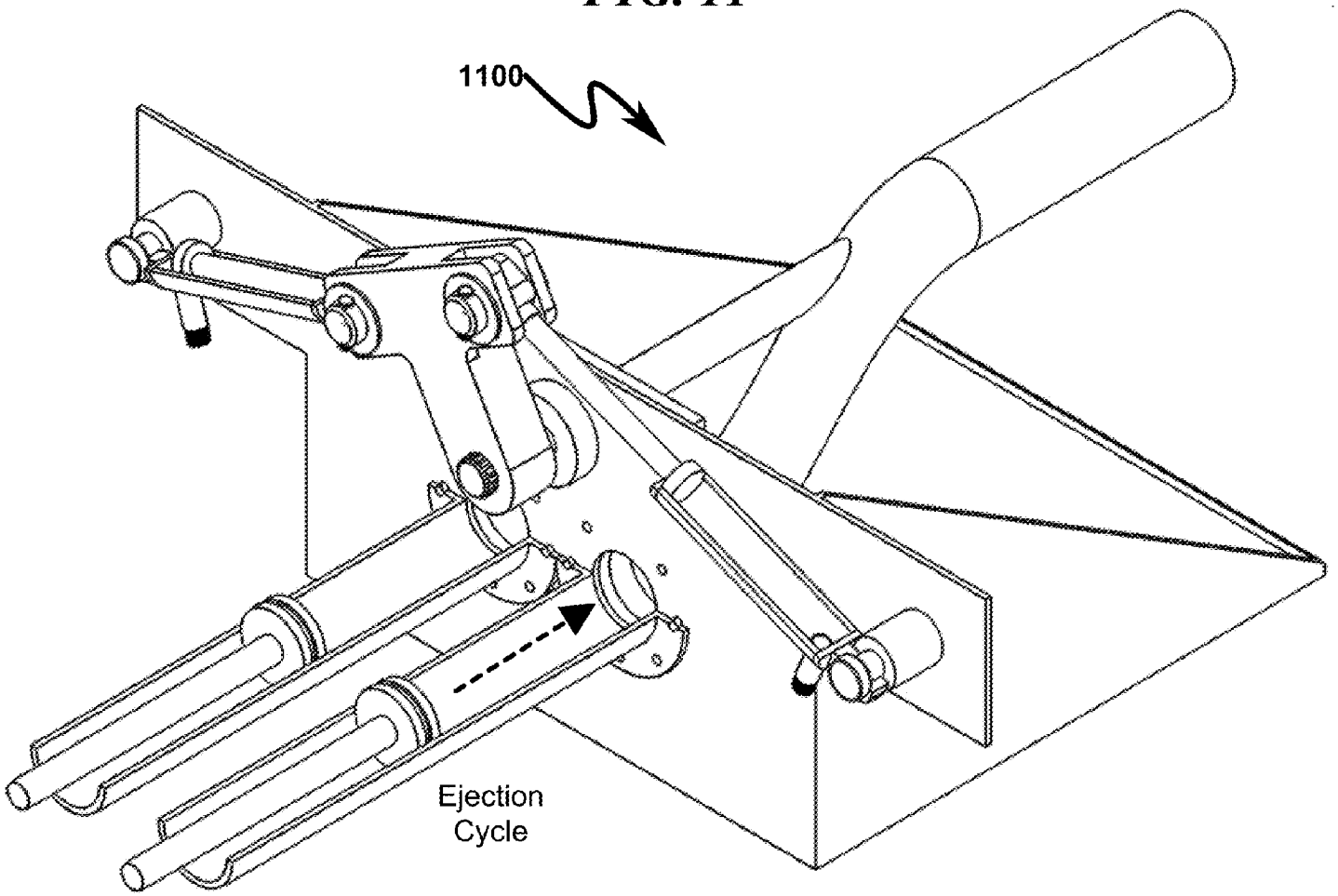
FIG. 11 Prior Art
FIG. 11 illustrates a front perspective sectional view of a prior art concrete pump ejecting material from the right pump cylinder.
Figure 12:
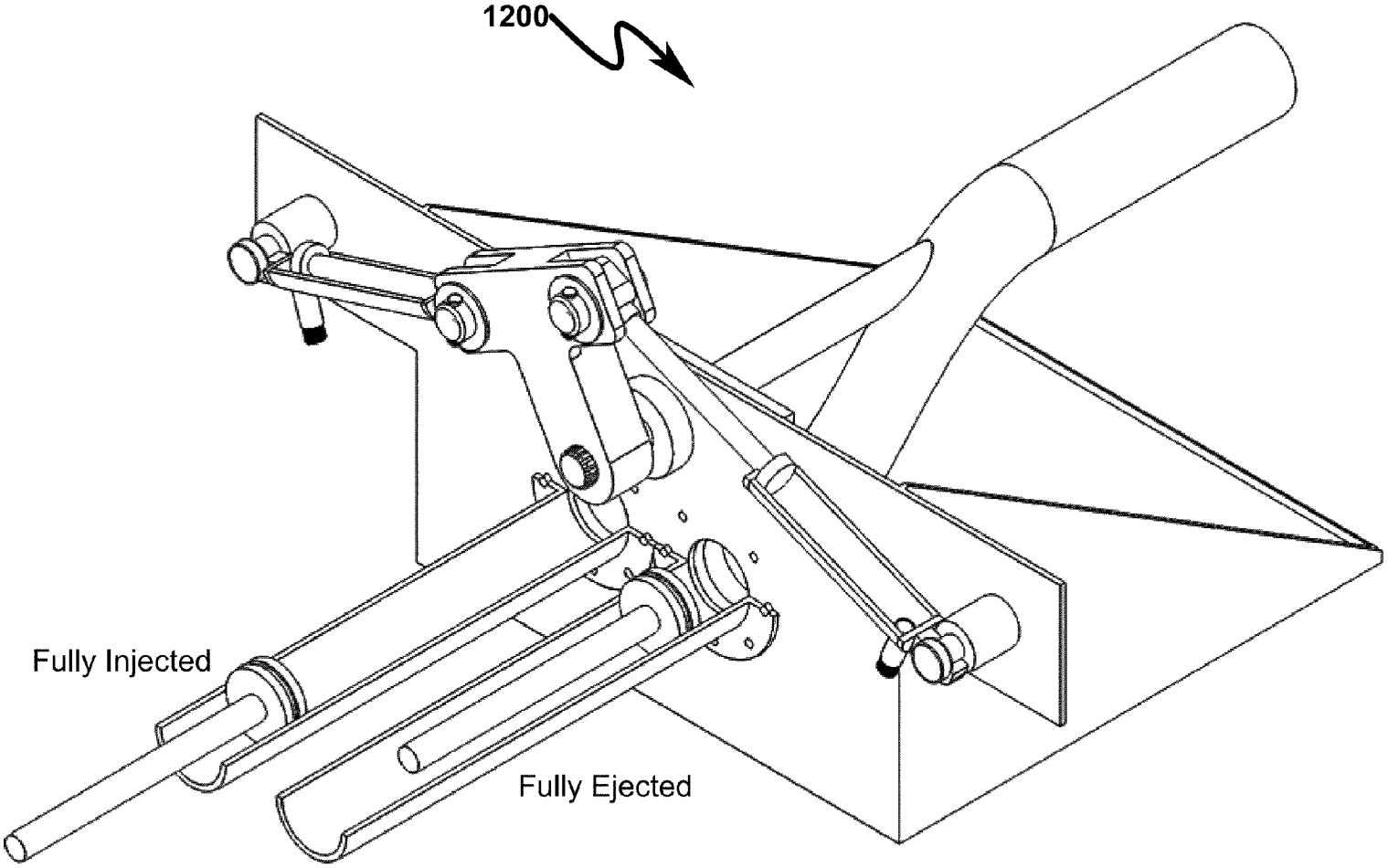
FIG. 12 Prior Art
FIG. 12 illustrates a front perspective sectional view of a prior art concrete pump with the left pump cylinder fully injected and the right pump cylinder fully ejected.
Figure 13:
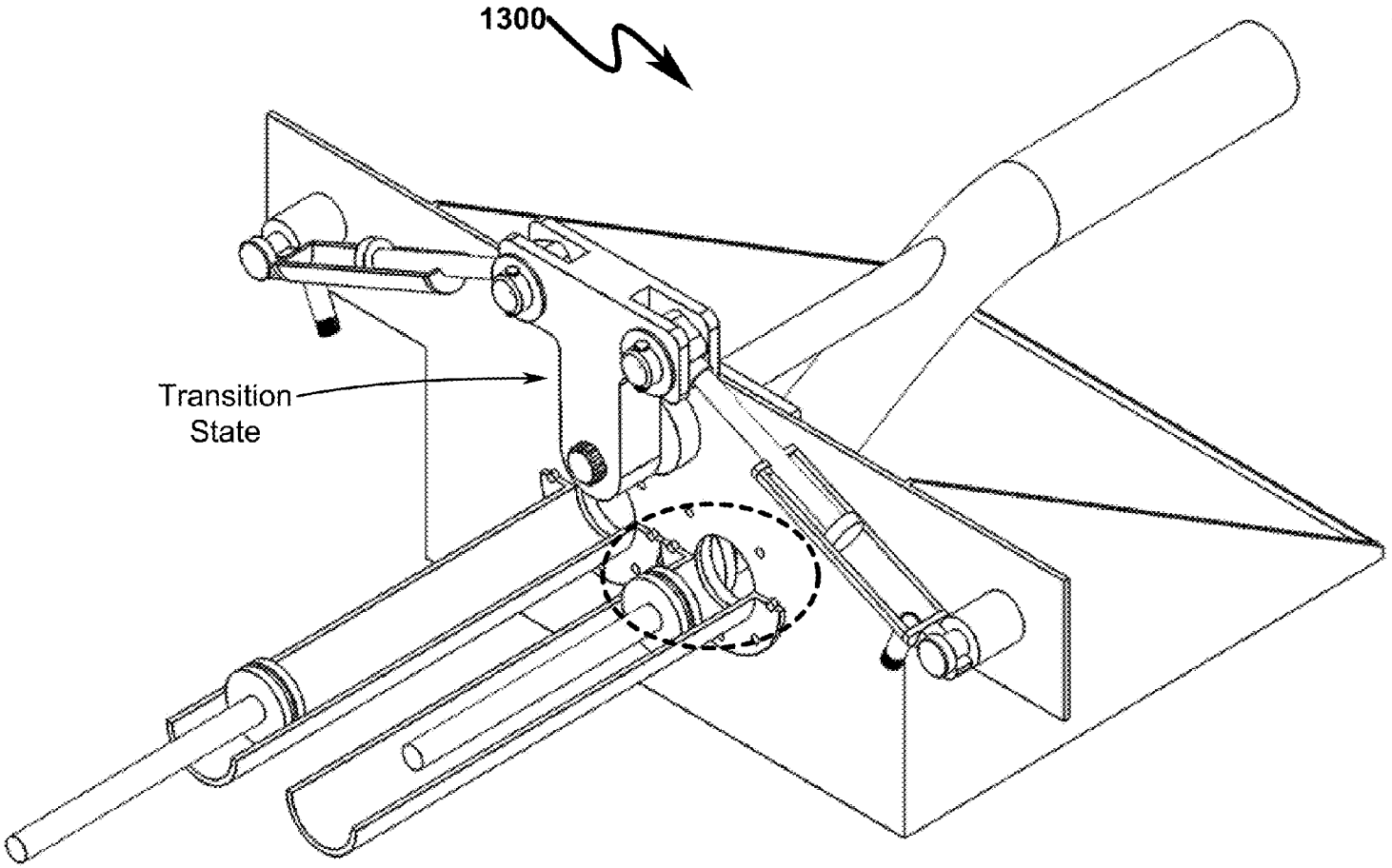
FIG. 13 Prior Art
FIG. 13 illustrates a front perspective sectional view of a prior art concrete pump in transition between right injection and left ejection cycles.
Figure 14:
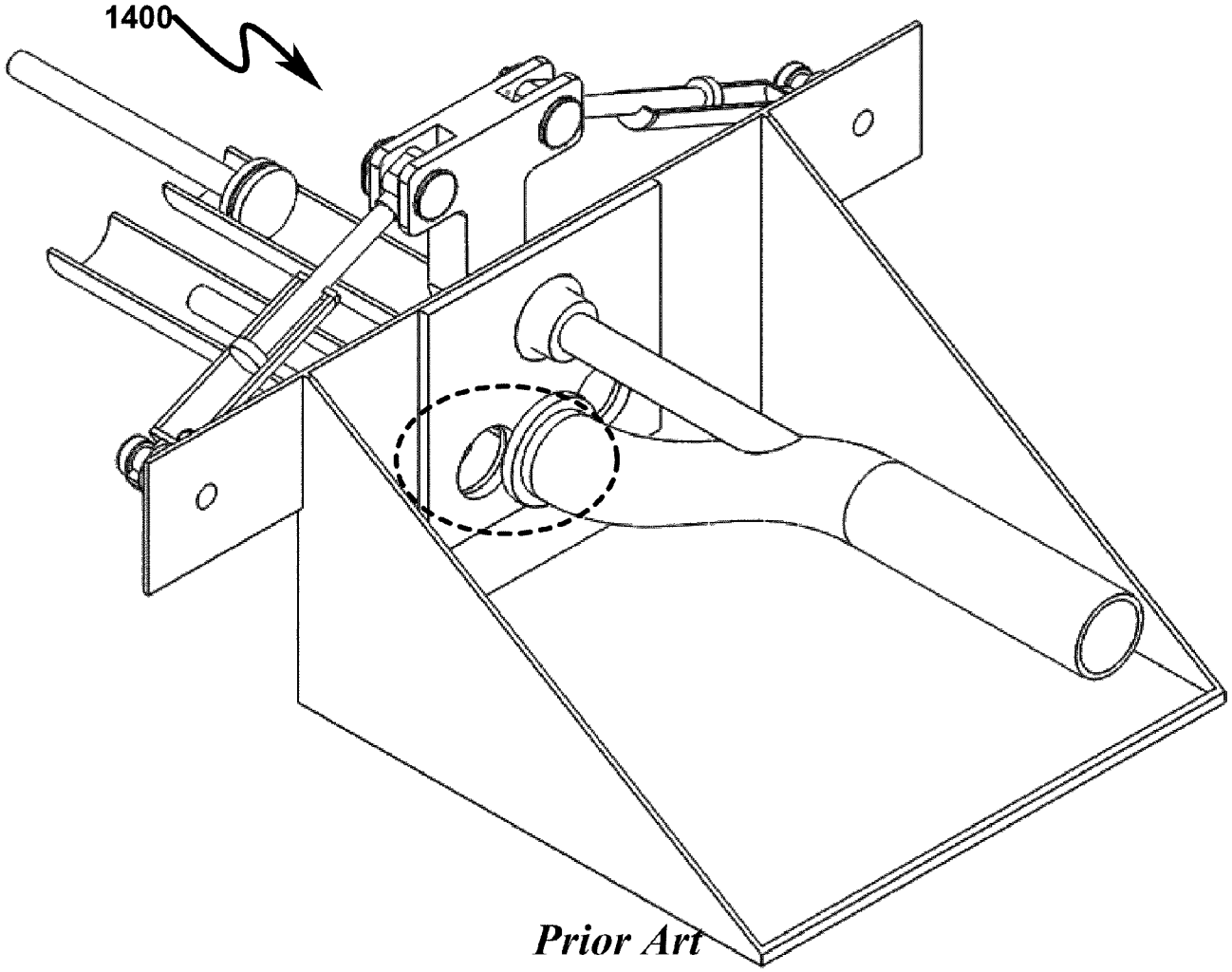
FIG. 14 Prior Art
FIG. 14 illustrates a rear perspective sectional view of a prior art concrete pump in transition between right injection and left ejection cycles.
Figure 15:
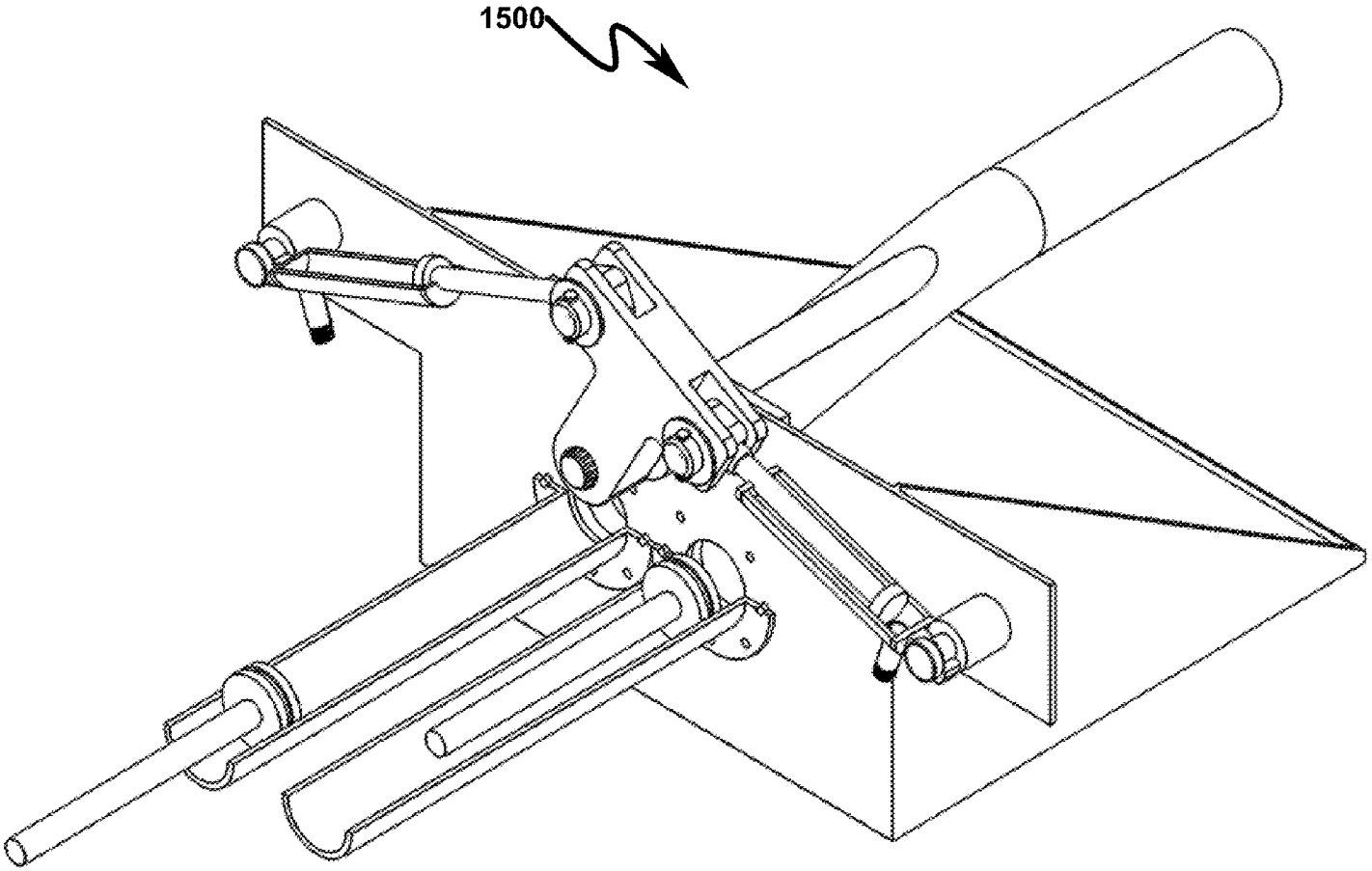
FIG. 15 Prior Art
FIG. 15 illustrates a front perspective sectional view of a prior art concrete pump positioned to inject material into the right pump cylinder and eject material from the left pump cylinder.
Figure 16:
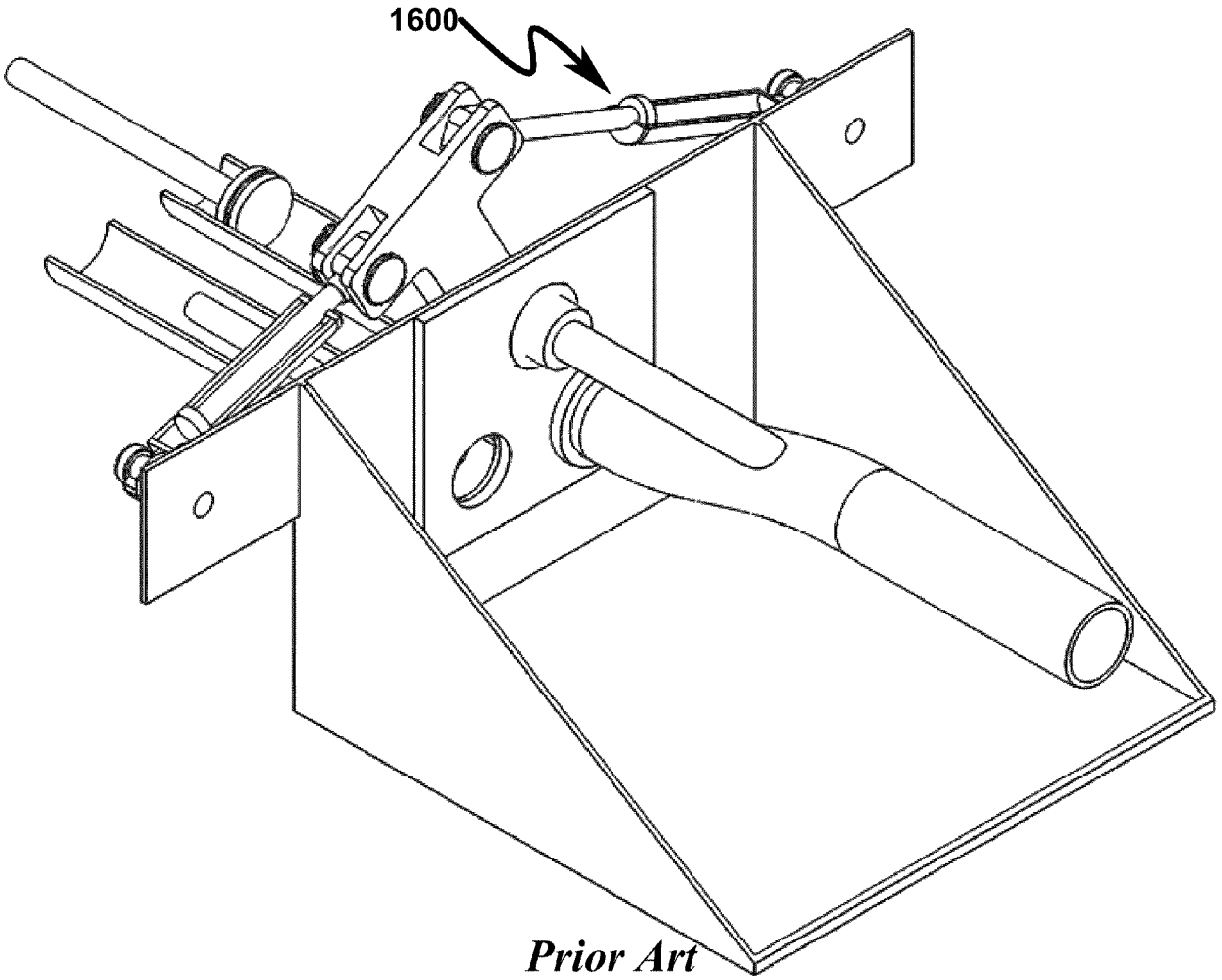
FIG. 16 Prior Art
FIG. 16 illustrates a front perspective sectional view of a prior art concrete pump positioned to inject material from the right pump cylinder and eject material from the left pump cylinder.
Figure 17:
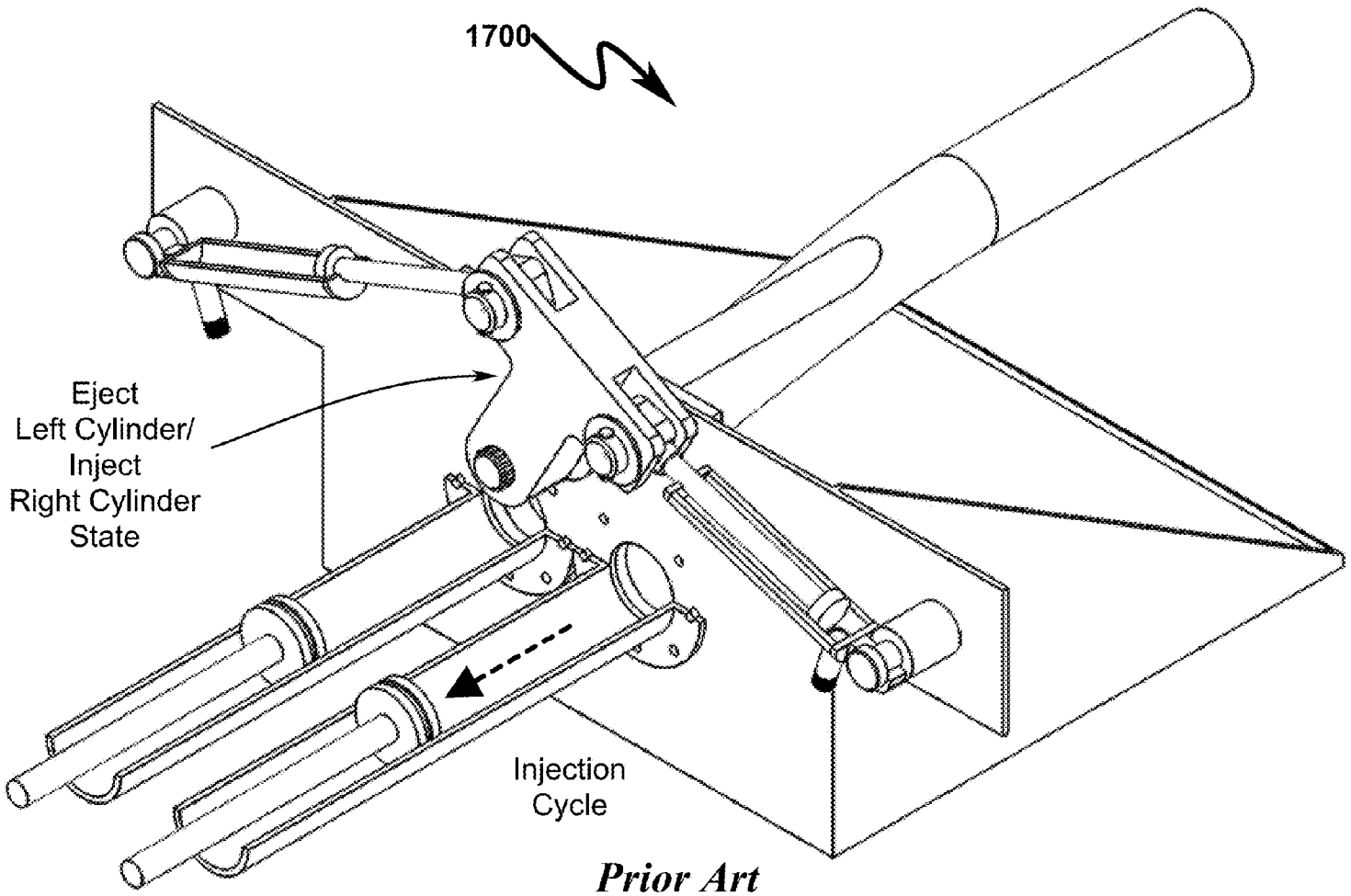
FIG. 17 Prior Art
FIG. 17 illustrates a front perspective sectional view of a prior art concrete pump injecting material into the right pump cylinder.
Figure 18:
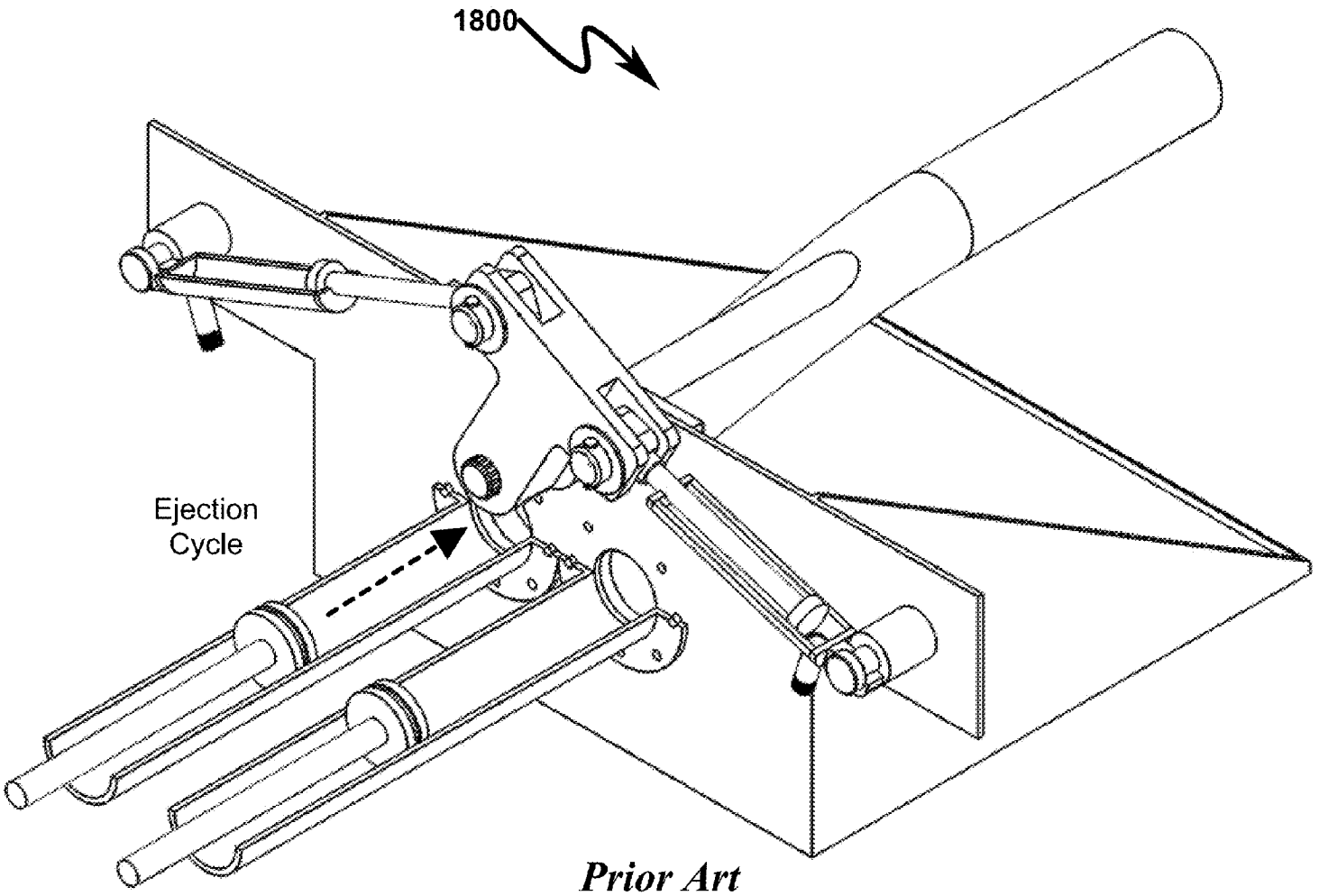
FIG. 18 Prior Art
FIG. 18 illustrates a front perspective sectional view of a prior art concrete pump ejecting material from the left pump cylinder.
Figure 19:
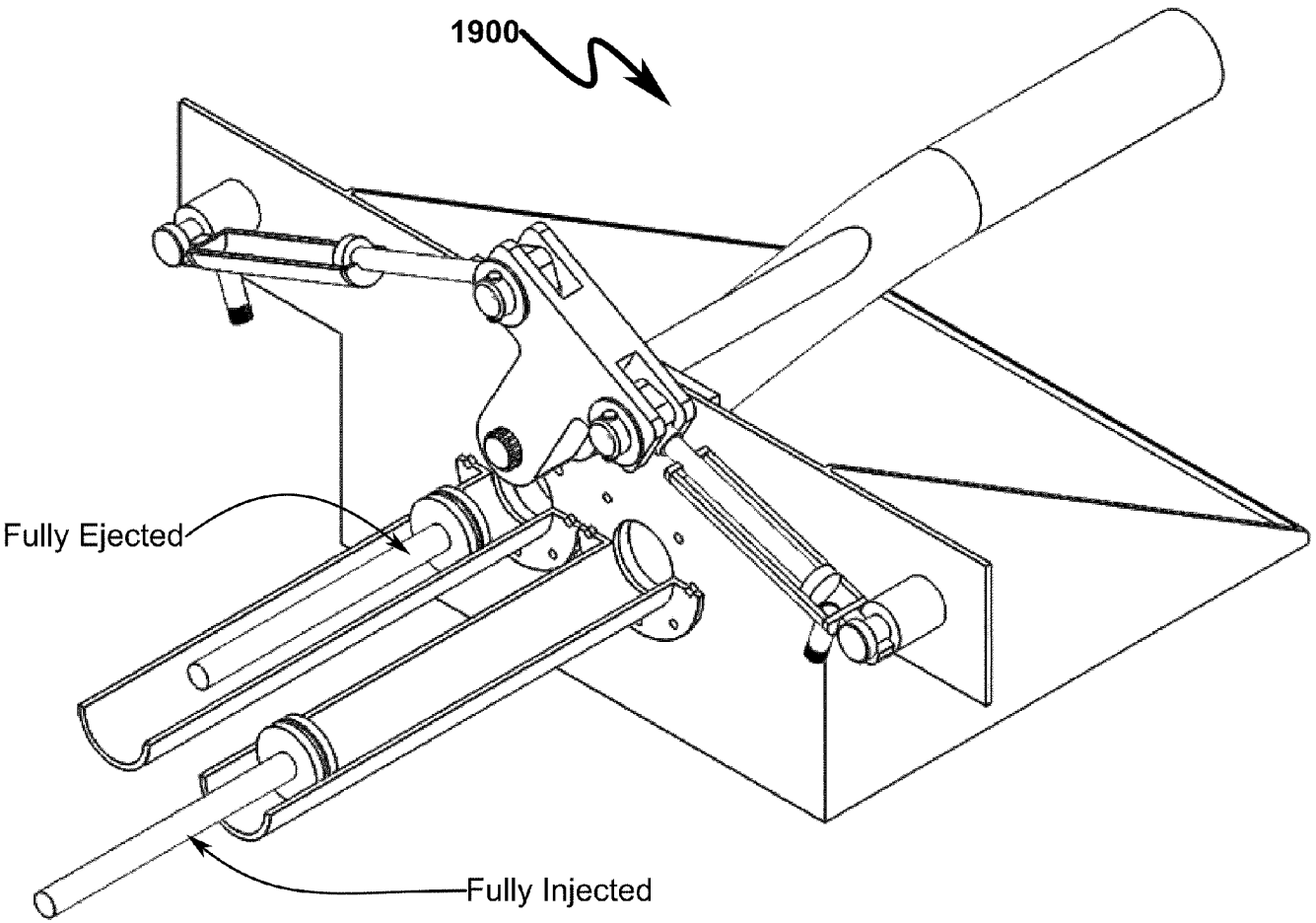
FIG. 19 Prior Art
FIG. 19 illustrates a front perspective sectional view of a prior art concrete pump with the right pump cylinder fully injected and the left pump cylinder fully ejected.
Figure 20:
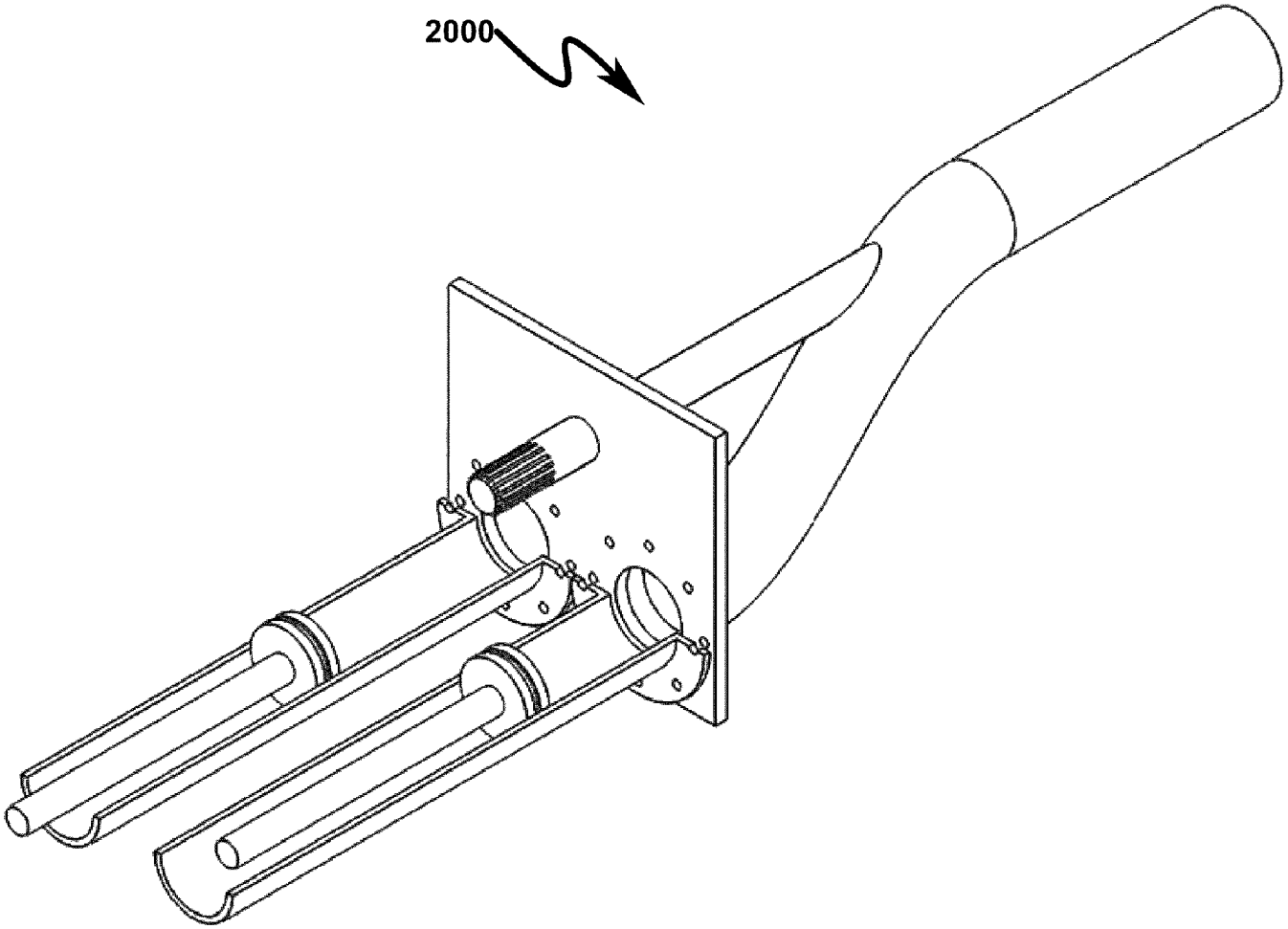
FIG. 20 Prior Art
FIG. 20 illustrates a front perspective sectional view of a prior art concrete pump depicting the left/right hydraulic pump rams and ejection port positioned to fully cover the right portion of the spectacle plate and associated hydraulic pump ram.
Figure 21:
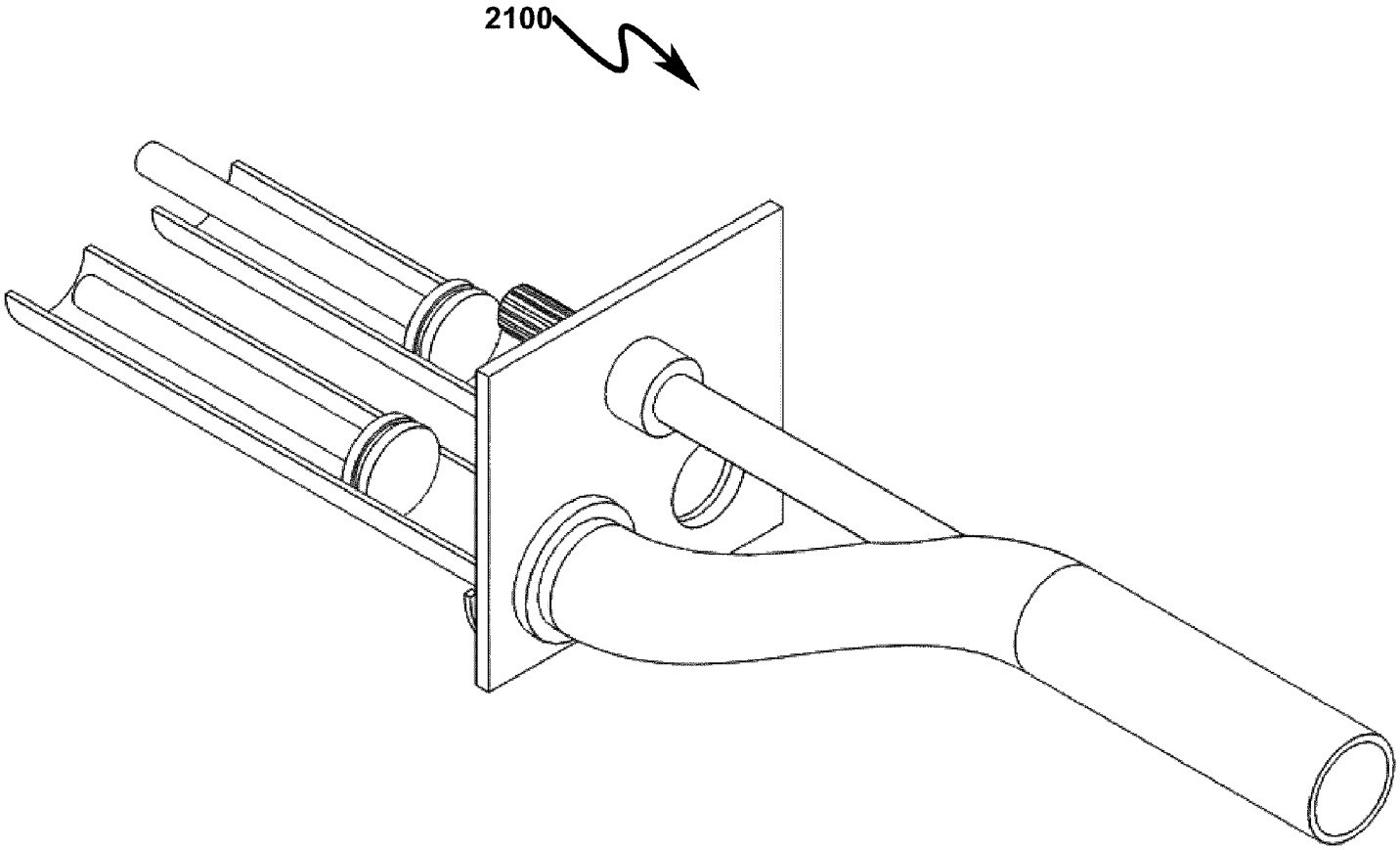
FIG. 21 Prior Art
FIG. 21 illustrates a rear perspective sectional view of a prior art concrete pump depicting the left/right hydraulic pump rams and ejection port positioned to fully cover the right portion of the spectacle plate and associated hydraulic pump ram.
Figure 22:
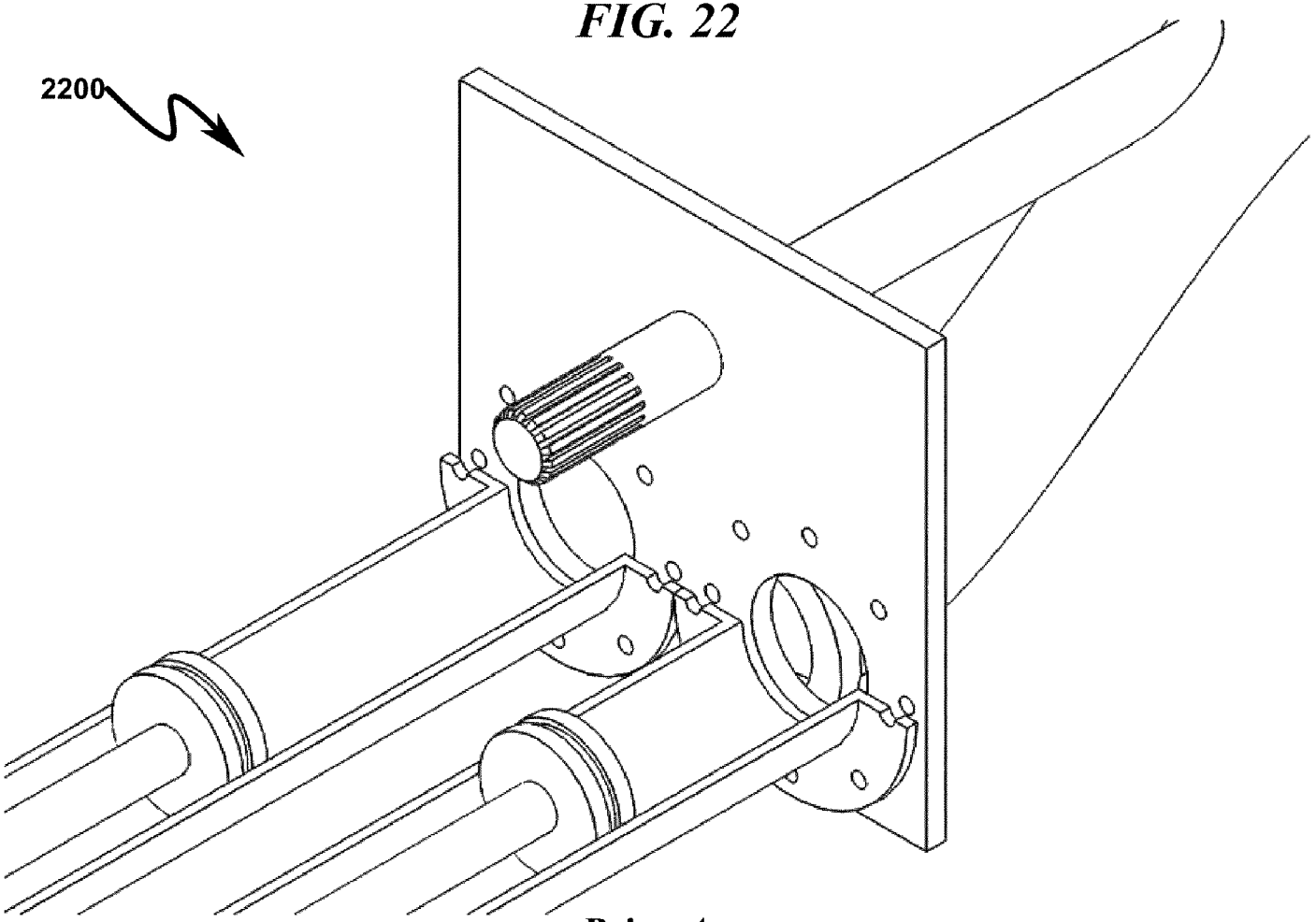
FIG. 22 Prior Art
FIG. 22 illustrates a front perspective sectional view of a prior art concrete pump depicting the left/right hydraulic pump rams and ejection port positioned to partially cover the right portion of the spectacle plate and associated hydraulic pump ram.
Figure 23:
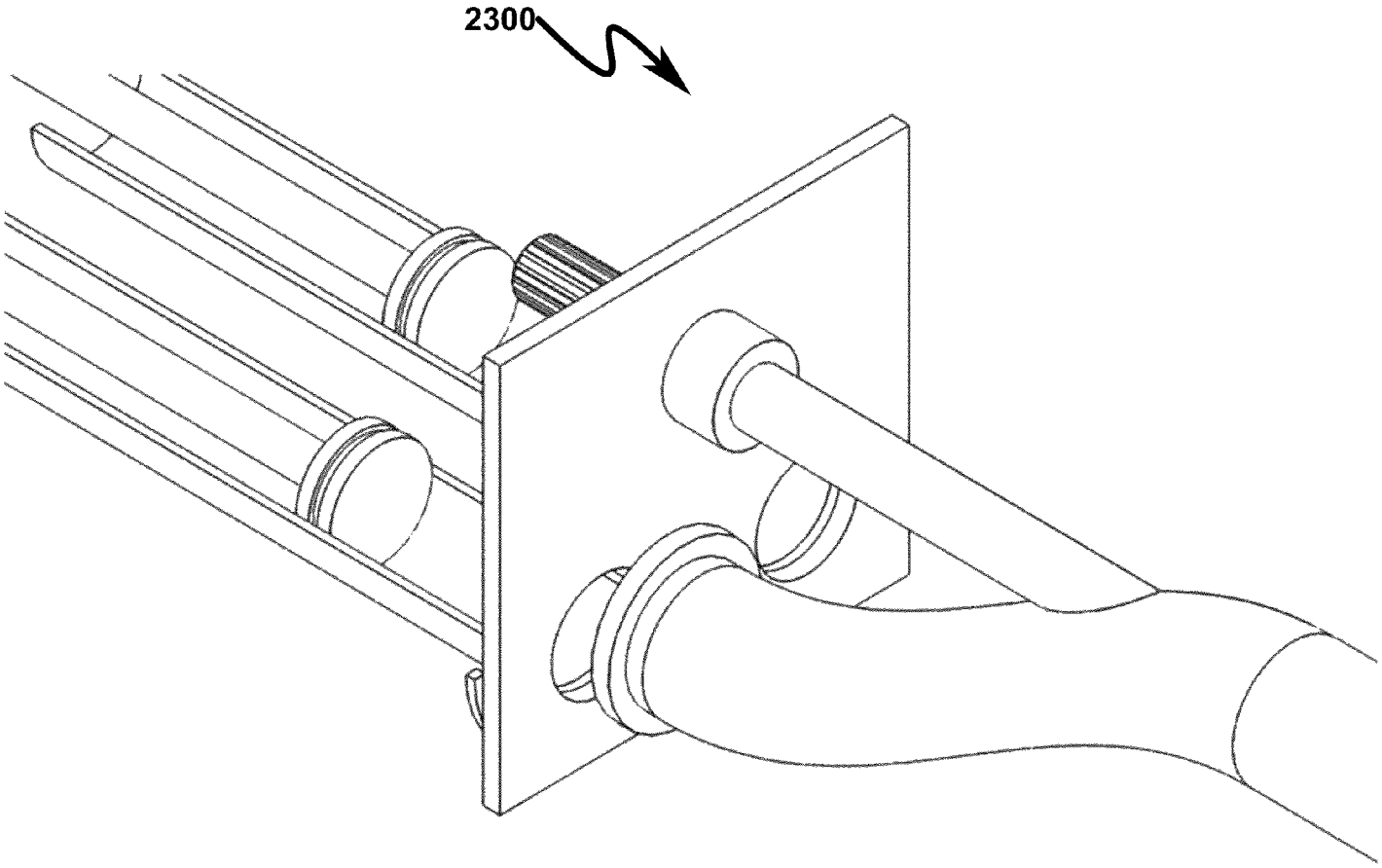
FIG. 23 Prior Art
FIG. 23 illustrates a rear perspective sectional view of a prior art concrete pump depicting the left/right hydraulic pump rams and ejection port positioned to partially cover the right portion of the spectacle plate and associated hydraulic pump ram.
Figure 24:
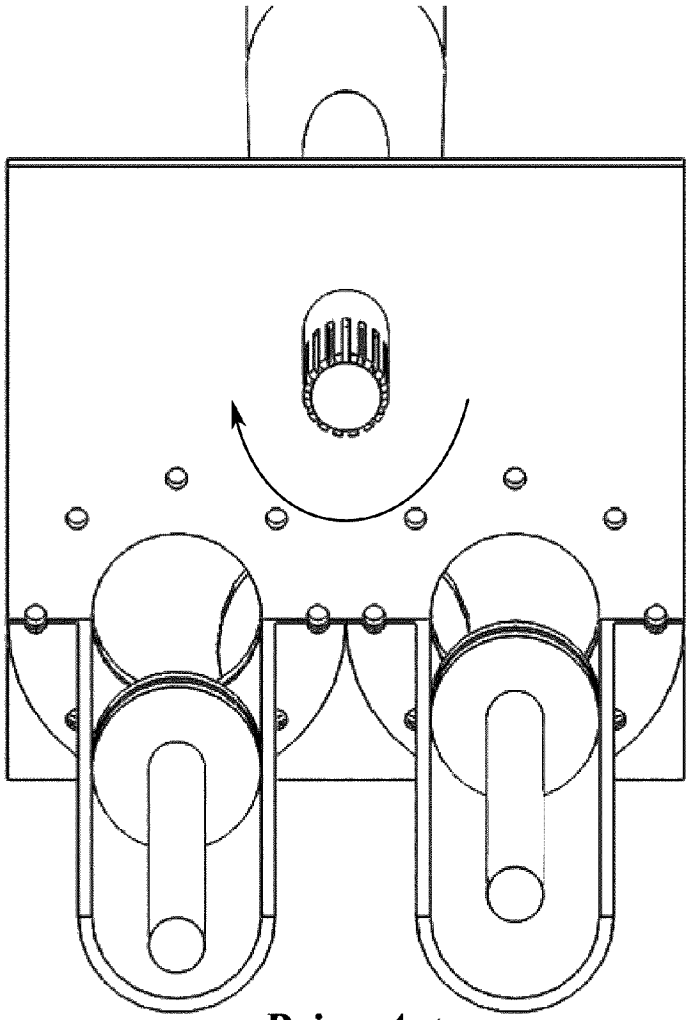
FIG. 24 Prior Art
FIG. 24 illustrates a front perspective sectional view of a prior art concrete pump depicting the left/right hydraulic pump rams and ejection port positioned at the center of the spectacle plate and associated left/right hydraulic pump rams.
Figure 25:
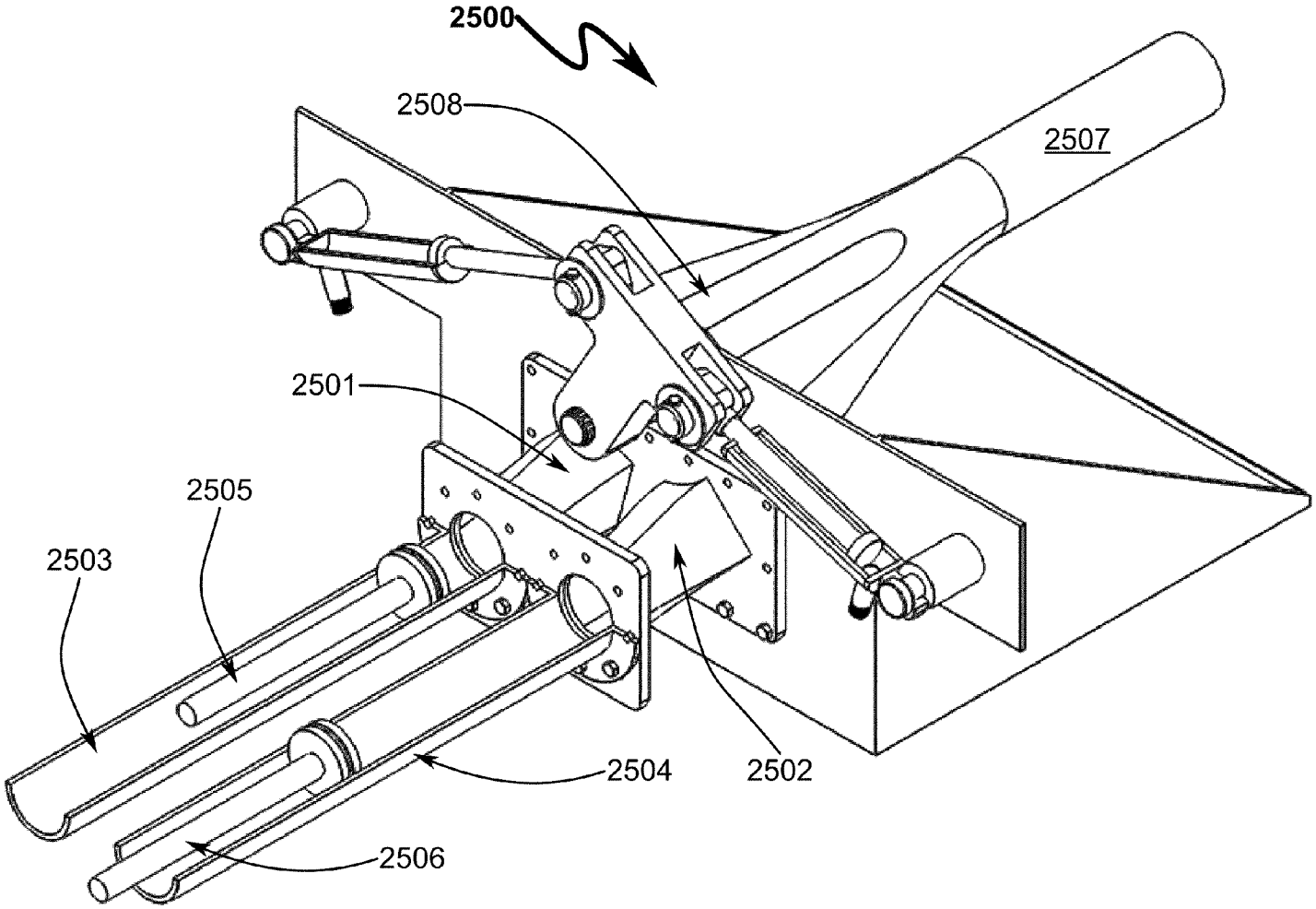
FIG. 25 illustrates a front perspective view of a preferred exemplary embodiment of the present invention utilizing a sectioned annular-ring-shaped spectacle plate and corresponding ejection port/cutting plate.
Figure 26:
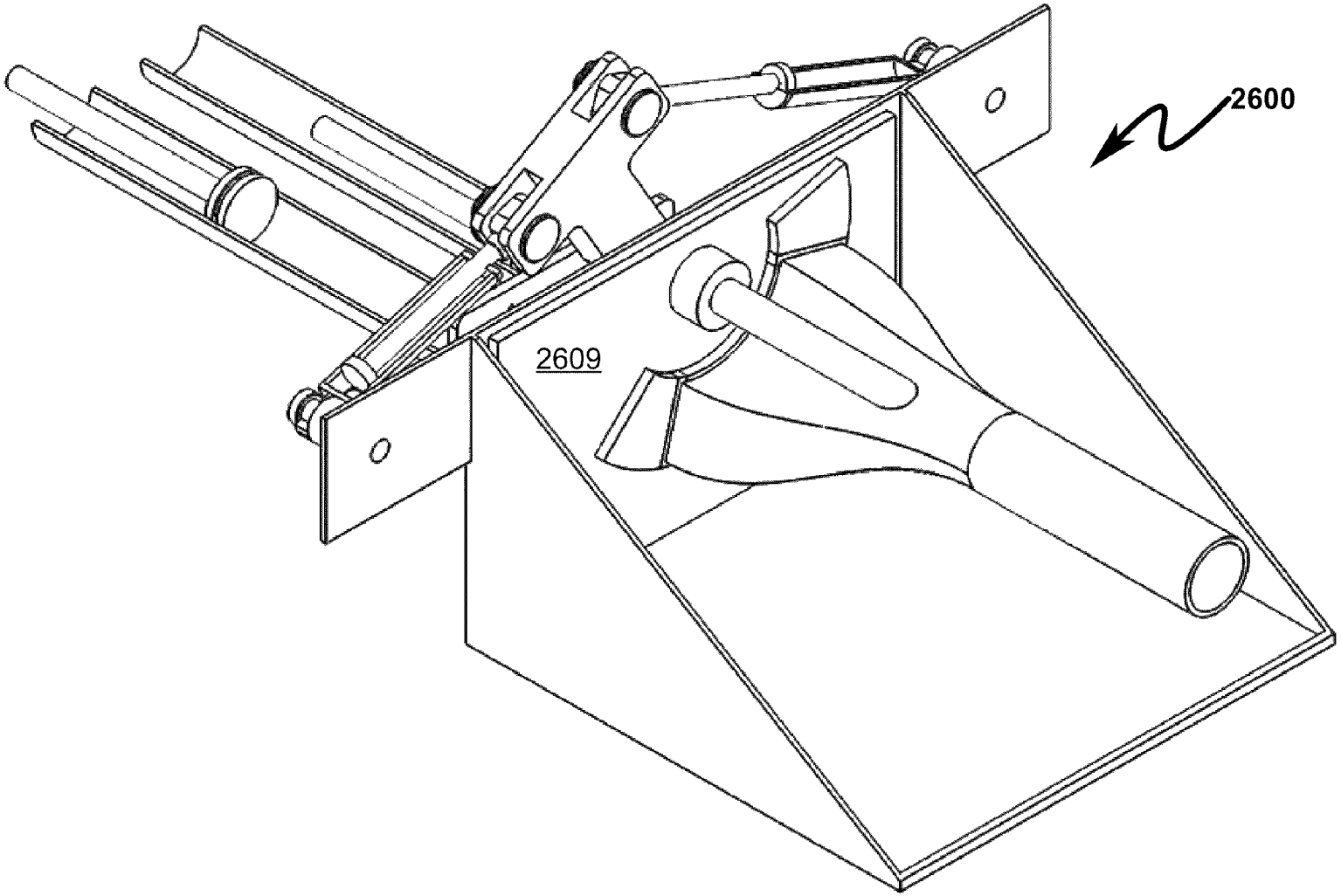
FIG. 26 illustrates a rear perspective view of a preferred exemplary embodiment of the present invention utilizing a sectioned annular-ring-shaped spectacle plate and corresponding ejection port/cutting plate.
Figure 32:
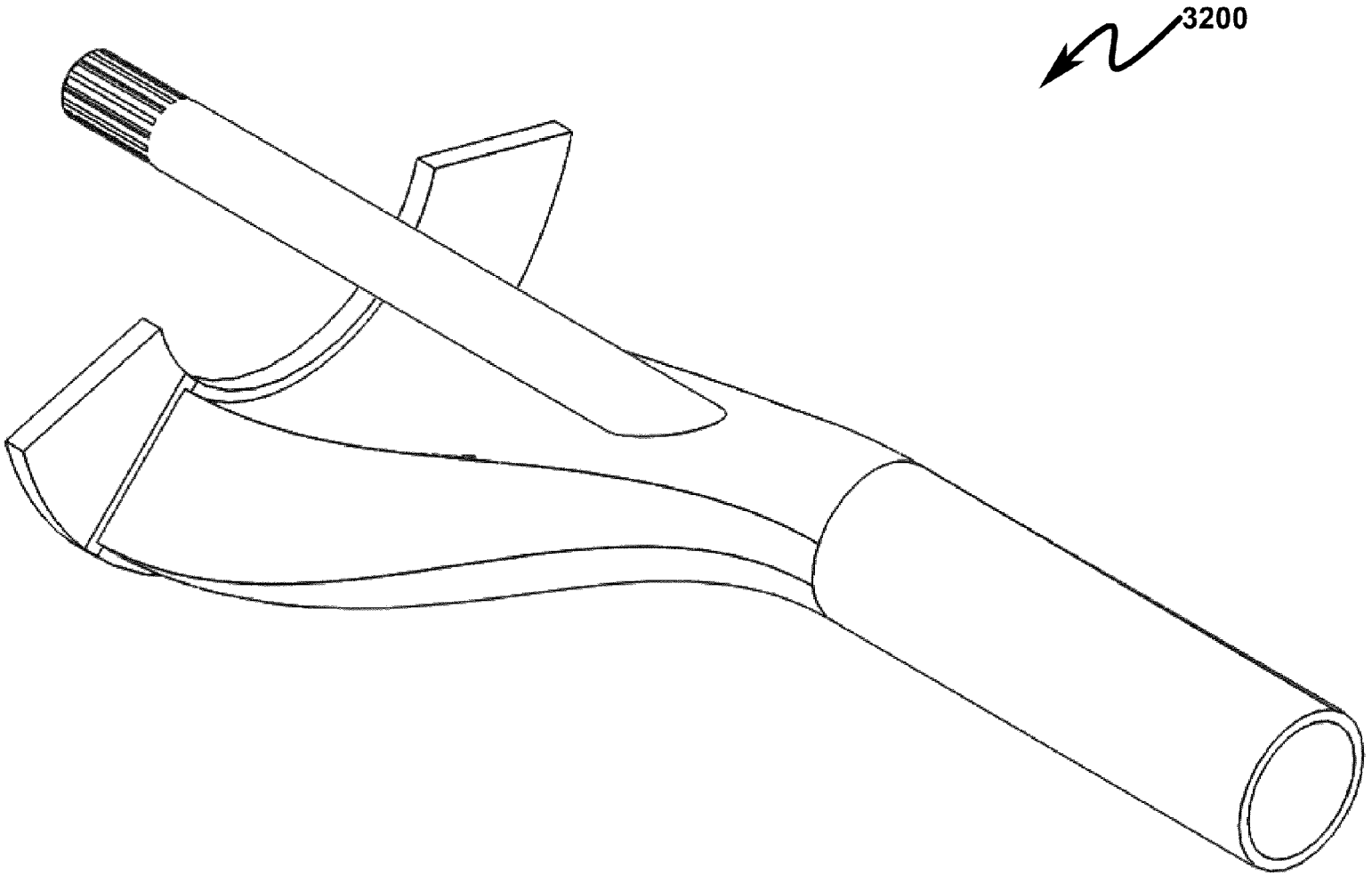
FIG. 32 illustrates a rear perspective detail view of a preferred exemplary embodiment of the present invention utilizing a sectioned annular-ring-shaped spectacle plate and corresponding ejection port/cutting plate and detailing the ejection port and cutting plate construction.

The present invention in various embodiments addresses one or more of the above objectives in the following manner as generally depicted in FIG. 25 (2500)-FIG. 32 (3200). As depicted in FIG. 25 (2500), the system provides for trapezoidal-shaped transition regions (2501, 2502) between the hydraulic pump cylinders (2503, 2504), their corresponding hydraulic pump rams (2505, 2506), and the material ejection port (2507). The ejection port (2507) is configured with a trapezoidal-shaped transition region (2508) that articulates between the left (2503) and right (2504) pump cylinders through the spectacle plate (2609) as depicted in FIG. 26 (2600).

Figure 27:
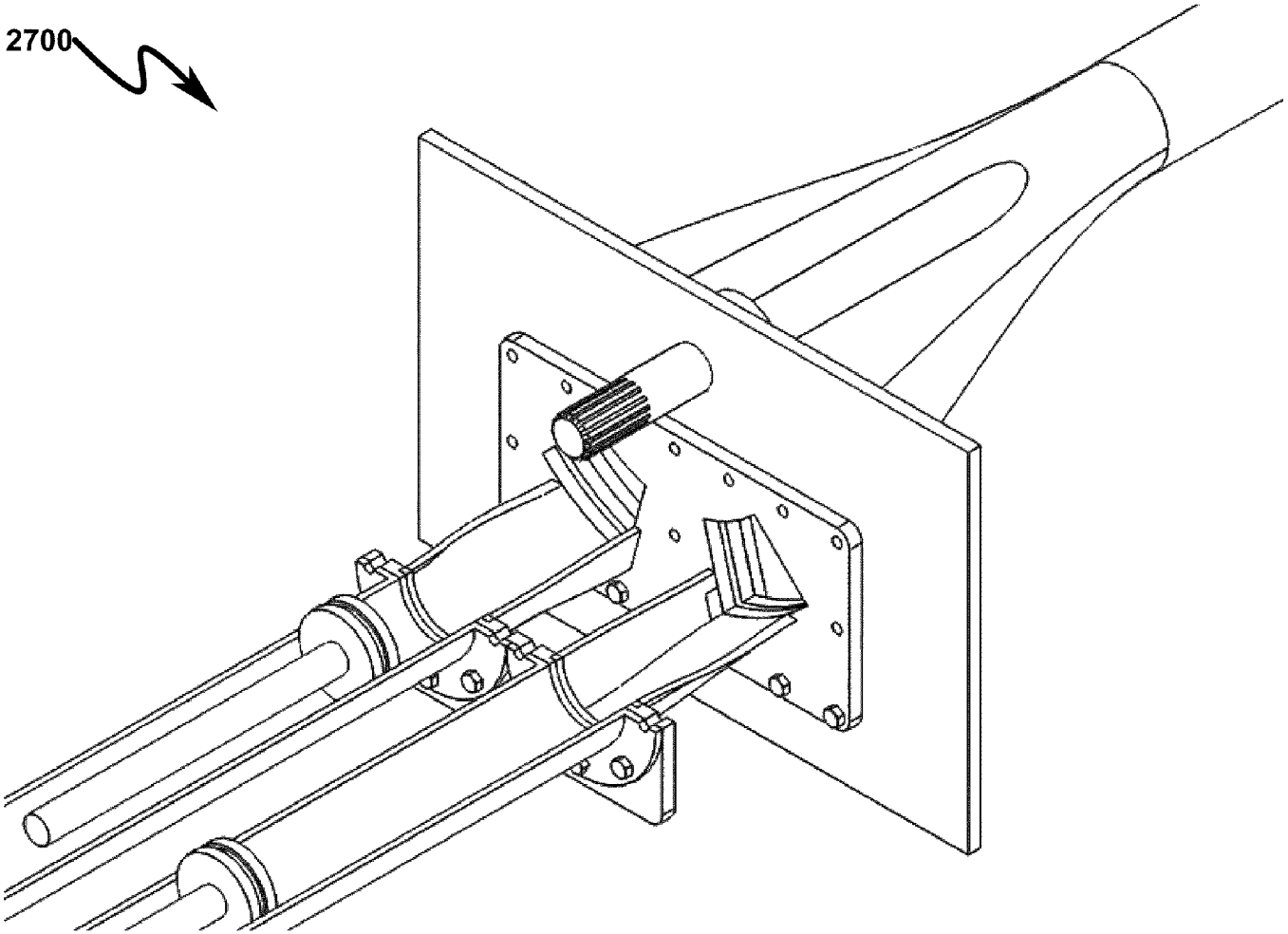
FIG. 27 illustrates a front perspective detail view of a preferred exemplary embodiment of the present invention utilizing a sectioned annular-ring-shaped spectacle plate and corresponding ejection port/cutting plate with transition hydraulic pump ram inputs in section view.
Figure 28:
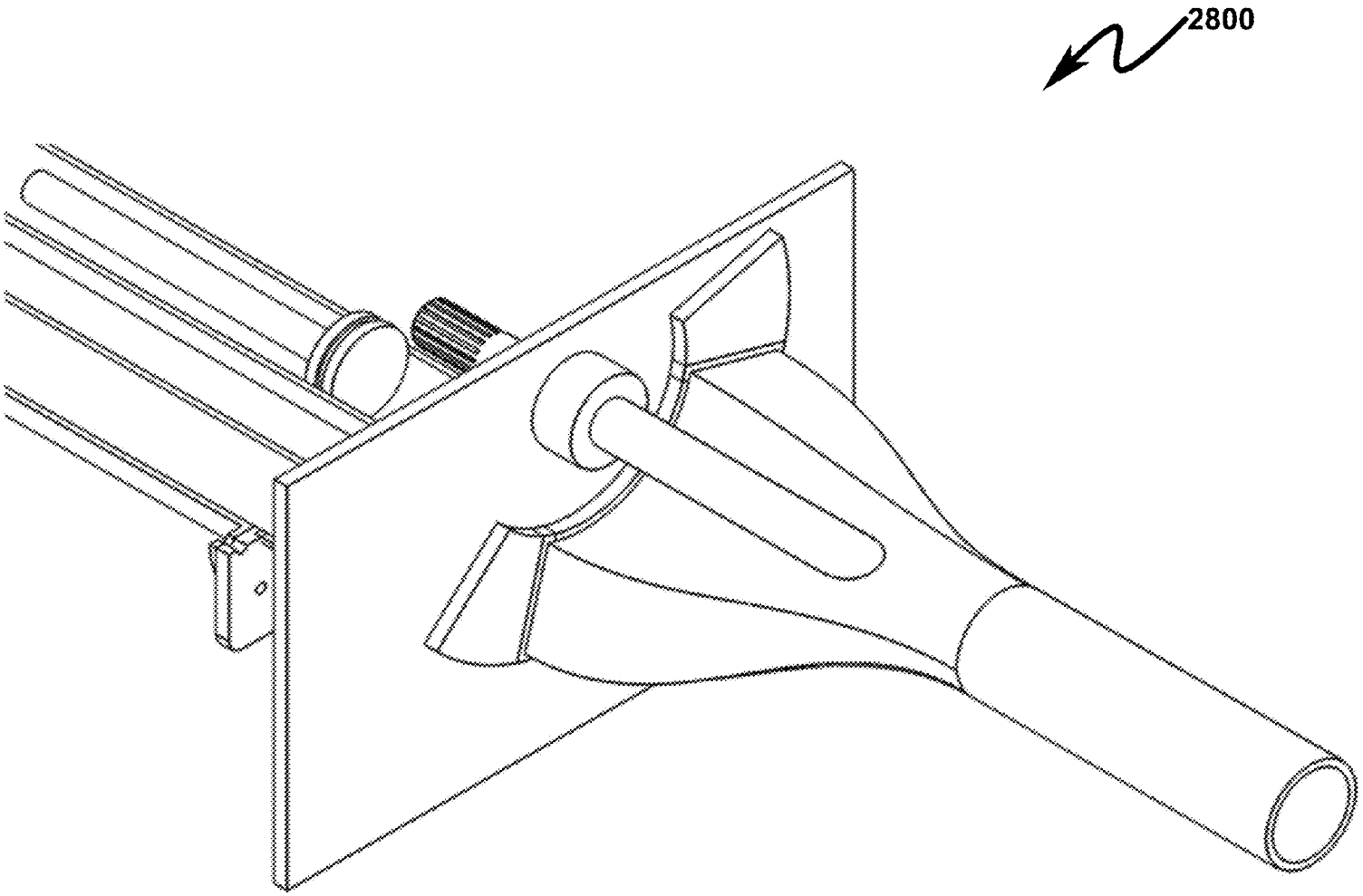
FIG. 28 illustrates a rear perspective detail view of a preferred exemplary embodiment of the present invention utilizing a sectioned annular-ring-shaped spectacle plate and corresponding ejection port/cutting plate with transition hydraulic pump ram inputs in section view.
Figure 29:
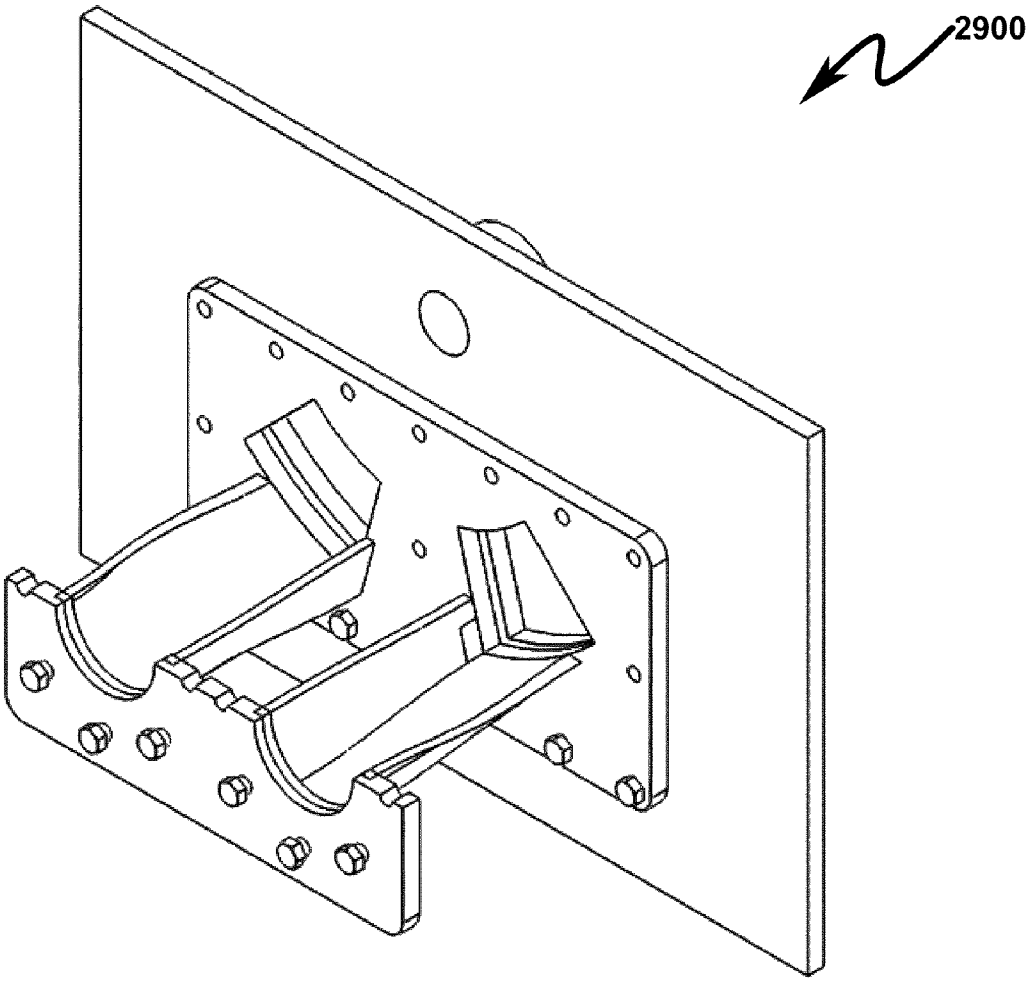
FIG. 29 illustrates a front perspective detail view of a preferred exemplary embodiment of the present invention utilizing a sectioned annular-ring-shaped spectacle plate and corresponding ejection port/cutting plate detailing the transition port apertures in the spectacle plate.
Figure 30:
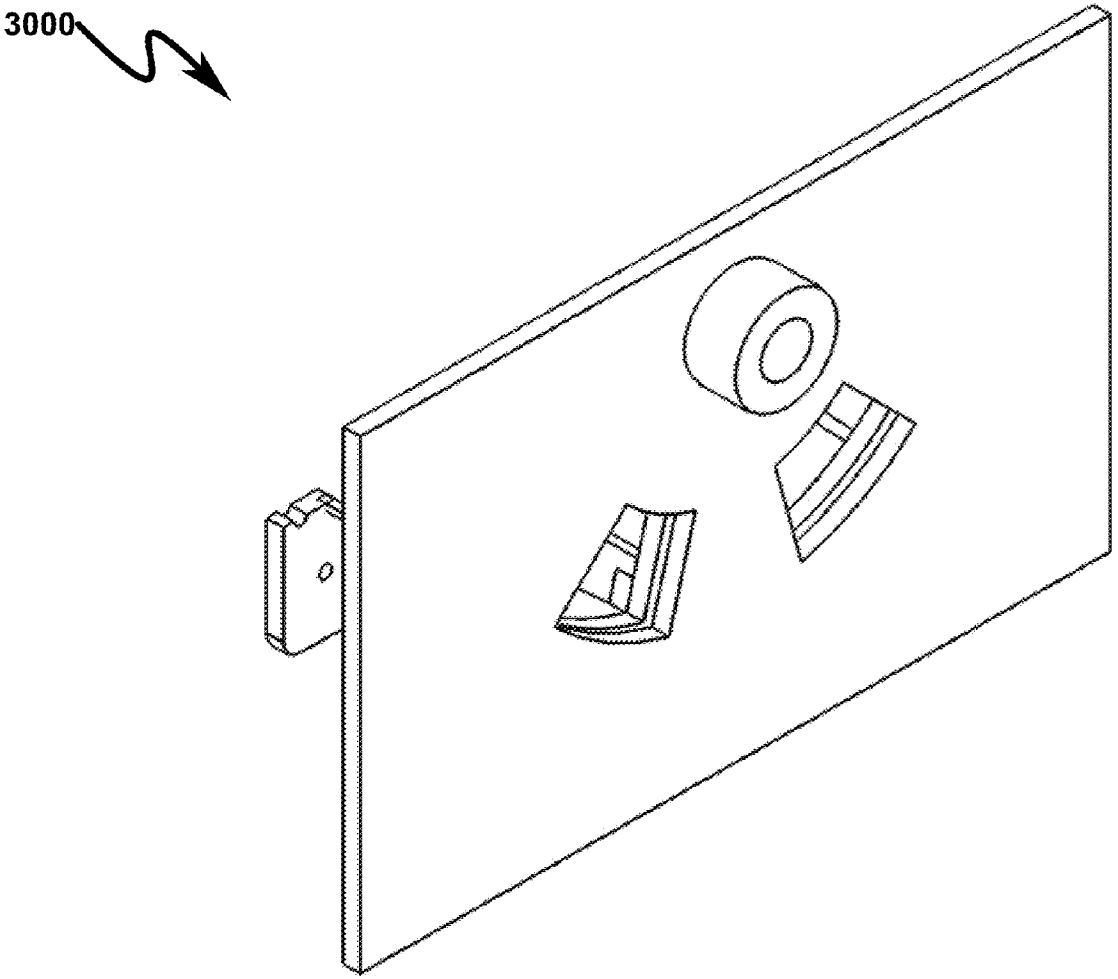
FIG. 30 illustrates a rear perspective detail view of a preferred exemplary embodiment of the present invention utilizing a sectioned annular-ring-shaped spectacle plate and corresponding ejection port/cutting plate detailing the transition port apertures in the spectacle plate.
Figure 31:
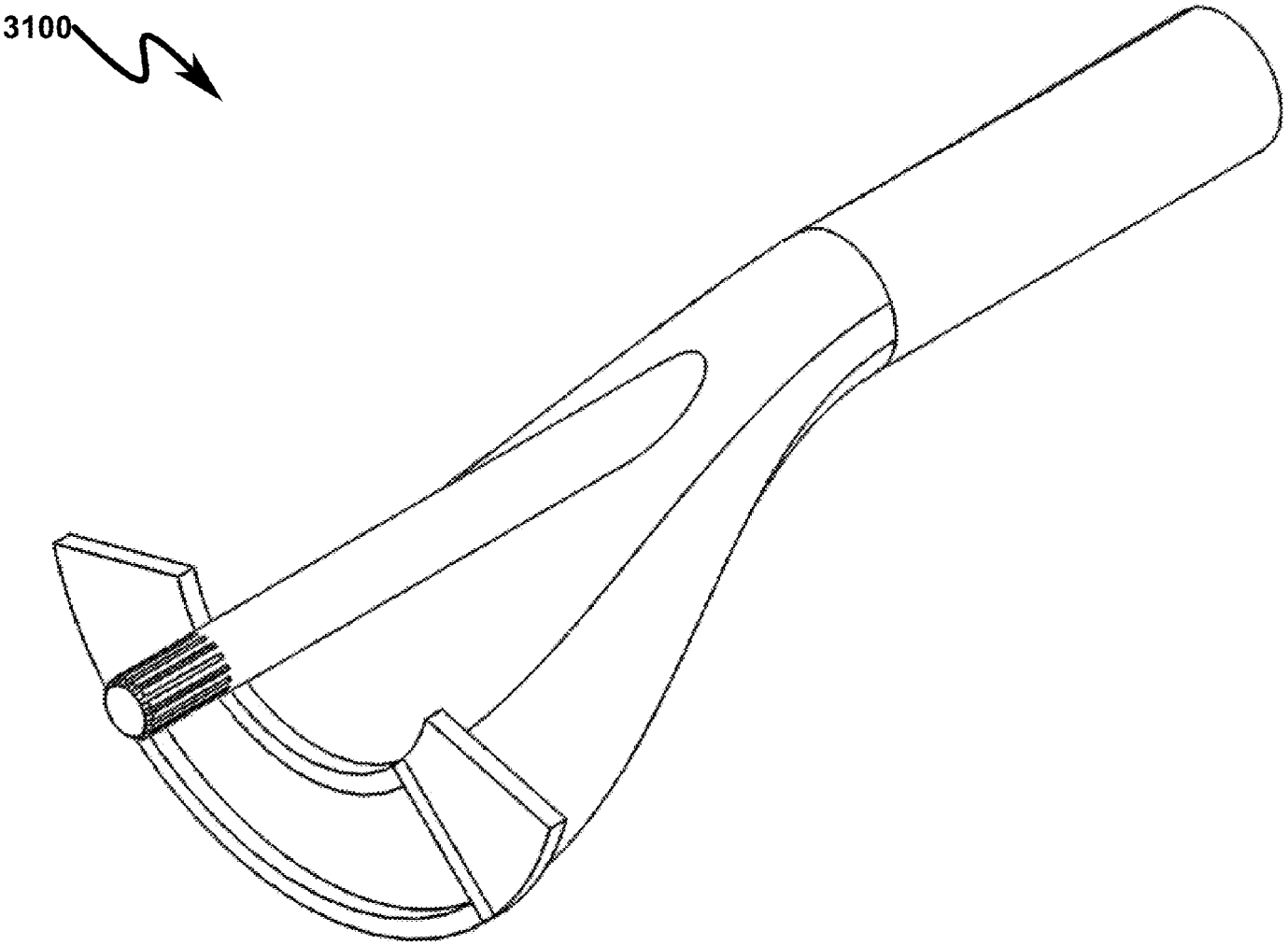
FIG. 31 illustrates a front perspective detail view of a preferred exemplary embodiment of the present invention utilizing a sectioned annular-ring-shaped spectacle plate and detailing the ejection port and cutting plate construction.

Further detail of the trapezoidal-shaped transition regions (2501, 2502) and spectacle plate (2609) are depicted in the sectional views of FIG. 27 (2700) and FIG. 28 (2800). FIG. 29 (2900) and FIG. 30 (3000) detail the trapezoidal-shaped transition regions (2501, 2502) and spectacle plate (2609) without the hydraulic pump cylinders and ejection port/cutting plate. The ejection port/cutting plate (with splined driveshaft) are illustrated in detail in the perspective views of FIG. 31 (3100) and FIG. 32 (3200).

One skilled in the art will recognize that the various embodiments depicted herein may be combined to produce a variety of system configurations consistent with the teachings of the invention.

Trapezoidal-Shaped Spectacle Plate Embodiment (3300)-(4000)

Figure 33:
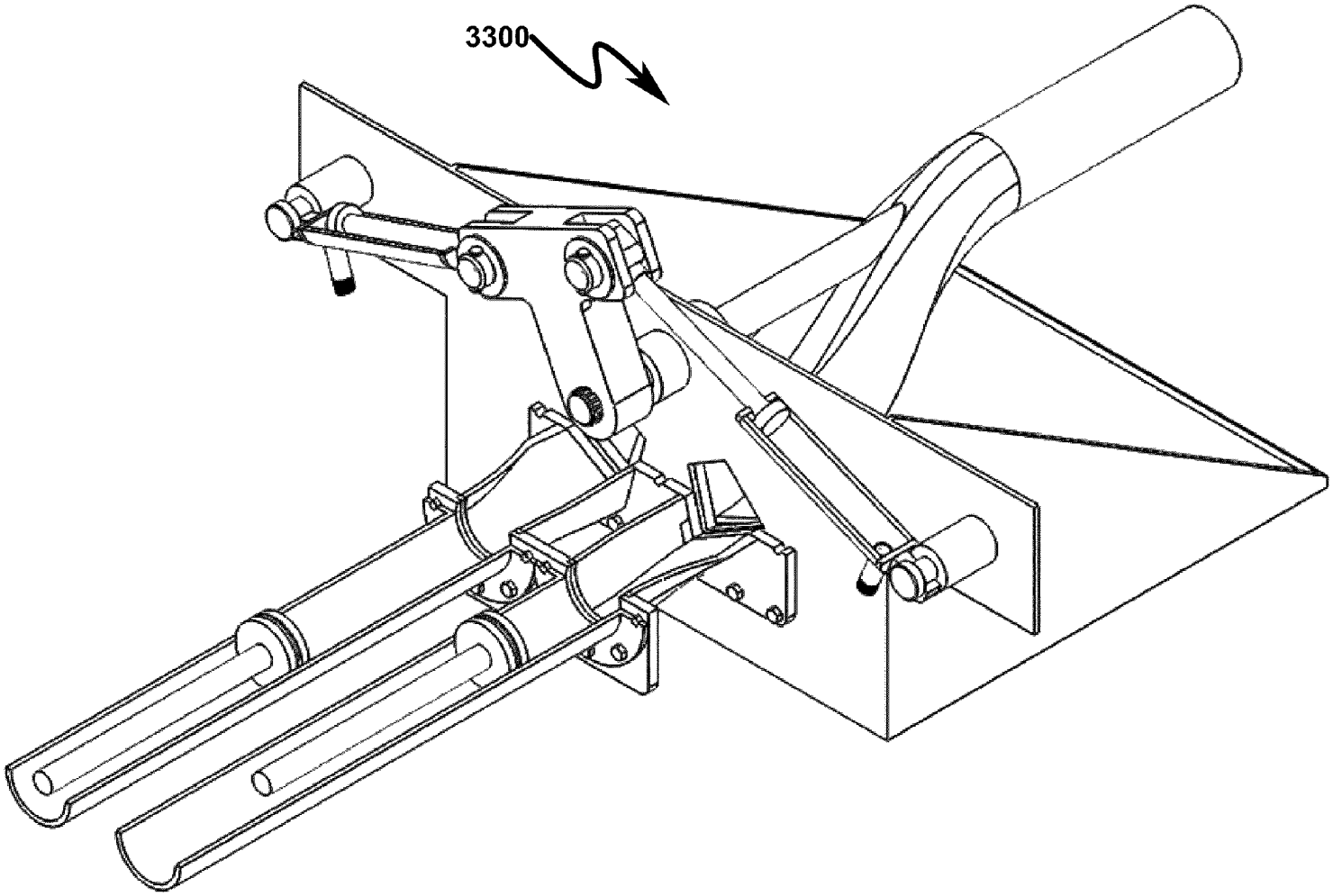
FIG. 33 illustrates a front perspective view of a preferred exemplary embodiment of the present invention utilizing a trapezoidal-shaped spectacle plate and corresponding ejection port/cutting plate.
Figure 34:
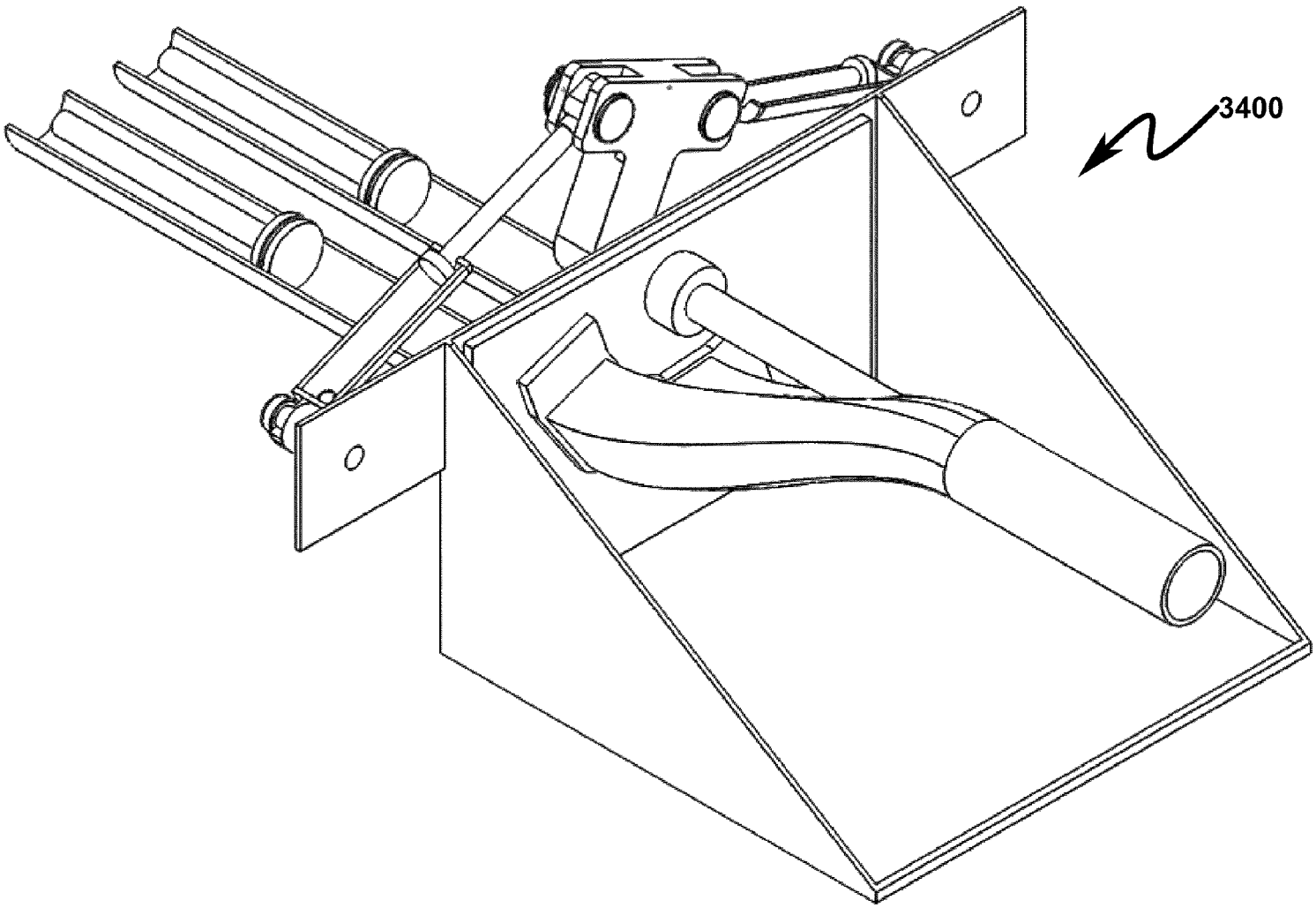
FIG. 34 illustrates a rear perspective view of a preferred exemplary embodiment of the present invention utilizing a trapezoidal-shaped spectacle plate and corresponding ejection port/cutting plate.
Figure 35:
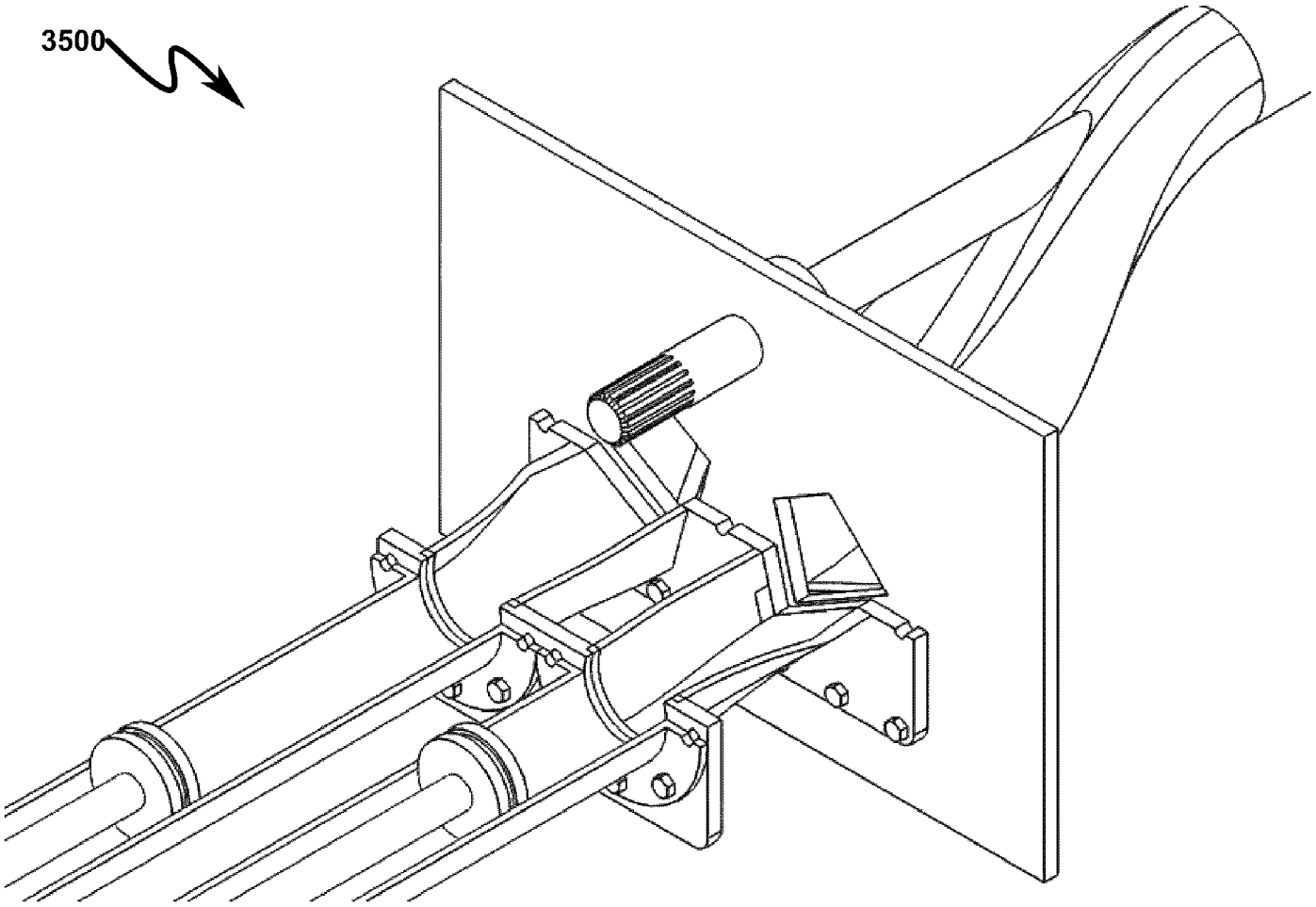
FIG. 35 illustrates a front perspective detail view of a preferred exemplary embodiment of the present invention utilizing a trapezoidal-shaped spectacle plate and corresponding ejection port/cutting plate with transition hydraulic pump ram inputs in section view.
Figure 36:
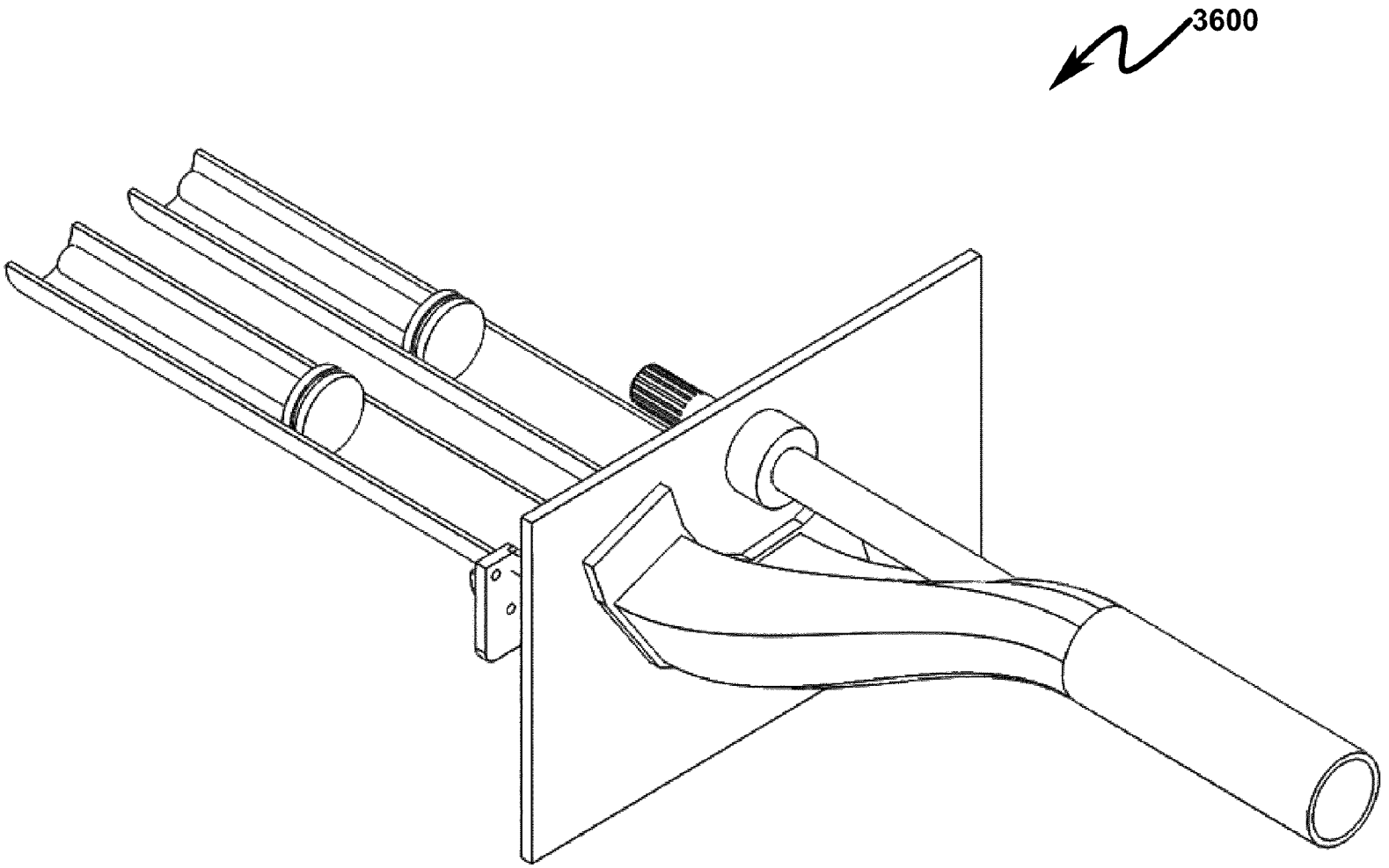
FIG. 36 illustrates a rear perspective detail view of a preferred exemplary embodiment of the present invention utilizing a trapezoidal-shaped spectacle plate and corresponding ejection port/cutting plate with transition hydraulic pump ram inputs in section view.
Figure 37:
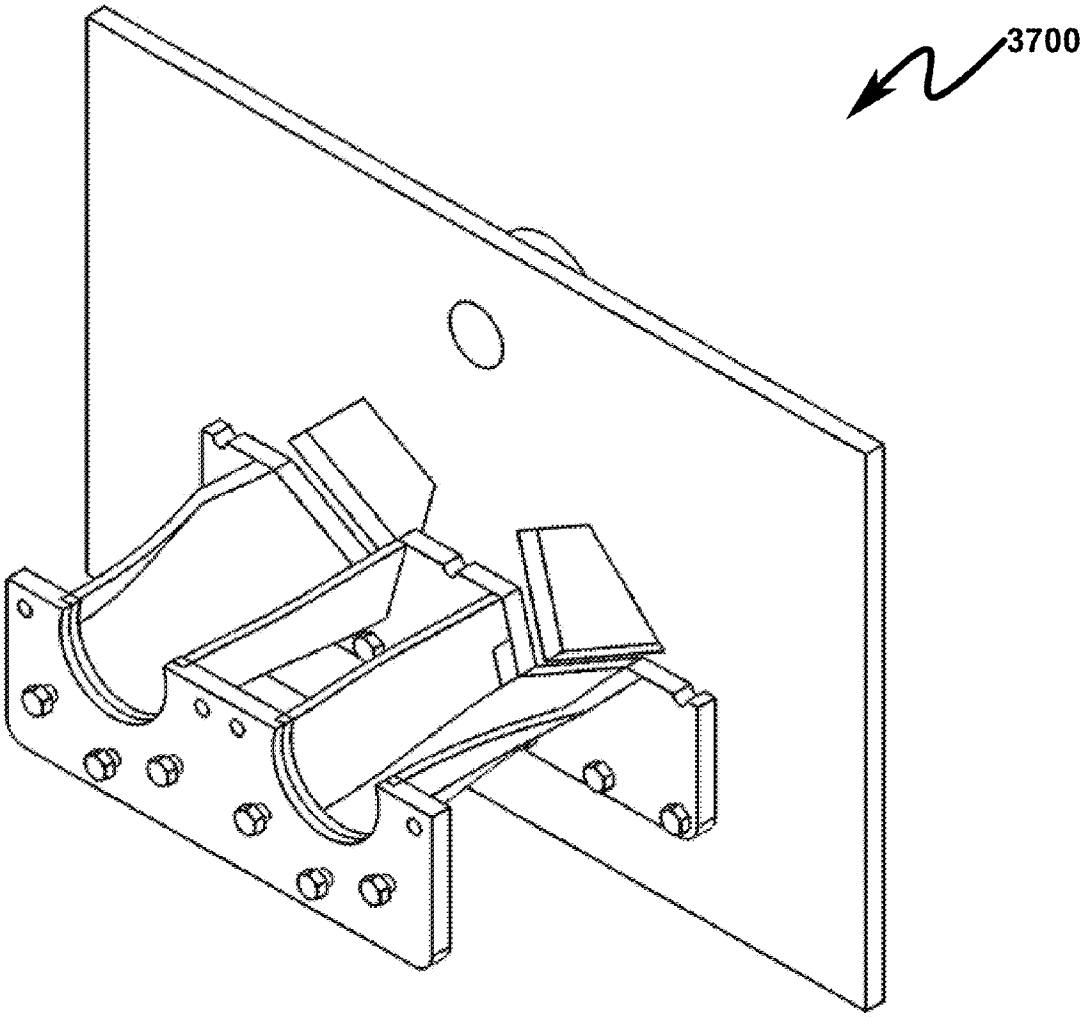
FIG. 37 illustrates a front perspective detail view of a preferred exemplary embodiment of the present invention utilizing a trapezoidal-shaped spectacle plate and corresponding ejection port/cutting plate detailing the transition port apertures in the spectacle plate.
Figure 38:
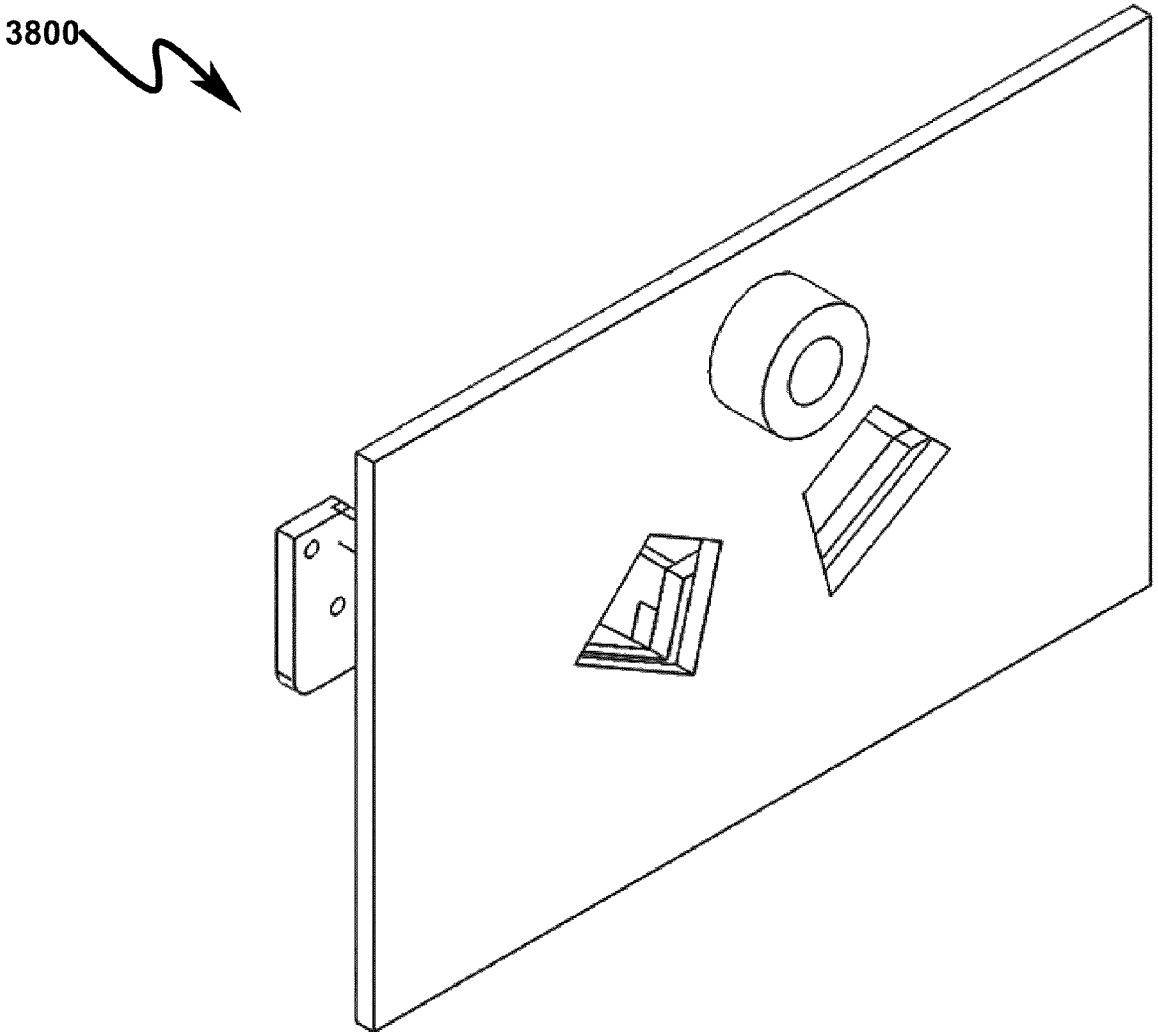
FIG. 38 illustrates a rear perspective detail view of a preferred exemplary embodiment of the present invention utilizing a trapezoidal-shaped spectacle plate and corresponding ejection port/cutting plate detailing the transition port apertures in the spectacle plate.
Figure 39:
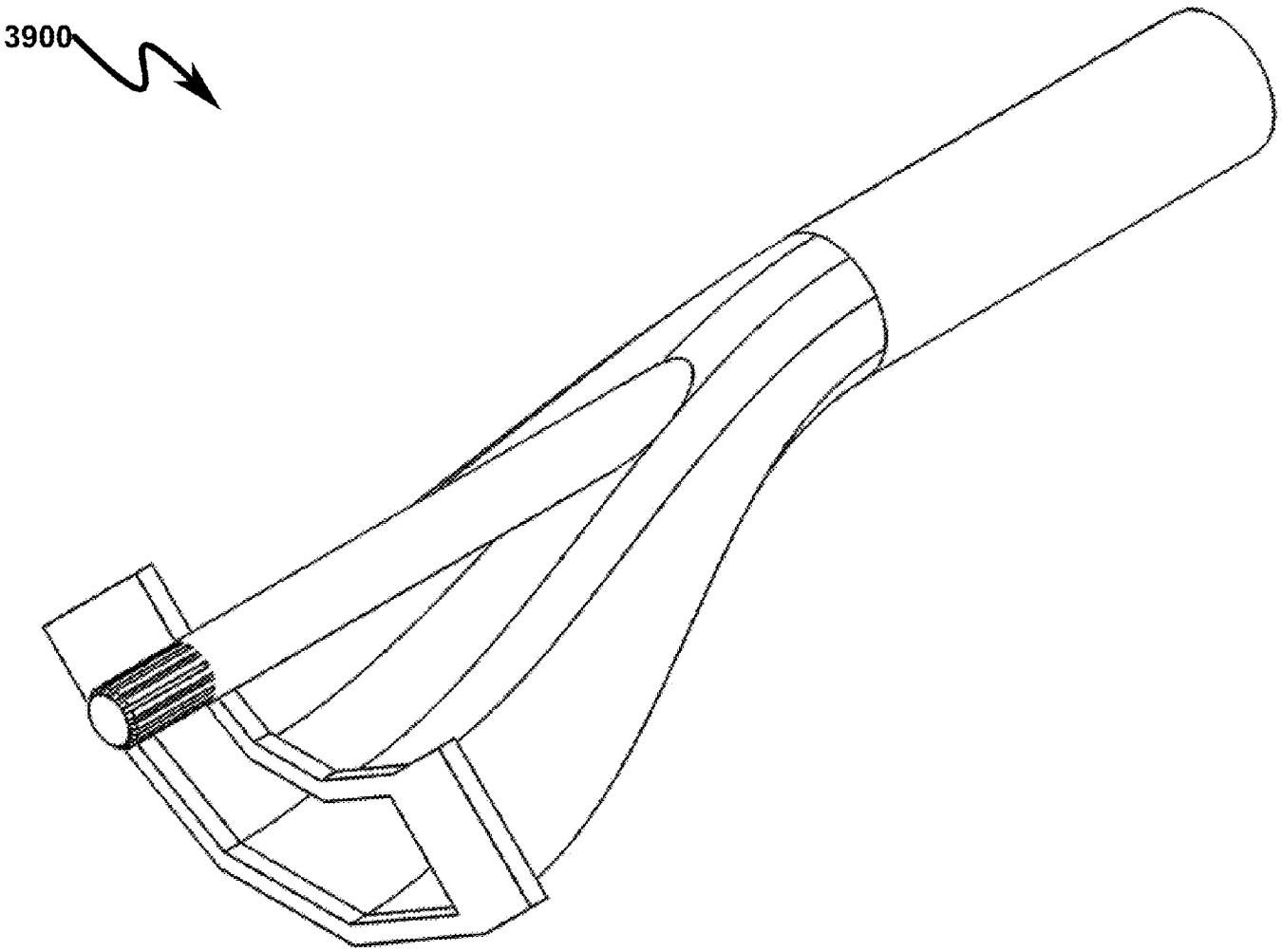
FIG. 39 illustrates a front perspective detail view of a preferred exemplary embodiment of the present invention utilizing a trapezoidal-shaped spectacle plate and detailing the ejection port and cutting plate construction.

As mentioned previously, the term "trapezoidal" should be given a broad interpretation in defining the scope of the present invention. As depicted in FIG. 25 (2500)-FIG. 32 (3200), this is embodied as a sector of an annulus or annular ring. However, as depicted in FIG. 33 (3300)-FIG. 40 (4000), the spectacle plate aperture (and corresponding ejection port cutting plate) may be configured using conventional trapezoidal structures as shown. Combinations of these two constructs are also anticipated by the present invention. The key features of (a) providing port flow during all portions of the pumping cycle and (b) sealing off access to the material hopper from the ejection port during cycle shifts are the only restraints on the invention operation and construction.

Method Overview (4100)-(6100)

Figure 43:
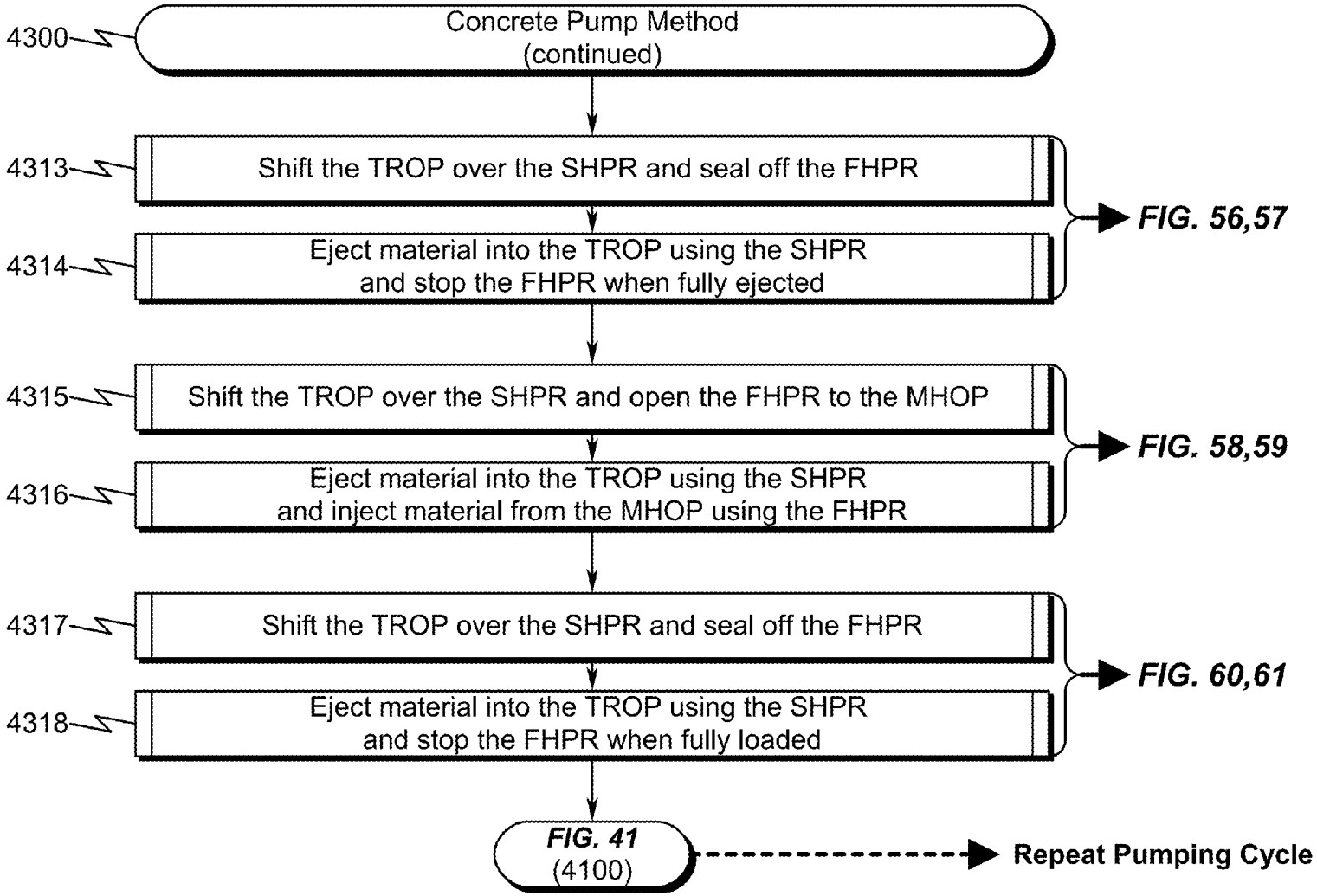
FIG. 43 illustrates a flowchart depicting a preferred exemplary invention method described in more detail in FIG. 44-FIG. 61.
Figure 45:
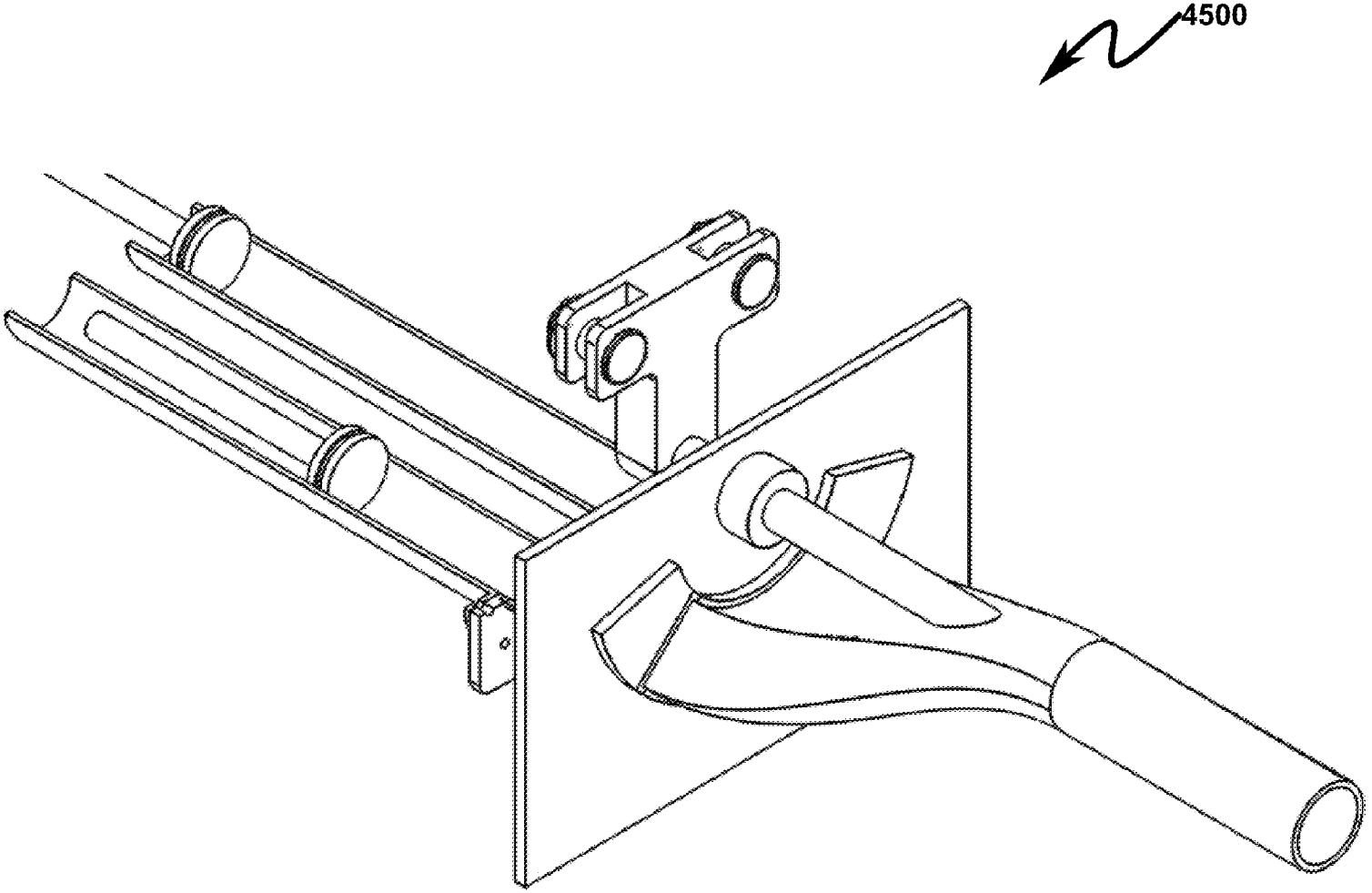
FIG. 45 illustrates a rear perspective view of a preferred exemplary embodiment of the present invention utilizing a sectioned annular-ring-shaped spectacle plate configured with the ejection port centered and both rams ejecting.
Figure 46:
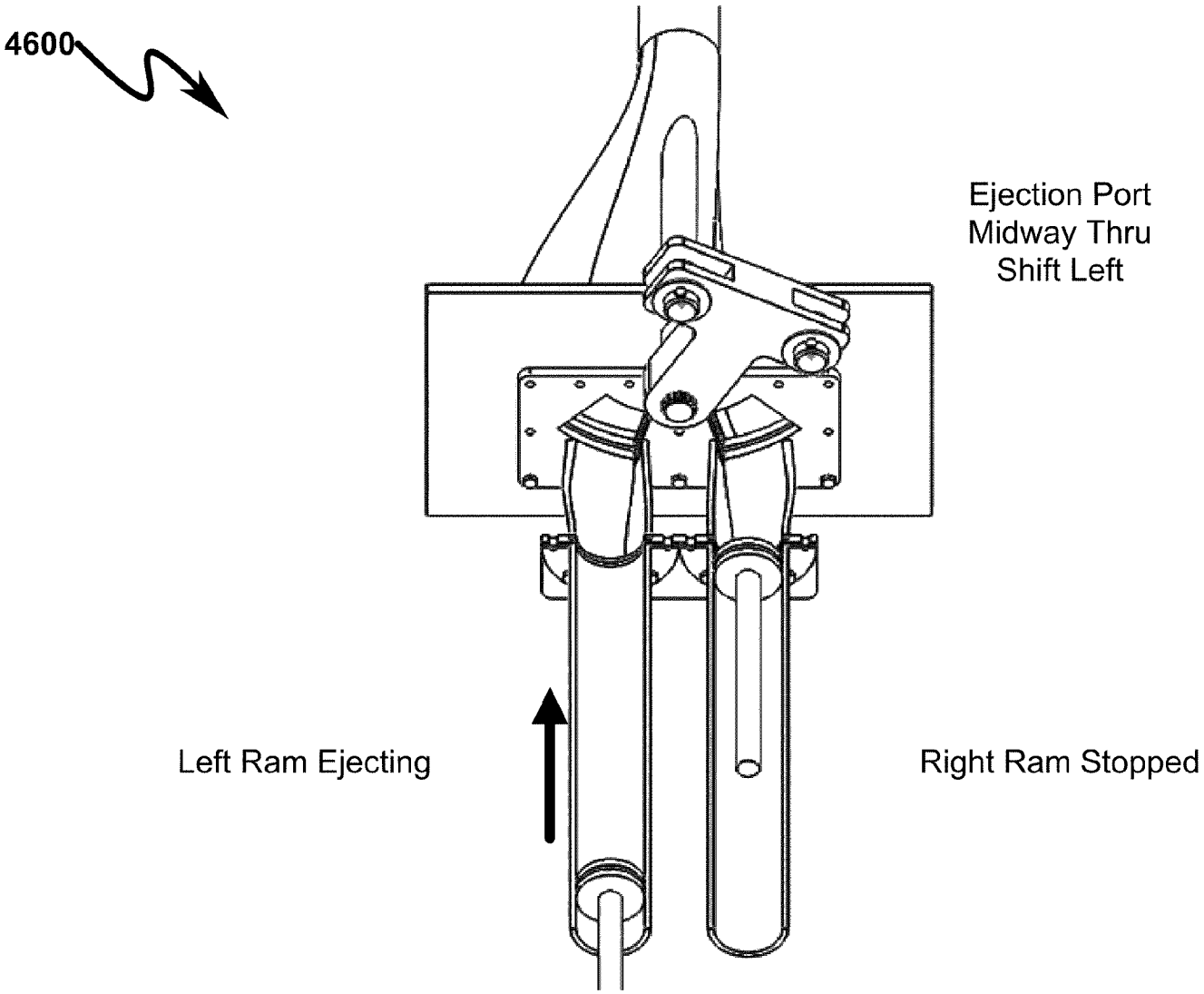
FIG. 46 illustrates a front perspective view of a preferred exemplary embodiment of the present invention utilizing a sectioned annular-ring-shaped spectacle plate configured with the ejection port positioned midway through shift left with the left ram ejecting and the right ram stopped.
Figure 47:
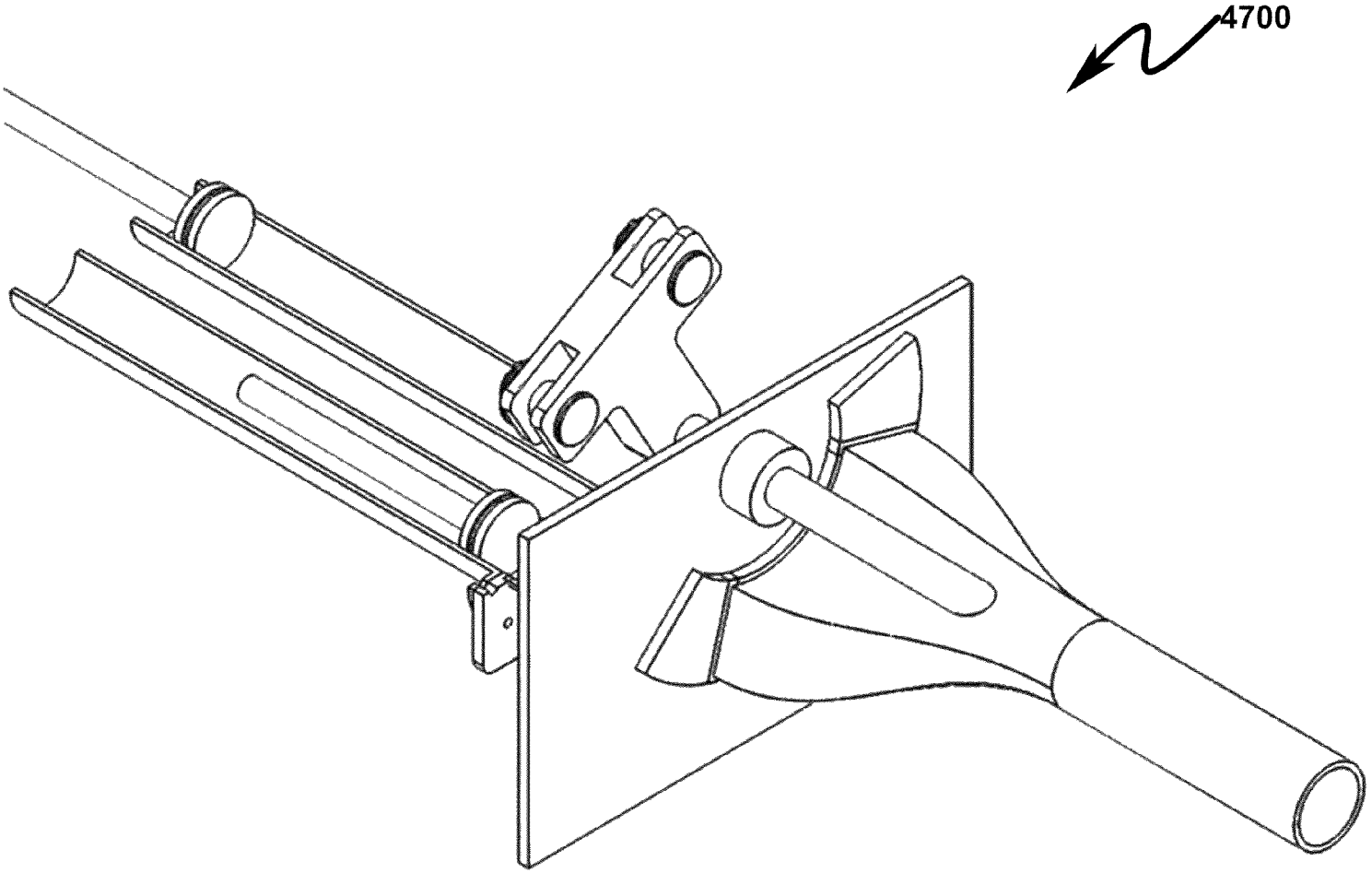
FIG. 47 illustrates a rear perspective view of a preferred exemplary embodiment of the present invention utilizing a sectioned annular-ring-shaped spectacle plate configured with the ejection port positioned midway through shift left with the left ram ejecting and the right ram stopped.
Figure 48:
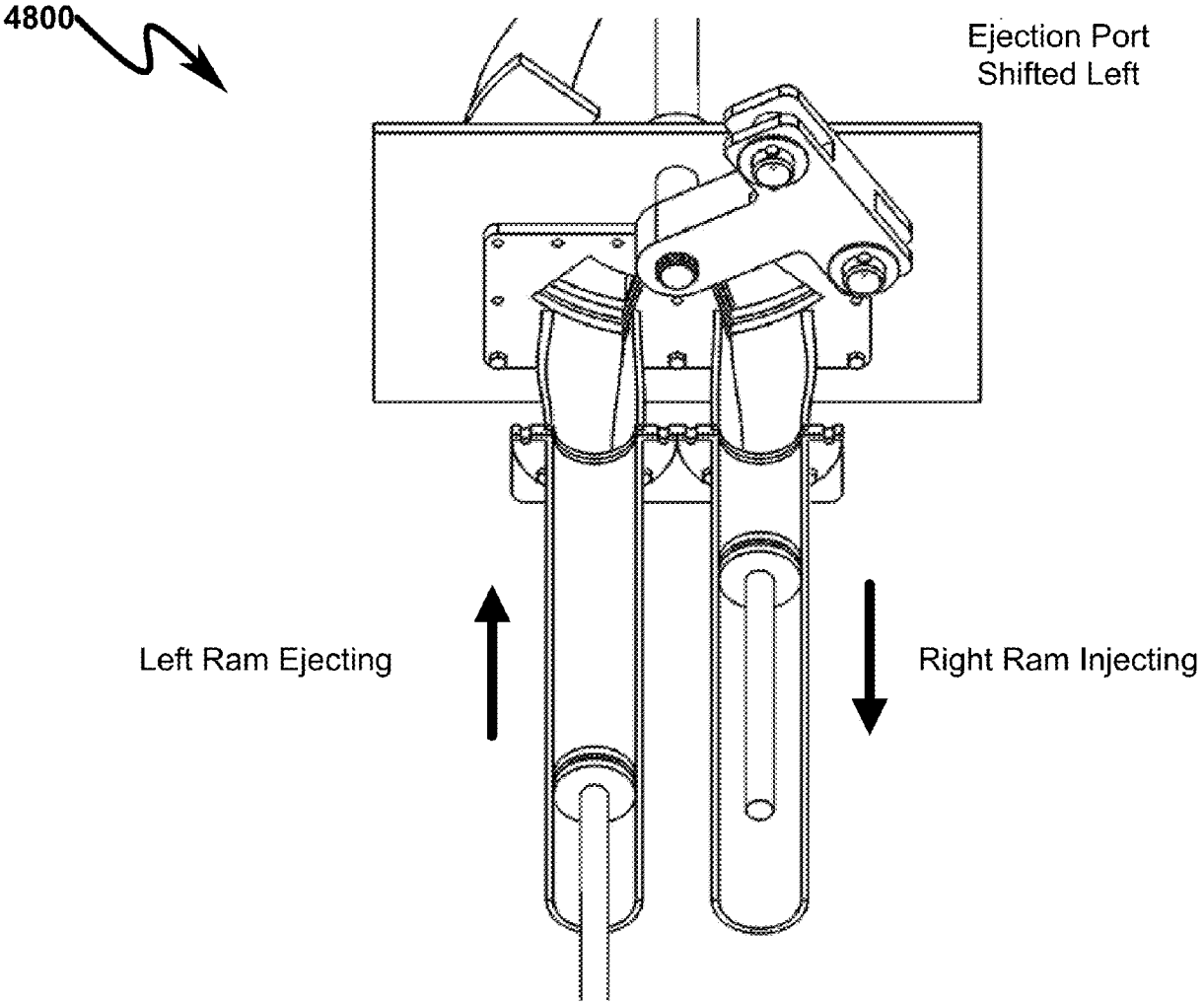
FIG. 48 illustrates a front perspective view of a preferred exemplary embodiment of the present invention utilizing a sectioned annular-ring-shaped spectacle plate configured with the ejection port shifted left with the left ram ejecting and the right ram injecting.
Figure 49:
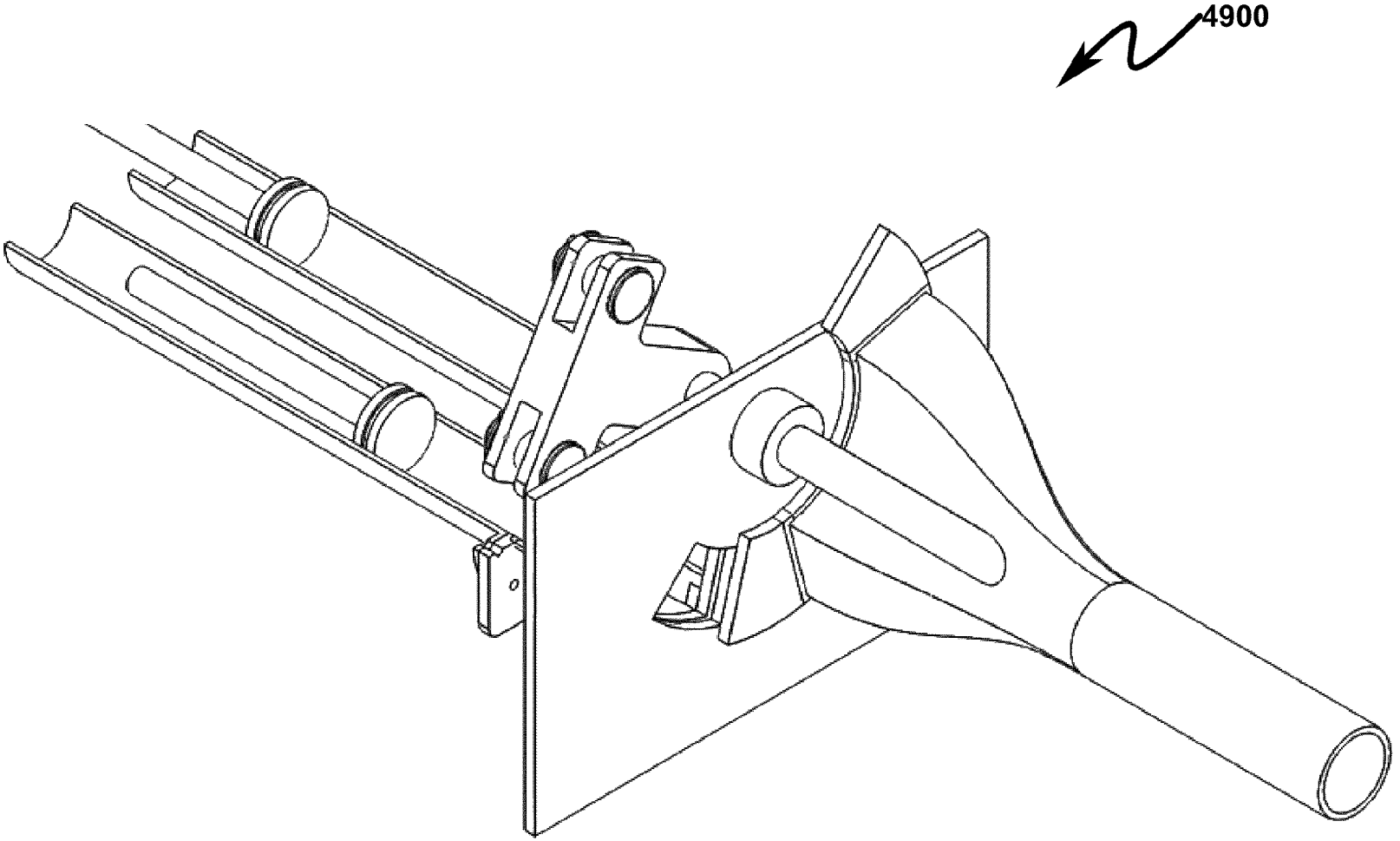
FIG. 49 illustrates a rear perspective view of a preferred exemplary embodiment of the present invention utilizing a sectioned annular-ring-shaped spectacle plate configured with the ejection port shifted left with the left ram ejecting and the right ram injecting.
Figure 50:
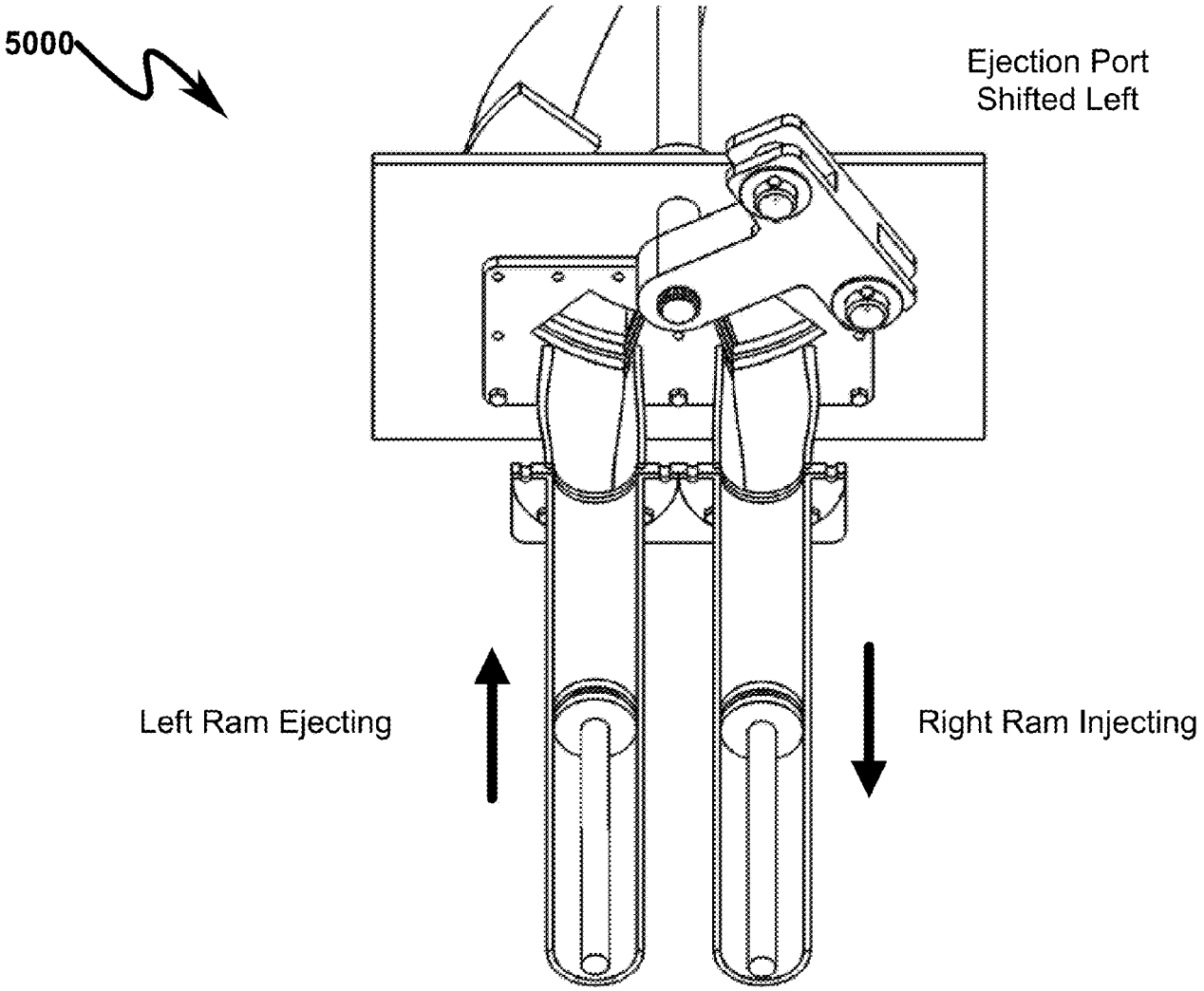
FIG. 50 illustrates a front perspective view of a preferred exemplary embodiment of the present invention utilizing a sectioned annular-ring-shaped spectacle plate configured with the ejection port shifted left with the left ram ejecting and the right ram injecting.
Figure 51:
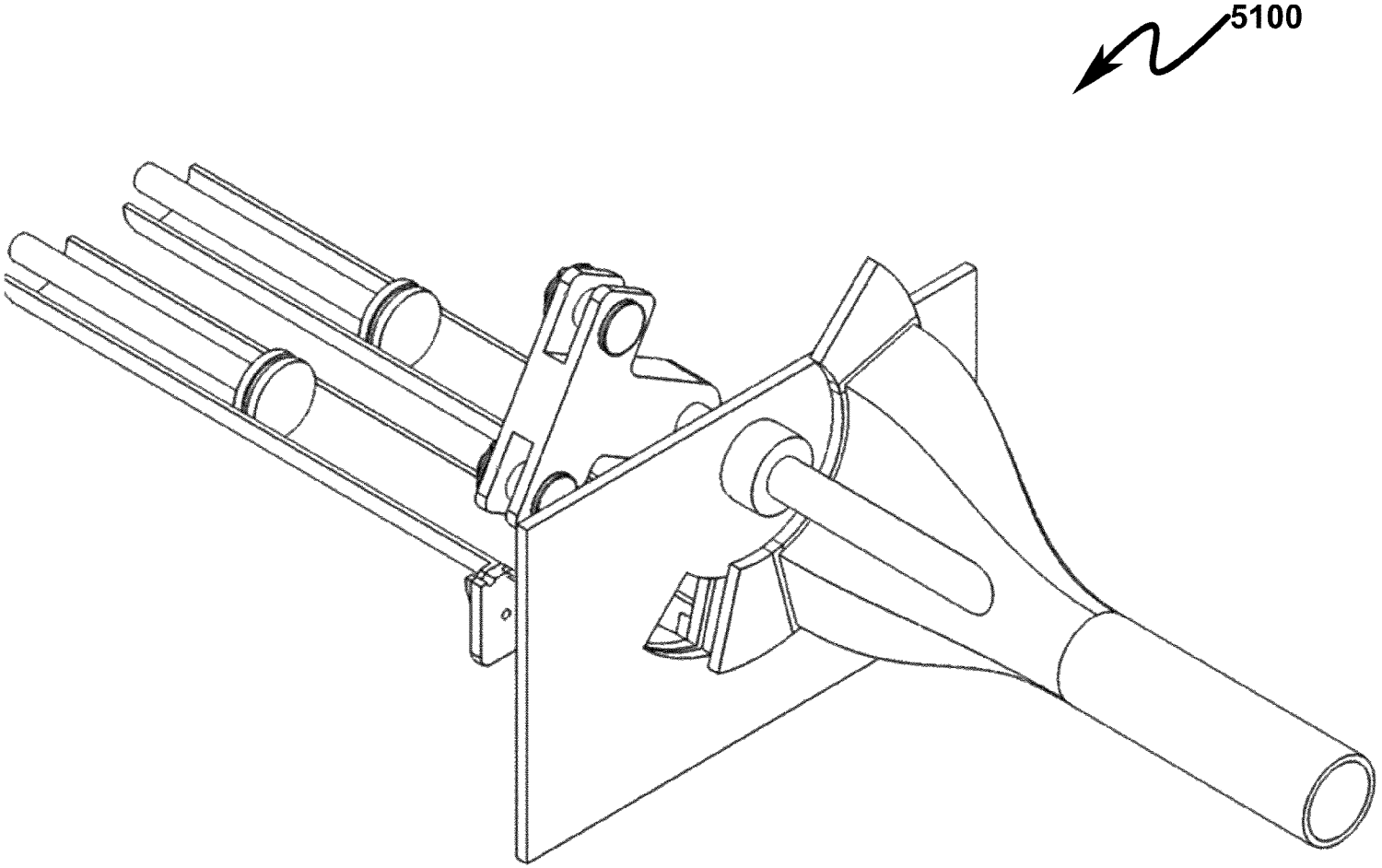
FIG. 51 illustrates a rear perspective view of a preferred exemplary embodiment of the present invention utilizing a sectioned annular-ring-shaped spectacle plate configured with the ejection port shifted left with the left ram ejecting and the right ram injecting.
Figure 52:
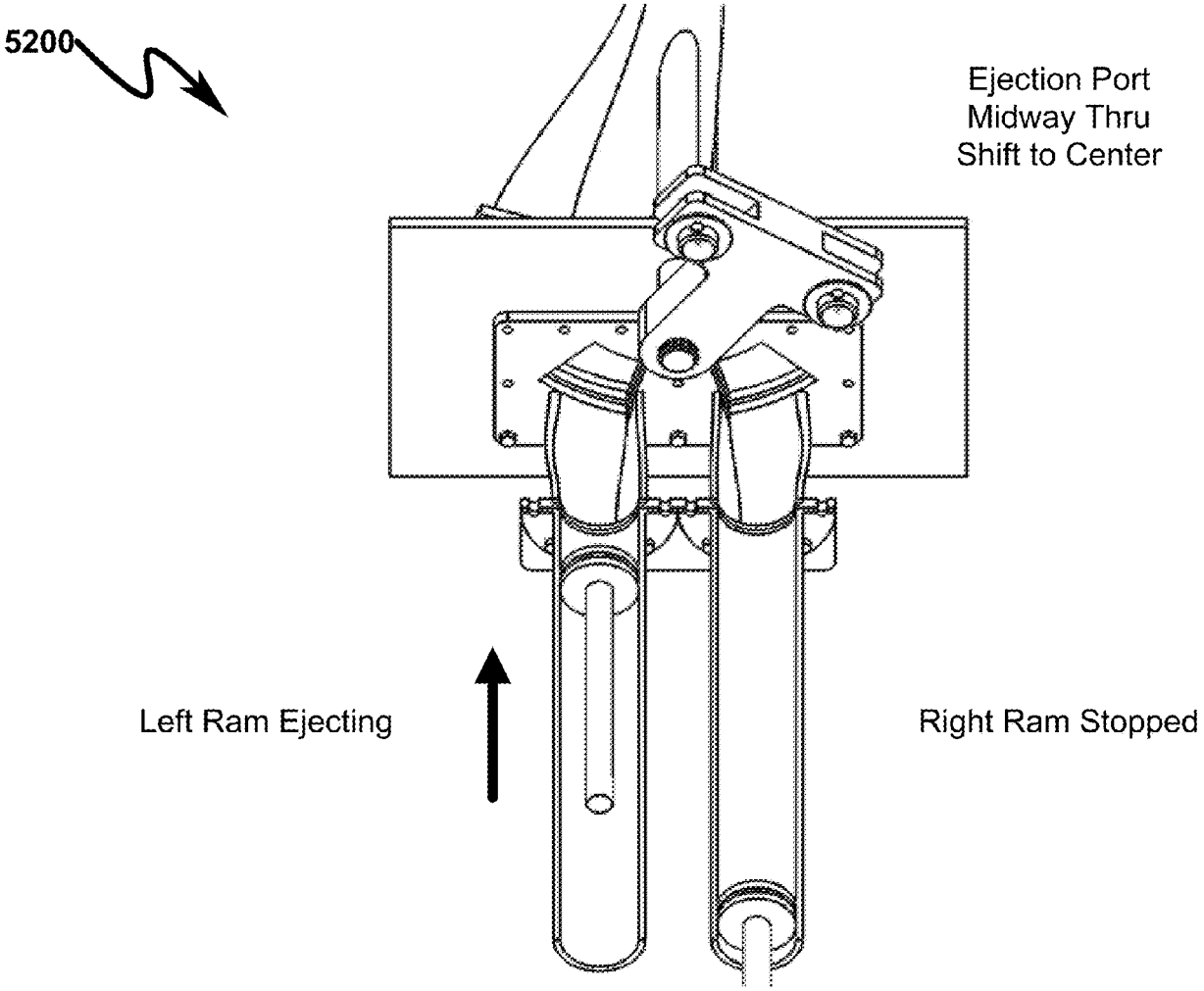
FIG. 52 illustrates a front perspective view of a preferred exemplary embodiment of the present invention utilizing a sectioned annular-ring-shaped spectacle plate configured with the ejection port positioned midway through shift to center with the left ram ejecting and the right ram stopped.
Figure 53:
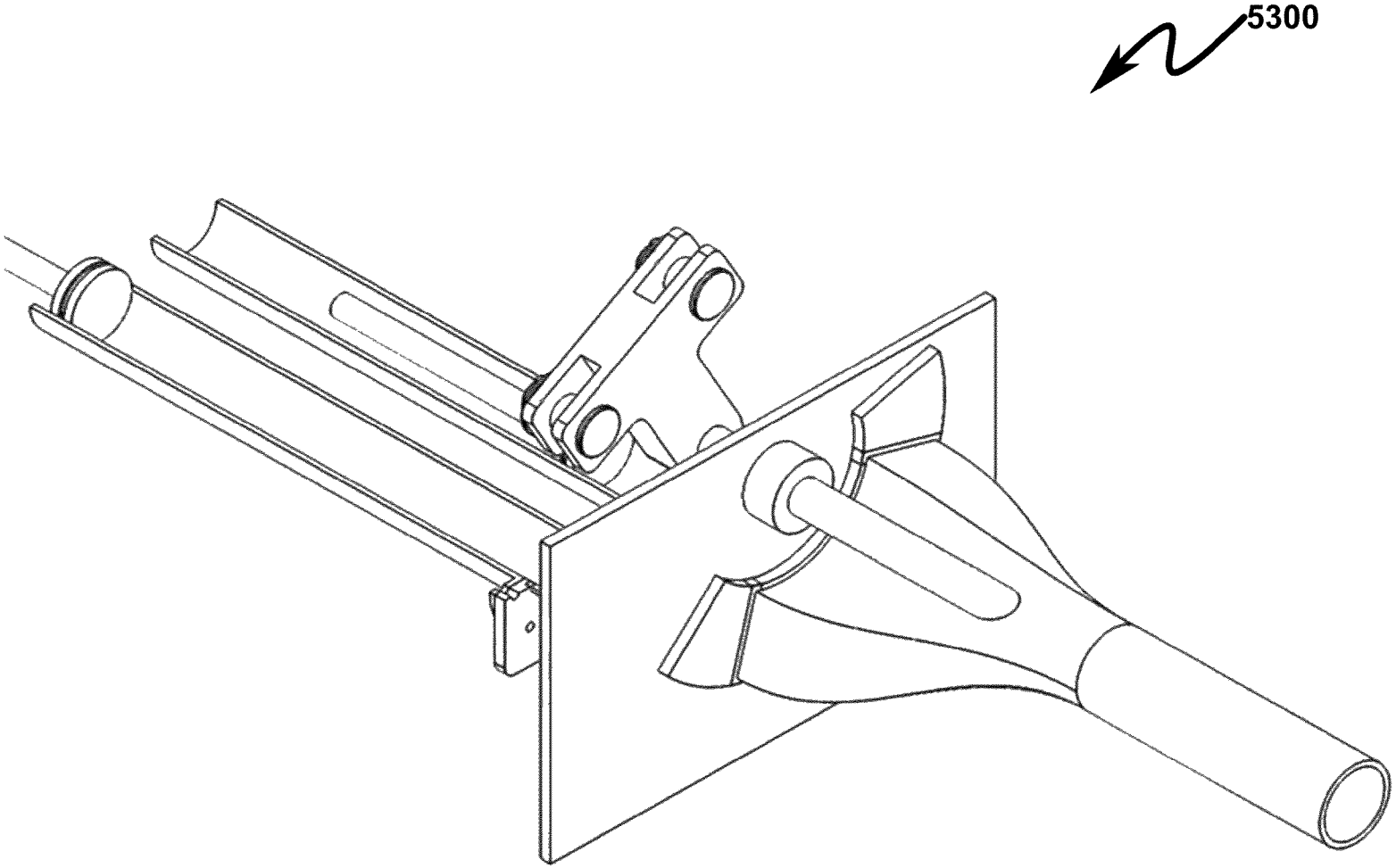
FIG. 53 illustrates a rear perspective view of a preferred exemplary embodiment of the present invention utilizing a sectioned annular-ring-shaped spectacle plate configured with the ejection port positioned midway through shift to center with the left ram ejecting and the right ram stopped.
Figure 54:
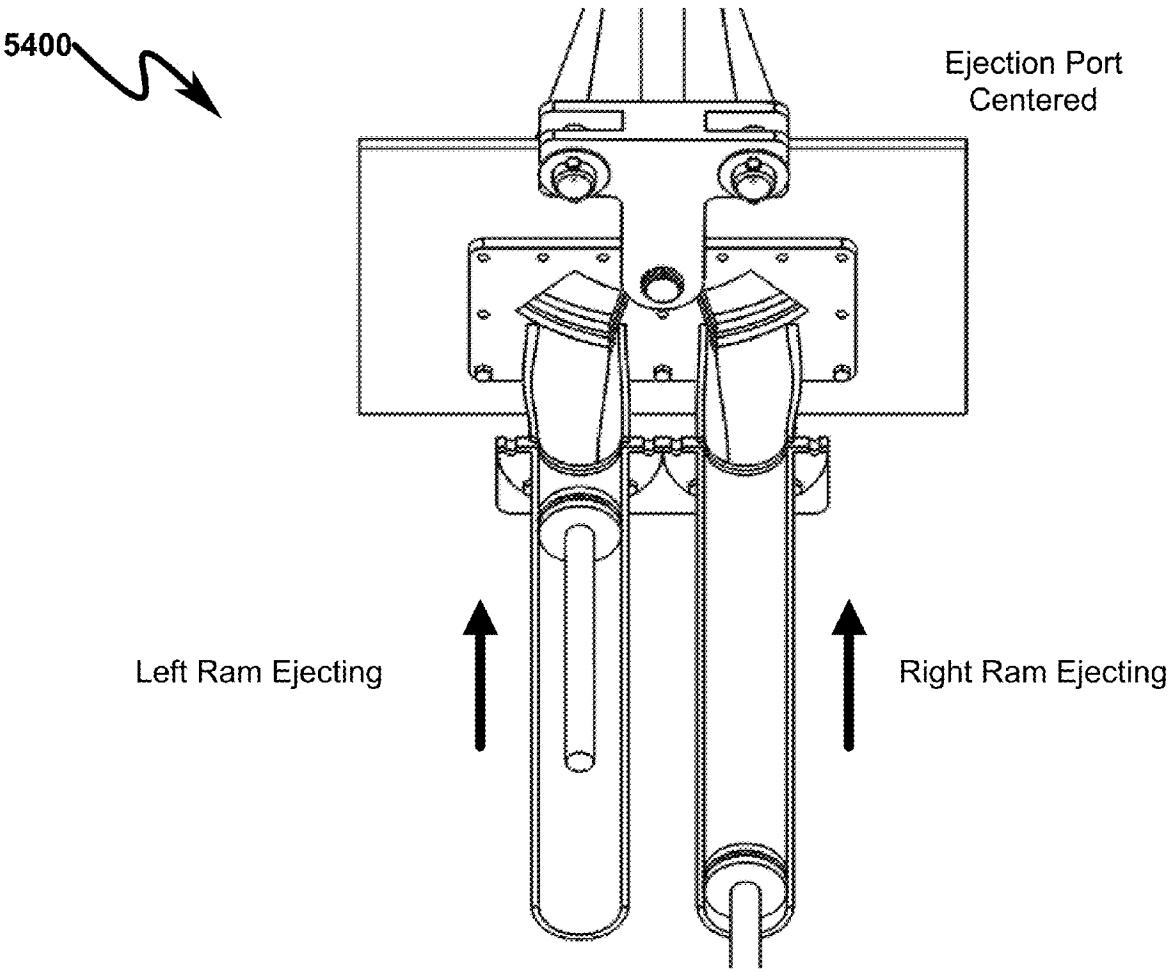
FIG. 54 illustrates a front perspective view of a preferred exemplary embodiment of the present invention utilizing a sectioned annular-ring-shaped spectacle plate configured with the ejection port centered with the left ram ejecting and the right ram ejecting.
Figure 55:
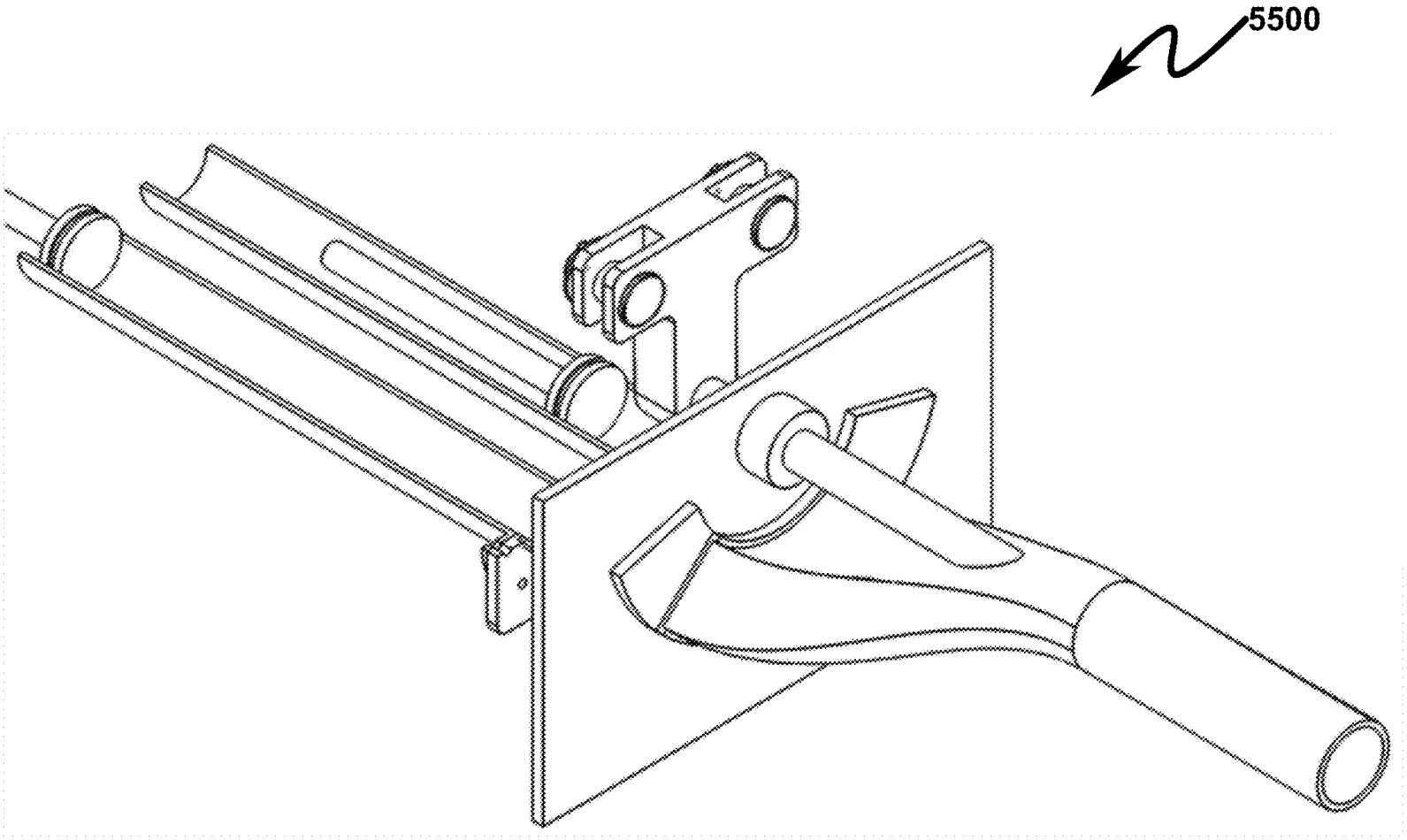
FIG. 55 illustrates a rear perspective view of a preferred exemplary embodiment of the present invention utilizing a sectioned annular-ring-shaped spectacle plate configured with the ejection port centered with the left ram ejecting and the right ram ejecting.
Figure 56:
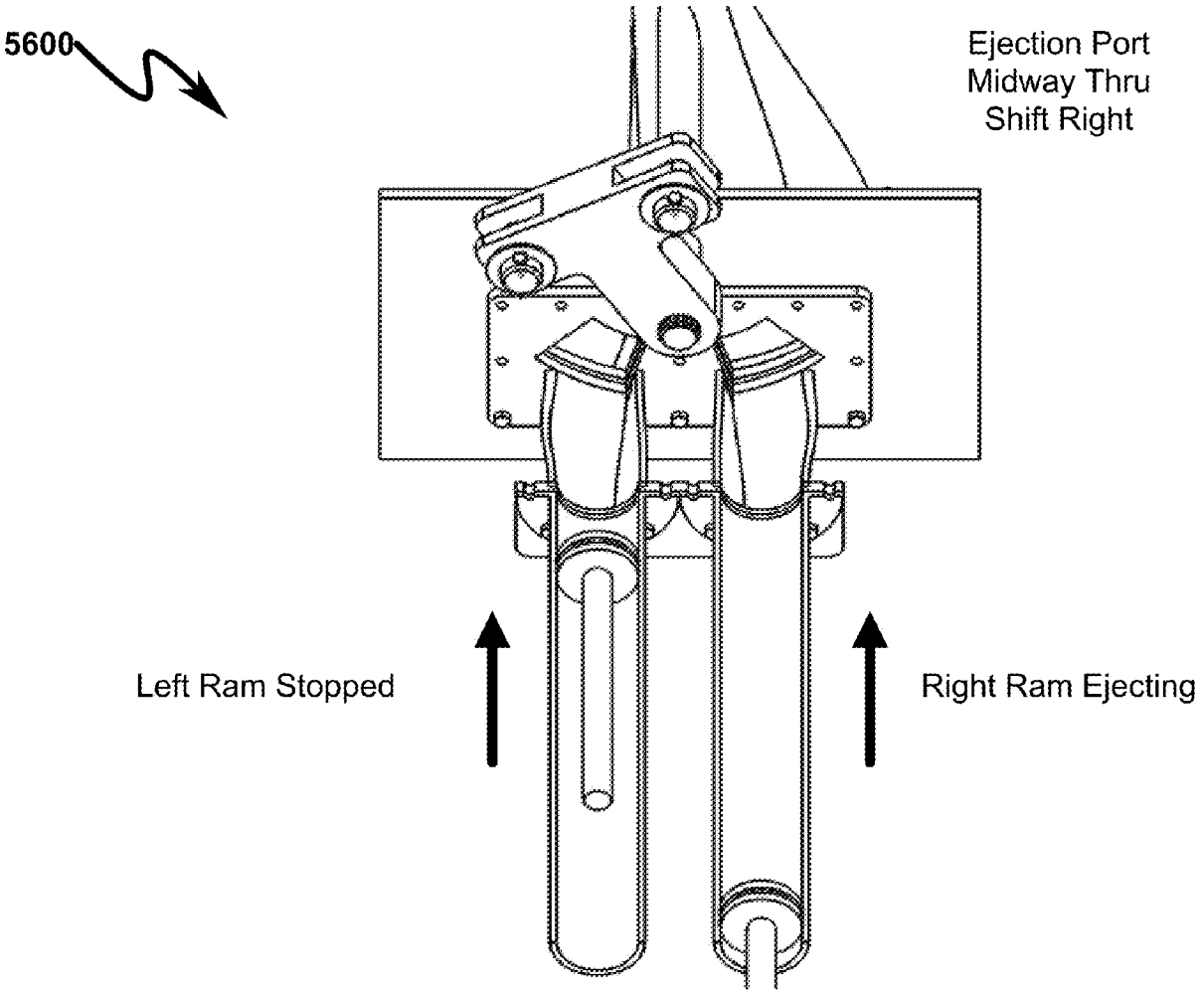
FIG. 56 illustrates a front perspective view of a preferred exemplary embodiment of the present invention utilizing a sectioned annular-ring-shaped spectacle plate configured with the ejection port positioned midway through shift right with the left ram stopped and the right ram ejecting.
Figure 57:
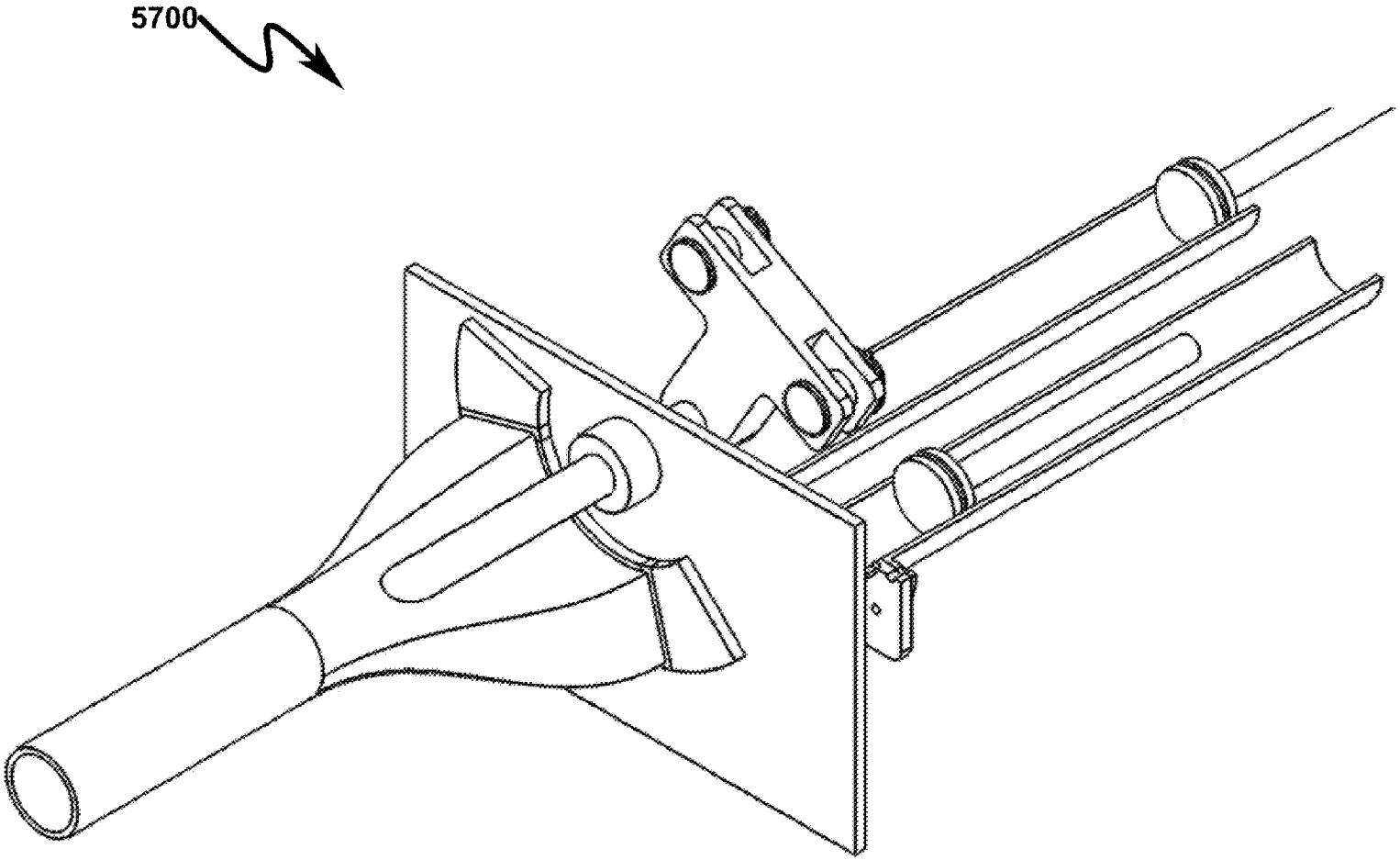
FIG. 57 illustrates a rear perspective view of a preferred exemplary embodiment of the present invention utilizing a sectioned annular-ring-shaped spectacle plate configured with the ejection port positioned midway through shift right with the left ram stopped and the right ram ejecting.
Figure 58:
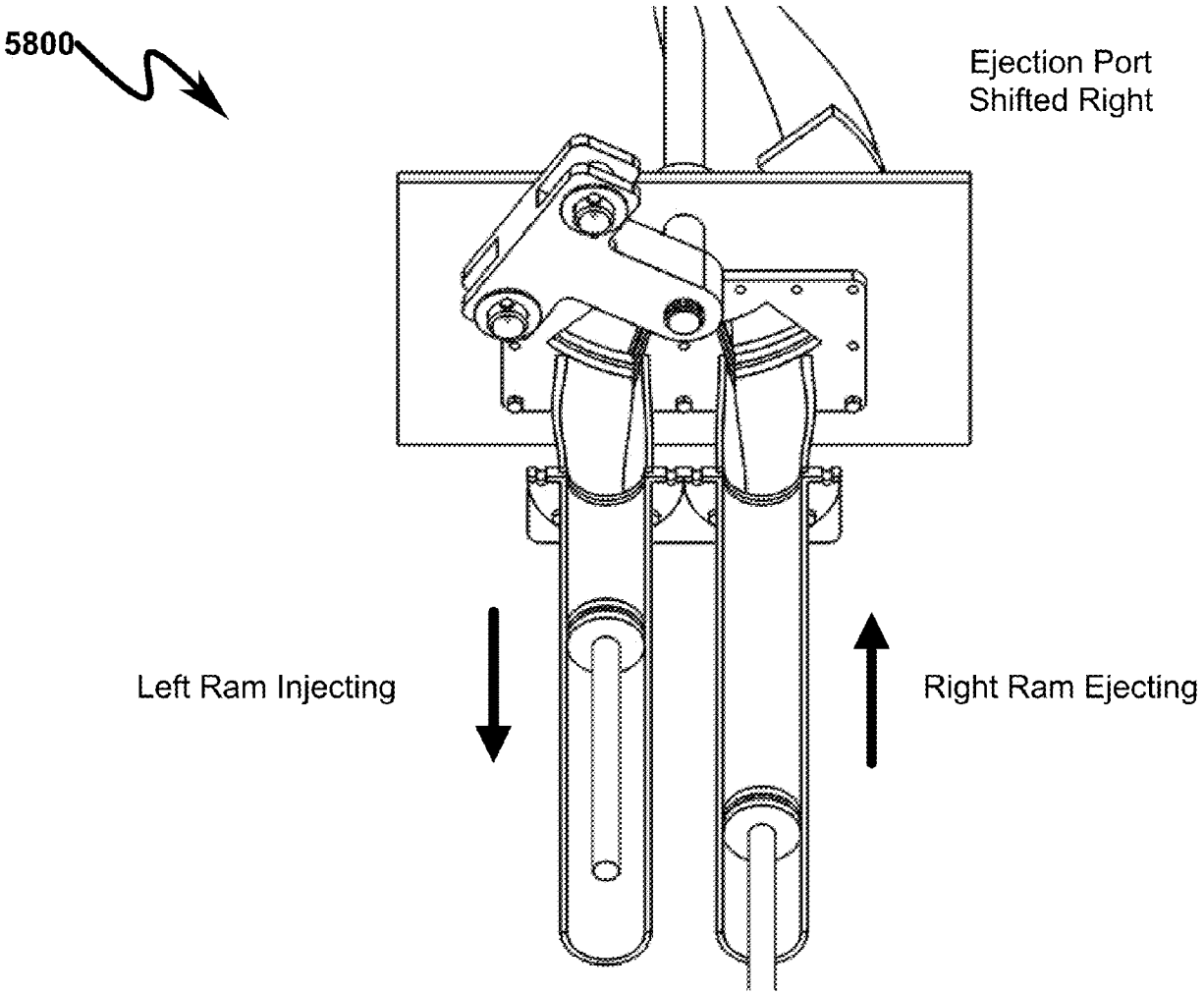
FIG. 58 illustrates a front perspective view of a preferred exemplary embodiment of the present invention utilizing a sectioned annular-ring-shaped spectacle plate configured with the ejection port shifted right with the left ram injecting and the right ram ejecting.
Figure 59:
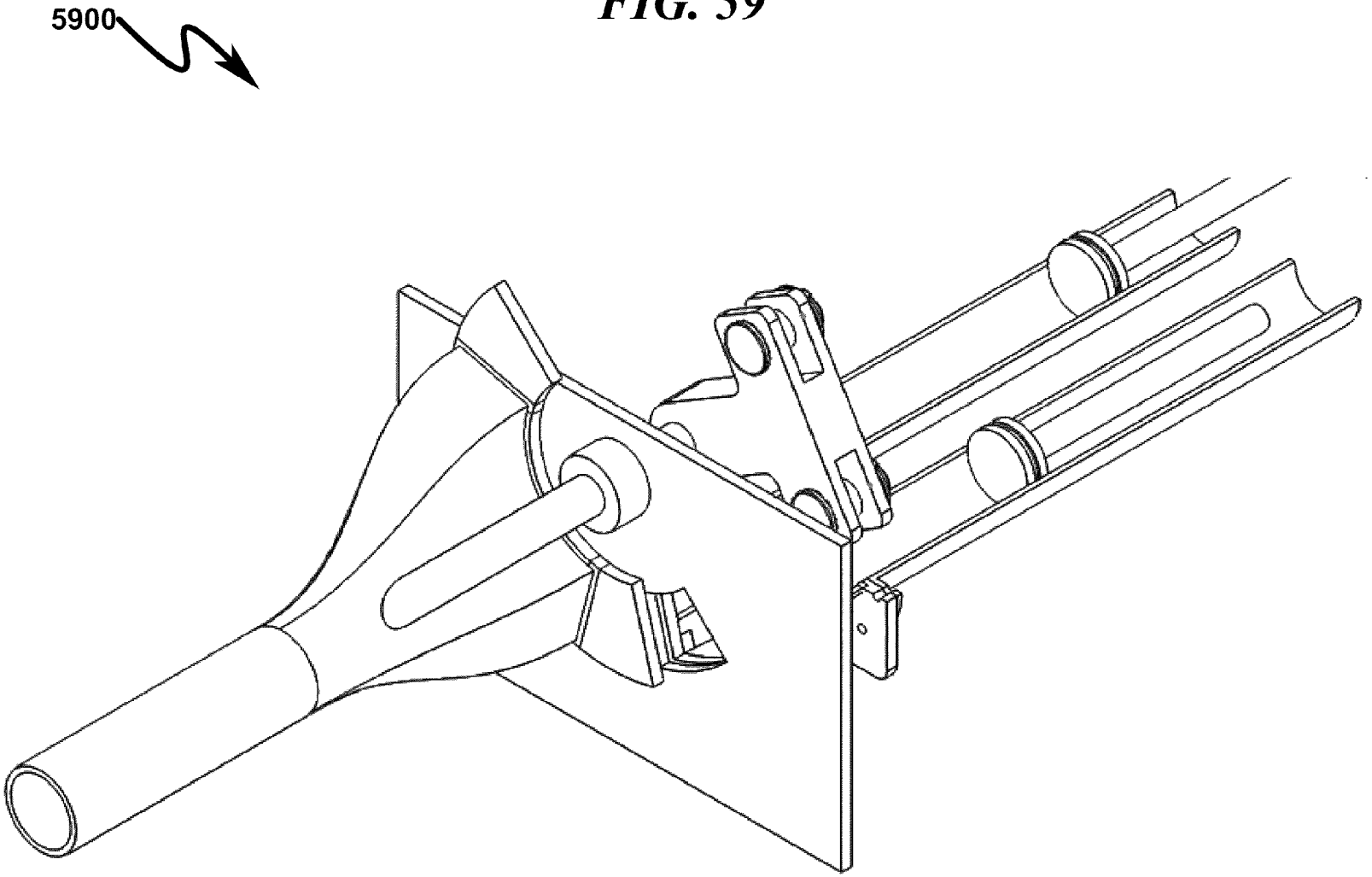
FIG. 59 illustrates a rear perspective view of a preferred exemplary embodiment of the present invention utilizing a sectioned annular-ring-shaped spectacle plate configured with the ejection port shifted right with the left ram injecting and the right ram ejecting.
Figure 60:
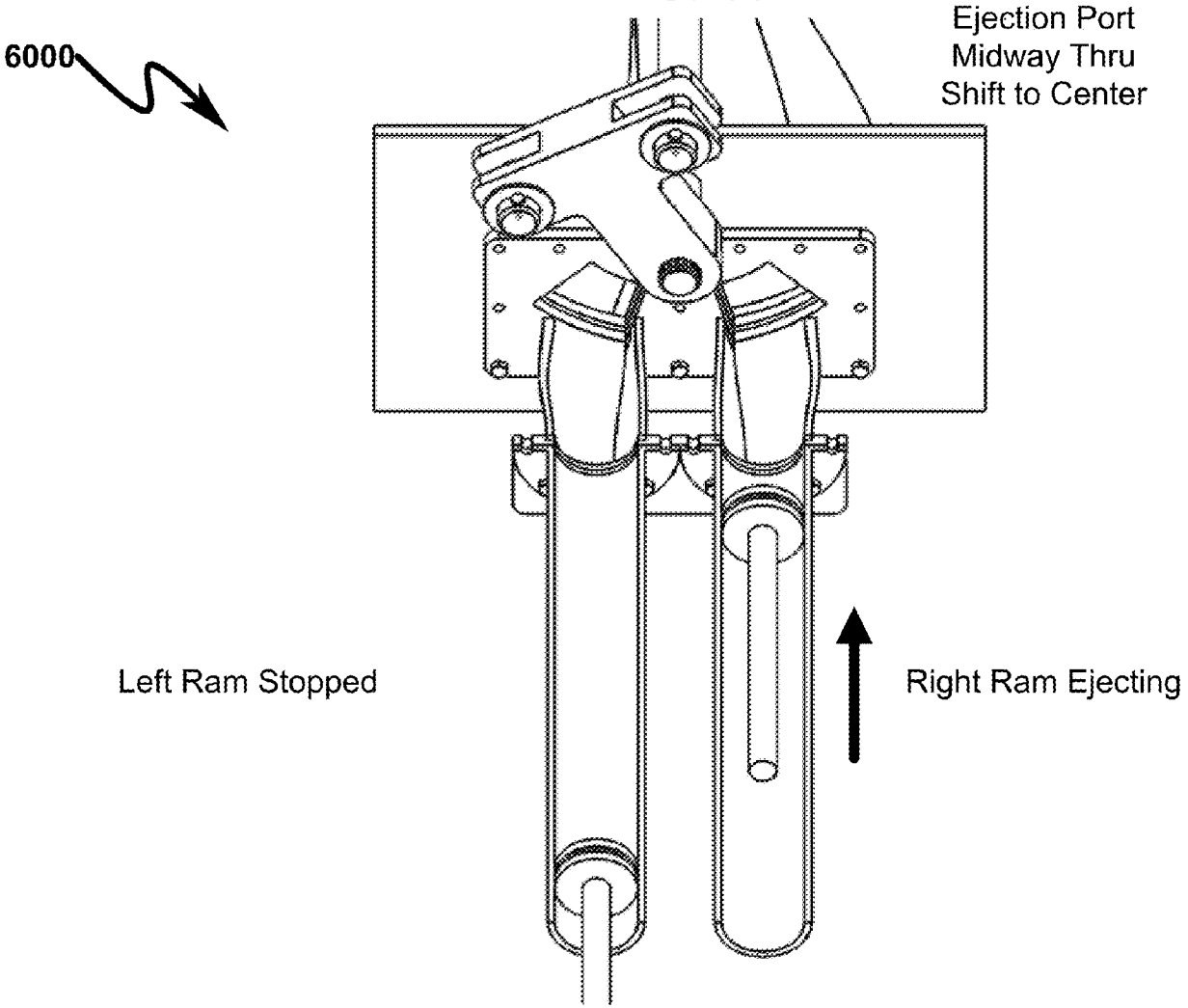
FIG. 60 illustrates a front perspective view of a preferred exemplary embodiment of the present invention utilizing a sectioned annular-ring-shaped spectacle plate configured with the ejection port positioned midway through shift to center with the left ram stopped and the right ram ejecting.
Figure 61:
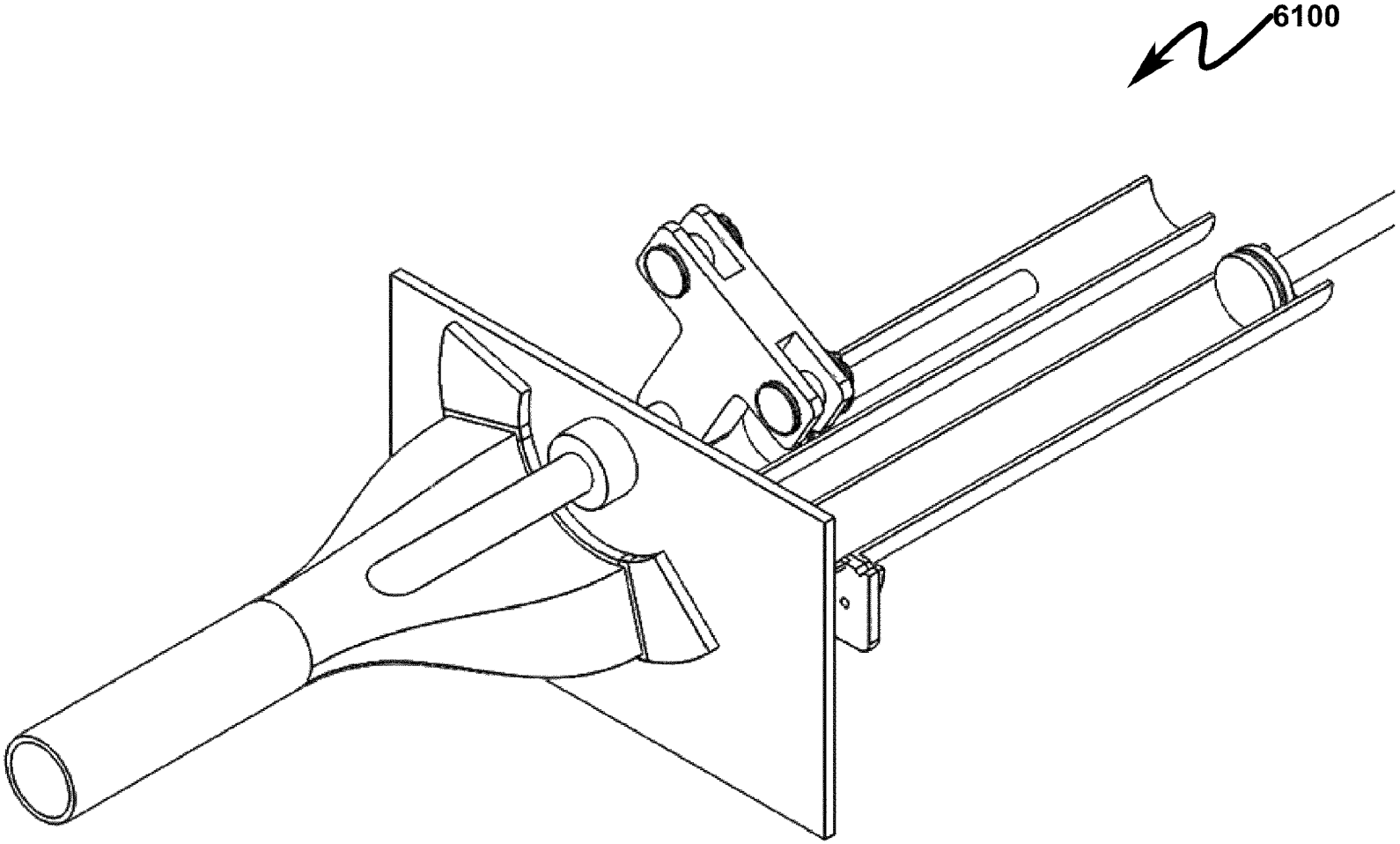
FIG. 61 illustrates a rear perspective view of a preferred exemplary embodiment of the present invention utilizing a sectioned annular-ring-shaped spectacle plate configured with the ejection port positioned midway through shift to center with the left ram stopped and the right ram ejecting.

A preferred invention method embodiment may be generalized as illustrated in the flowcharts depicted in FIG. 41 (4100)-FIG. 43 (4300) and corresponding positional diagrams depicted in FIG. 44 (4400)-FIG. 61 (6100) wherein the method operates in conjunction with a concrete pump system comprising:

(a) material hopper (MHOP);
(b) trapezoidal-shaped spectacle plate (TSSP);
(c) hydraulic pump;
(d) trapezoidal-shaped cutting ring (TSCR); and
(e) ejection port;

wherein the TSSP comprises a first trapezoidal inlet port (FTIP) and a second trapezoidal inlet port (STIP);

the TSSP is attached to the MHOP and configured to supply concrete from the MHOP to the hydraulic pump through the FTIP and the STIP;

the hydraulic pump comprises a first hydraulic pump ram (FHPR) and a second hydraulic pump ram (SHPR);

the FHPR is configured to accept concrete via the FTIP;

the SHPR is configured to accept concrete via the STIP;

the TSCR comprises a trapezoidal receiver output port (TROP) configured to alternately traverse between positions that cover the FTIP and the STIP;

the TROP is configured to direct concrete from the FTIP and the STIP to the ejection port;

the hydraulic pump is configured to eject concrete from the FHPR into the TROP when the TROP is positioned to cover the FTIP;

the hydraulic pump is configured to inject concrete from the MHOP into the SHPR when the TROP is positioned to cover the FTIP;

the hydraulic pump is configured to eject concrete from the SHPR into the TROP when the TROP is positioned to cover the STIP; and the hydraulic pump is configured to inject concrete from the MHOP into the FHPR when the TROP is positioned to cover the STIP;

wherein the method comprises the steps of:

(1) Centering the TROP over the TSSP to open the TROP to the FHPR and the SHPR (4101) (as depicted in FIG. 44 (4400) and FIG. 45 (4500));

(2) Ejecting material using the FHPR and the SHPR into the TROP (4102) (as depicted in FIG. 44 (4400) and FIG. 45 (4500));

(3) Shifting the TROP over the FHPR and sealing off the SHPR (4103) (as depicted in FIG. 46 (4600) and FIG. 47 (4700));

(4) Ejecting material into the TROP using the FHPR (4104) (as depicted in FIG. 46 (4600) and FIG. 47 (4700));

(5) Shifting the TROP over the FHPR and opening the SHPR to the MHOP (4105) (as depicted in FIG. 48 (4800) and FIG. 49 (4900));

(6) Ejecting material into the TROP using the FHPR and injecting material from the MHOP using the SHPR (4106) (as depicted in FIG. 48 (4800) and FIG. 49 (4900));

(7) Shifting the TROP over the FHPR and opening the SHPR to the MHOP (4207) (as depicted in FIG. 50 (5000) and FIG. 51 (5100));

(8) Ejecting material into the TROP using the FHPR and injecting material from the MHOP using the SHPR (optionally at twice the ejection rate of the FHPR) (4208) (as depicted in FIG. 50 (5000) and FIG. 51 (5100));

(9) Shifting the TROP over the FHPR and sealing off the SHPR (4209) (as depicted in FIG. 52 (5200) and FIG. 53 (5300));

(10) Ejecting material into the TROP using the FHPR and stopping the SHPR when fully loaded (4210) (as depicted in FIG. 52 (5200) and FIG. 53 (5300));

(11) Centering the TROP over the TSSP to open the TROP to the FHPR and the SHPR (4211) (as depicted in FIG. 54 (5400) and FIG. 55 (5500));

(12) Ejecting material into the TROP using the FHPR and the SHPR (4212) (as depicted in FIG. 54 (5400) and FIG. 55 (5500));

(13) Shifting the TROP over the SHPR and sealing off the FHPR (4313) (as depicted in FIG. 56 (5600) and FIG. 57 (5700));

(14) Ejecting material into the TROP using the SHPR and stopping the FHPR when fully ejected (4314) (as depicted in FIG. 56 (5600) and FIG. 57 (5700));

(15) Shifting the TROP over the SHPR and opening the FHPR to the MHOP (4315) (as depicted in FIG. 58 (5800) and FIG. 59 (5900));

(16) Ejecting material into the TROP using the SHPR and injecting material from the MHOP using the FHPR (optionally at twice the ejection rate of the SHPR) (4316) (as depicted in FIG. 58 (5800) and FIG. 59 (5900));

(17) Shifting the TROP over the SHPR and sealing off the FHPR (4317) (as depicted in FIG. 60 (6000) and FIG. 61 (6100));

(18) Ejecting material into the TROP using the SHPR and stopping the FHPR when fully loaded (4318) (as depicted in FIG. 60 (6000) and FIG. 61 (6100)); and

(19) Proceeding to step (1) to repeat material pumping operations.

One skilled in the art will recognize that this method as depicted is applied to a pumping system having two hydraulic pump rams (HPRs). Other preferred invention embodiments may employ a plurality of HPRs in a coordinated fashion using the same techniques to achieve higher pump flow rates as discussed elsewhere herein.

Annulus Transition Sizing Calculations

Figure 40:
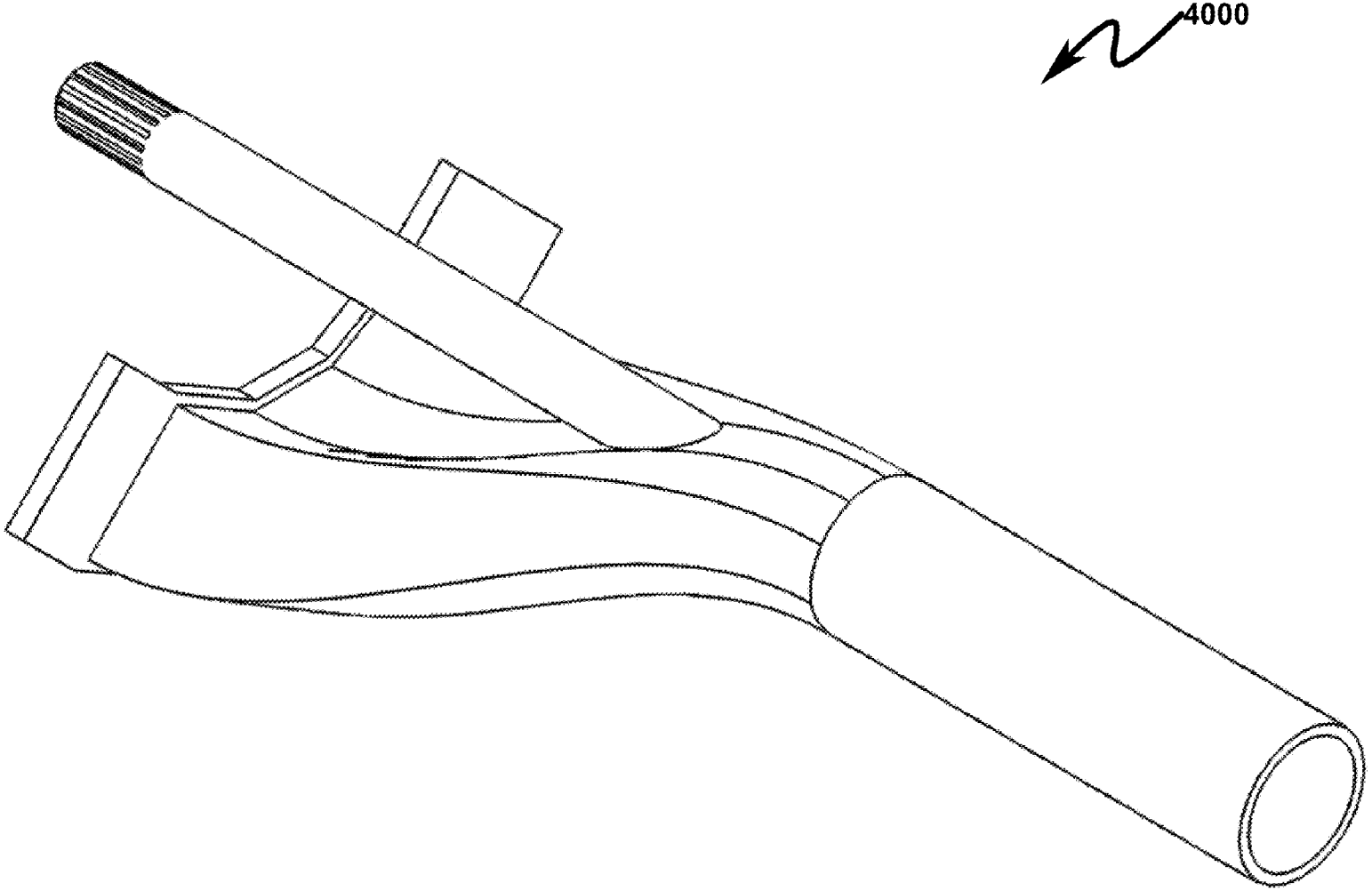
FIG. 40 illustrates a rear perspective detail view of a preferred exemplary embodiment of the present invention utilizing a trapezoidal-shaped spectacle plate and corresponding ejection port/cutting plate and detailing the ejection port and cutting plate construction.

As generally depicted in FIG. 25 (2500)-FIG. 40 (4000), the transition interfaces between the pump cylinders and the spectacle plate may be optimally sized in some preferred embodiments so that the circular pump cylinder face area and the trapezoidal spectacle plate interfaces are approximately equal. One skilled in the art will readily be able to calculate the required spectacle plate sizing for these preferred embodiments.

TSSP/TSCR Shearing Edge Embodiments (6200)-(6400)

Figure 62:
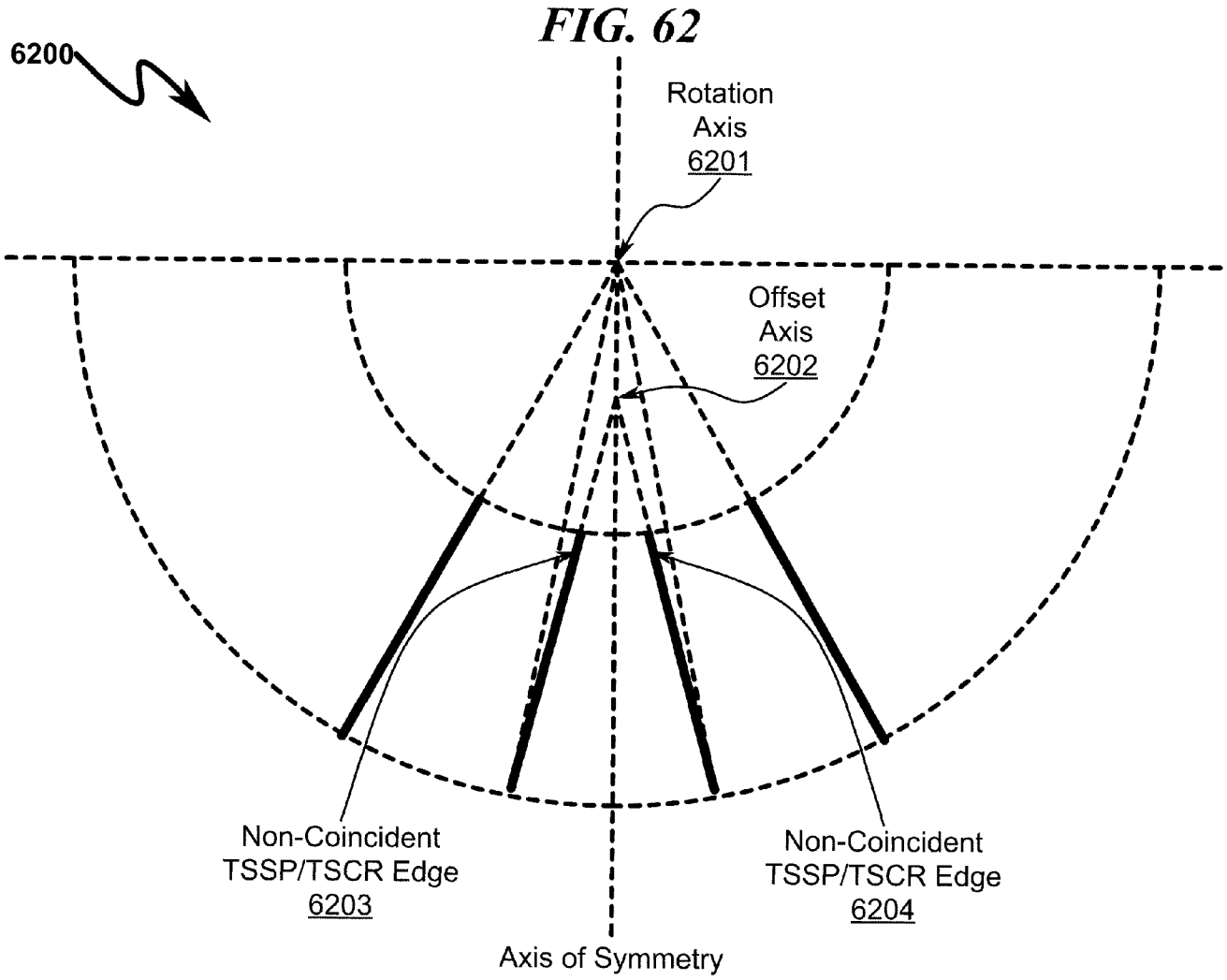
FIG. 62 illustrates a schematic view of a TSSP/TSCR shearing edge embodiment wherein the TSSP and TSCR are misaligned so that as the TSCR rotates about the axis of rotation (AOR) and the TSSP and TSCR are misaligned about a shearing offset axis (SOA) that is below the axis of rotation (AOR) so as to create one or more non-coincident TSSP/TSCR interfaces centered about an axis of symmetry.

Some preferred invention embodiments may purposely misalign the non-radial (side) edges of the TSSP and TSCR in order to achieve a shearing action as the TSCR moves across the TSSP. This shearing action reduces wear in the TSSP/TSCR right/left edge interfaces and promotes a reduction in hydraulic power required to articulate (rotate) the TSCR across the TSSP. Several examples of these preferred embodiments are illustrated in FIG. 62 (6200)-FIG. 64 (6400) and described below.

Shearing Offset Axis (SOA) Below Axis of Rotation (AOR) (6200)

In the example depicted in FIG. 62 (6200), the TSSP and TSCR are misaligned so that as the TSCR rotates about the axis of rotation (AOR) (6201), the TSSP and TSCR are misaligned about a shearing offset axis (SOA) (6202) that is below the axis of rotation (AOR) (6201) so as to create one or more non-coincident TSSP/TSCR interfaces (6203, 6204) centered about an axis of symmetry. These non-coincident TSSP/TSCR interfaces (6203, 6204) may be formed by adjusting the inner side edge of either the TSSP or the TSCR to be misaligned according to the shearing offset axis (SOA) (6202) positioned below the axis of rotation (AOR) (6201).

Shearing Offset Axis (SOA) Above Axis of Rotation (AOR) (6300)

Figure 63:
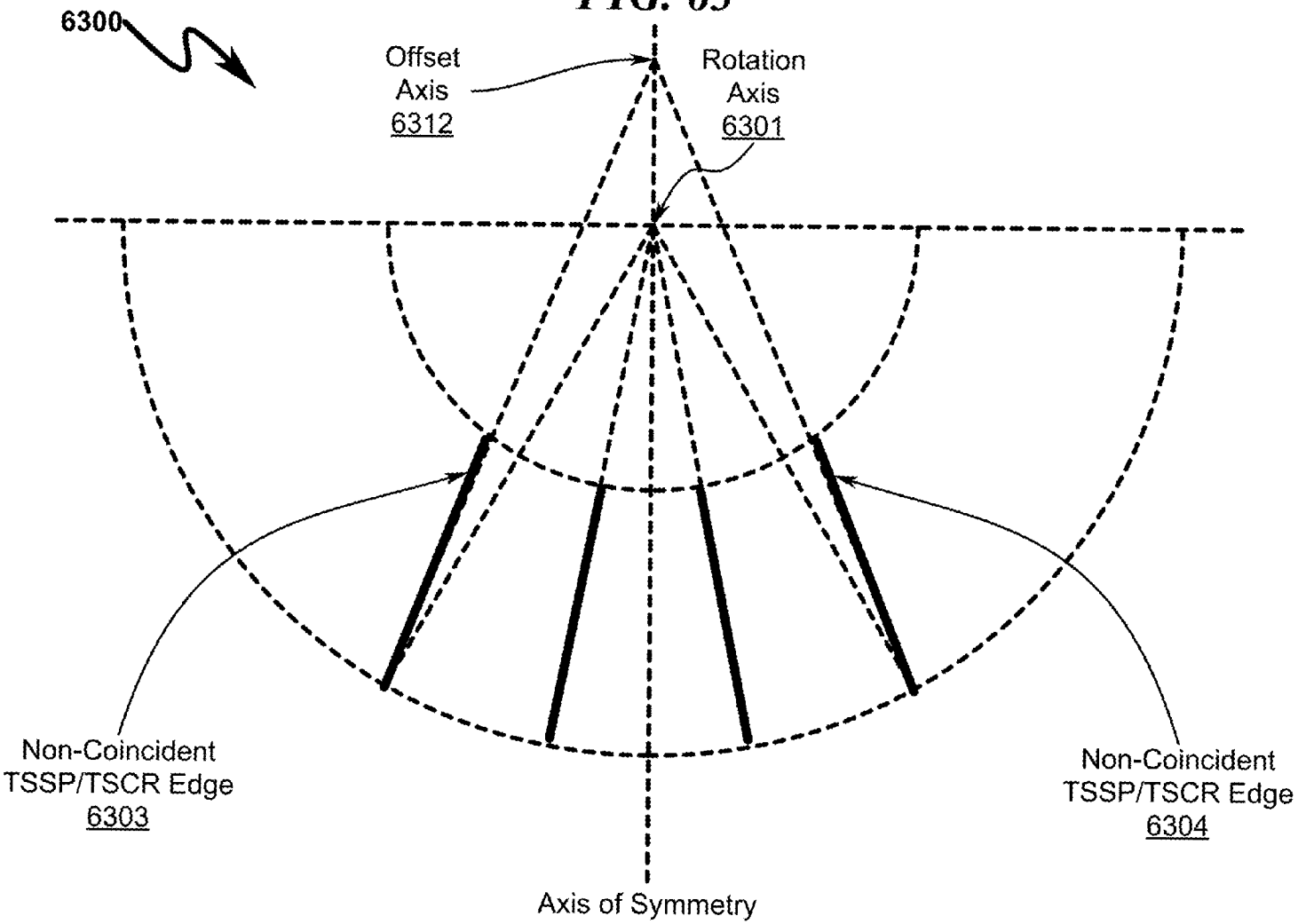
FIG. 63 illustrates a schematic view of a TSSP/TSCR shearing edge embodiment wherein the TSSP and TSCR are misaligned so that as the TSCR rotates about the axis of rotation (AOR) and the TSSP and TSCR are misaligned about a shearing offset axis (SOA) that is above the axis of rotation (AOR) so as to create one or more non-coincident TSSP/TSCR interfaces centered about an axis of symmetry.

In the example depicted in FIG. 63 (6300), the TSSP and TSCR are misaligned so that as the TSCR rotates about the axis of rotation (AOR) (6301), the TSSP and TSCR are misaligned about a shearing offset axis (SOA) (6312) that is above the axis of rotation (AOR) (6301) so as to create one or more non-coincident TSSP/TSCR interfaces (6303, 6304) centered about an axis of symmetry. These non-coincident TSSP/TSCR interfaces (6303, 6304) may be formed by adjusting the outer side edge of either the TSSP or the TSCR to be misaligned according to the shearing offset axis (SOA) (6312) positioned above the axis of rotation (AOR) (6301).

Shearing Offset Axis (SOAs) Below/Above Axis of Rotation (AOR) (6400)

Figure 64:
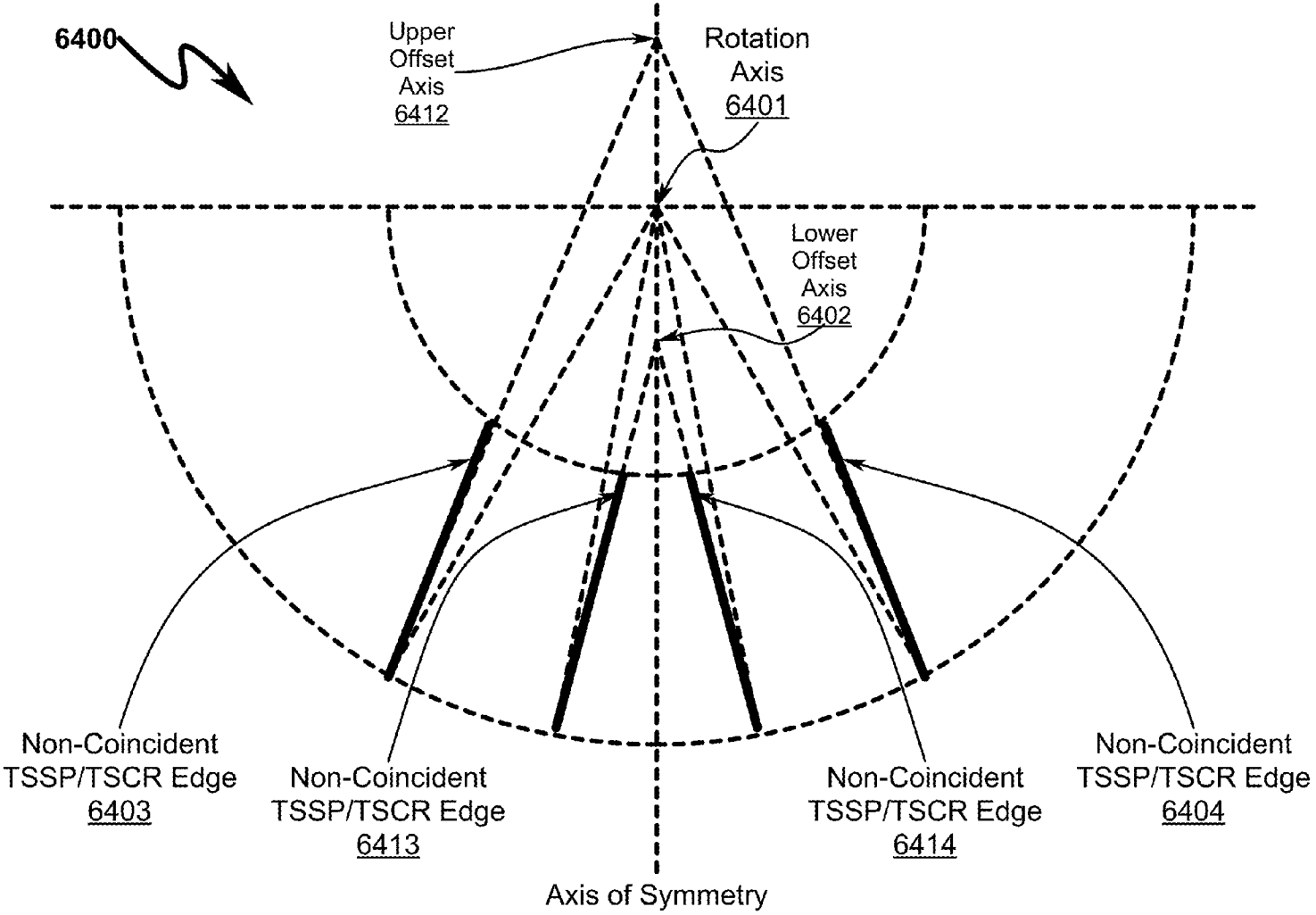
FIG. 64 illustrates a schematic view of a TSSP/TSCR shearing edge embodiment wherein the TSSP and TSCR are misaligned so that as the TSCR rotates about the axis of rotation (AOR) and the TSSP and TSCR are misaligned about an offset axes that are above/below the axis of rotation (AOR) so as to create one or more non-coincident TSSP/TSCR interfaces centered about an axis of symmetry.

As depicted in FIG. 64 (6400), it is possible to incorporate shearing offset axes (SOAs) that are both above/below the axis of rotation (AOR). In the example depicted in FIG. 64 (6400), the TSSP and TSCR are misaligned so that as the TSCR rotates about the axis of rotation (AOR) (6401), the TSSP and TSCR are misaligned about a lower shearing offset axis (SOA) (6402) and upper shearing offset axis (SOA) (6412) that are respectively below/above the axis of rotation (AOR) (6401) so as to create one or more non-coincident TSSP/TSCR interfaces (6403, 6413, 6404, 6414) centered about an axis of symmetry. These non-coincident TSSP/TSCR interfaces (6403, 6413, 6404, 6414) may be formed by adjusting the inner/outer side edges of either the TSSP or the TSCR to be misaligned according to the offset axes (6402, 6412) positioned below/above the common axis of rotation (AOR) (6401).

Axis of Symmetry Exemplary

The common axis of symmetry depicted in FIG. 62 (6200)-FIG. 64 (6400) is not strictly necessary to implement the TSSP/TSCR shearing function described herein. In other words, the axis of rotation (AOR) and offset axes depicted need not be vertically aligned. In some circumstances there may be configured different offset axes associated with the left and right sides of the TSSP/TSCR interfaces. These different offset axes may be associated with either the lower or upper offset axes or both of these offset axes.

Exemplary TSSP/TSCR Shearing Edge Below AOR (6500)-(7200)

Figure 65:
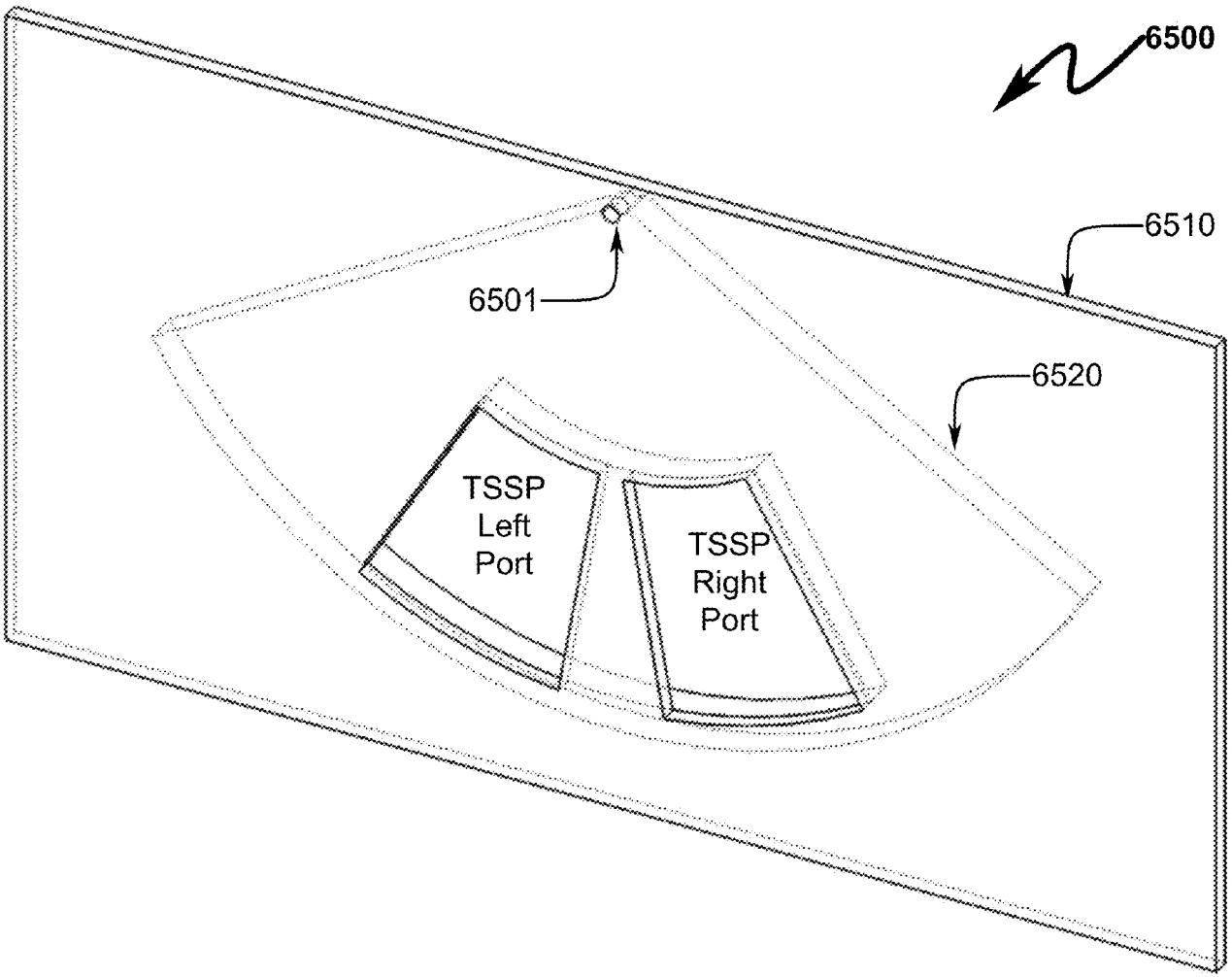
FIG. 65 illustrates a front perspective hidden line view of a TSSP/TSCR configuration incorporating edge shearing with a TSSP shearing offset axis (SOA) below the axis of rotation (AOR)

FIG. 65 (6500)-FIG. 72 (7200) depict an example of a TSSP/TSCR shearing edge embodiment wherein the shearing offset axis (SOA) is below the axis of rotation (AOR). These diagrams omit the material hopper, output material port, and hydraulic pump rams for clarity, and provide detail on the relationship between the radial edges of the TSSP and TSCR.

Note that while the SOA is illustrated in these depictions as being below the AOR for the TSSP, this SOA could also equivalently be implemented below the AOR for the TSCR with the TSSP being configured normally. Thus, the SOA offset may be applied to either the TSSP as shown or the TSCR.

Figure 66:
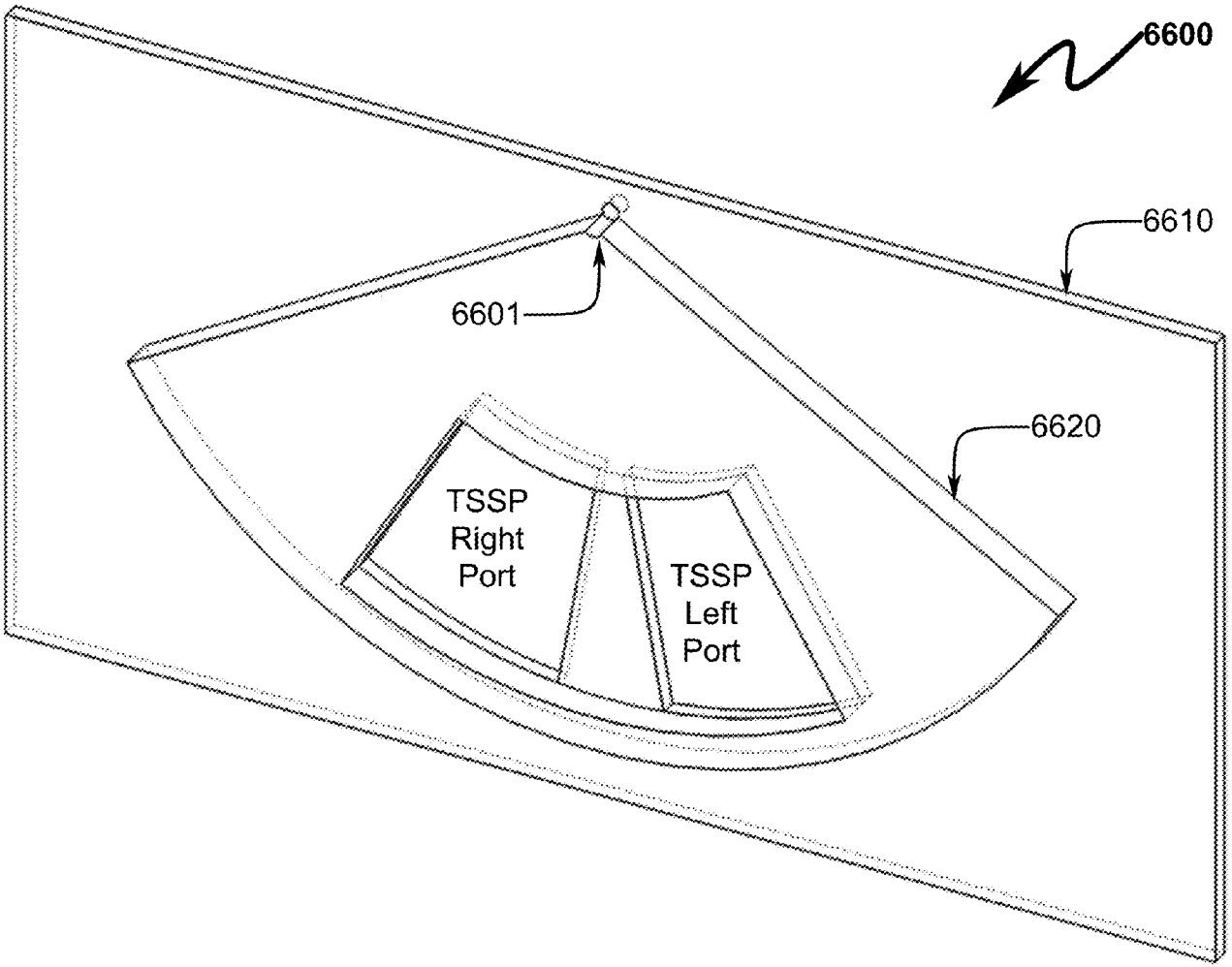
FIG. 66 illustrates a rear perspective hidden line view of a TSSP/TSCR configuration incorporating edge shearing with a TSSP shearing offset axis (SOA) below the axis of rotation (AOR)

As depicted in the front perspective view of FIG. 65 (6500), the TSSP (6510) is illustrated with solid lines and the TSCR (6520) depicted with hidden lines. A corresponding rear perspective view is provided in FIG. 66 (6600) wherein the TSSP (6610) is illustrated with hidden lines and the TSCR (6620) depicted with solid lines. Both of these views depict the TSCR (6510, 6610) fully covering both ports of the TSSP (6520, 6620). The axis of rotation (6501, 6601) is illustrated symbolically in these diagrams and may take a variety of forms as described within this disclosure.

Figure 67:
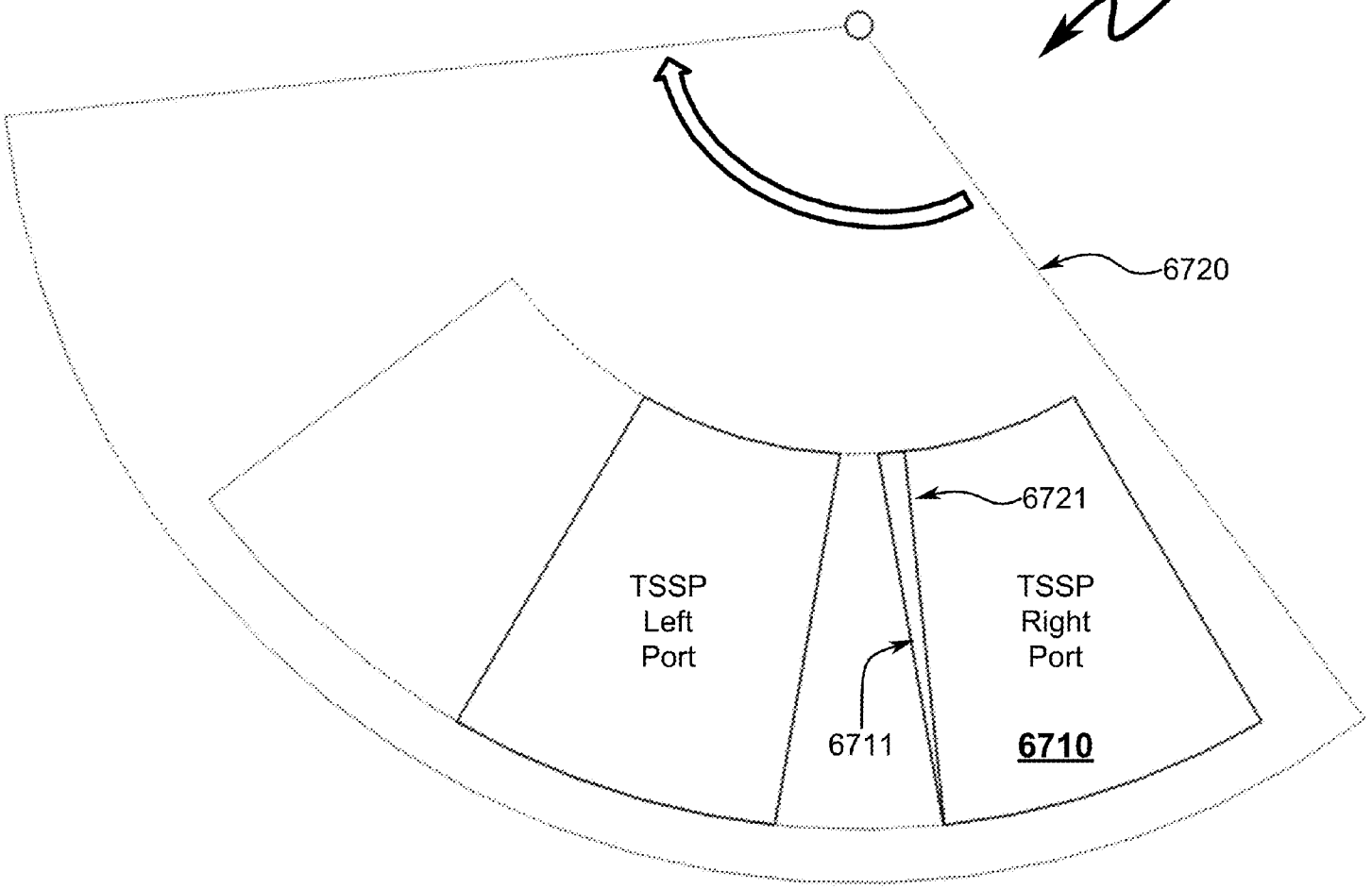
FIG. 67 illustrates a front hidden line view of a TSSP/TSCR configuration incorporating edge shearing with a TSSP shearing offset axis (SOA) below the axis of rotation (AOR) wherein the TSCR is rotating clockwise and the right TSCR edge is beginning to shear.
Figure 68:
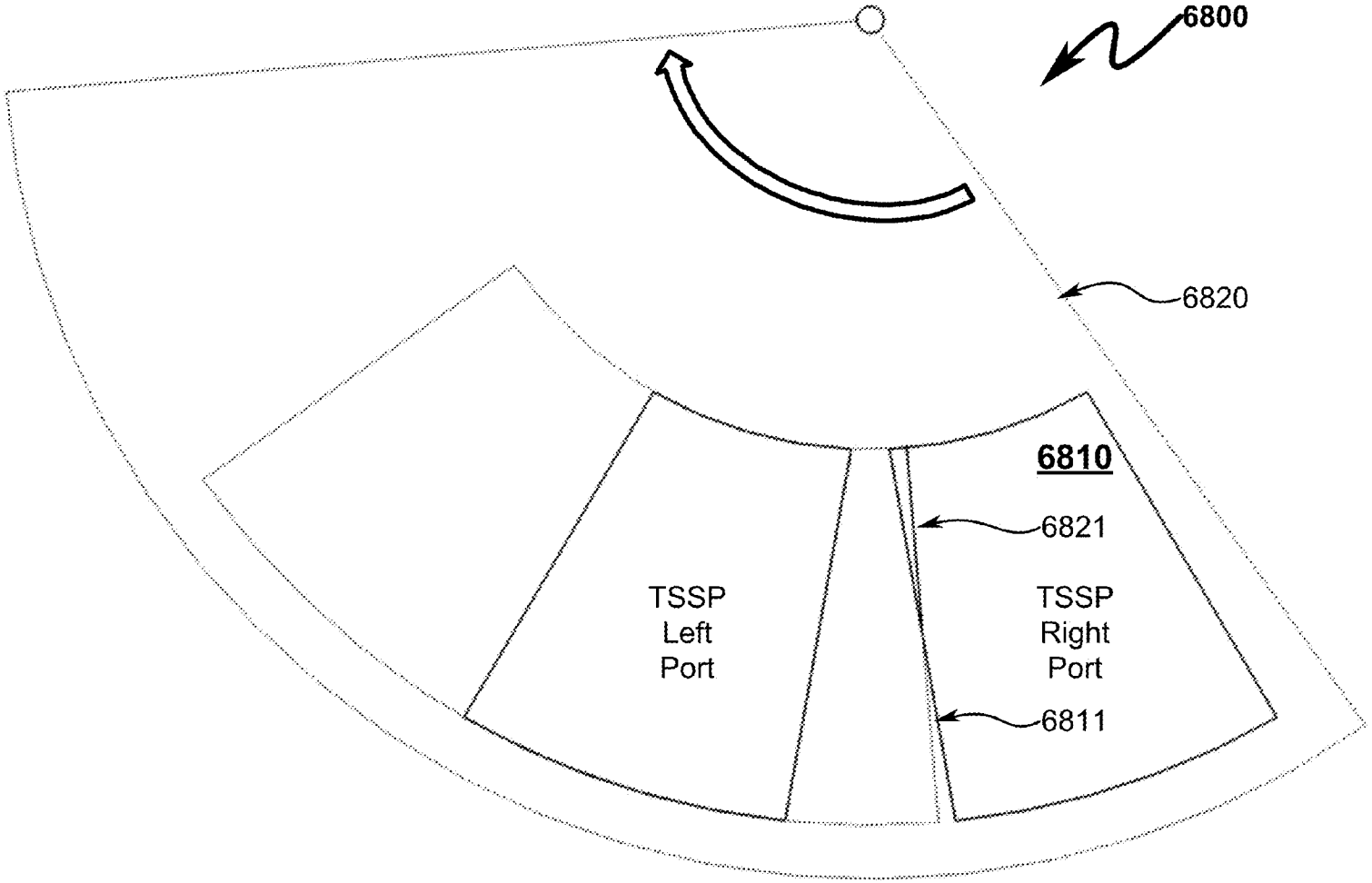
FIG. 68 illustrates a front hidden line view of a TSSP/TSCR configuration incorporating edge shearing with a TSSP shearing offset axis (SOA) below the axis of rotation (AOR) wherein the TSCR is rotating clockwise and the right TSCR edge is midway through the shearing action.
Figure 69:
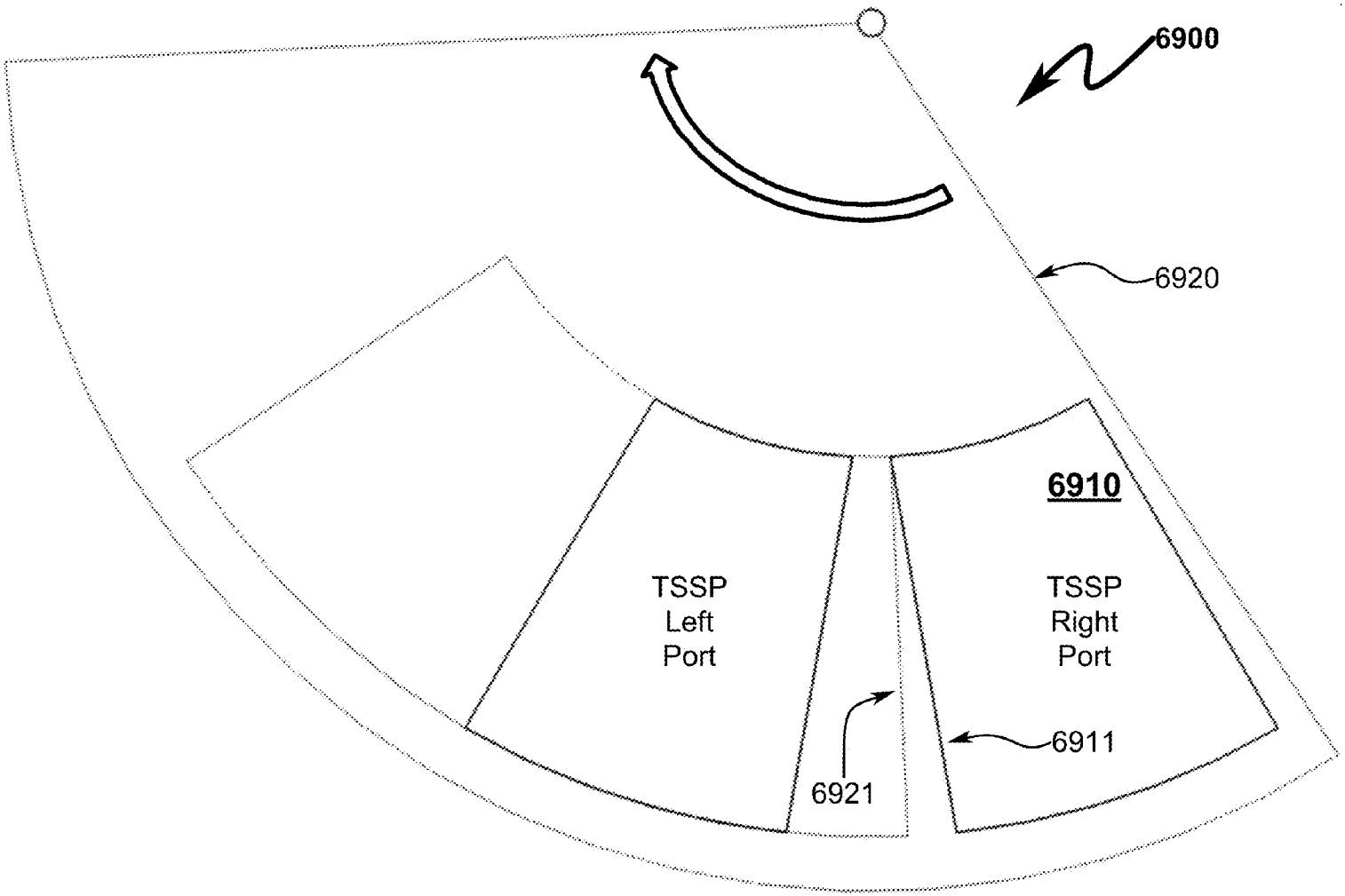
FIG. 69 illustrates a front hidden line view of a TSSP/TSCR configuration incorporating edge shearing with a TSSP shearing offset axis (SOA) below the axis of rotation (AOR) wherein the TSCR is rotating clockwise and the right TSCR edge has completed the shearing action.

The shearing action of this TSSP/TSCR with respect to the right radial edge of the TSCR is further detailed in FIG. 67 (6700)-FIG. 69 (6900). As illustrated in FIG. 67 (6700), the right TSCR radial edge (6721) is not coincident with the left radial edge of the TSSP (6711) as the TSCR (6720) rotates from right to left (clockwise) and begins the shearing action across the right TSSP port (6710). As illustrated in FIG. 68 (6800), as the TSCR (6820) edge (6821) continues to rotate clockwise across the left radial edge of the TSSP (6811), the shearing action continues across the right TSSP port (6810). As illustrated in FIG. 69 (6900), as the TSCR (6920) edge (6921) completes clockwise rotation across the left radial edge of the TSSP (6911), the shearing action is completed and the right port (6910) of the TSSP is completely occluded by the TSCR (6920).

Figure 70:
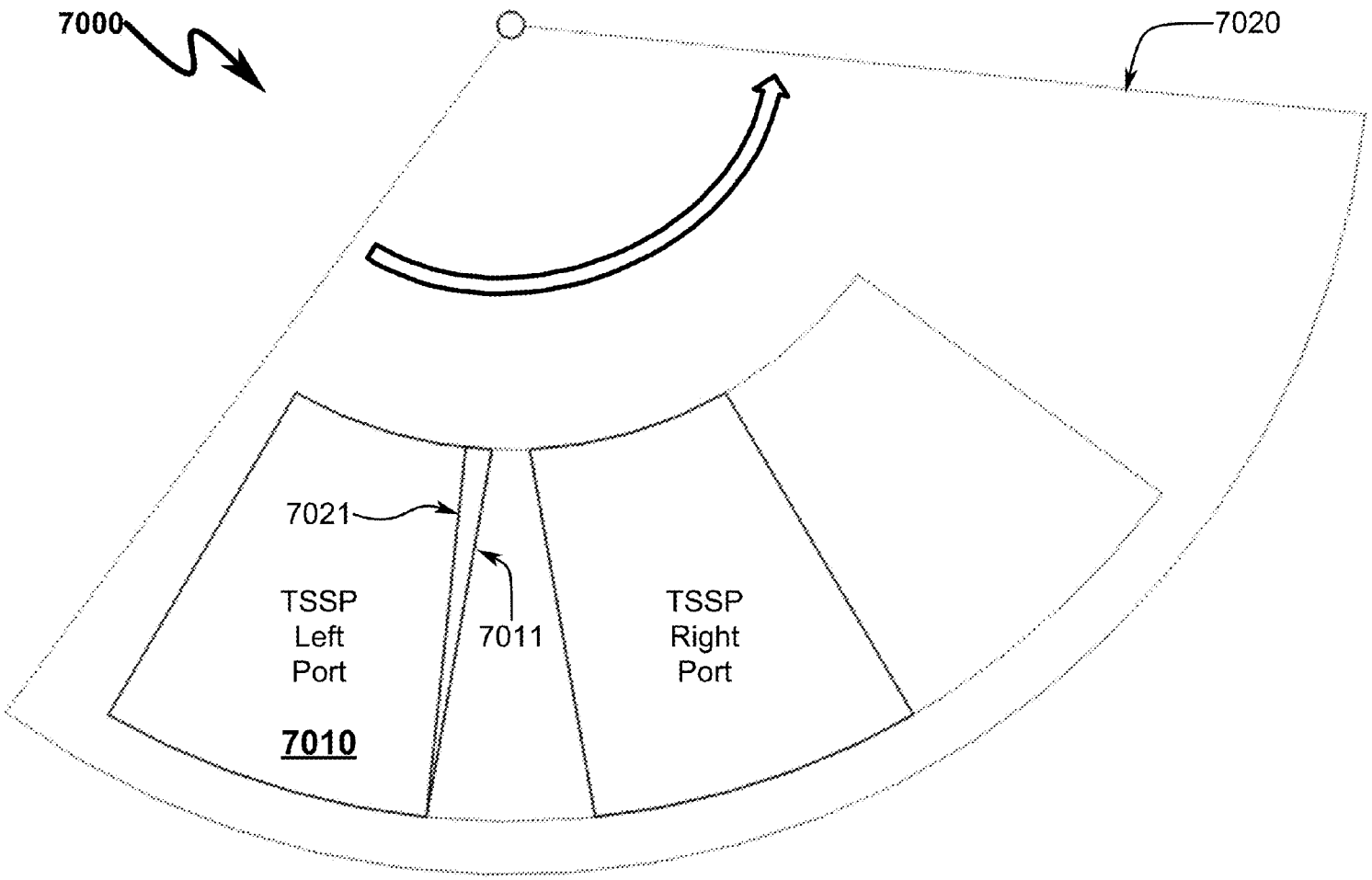
FIG. 70 illustrates a front hidden line view of a TSSP/TSCR configuration incorporating edge shearing with a TSSP shearing offset axis (SOA) below the axis of rotation (AOR) wherein the TSCR is rotating counter-clockwise and the left TSCR edge is beginning to shear.
Figure 71:
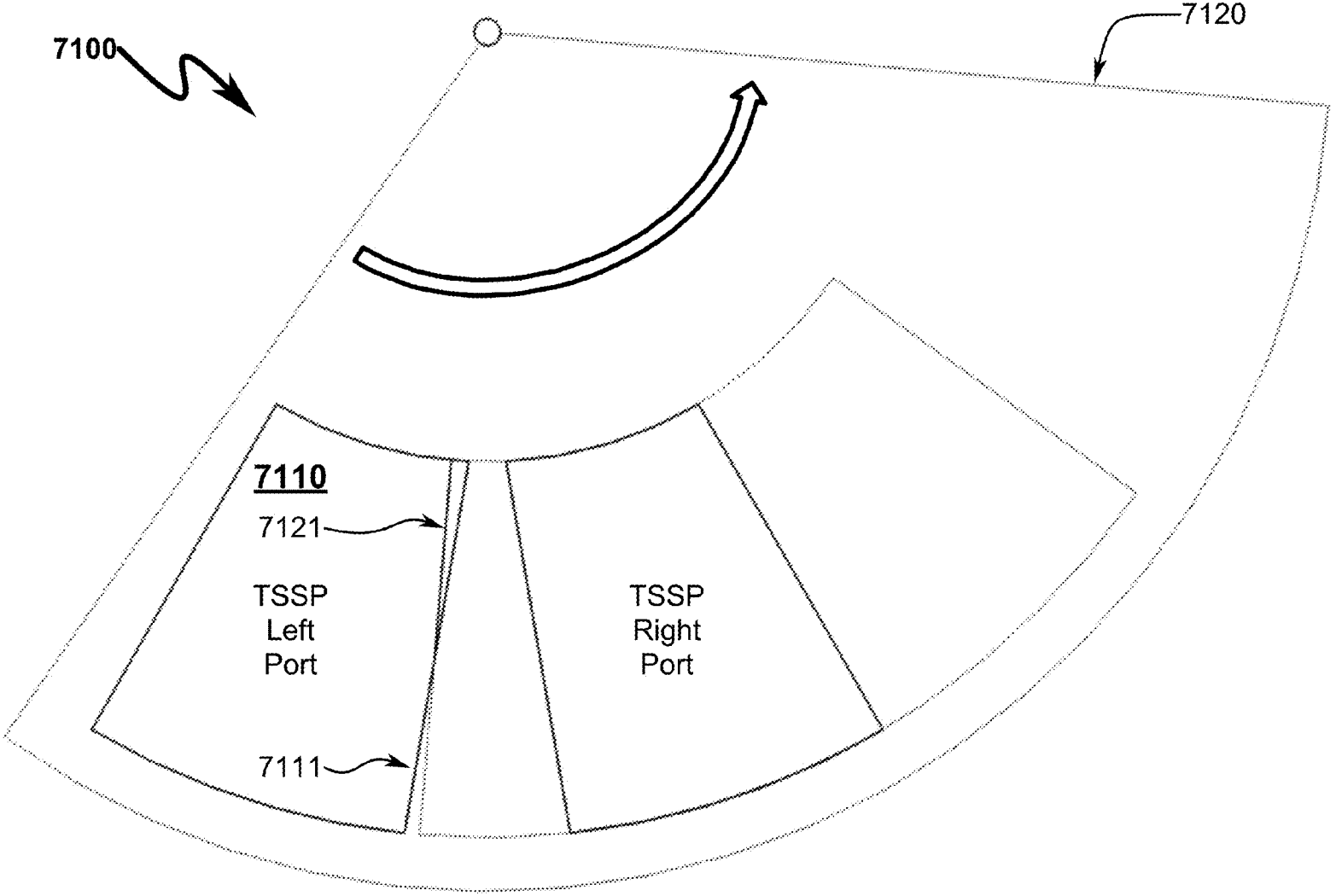
FIG. 71 illustrates a front hidden line view of a TSSP/TSCR configuration incorporating edge shearing with a TSSP shearing offset axis (SOA) below the axis of rotation (AOR) wherein the TSCR is rotating counter-clockwise and the left TSCR edge is midway through the shearing action.
Figure 72:
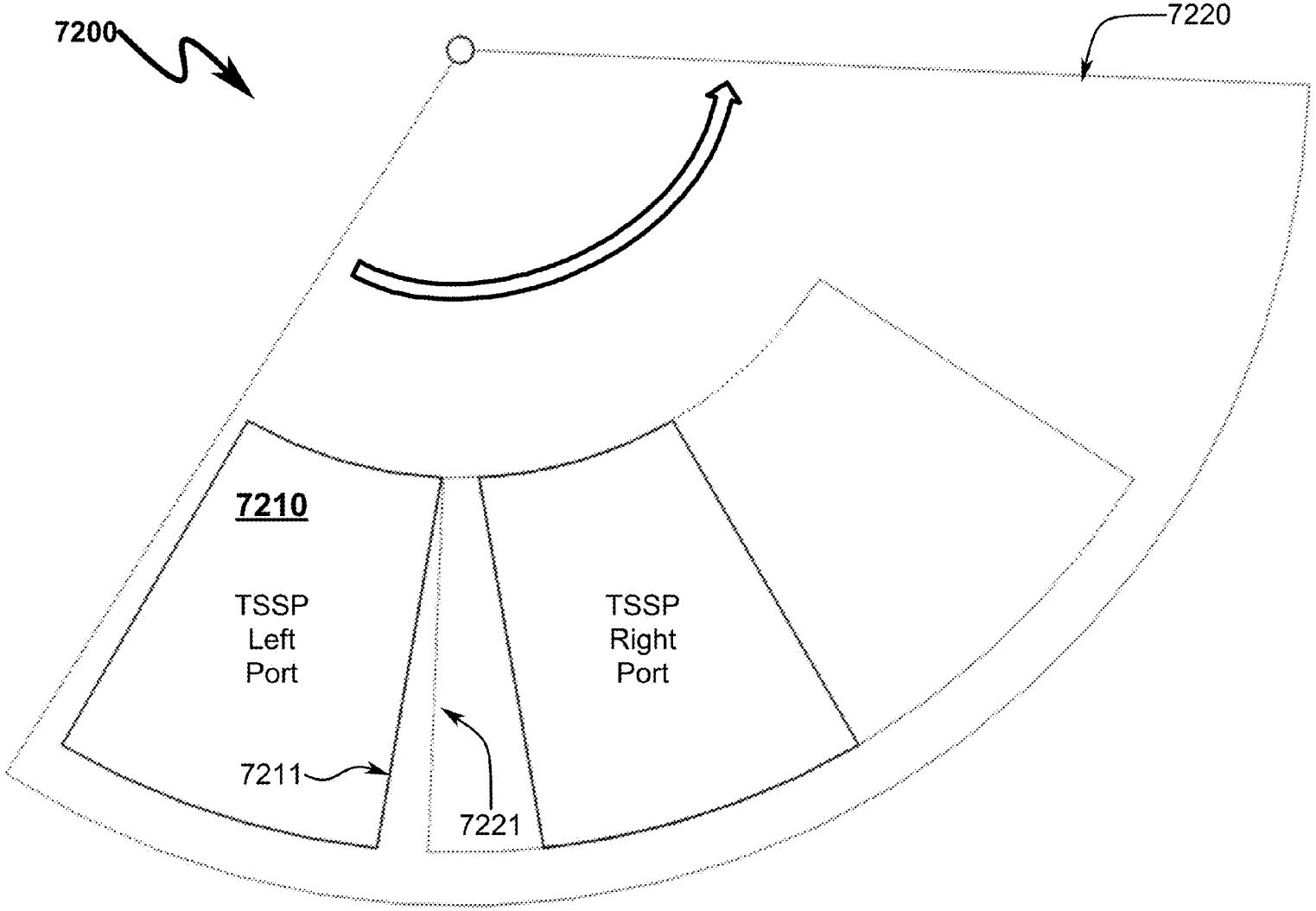
FIG. 72 illustrates a front hidden line view of a TSSP/TSCR configuration incorporating edge shearing with a TSSP shearing offset axis (SOA) below the axis of rotation (AOR) wherein the TSCR is rotating counter-clockwise and the left TSCR edge has completed the shearing action.

The shearing action of this TSSP/TSCR with respect to the left radial edge of the TSCR is further detailed in FIG. 70 (7000)-FIG. 72 (7200). As illustrated in FIG. 70 (7000), the left TSCR radial edge (7021) is not coincident with the left radial edge of the TSSP (7011) as the TSCR (7020) rotates from left to right (counter-clockwise) and begins the shearing action across the right TSSP port (7010). As illustrated in FIG. 71 (7100), as the TSCR (7120) edge (7121) continues to rotate counter-clockwise across the right radial edge of the TSSP (7111), the shearing action continues across the left TSSP port (7110). As illustrated in FIG. 72 (7200), as the TSCR (7220) edge (7221) completes counter-clockwise rotation across the left radial edge of the TSSP (7211), the shearing action is completed and the left port (7210) of the TSSP is completely occluded by the TSCR (7220).

Exemplary TSSP/TSCR Sharing Edge Above AOR (7300)-(8000)

Figure 73:
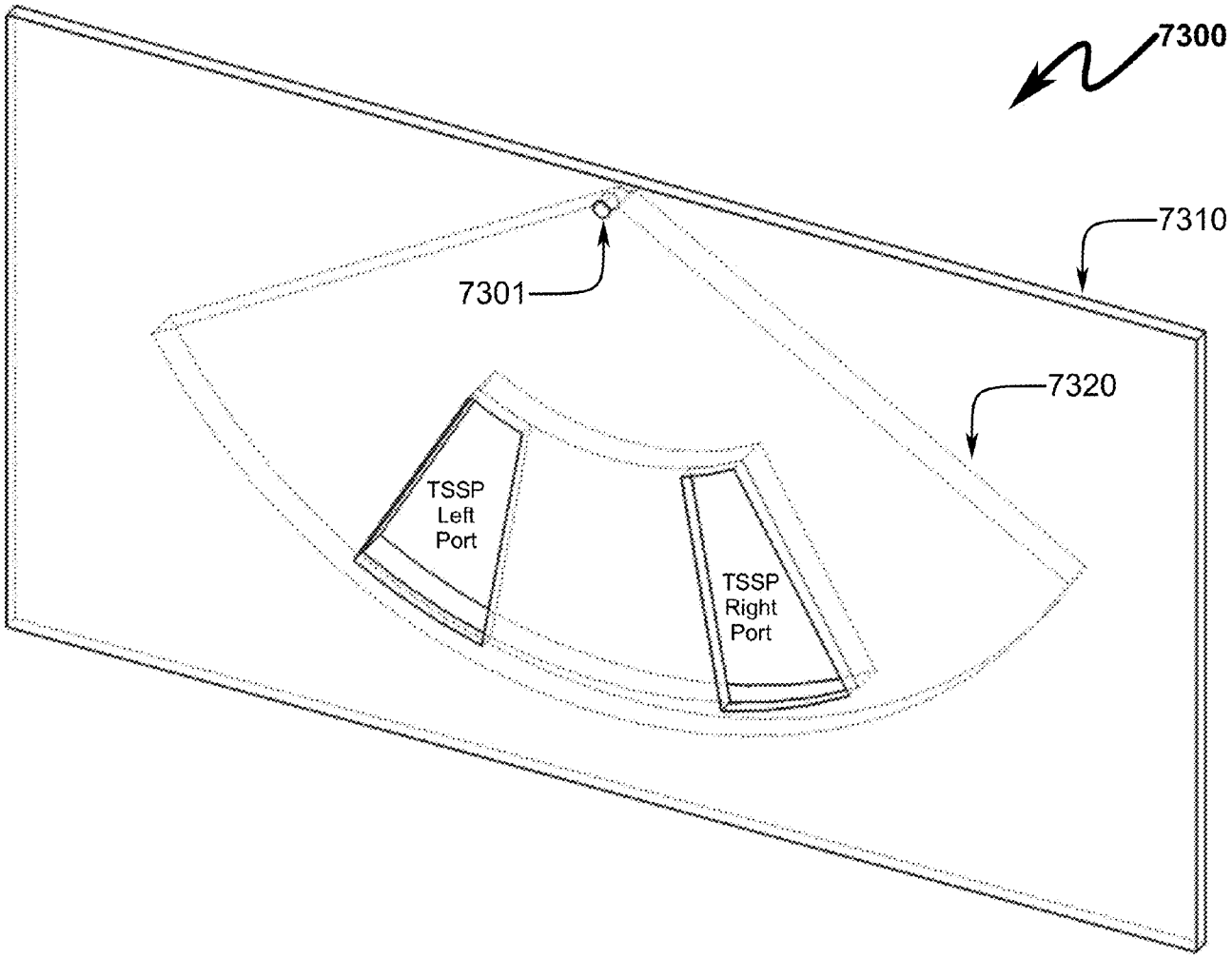
FIG. 73 illustrates a front perspective hidden line view of a TSSP/TSCR configuration incorporating edge shearing with a TSSP shearing offset axis (SOA) above the axis of rotation (AOR)
Figure 80:
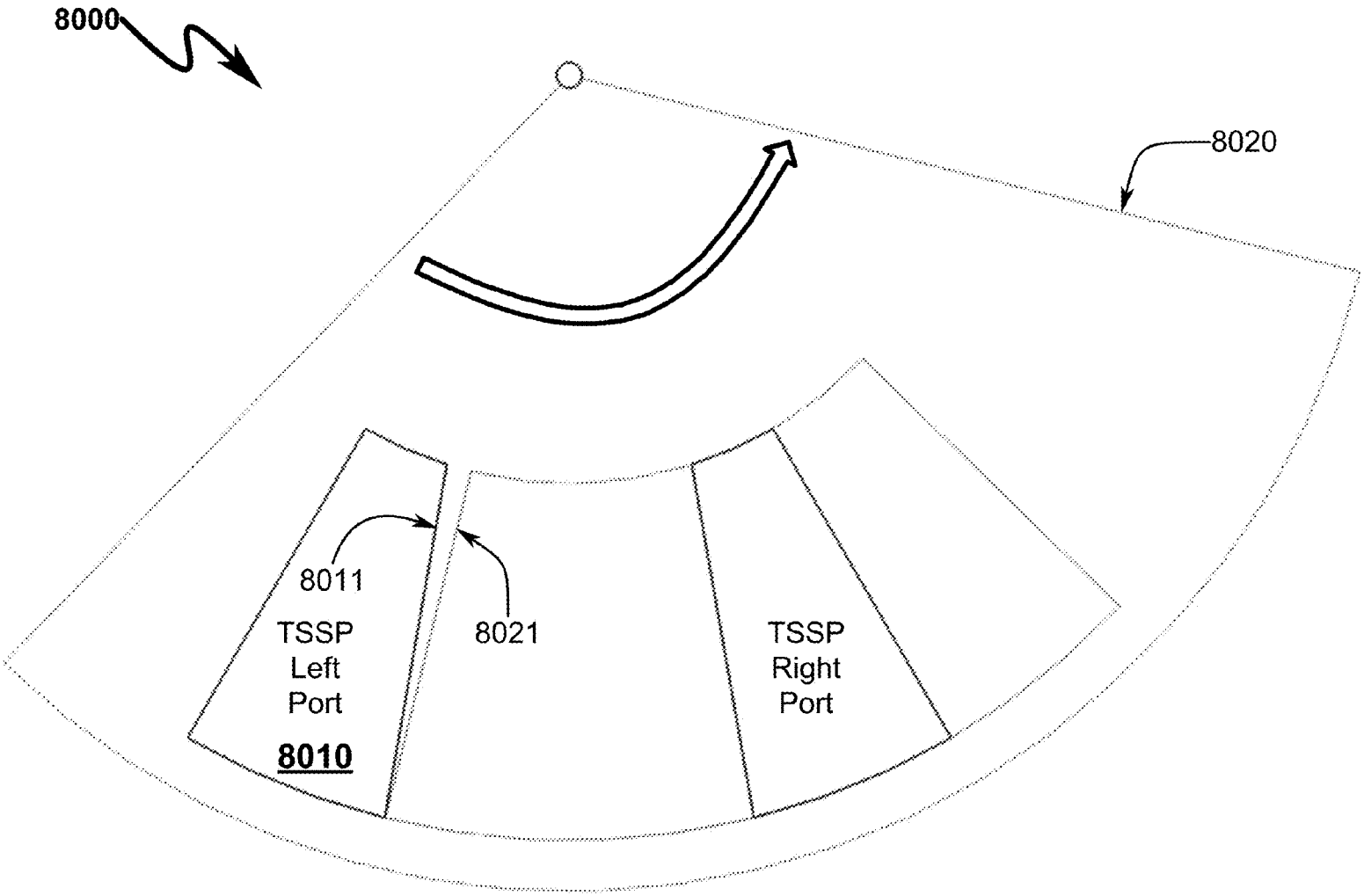
FIG. 80 illustrates a front hidden line view of a TSSP/TSCR configuration incorporating edge shearing with a TSSP shearing offset axis (SOA) above the axis of rotation (AOR) wherein the TSCR is rotating counter-clockwise and the left TSCR edge has completed the shearing action.

FIG. 73 (7300)-FIG. 80 (8000) depict an example of a TSSP/TSCR shearing edge embodiment wherein the shearing offset axis (SOA) is above the axis of rotation (AOR). These diagrams omit the material hopper, output material port, and hydraulic pump rams for clarity, and provide detail on the relationship between the radial edges of the TSSP and TSCR.

Note that while the SOA is illustrated in these depictions as being above the AOR for the TSSP, this SOA could also equivalently be implemented below the AOR for the TSCR with the TSSP being configured normally. Thus, the SOA offset may be applied to either the TSSP as shown or the TSCR.

Figure 74:
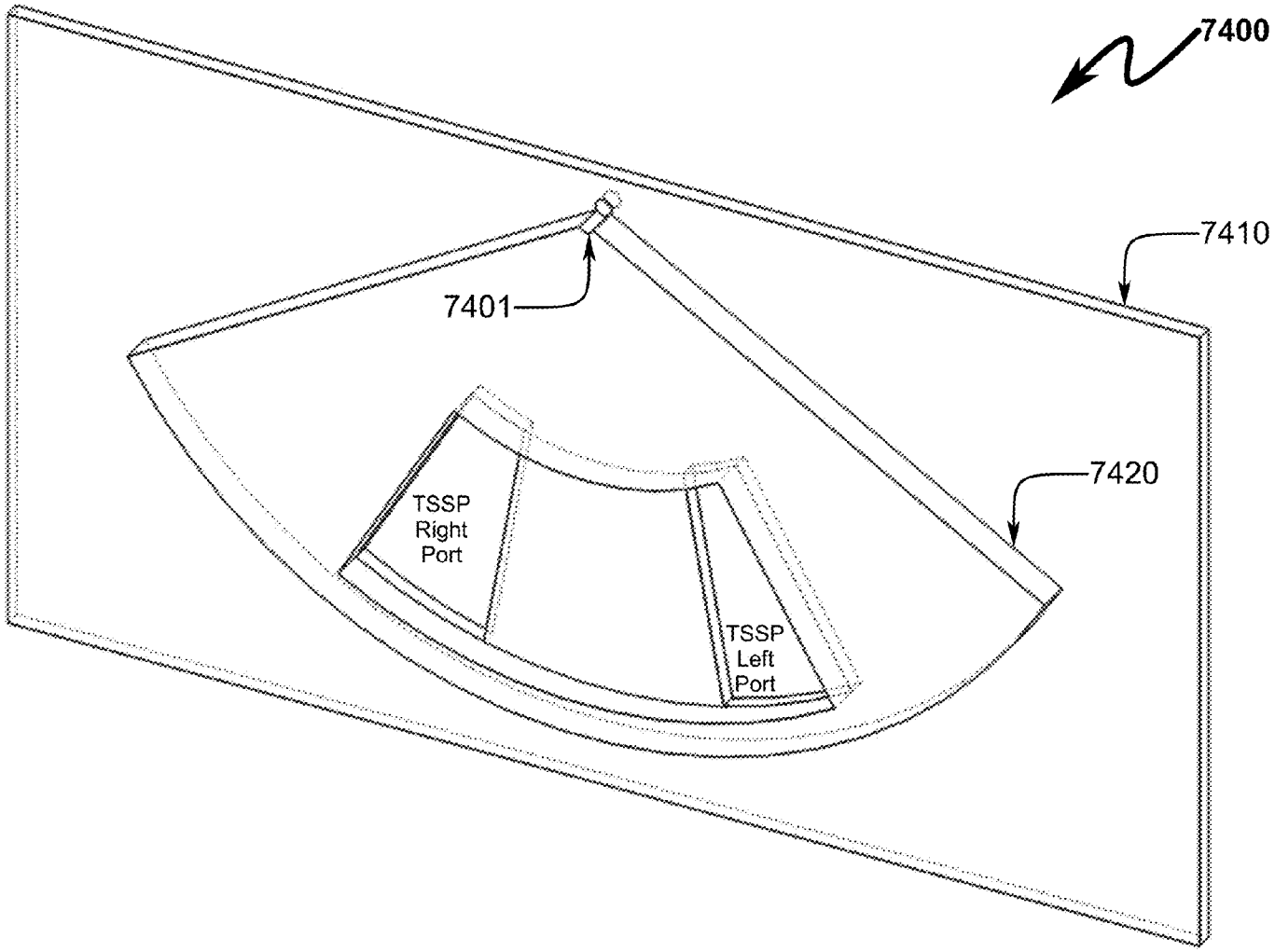
FIG. 74 illustrates a rear perspective hidden line view of a TSSP/TSCR configuration incorporating edge shearing with a TSSP shearing offset axis (SOA) above the axis of rotation (AOR)

As depicted in the front perspective view of FIG. 73 (7300), the TSSP (7310) is illustrated with solid lines and the TSCR (7320) is depicted with hidden lines. A corresponding rear perspective view is provided in FIG. 74 (7400) wherein the TSSP (7410) is illustrated with hidden lines and the TSCR (7420) is depicted with solid lines. Both of these views depict the TSCR (7310, 7410) fully covering both ports of the TSSP (7320, 7420). The axis of rotation (7301, 7401) is illustrated symbolically in these diagrams and may take a variety of forms as described within this disclosure.

Figure 75:
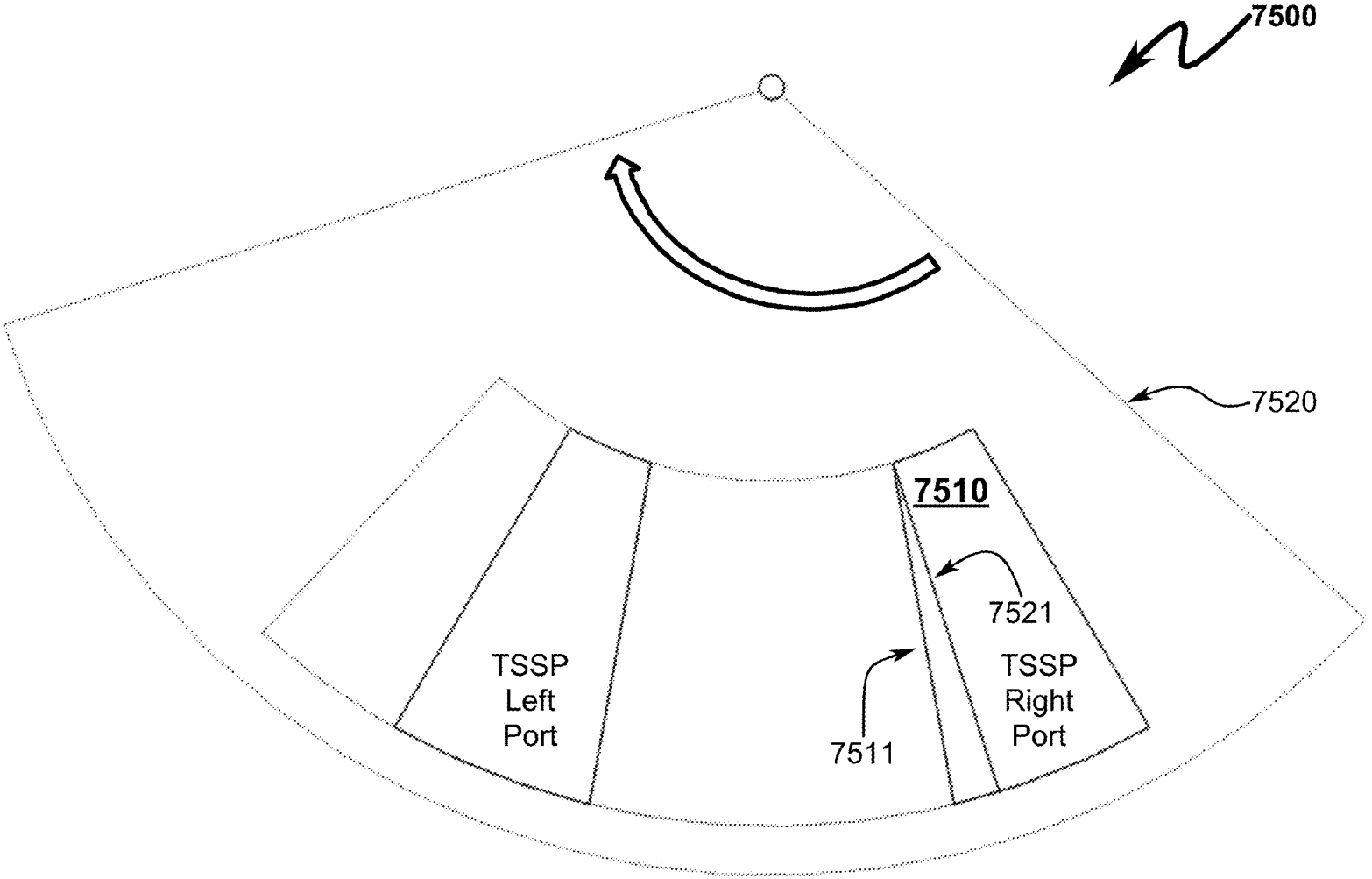
FIG. 75 illustrates a front hidden line view of a TSSP/TSCR configuration incorporating edge shearing with a TSSP shearing offset axis (SOA) above the axis of rotation (AOR) wherein the TSCR is rotating clockwise and the right TSCR edge is beginning to shear.
Figure 76:
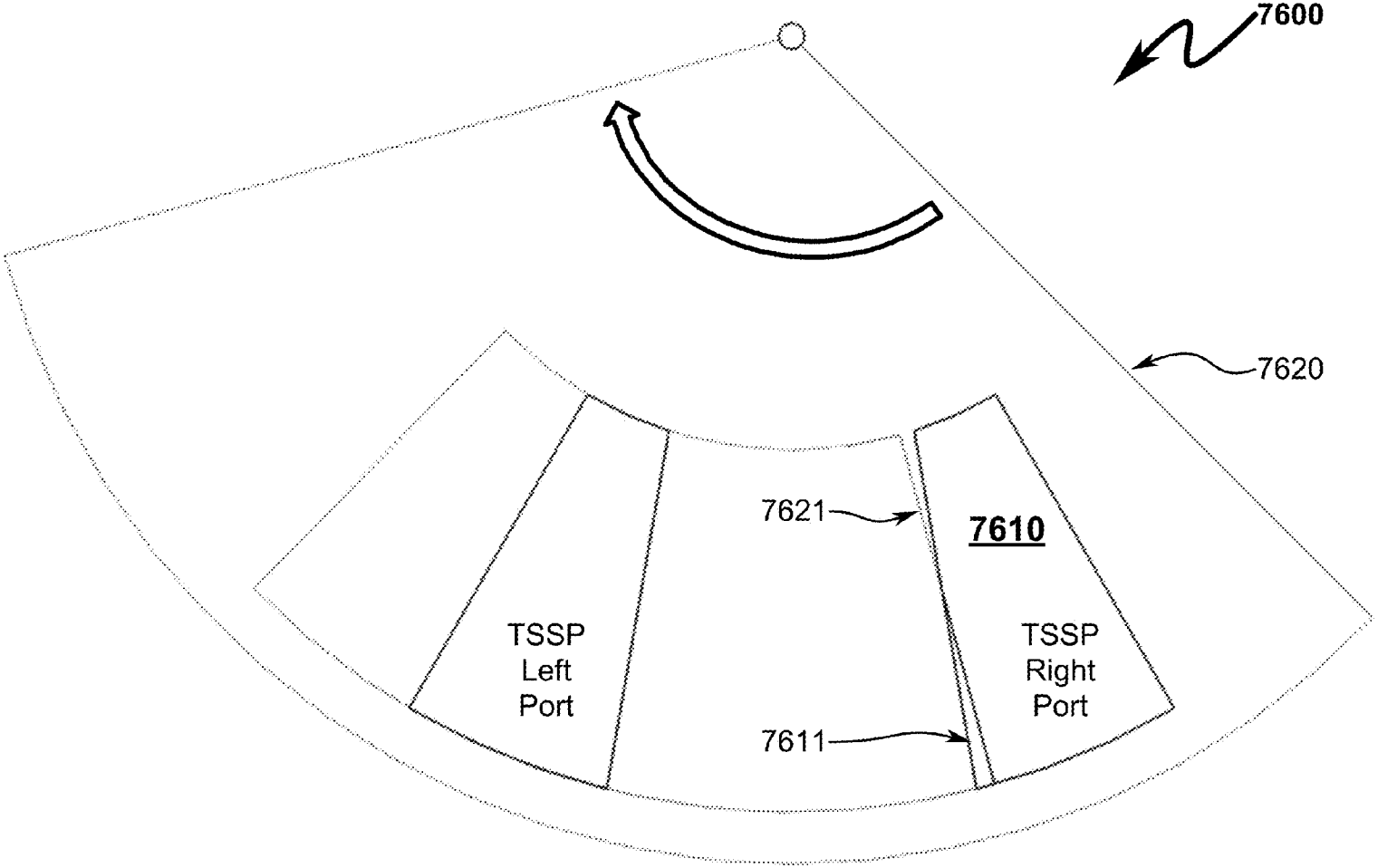
FIG. 76 illustrates a front hidden line view of a TSSP/TSCR configuration incorporating edge shearing with a TSSP shearing offset axis (SOA) above the axis of rotation (AOR) wherein the TSCR is rotating clockwise and the right TSCR edge is midway through the shearing action.
Figure 77:
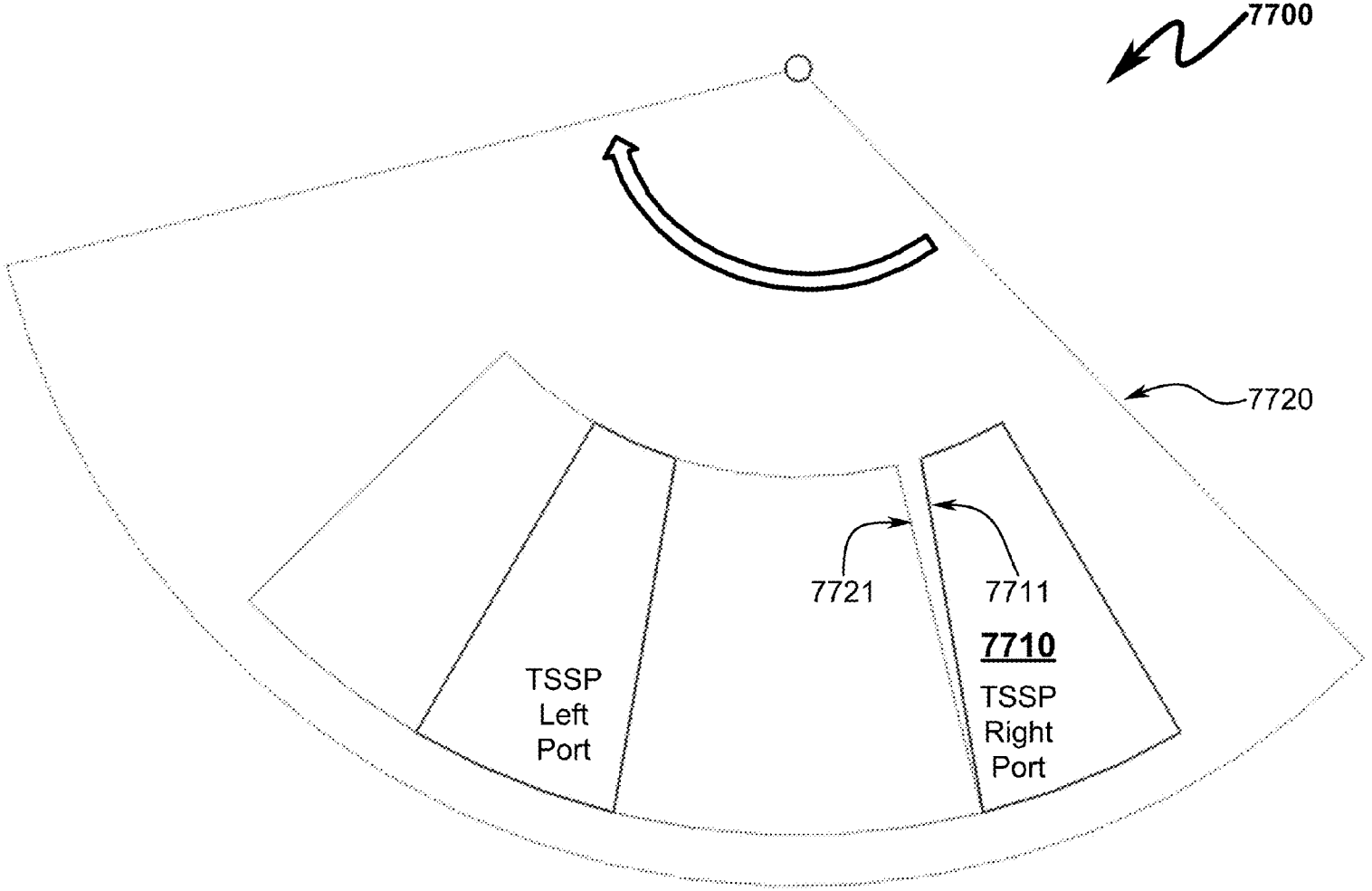
FIG. 77 illustrates a front hidden line view of a TSSP/TSCR configuration incorporating edge shearing with a TSSP shearing offset axis (SOA) above the axis of rotation (AOR) wherein the TSCR is rotating clockwise and the right TSCR edge has completed the shearing action.

The shearing action of this TSSP/TSCR with respect to the right radial edge of the TSCR is further detailed in FIG. 75 (7500)-FIG. 77 (7700). As illustrated in FIG. 75 (7500), the right TSCR radial edge (7521) is not coincident with the left radial edge of the TSSP (7511) as the TSCR (7520) rotates from right to left (clockwise) and begins the shearing action across the right TSSP port (7510). As illustrated in FIG. 76 (7600), as the TSCR (7620) edge (7621) continues to rotate clockwise across the left radial edge of the TSSP (7611), the shearing action continues across the right TSSP port (7610). As illustrated in FIG. 77 (7700), as the TSCR (7720) edge (7721) completes clockwise rotation across the left radial edge of the TSSP (7711), the shearing action is completed and the right port (7710) of the TSSP is completely occluded by the TSCR (7720).

Figure 78:
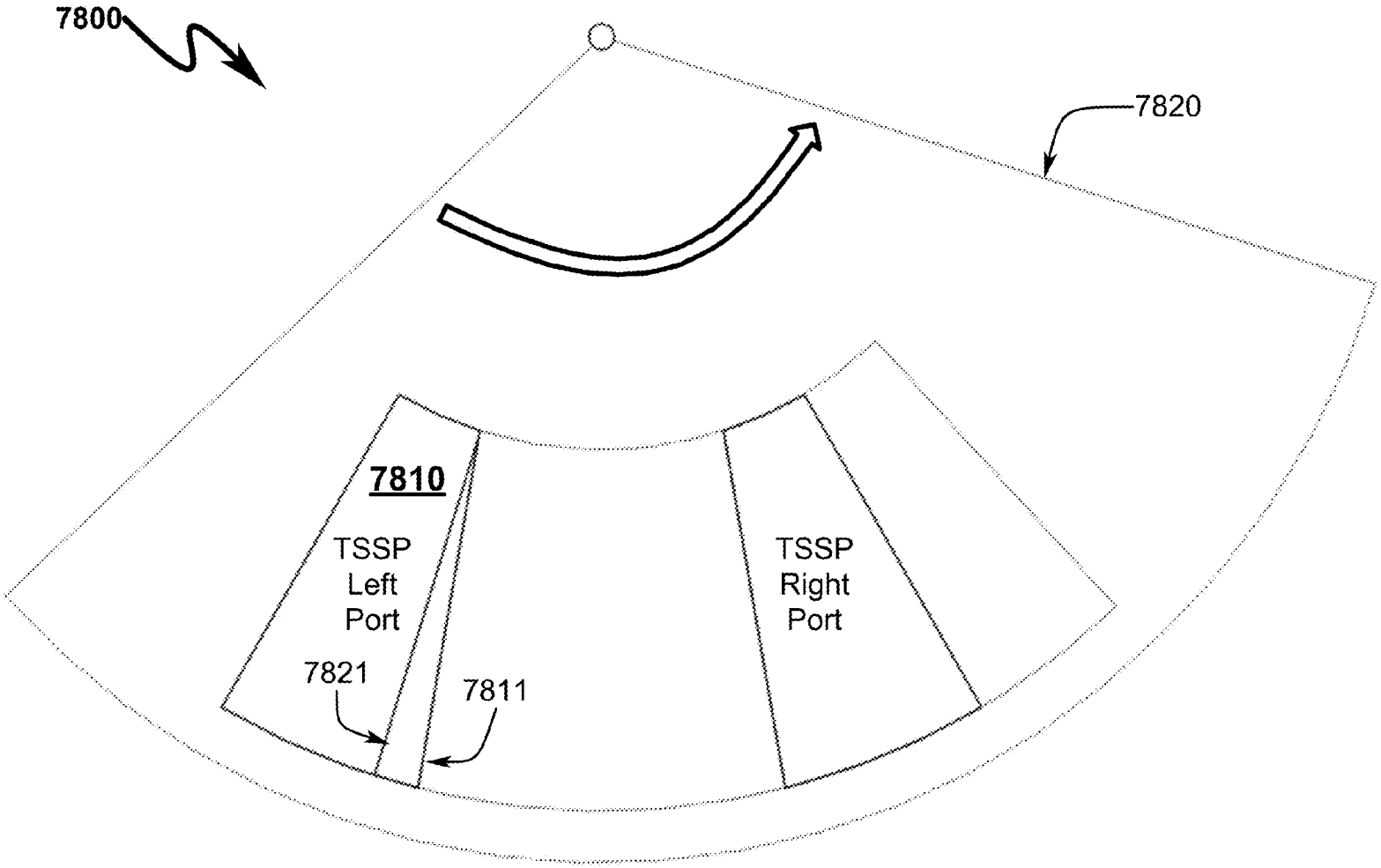
FIG. 78 illustrates a front hidden line view of a TSSP/TSCR configuration incorporating edge shearing with a TSSP shearing offset axis (SOA) above the axis of rotation (AOR) wherein the TSCR is rotating counter-clockwise and the left TSCR edge is beginning to shear.
Figure 79:
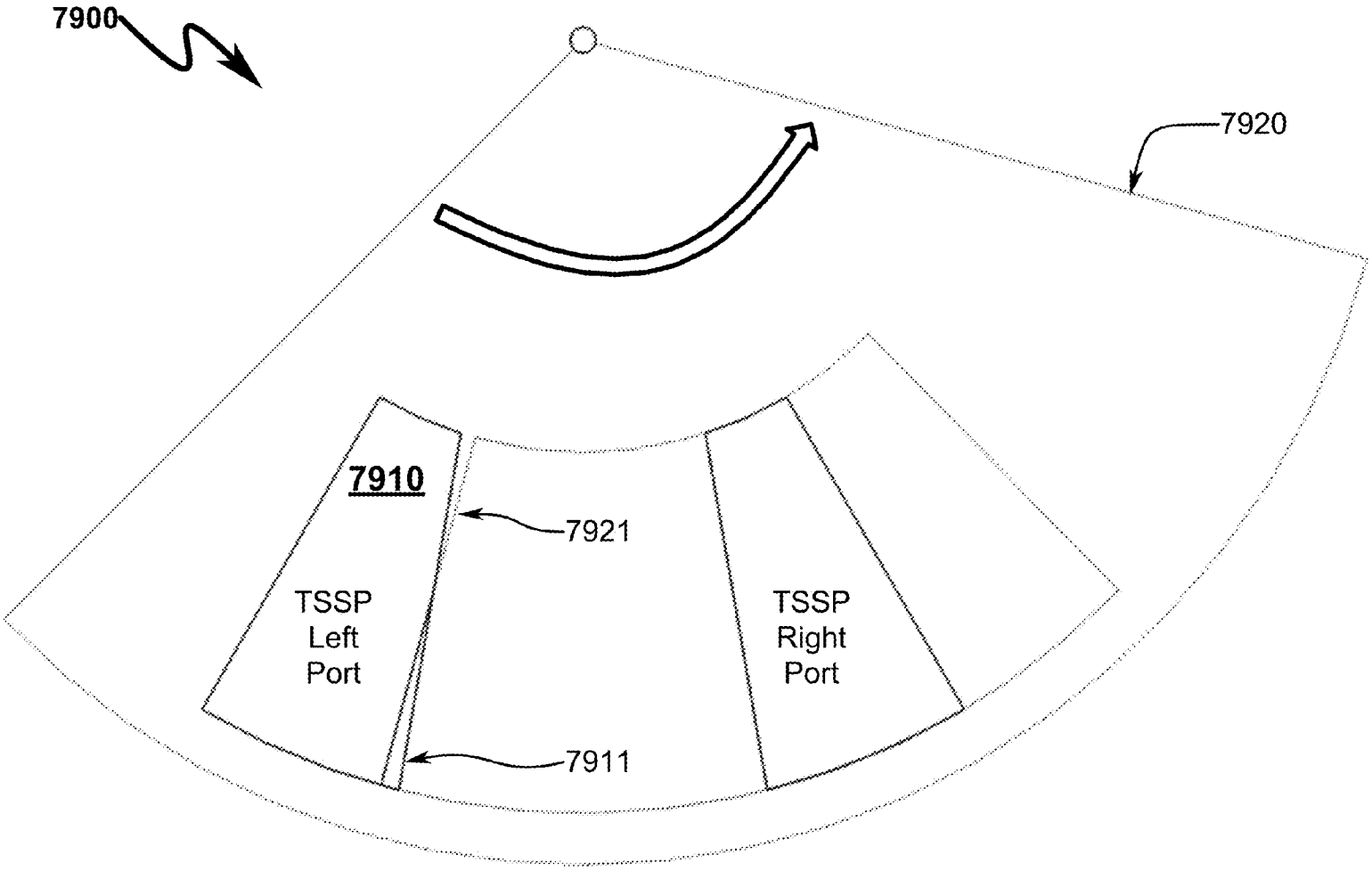
FIG. 79 illustrates a front hidden line view of a TSSP/TSCR configuration incorporating edge shearing with a TSSP shearing offset axis (SOA) above the axis of rotation (AOR) wherein the TSCR is rotating counter-clockwise and the left TSCR edge is midway through the shearing action.

The shearing action of this TSSP/TSCR with respect to the left radial edge of the TSCR is further detailed in FIG. 78 (7800)-FIG. 80 (8000). As illustrated in FIG. 78 (7800), the left TSCR radial edge (7821) is not coincident with the left radial edge of the TSSP (7811) as the TSCR (7820) rotates from left to right (counter-clockwise) and begins the shearing action across the right TSSP port (7810). As illustrated in FIG. 79 (7900), as the TSCR (7920) edge (7921) continues to rotate counter-clockwise across the right radial edge of the TSSP (7911), the shearing action continues across the left TSSP port (7910). As illustrated in FIG. 80 (8000), as the TSCR (8020) edge (8021) completes counter-clockwise rotation across the left radial edge of the TSSP (8011), the shearing action is completed and the left port (8010) of the TSSP is completely occluded by the TSCR (8020).

TSSP/TSCR Shearing Edge Above/Below AOR (8100)-(8800)

Figure 81:
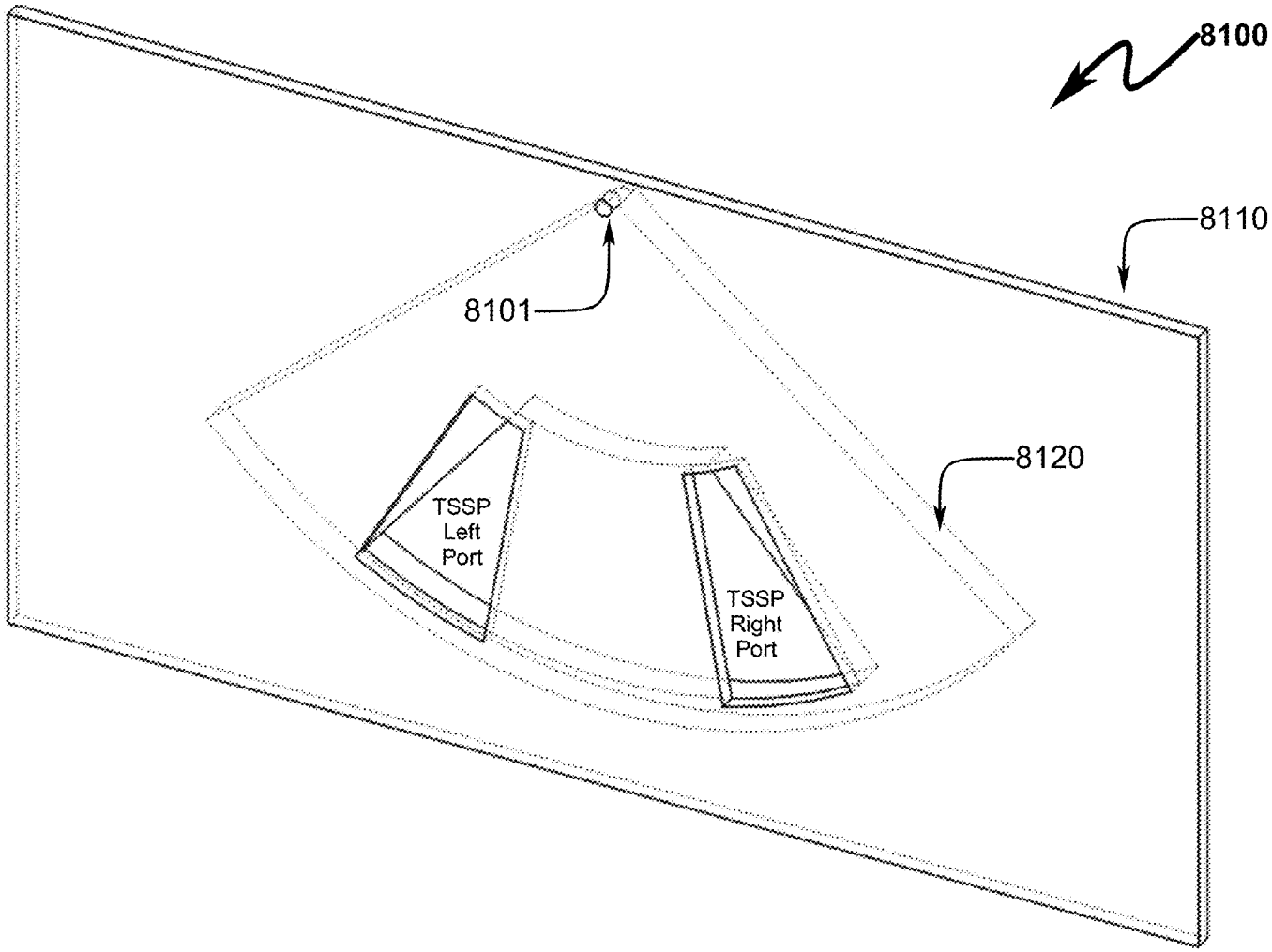
FIG. 81 illustrates a front perspective hidden line view of a TSSP/TSCR configuration incorporating edge shearing with a TSSP shearing offset axis (SOA) above the axis of rotation (AOR) and a TSCR shearing offset axis (SOA) below the axis of rotation (AOR)

FIG. 81 (8100)-FIG. 88 (8800) depict an example of a TSSP/TSCR shearing edge embodiment wherein the shearing offset axis (SOA) is above the axis of rotation (AOR) for the TSSP and below the AOR for the TSCR. This configuration illustrates one potential hybrid combination of the shearing options depicted in FIG. 65 (6500)-FIG. 72 (7200) and FIG. 73 (7300)-FIG. 80 (8000). These diagrams omit the material hopper, output material port, and hydraulic pump rams for clarity and provide detail on the relationship between the radial edges of the TSSP and TSCR.

Note that while the SOA is illustrated in these depictions as being above the AOR for the TSSP and below the AOR for the TSCR, this configuration could equivalently be reversed. Thus, the SOA offset might be below the AOR for the TSSP and above the AOR for the TSCR. In either of these configurations, the side edges of the trapezoid provide a shearing action which aids in the overall operation of the concrete pump.

Figure 82:
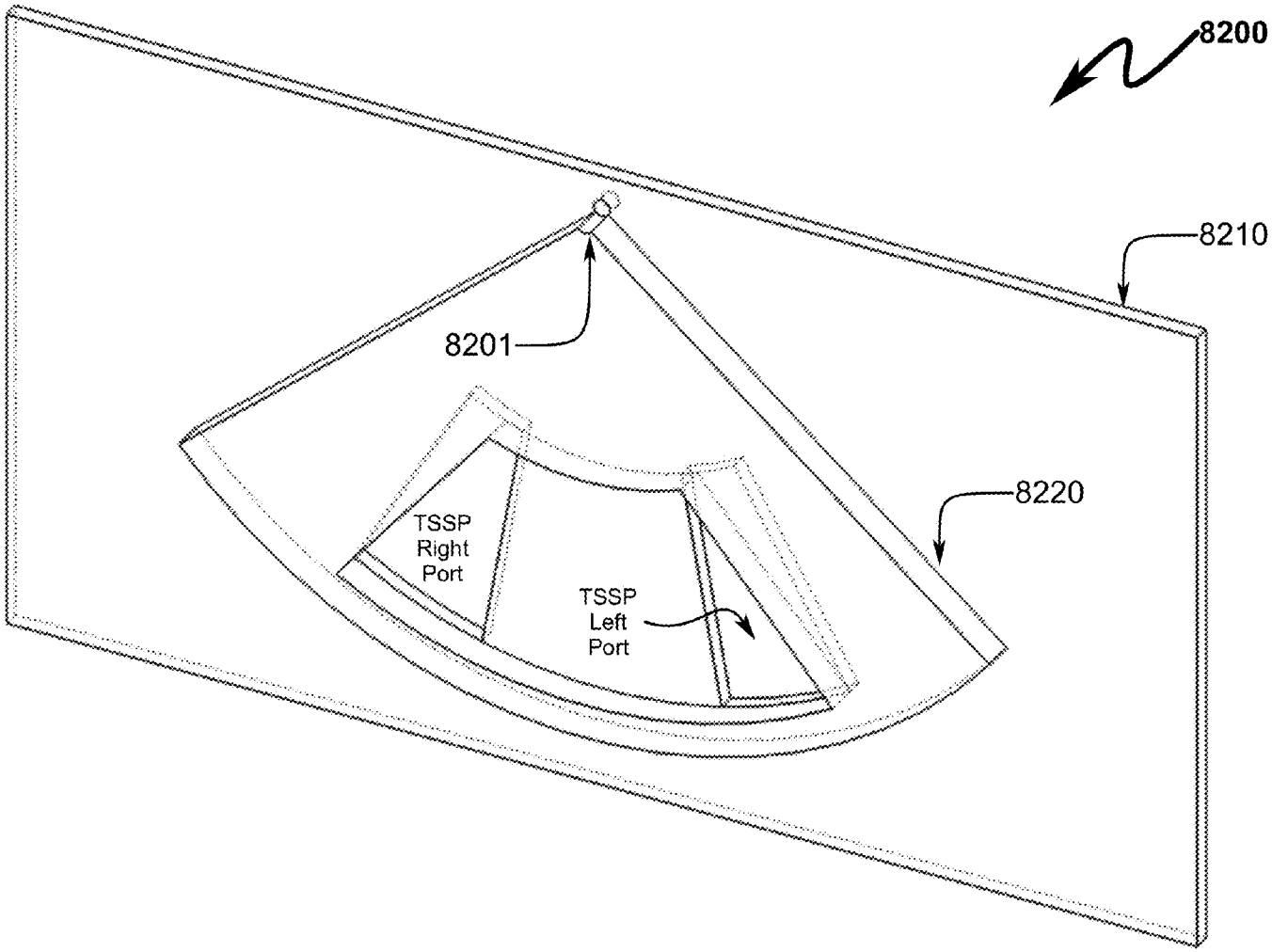
FIG. 82 illustrates a rear perspective hidden line view of a TSSP/TSCR configuration incorporating edge shearing with a TSSP shearing offset axis (SOA) above the axis of rotation (AOR) and a TSCR shearing offset axis (SOA) below the axis of rotation (AOR)

As depicted in the front perspective view of FIG. 81 (8100), the TSSP (8110) is illustrated with solid lines and the TSCR (8120) is depicted with hidden lines. A corresponding rear perspective view is provided in FIG. 82 (8200) wherein the TSSP (8210) is illustrated with hidden lines and the TSCR (8220) is depicted with solid lines. Both of these views depict the TSCR (8110, 8210) covering both ports of the TSSP (8120, 8220). The axis of rotation (8101, 8201) is illustrated symbolically in these diagrams and may take a variety of forms as described within this disclosure.

Figure 83:
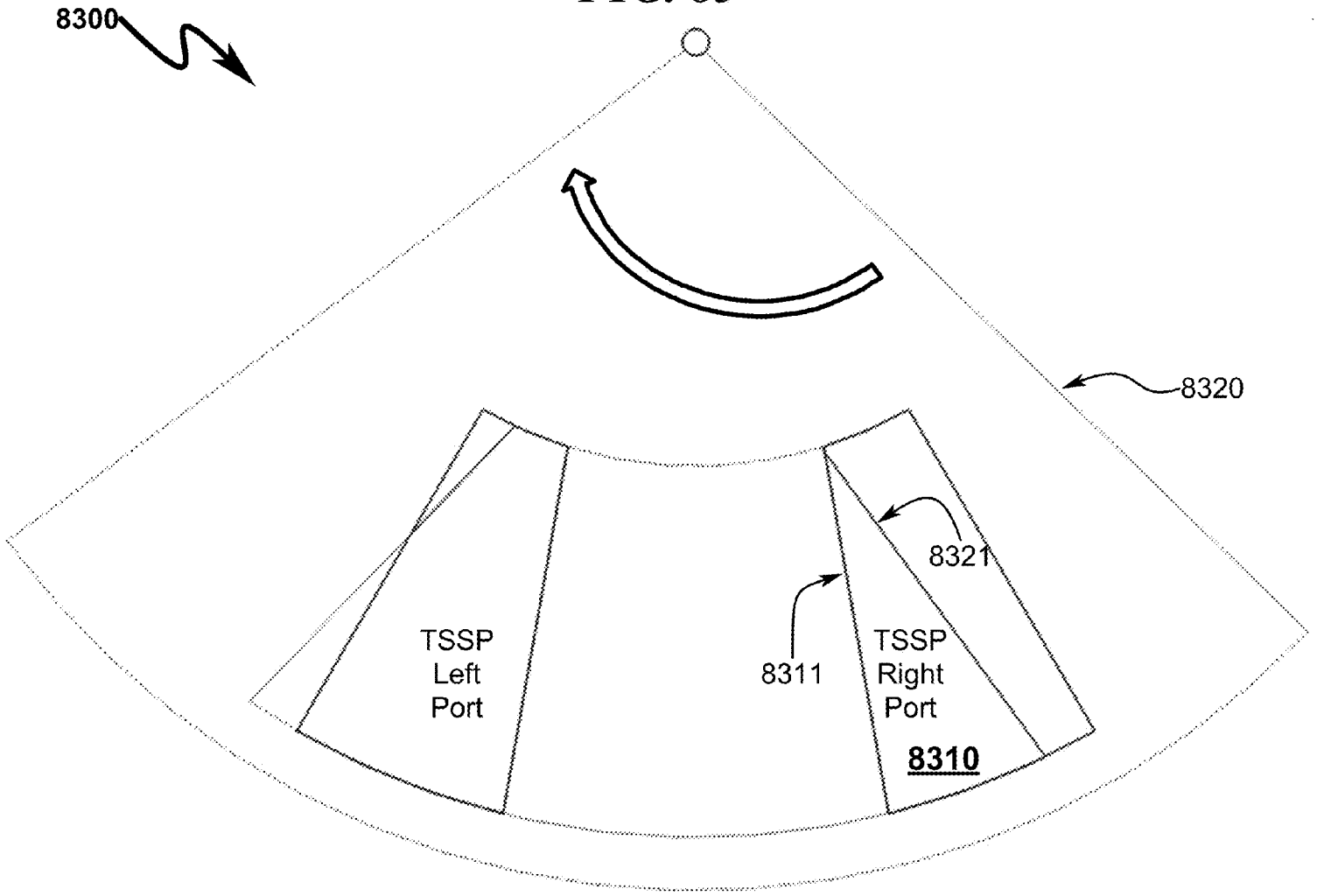
FIG. 83 illustrates a front hidden line view of a TSSP/TSCR configuration incorporating edge shearing with a TSSP shearing offset axis (SOA) above the axis of rotation (AOR) and a TSCR shearing offset axis (SOA) below the axis of rotation (AOR) wherein the TSCR is rotating clockwise and the right TSCR edge is beginning to shear.
Figure 84:
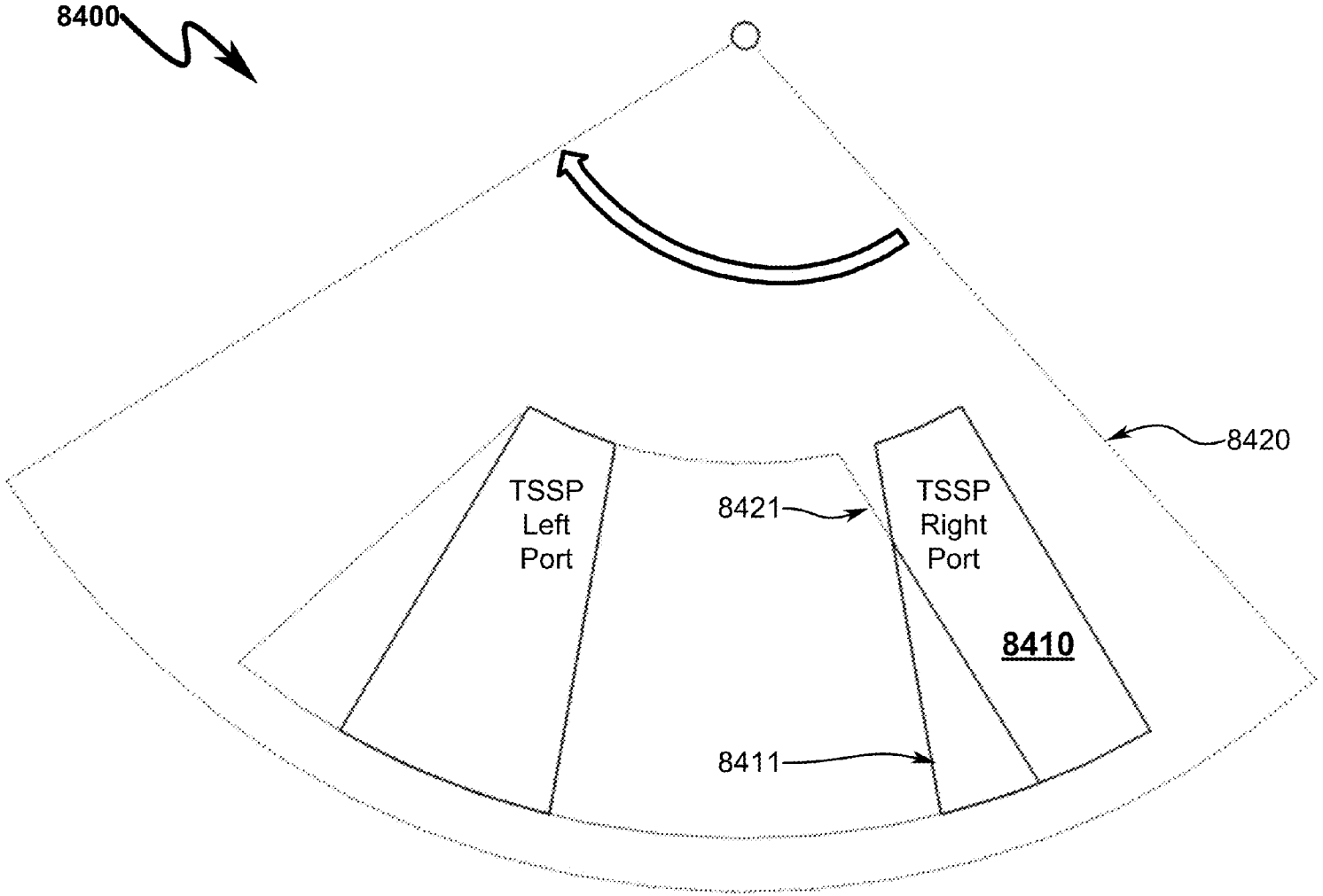
FIG. 84 illustrates a front hidden line view of a TSSP/TSCR configuration incorporating edge shearing with a TSSP shearing offset axis (SOA) above the axis of rotation (AOR) and a TSCR shearing offset axis (SOA) below the axis of rotation (AOR) wherein the TSCR is rotating clockwise and the right TSCR edge is midway through the shearing action.
Figure 85:
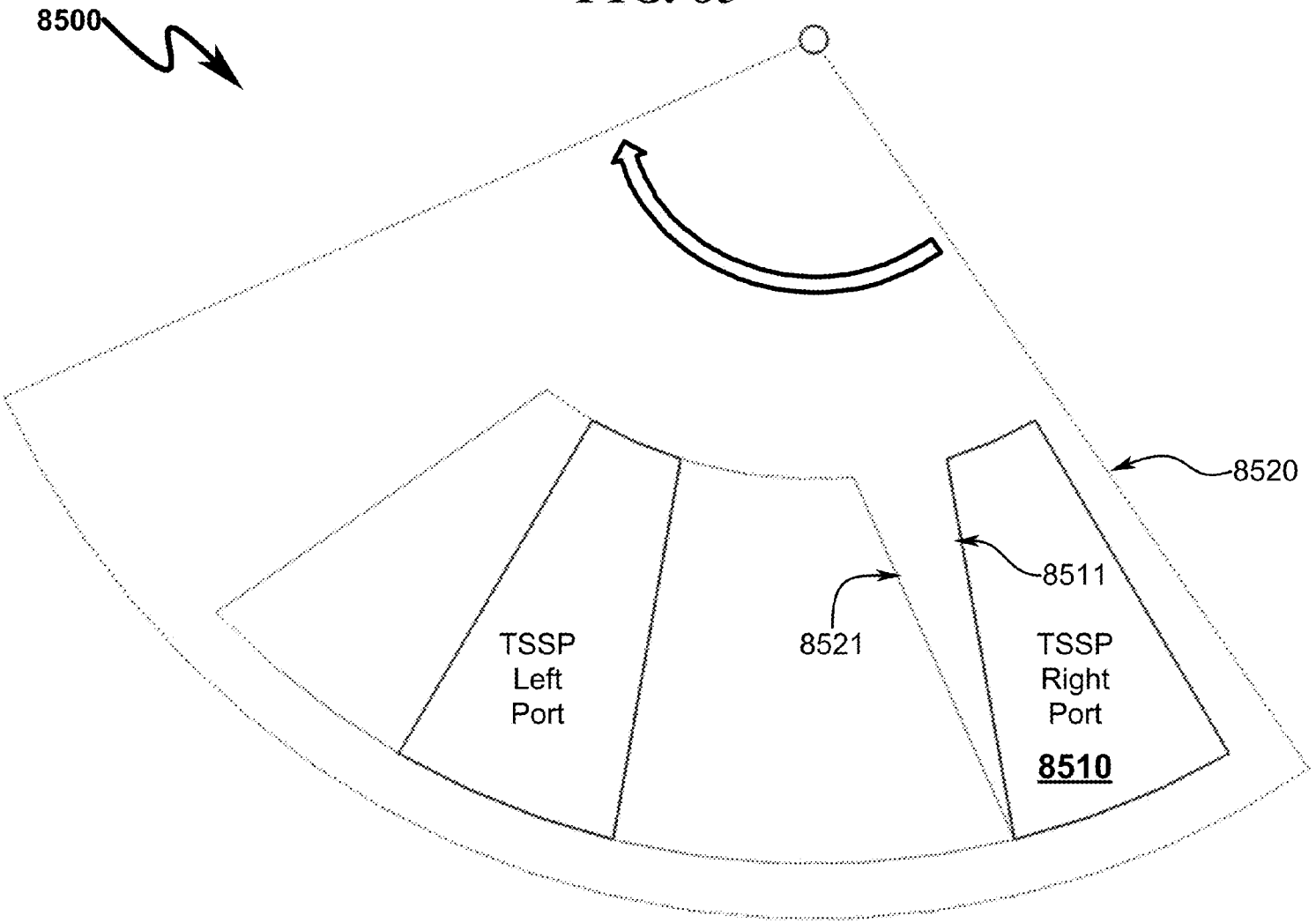
FIG. 85 illustrates a front hidden line view of a TSSP/TSCR configuration incorporating edge shearing with a TSSP shearing offset axis (SOA) above the axis of rotation (AOR) and a TSCR shearing offset axis (SOA) below the axis of rotation (AOR) wherein the TSCR is rotating clockwise and the right TSCR edge has completed the shearing action.

The shearing action of this TSSP/TSCR with respect to the right radial edge of the TSCR is further detailed in FIG. 83 (8300)-FIG. 85 (8500). As illustrated in FIG. 83 (8300), the right TSCR radial edge (8321) is not coincident with the left radial edge of the TSSP (8311) as the TSCR (8320) rotates from right to left (clockwise) and begins the shearing action across the right TSSP port (8310). As illustrated in FIG. 84 (8400), as the TSCR (8420) edge (8421) continues to rotate clockwise across the left radial edge of the TSSP (8411), the shearing action continues across the right TSSP port (8410). As illustrated in FIG. 85 (8500), as the TSCR (8520) edge (8521) completes clockwise rotation across the left radial edge of the TSSP (8511), the shearing action is completed and the right port (8510) of the TSSP is completely occluded by the TSCR (8520).

Figure 86:
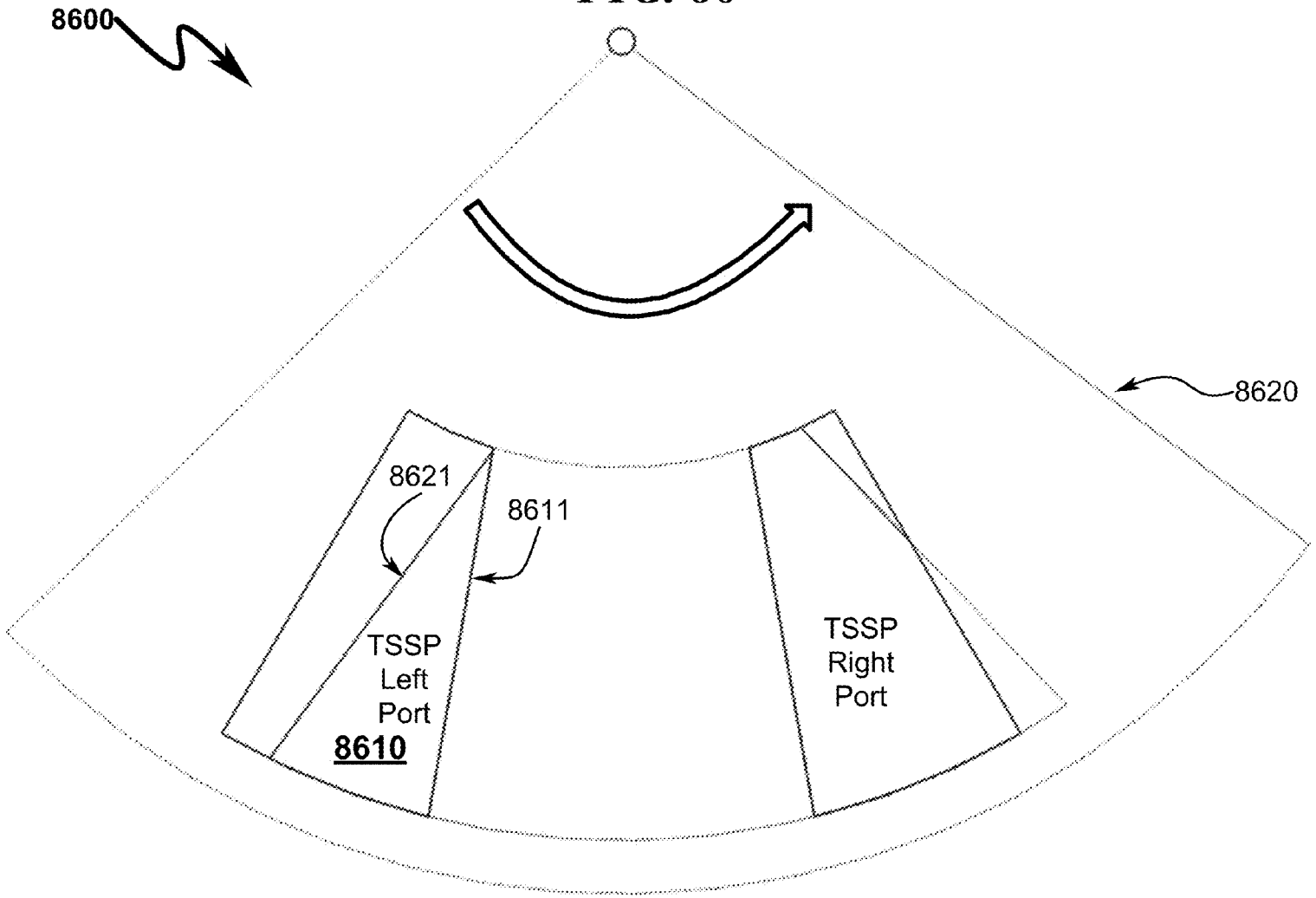
FIG. 86 illustrates a front hidden line view of a TSSP/TSCR configuration incorporating edge shearing with a TSSP shearing offset axis (SOA) above the axis of rotation (AOR) and a TSCR shearing offset axis (SOA) below the axis of rotation (AOR) wherein the TSCR is rotating counter-clockwise and the left TSCR edge is beginning to shear.
Figure 87:
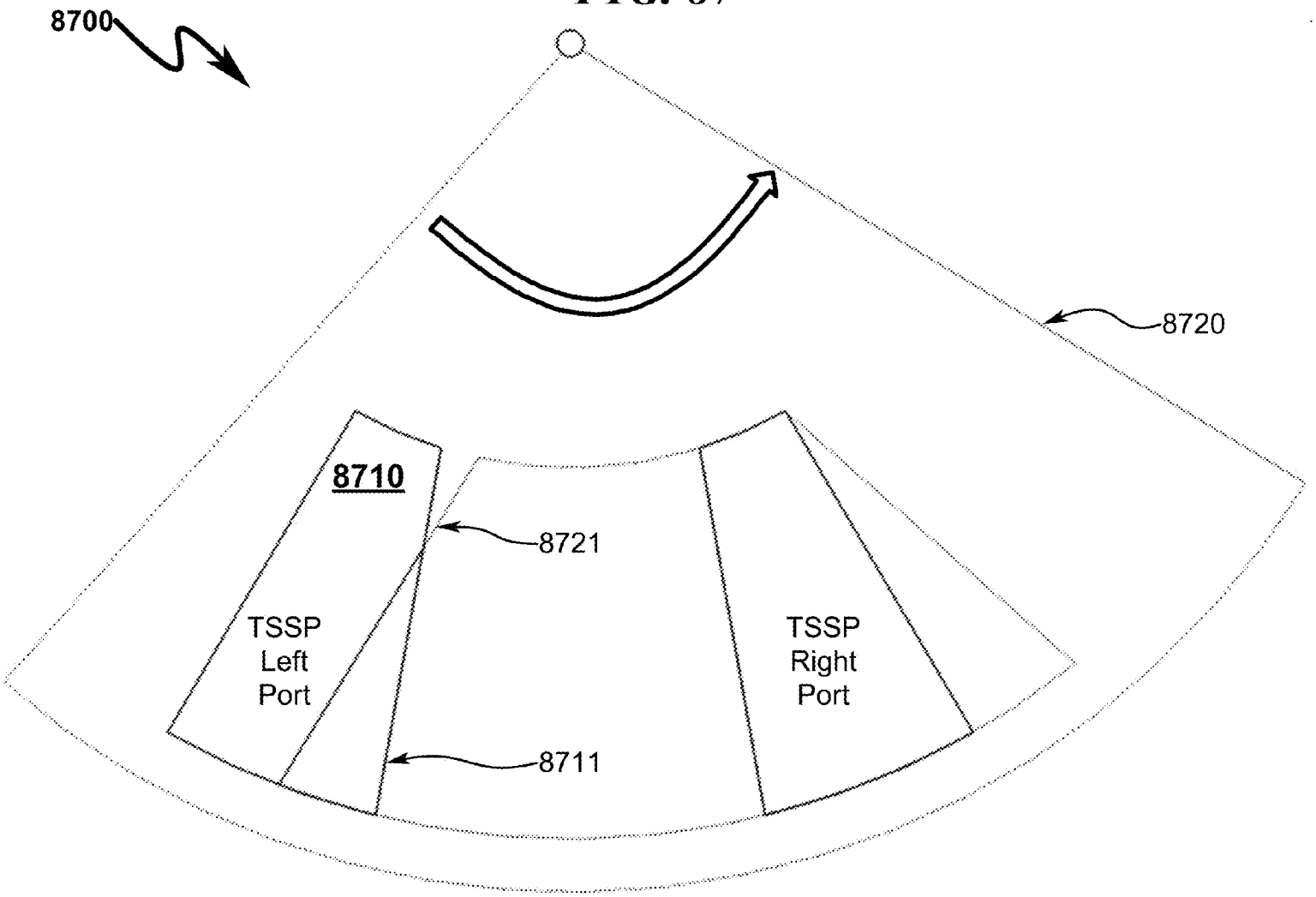
FIG. 87 illustrates a front hidden line view of a TSSP/TSCR configuration incorporating edge shearing with a TSSP shearing offset axis (SOA) above the axis of rotation (AOR) and a TSCR shearing offset axis (SOA) below the axis of rotation (AOR) wherein the TSCR is rotating counter-clockwise and the left TSCR edge is midway through the shearing action.
Figure 88:
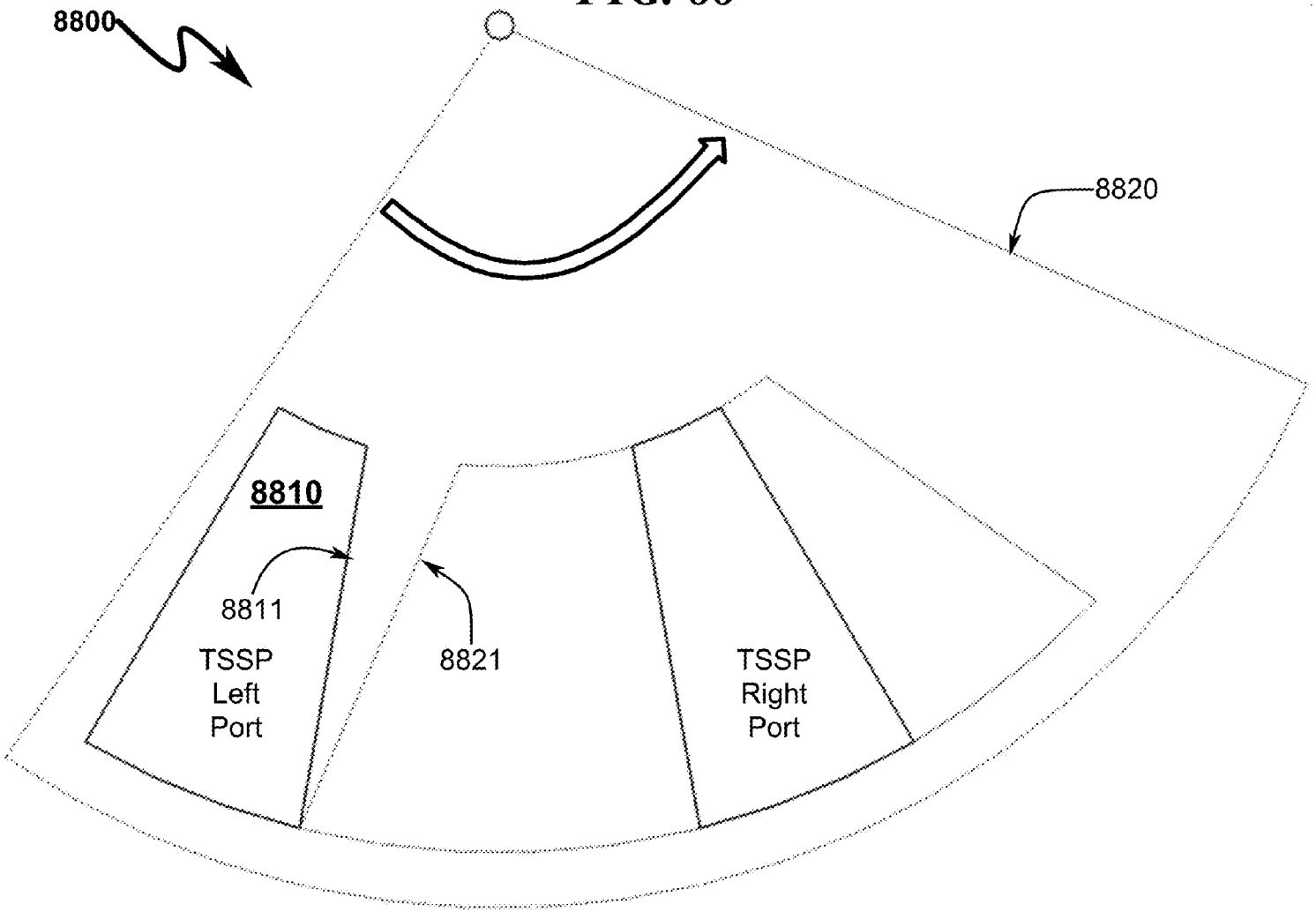
FIG. 88 illustrates a front hidden line view of a TSSP/TSCR configuration incorporating edge shearing with a TSSP shearing offset axis (SOA) above the axis of rotation (AOR) and a TSCR shearing offset axis (SOA) below the axis of rotation (AOR) wherein the TSCR is rotating counter-clockwise and the left TSCR edge has completed the shearing action.

The shearing action of this TSSP/TSCR with respect to the left radial edge of the TSCR is further detailed in FIG. 86 (8600)-FIG. 88 (8800). As illustrated in FIG. 86 (8600), the left TSCR radial edge (8621) is not coincident with the left radial edge of the TSSP (8611) as the TSCR (8620) rotates from left to right (counter-clockwise) and begins the shearing action across the right TSSP port (8610). As illustrated in FIG. 87 (8700), as the TSCR (8720) edge (8721) continues to rotate counter-clockwise across the right radial edge of the TSSP (8711), the shearing action continues across the left TSSP port (8710). As illustrated in FIG. 88 (8800), as the TSCR (8820) edge (8821) completes counter-clockwise rotation across the left radial edge of the TSSP (8811), the shearing action is completed and the left port (8810) of the TSSP is completely occluded by the TSCR (8820).

TSSP/TSCR Shearing Edge Summary

Based on the above discussion, the following variations in TSSP/TSCR shearing edge configurations are anticipated:

- An embodiment wherein the TSCR comprises a side edge that intersects a shearing offset axis (SOA) that is below an axis of rotation (AOR) about which the TSCR rotates.
- An embodiment wherein the TSCR comprises a side edge that intersects a shearing offset axis (SOA) that is above an axis of rotation (AOR) about which the TSCR rotates.
- An embodiment wherein the TSSP comprises a side edge that intersects a shearing offset axis (SOA) that is below an axis of rotation (AOR) about which the TSCR rotates.
- An embodiment wherein the TSSP comprises a side edge that intersects a shearing offset axis (SOA) that is above an axis of rotation (AOR) about which the TSCR rotates.
- An embodiment wherein the TSCR comprises a side edge that intersects a shearing offset axis (SOA) that is below an axis of rotation (AOR) about which the TSCR rotates and the TSSP comprises a side edge that intersects a shearing offset axis (SOA) that is above an axis of rotation (AOR) about which the TSCR rotates.
- An embodiment wherein the TSCR comprises a side edge that intersects a shearing offset axis (SOA) that is above an axis of rotation (AOR) about which the TSCR rotates and the TSSP comprises a side edge that intersects a shearing offset axis (SOA) that is below an axis of rotation (AOR) about which the TSCR rotates.

One skilled in the art will recognize that the key feature in these configurations is that the TSCR and TSSP side edges are configured to be non-collinear (thus with the geometric perimeters of the TSSP and TSCR being non-identical), thus permitting a shearing action as the TSCR moves across the TSSP.

Mechanical Methods of Operation (8900)-(9200)

Figure 89:
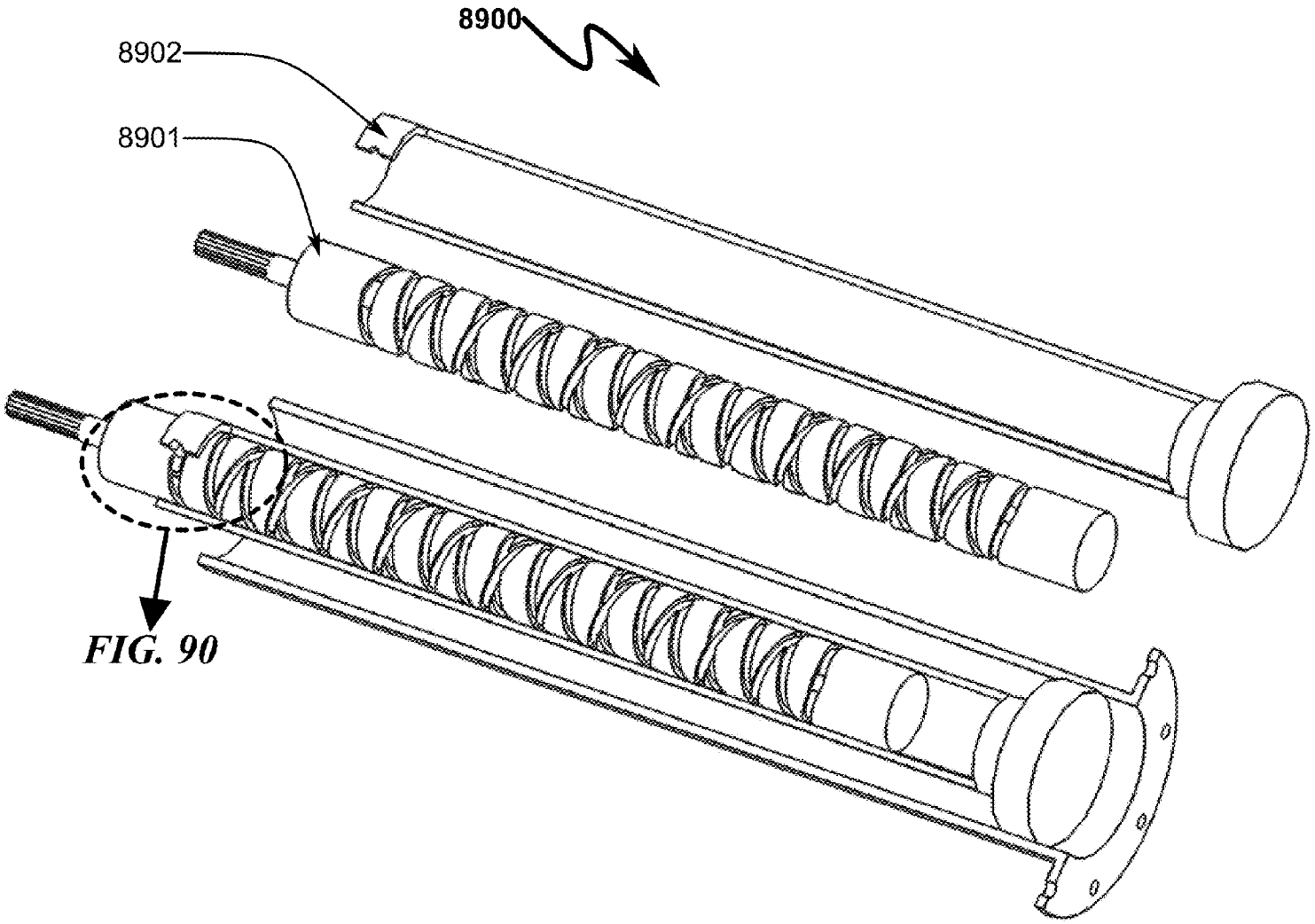
FIG. 89 illustrates a perspective sectional view of a preferred exemplary embodiment of the present invention incorporating a shaft-driven pumping system.
Figure 90:
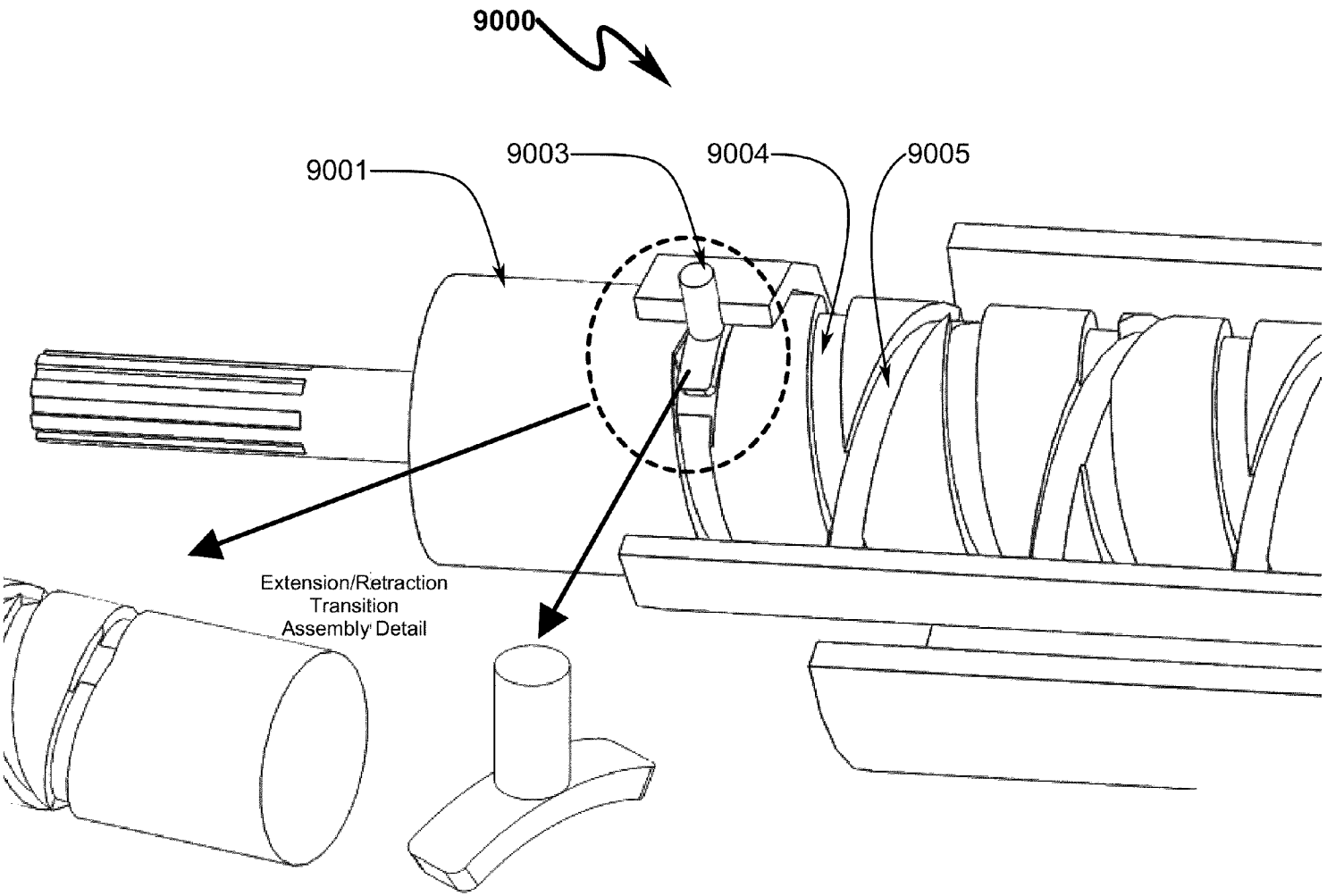
FIG. 90 illustrates a detail perspective sectional view of a preferred exemplary embodiment of the present invention incorporating a shaft-driven pumping system.

While many preferred invention embodiments operate hydraulically, the present invention also anticipates that some embodiments may operate mechanically. Within this context, there are various methods to achieve these functions including:

- Threaded Driveshaft Operation. As generally depicted in FIG. 89 (8900)-FIG. 90 (9000), the present invention may in some preferred embodiments be implemented using a threaded driveshaft (8901) to operate the pump cylinder pistons (8902). In this embodiment, gear or chain driven threaded driveshafts (8901) incorporate an automatic reversing channel thread (9004, 9005) that retracts the pump rams (8902) at a faster rate than it extends the pump rams (8902). Within this context, a driveshaft engagement key (9003) rides within the right-handed (9004) and left-handed (9005) channels of the driveshaft (9001) to affect the extension and retraction cycles respectively. As an operational example, assume a 1.00 thread per inch extension and a 1.25 thread per inch retraction pitch. A 40-inch long thread stroke would thus create one full extension in 40 revolutions and a full retraction in 32 revolutions. Using two units driven simultaneously results in a 4-inch simultaneous extension (pumping) at the beginning and end of every stroke. This varying pumping flow can also be accomplished using a variable thread pitch along the shaft on the extension stroke. For example, the first and last portion of the threaded shaft can be at a lesser TPI than the middle portion of the shaft. This would create pistons that stroke at different rates as they discharge simultaneously during the beginning and end of their strokes than in the middle when discharging singularly. The retraction TPI would still generally be at a faster rate to retract in about half the revolutions as compared to the extension cycle.

Figure 91:
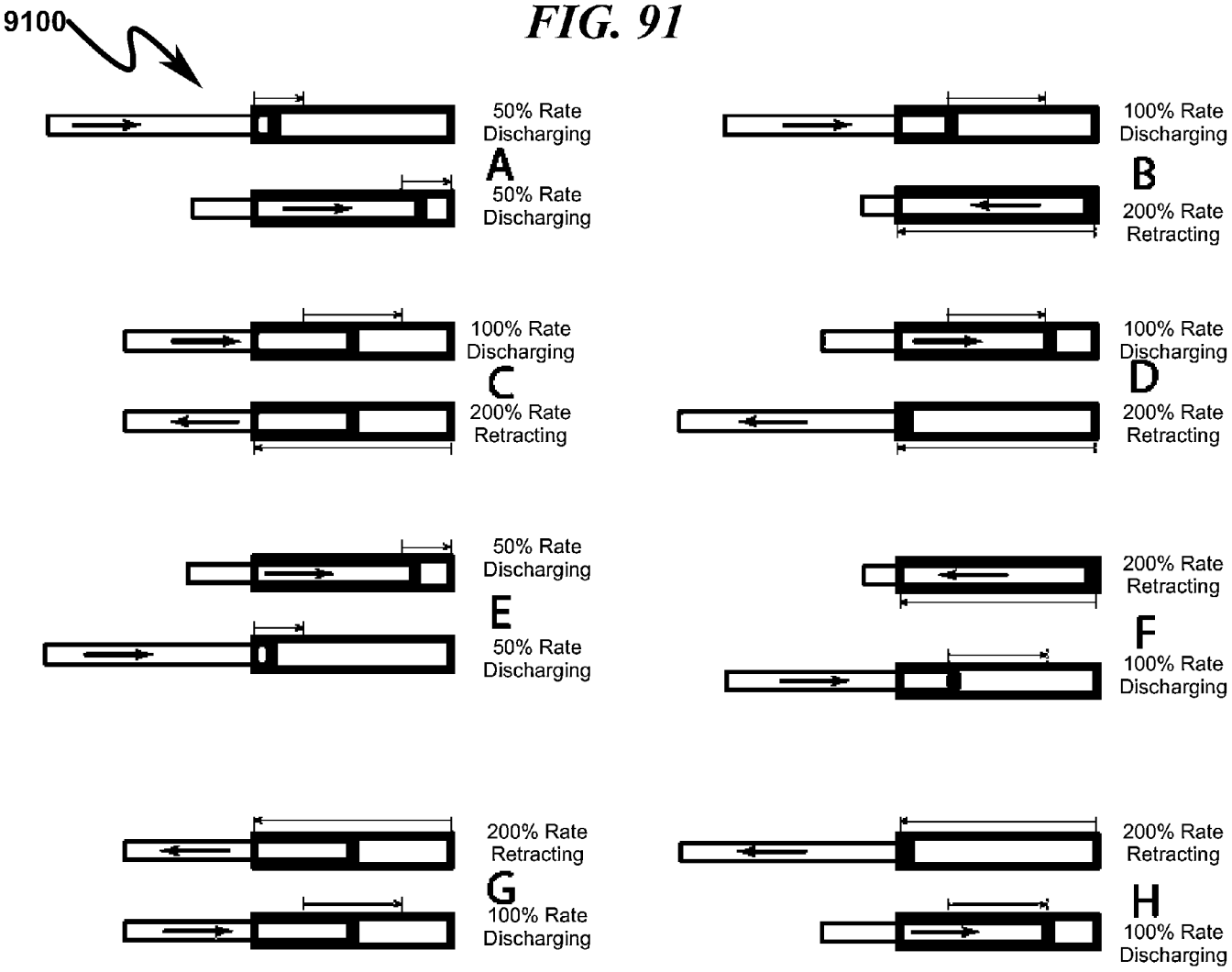
FIG. 91 illustrates a detail depicting a typical hydraulic ram driving cycle useful in many preferred invention embodiments.

Exemplary Hydraulic Cylinder Cycling. As generally depicted in FIG. 91 (9100), the present invention utilizes variable speeds in driving the hydraulic rams. This mechanical cycle is depicted in stages A-H in this diagram and may vary based on application context with the proviso that the hydraulic rams be driven to achieve constant (or nearly constant) output flow. More detail on this typical hydraulic pumping cycle is provided in FIG. 95 (9500)-FIG. 96 (9600).

Figure 92:
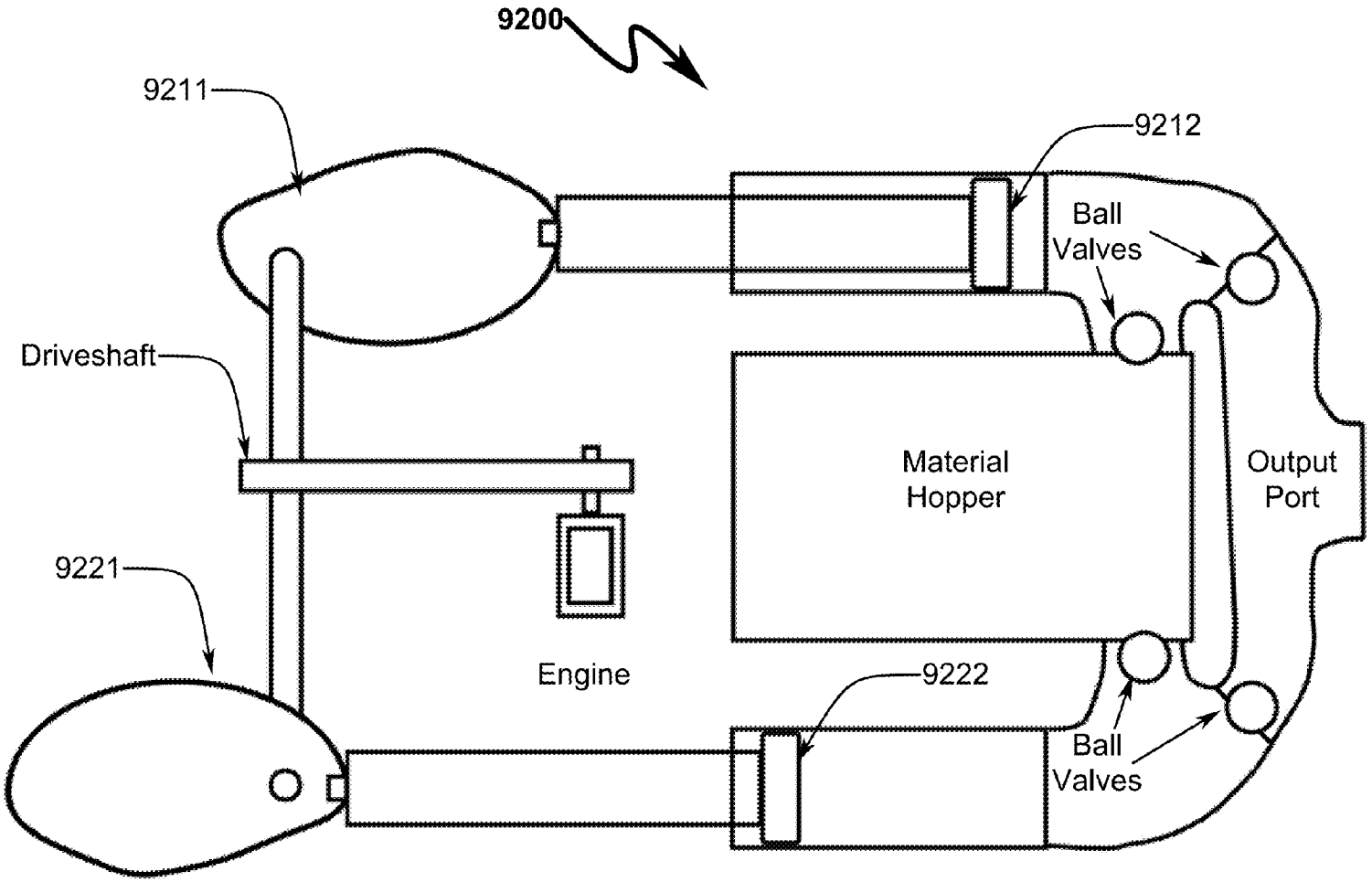
FIG. 92 illustrates a schematic diagram of a preferred exemplary invention embodiment utilizing a cam-driven pump lever ram operation with ball valves.

Cam Driven Mechanical Lever Rams. As generally depicted in FIG. 92 (9200), the present invention functionality can also be accomplished utilizing cam (9211, 9221) driven lever rams (9212, 9222). The cam drives (9211, 9221) allow the retraction stroke to be at a faster rate than the discharge stroke. This allows the timing of the beginning of each cylinder stroke to begin prior to the opposite cylinder finishing its discharge stroke while being driven by a common drive shaft power apparatus that maintains a constant speed.

One skilled in the art will recognize that these mechanical implementations are only exemplary of a variety of methods that may be used to affect the disclosed pumping action. With respect to the threaded driveshaft (8901) embodiment, the implementation of the driveshaft engagement key (9003) may have many forms, but in general is designed to ride within the threads of the threaded driveshaft (8901) in such a way that transition between the right-handed (9004) and left-handed (9005) threaded regions is possible at the distal ends of the threaded driveshaft (8901).

Differentiation with the Prior Art (9300, 9400)

All other twin reciprocating concrete pumps in the prior art exhibit a surging discharge of material. This is due to the inherit design of a round cutting ring valve at round discharge spectacle plates from the pumping cylinders. Pressure is lost and actual backflow of material is unpreventable during the valve shift (through the center position). Some prior art configurations try to cushion how the pumping pistons start each stroke to reduce the destructive forces while others add shock absorbing air cylinders to the discharge pipeline.

The present invention utilizes a "YS Tube" discharge port that is designed to never allow the pressurized discharge material pressure to be relaxed nor back-flow into the material hopper. This is achieved by the use of a trapezoidal-shaped cutting ring and spectacle plate.

There is never a position that the "YS Tube" is in during transitioning from one discharge port to the other that allows material pressure to bleed off or backflow into the loading hopper. The trapezoidal cutting ring completely seals off the trapezoid spectacle ports as it transitions across the spectacle plate during cycle changes.

The trapezoidal ejection port shape is designed with the same or larger material face area as an equivalent round spectacle plate to allow for the harsh mixes to still flow without a reduction in flow rate. For example, an 8-inch I.D. round cutting ring has a flow area of approximately 50.24 square inches. A trapezoid design generally provides an equal or larger flow area by construction of appropriate side lengths of the trapezoid having opposite side dimensions of approximately 4/6 inches and 10/10 inches respectively.

In addition, the "YS Tube" design described herein has three operating positions. The center position allows both pumping pistons to begin its discharge stroke simultaneously prior to the other piston finishing their respective discharge stroke. This results in the pistons retracting (loading concrete) at a faster rate than they discharge (pump concrete). Prior art twin piston pumps reciprocate simultaneously at the same retract (loading) rate as discharging (pumping) rate.

Figure 93:
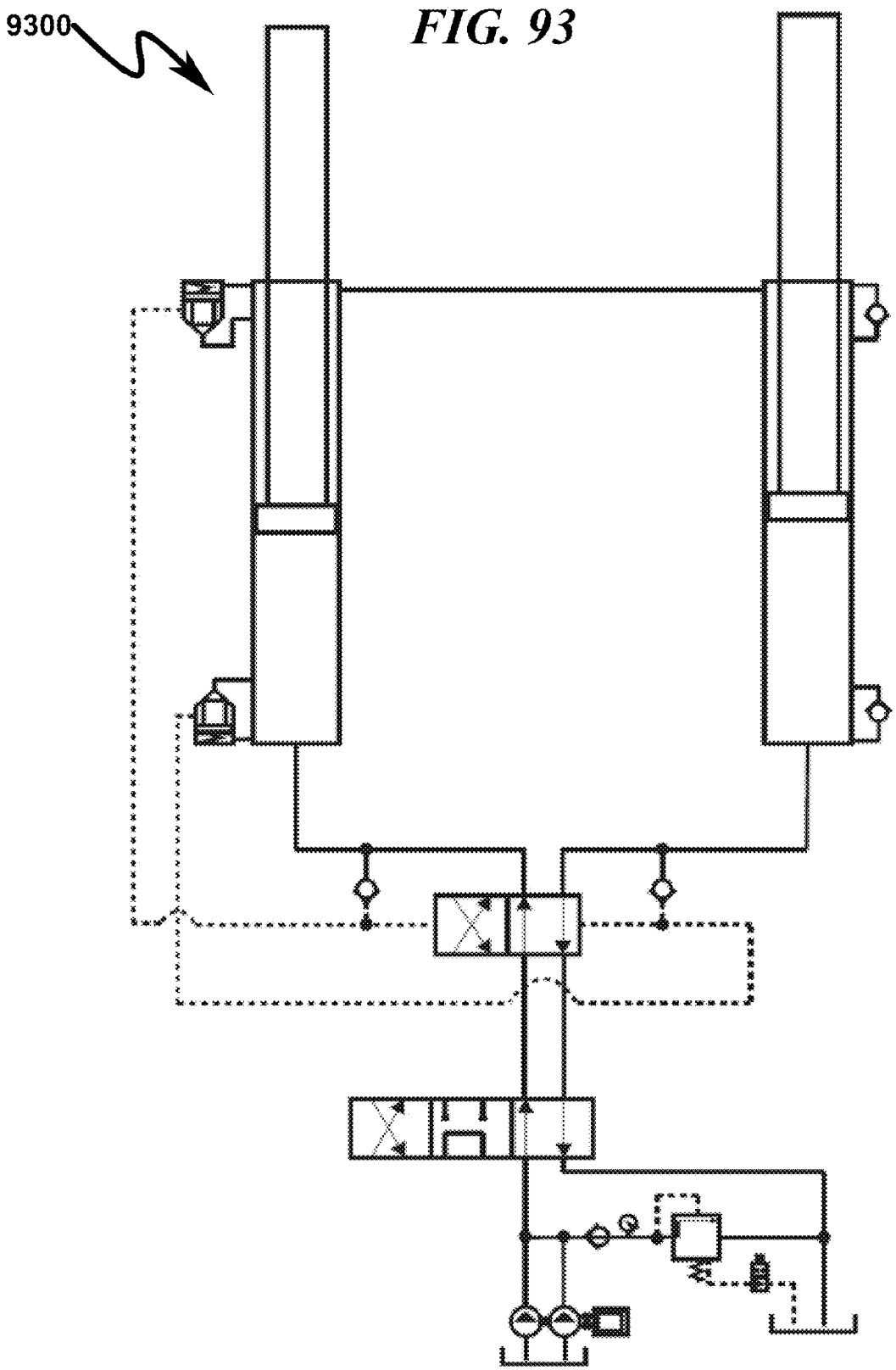
FIG. 93 illustrates a hydraulic schematic diagram of a typical prior art twin cylinder concrete pump system.
Figure 94:
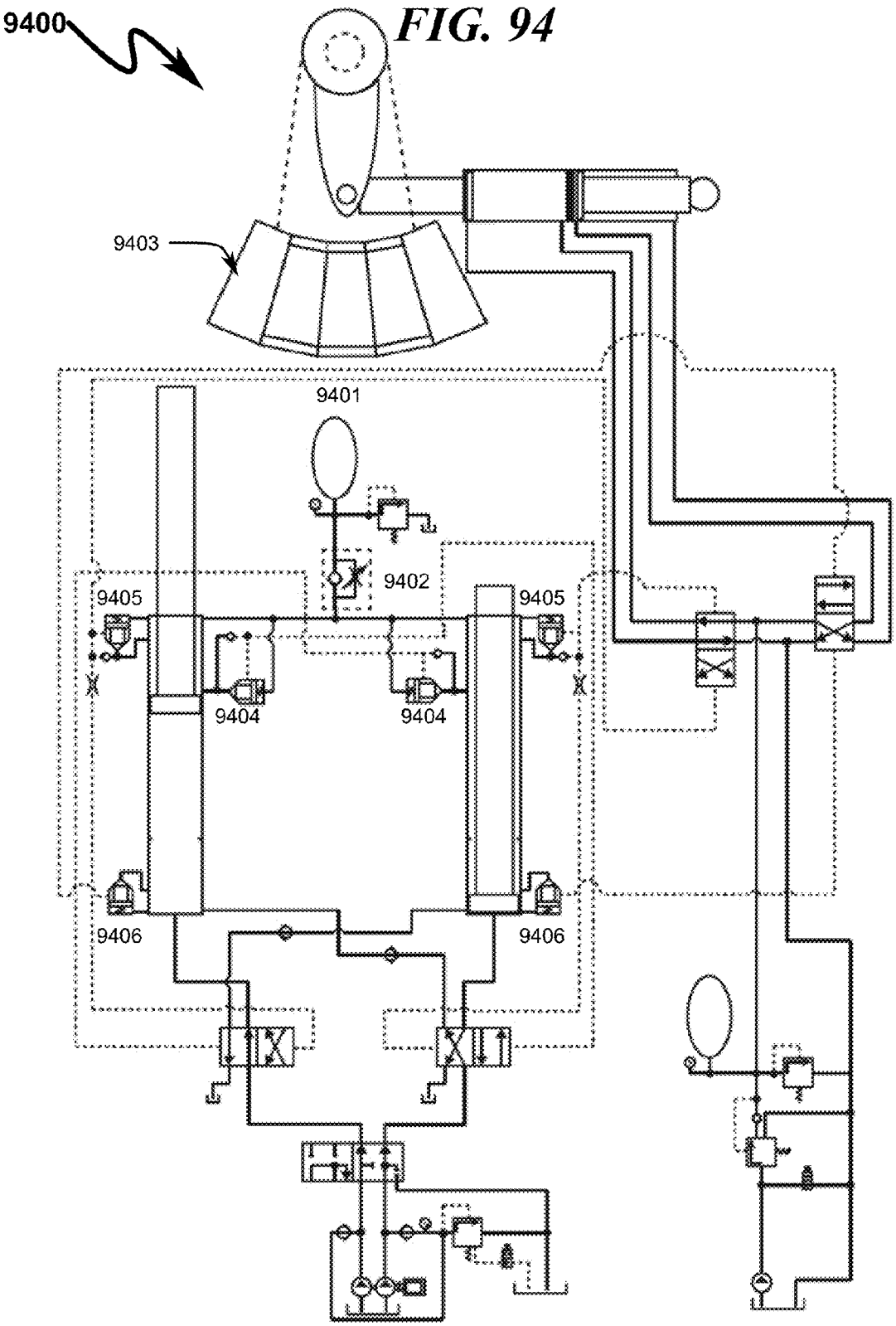
FIG. 94 illustrates a hydraulic schematic diagram of a preferred exemplary invention embodiment utilizing a trapezoidal-shaped spectacle plate ejection port that may in some embodiments be substituted by ball valves.

There are various methods hydraulically to achieve the pumping functions described herein. FIG. 93 (9300) depicts a traditional concrete pump schematic and is contrasted with FIG. 94 (9400), which illustrates an exemplary invention system schematic that may be used to implement some of the features of the present invention which may include:

Referencing FIG. 94 (9400), one embodiment may utilize an accumulator (9401) in the slave oil of the hydraulic differential cylinders that stores the energy from both cylinders during their discharge strokes. This is accomplished by the 75% signal port (9404) on each cylinder which causes both cylinders to discharge simultaneously. That energy is then released and controlled by the throttle check valve (9402) once a cylinder reaches its full discharge stroke and the YS tube (3) has been shifted. The 100% signal port (9405) activates the YS tube (9403) to shift the accumulator (9401) to unload its stored energy controllably through the throttle check valve (9402) along with the slave oil from the opposite cylinder to retract the loading cylinder at a faster rate. Once the retracted cylinder reaches the 0% port (9406), the YS tube is shifted and the retracted cylinder rests until the discharging cylinder reaches the 75% signal port (9404) and it all repeats.

Referencing FIG. 92 (9200), for grout and small aggregate concrete pumping, ball valve type concrete pump machines are very popular. They may utilize both hydraulic and mechanical pumping cylinders. Again, having both pumping pistons begin their discharge stroke simultaneously prior to the other piston finishing its discharge stroke will provide a truly continuous flow.

As indicated in the examples provided herein, the use of hydraulic and/or mechanical controls to drive the pump cylinders may take many forms. Included within the scope of the present invention is the anticipation that these hydraulic/mechanical controls may be computer driven and be manipulated by machine instructions read from a computer readable medium. Thus, with the proper computer control configuration, a variety of pump cycles incorporating the trapezoidal-shaped spectacle plate may be implemented to support a variety of material delivery methodologies, material consistencies, piping configurations, and specific job site requirements. This may permit a single concrete pump hardware configuration to be programmed to support a wide variety of materials and work environments without the need for significant hardware modifications to the machinery.

Hydraulic Ram Timing (9500)-(9600)

The present invention in many preferred embodiments individually times the hydraulic pump rams in conjunction with the relative rotational positions of the TSSP/TSCR in order to maintain constant concrete material flow during the entire pumping cycle. Exemplary timing diagrams depicting this behavior are depicted in FIG. 95 (9500)-FIG. 96 (9600).

Figure 95:
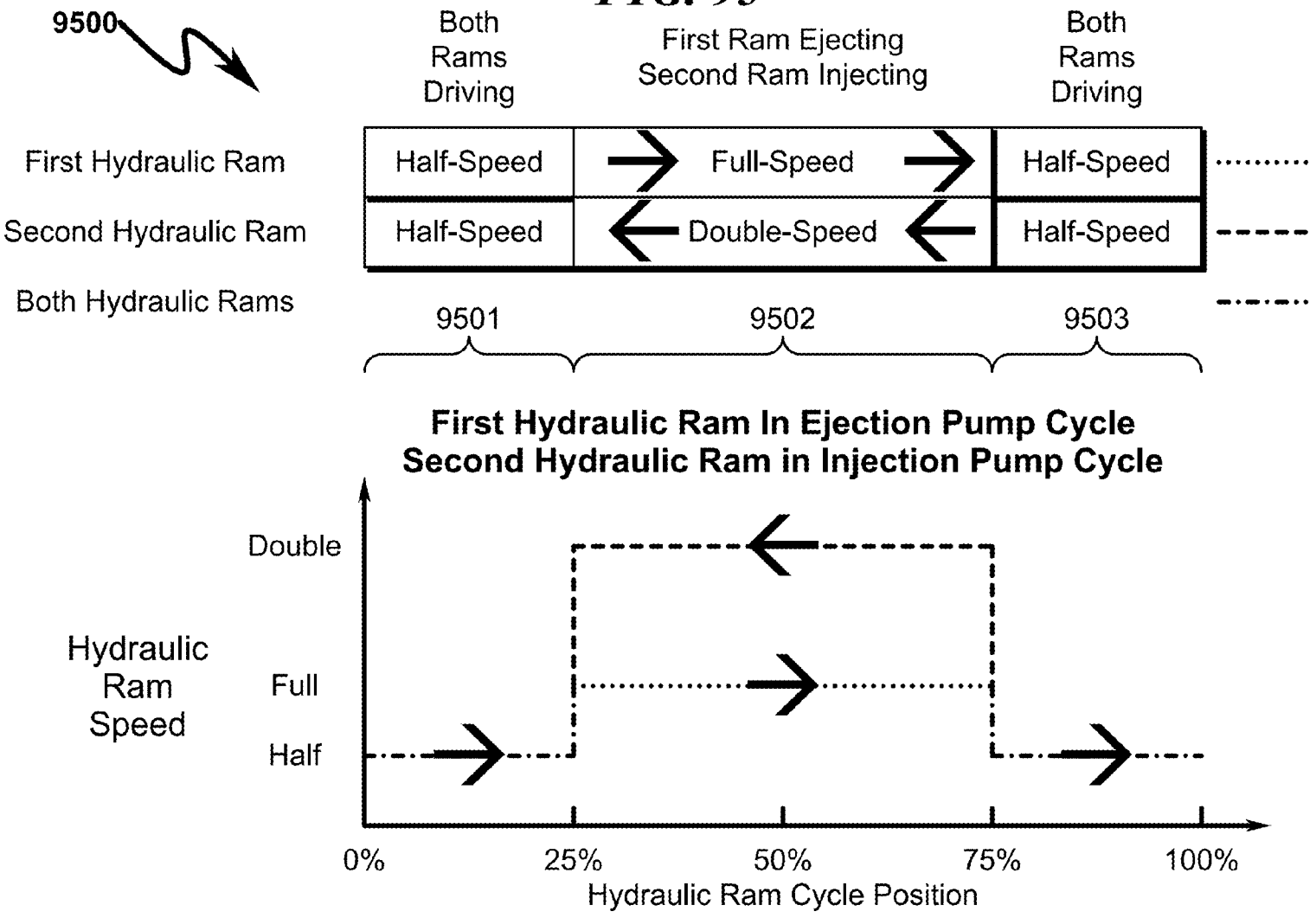
FIG. 95 illustrates a pump cycle graph depicting a scenario wherein a first hydraulic pump ram is ejecting material and a second hydraulic pump ram is injecting during the middle of the pump cycle, and both hydraulic rams are ejecting material during the first and last portions of the pump cycle.

FIG. 95 (9500) depicts the scenario in which the first hydraulic pump ram is in the ejection mode (transmitting to the output ejection port) during the middle of the pump cycle (9502) and the second hydraulic pump ram is in the injection mode (receiving from the material hopper) during the middle of the pump cycle (9502). Both hydraulic pump rams are ejecting at half speed during the first (9501) and last (9503) portions of the pump cycle.

Figure 96:
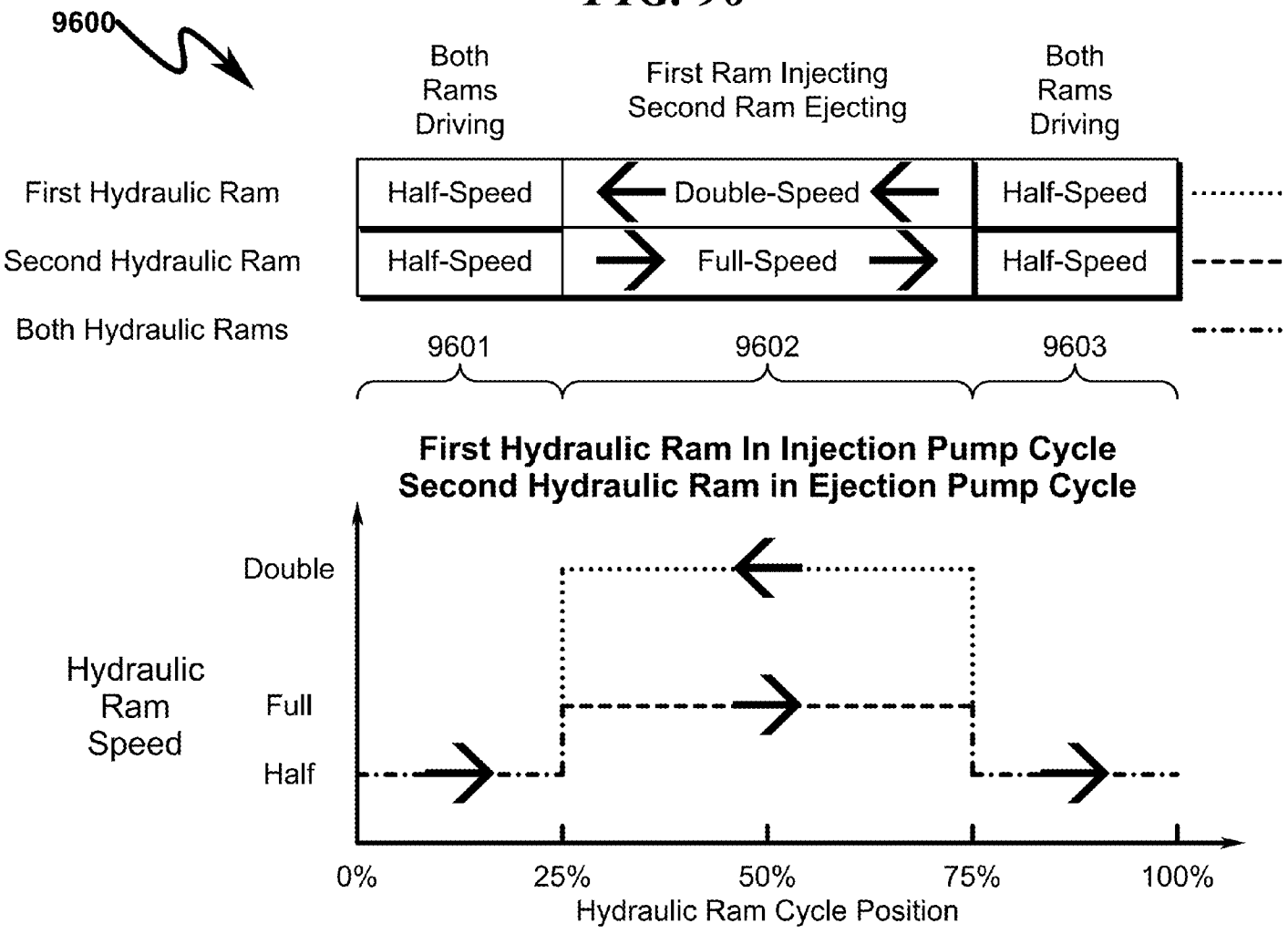
FIG. 96 illustrates a pump cycle graph depicting a scenario wherein a first hydraulic pump ram is injecting material and a second hydraulic pump ram is ejecting during the middle of the pump cycle, and both hydraulic rams are ejecting material during the first and last portions of the pump cycle.

FIG. 96 (9600) depicts the scenario in which the first hydraulic pump ram is in the injection mode (receiving from the material hopper) during the middle of the pump cycle (9602) and the second hydraulic pump ram is in the ejection mode (transmitting to the output ejection port) during the middle of the pump cycle (9602). Both hydraulic pump rams are ejecting at half speed during the first (9601) and last (9603) portions of the pump cycle.

One skilled in the art will recognize that the pump flow diagrams in FIG. 95 (9500)-FIG. 96 (9600) represent one embodiment of a larger concept in which the ejection and injection rates of the hydraulic rams are matched to ensure that the output ejection flow rates are maintained at a constant rate. For this to occur, the following constraints are necessary:

- The SUM of the ejection rates of the first and second hydraulic ram pumps must be equal to the desired full ejection rate when both hydraulic ram pumps are ejecting material to the output port during the first (9501, 9601) and last (9503, 9603) portions of the pump cycle.
- During the middle of the pump cycle (9502, 9602) when only one hydraulic ram is ejecting material to the output port, the ejection rate of this ejecting hydraulic ram must be equal to the desired full ejection rate.
- During the middle of the pump cycle (9502, 9602) when one hydraulic ram is injecting material from the material hopper, the movement of this hydraulic ram must be sufficiently rapid to cycle forward and back to inject material from the material hopper, and be positioned to eject this material in concert with the other hydraulic pump ram during the last portion of the next cycle.

Additionally, it should be noted that the cycle position percentages depicted in FIG. 95 (9500)-FIG. 96 (9600) (0%, 25%, 50%, 75%, 100%), are exemplary and not limitive of the present invention scope. As described above, it is only necessary that the first hydraulic pump ram and second hydraulic pump ram are coordinated to enable simultaneous pumping during the (9501, 9601) and last (9503, 9603) portions of the pump cycle. The relative portions of first (9501, 9601), middle (9502, 9602), and last (9503, 9603) pump cycles may be varied by adjusting the relative speed of each hydraulic pump ram during the overall pump cycle.

Hydraulic Tensioner (9700)-(10400)

Figure 97:
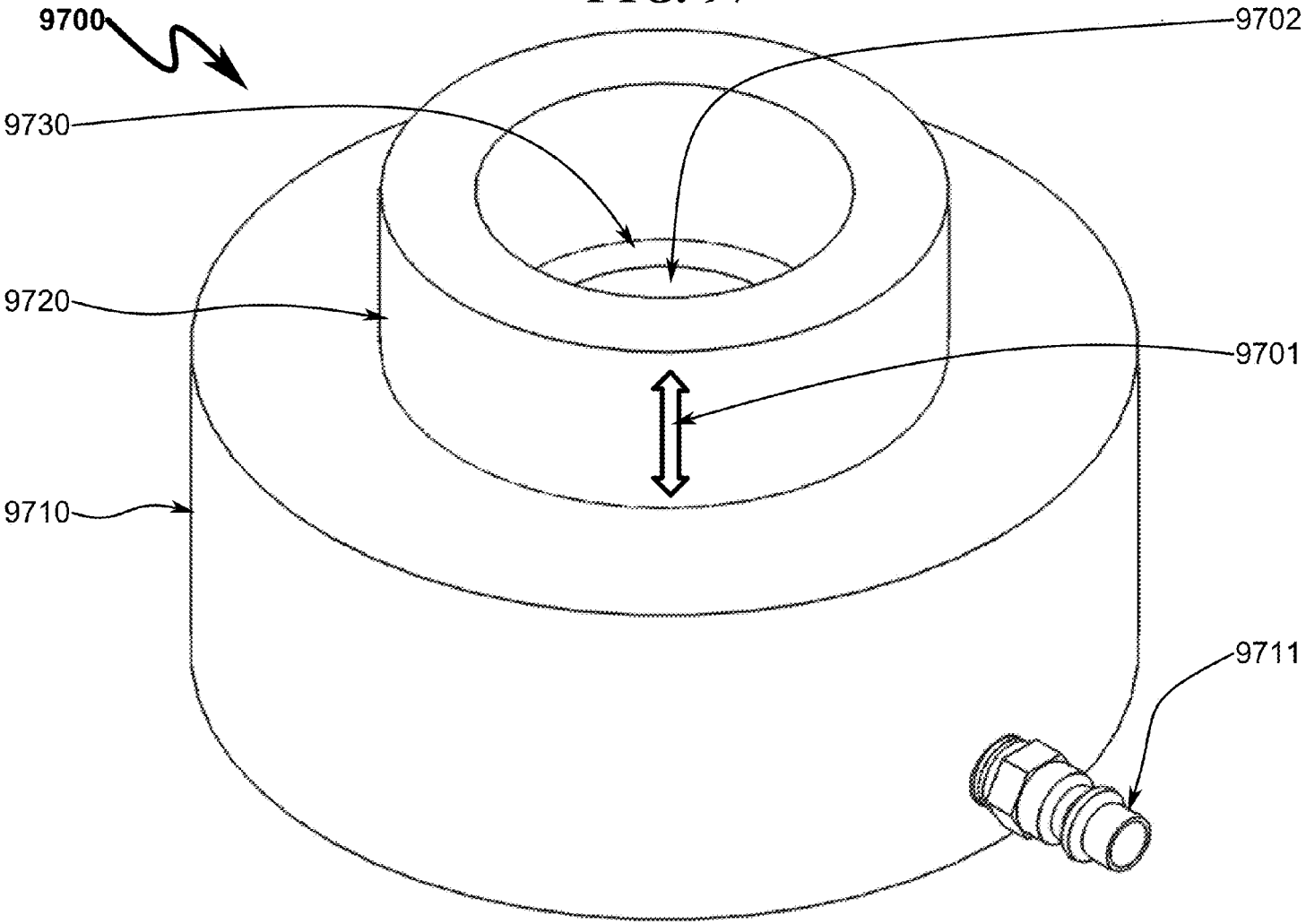
FIG. 97 illustrates a top perspective view of an exemplary thru-hole hydraulic tensioner useful in some preferred invention embodiments.

In several preferred invention embodiments the TSSP and TSCR may be hydraulically locked in a mated position via the use of a thru-hole hydraulic tensioner. An exemplary embodiment of this thru-hole hydraulic tensioner is depicted in FIG. 97 (9700)-FIG. 104 (10400). As generally depicted in FIG. 97 (9700), the thru-hole hydraulic tensioner comprises a support shell (9710) in which a hydraulic ram (9720) may be extended/contracted (9701) based on hydraulic pressure provided by a coupling input (9711). A hydraulic core base (9730) supports and guides the hydraulic ram (9720) and comprises a thru-hole (9702) that allows insertion of a thru-shaft, transfer pipe, or other object associated with the concrete mixer.

Figure 98:
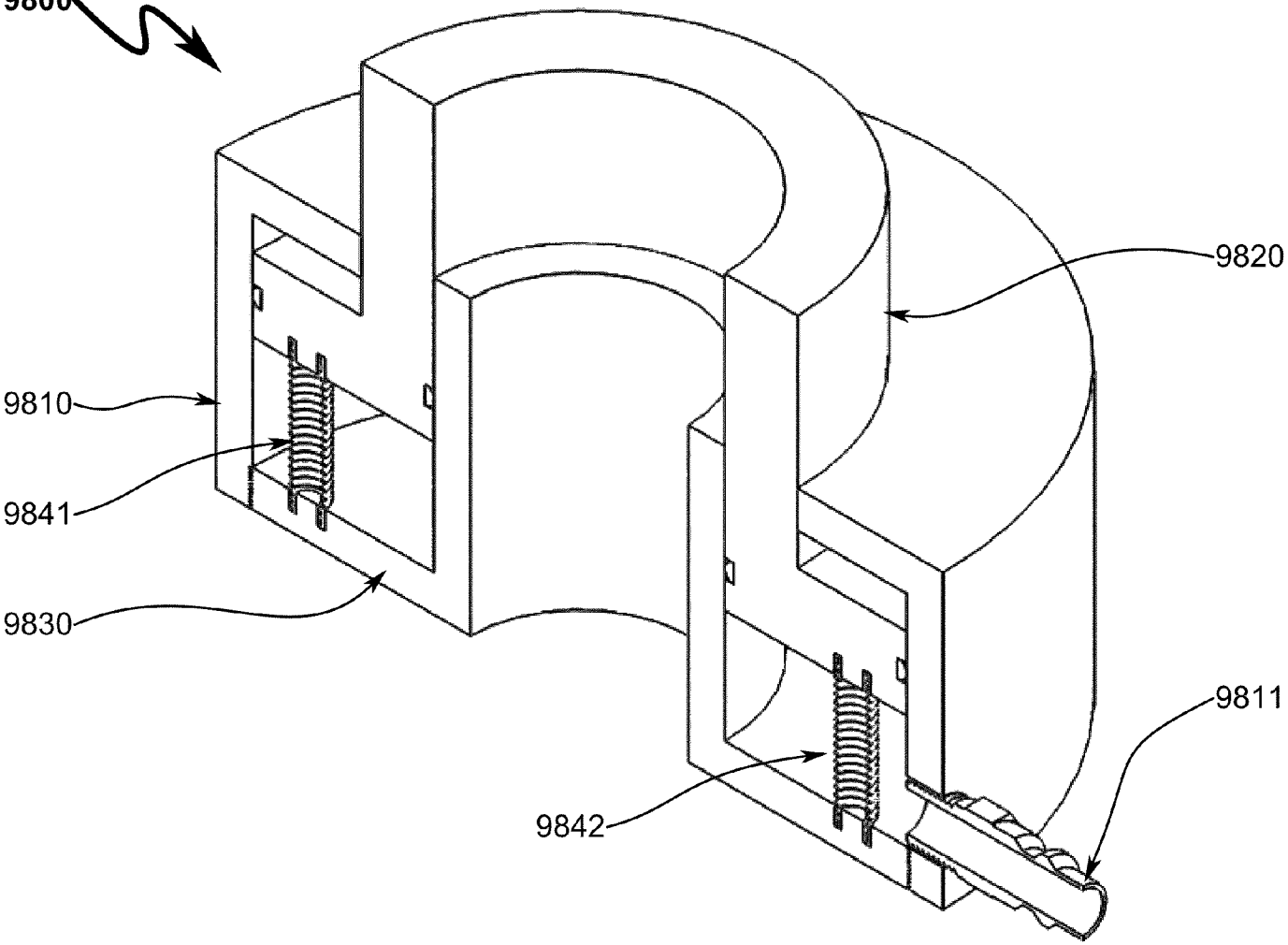
FIG. 98 illustrates a top perspective sectional view of an exemplary thru-hole hydraulic tensioner useful in some preferred invention embodiments.

Additional internal detail of the thru-hole hydraulic tensioner is depicted in the sectional view of FIG. 98 (9800) wherein the support shell (9810) permits movement of the hydraulic ram (9820) as constrained by the hydraulic core base (9830). A plurality of springs (9841, 9842) (the exact number and type depending on application context) provide preliminary tension to ensure that the hydraulic core base (9830) (attached to the support shell (9810)) and top of the hydraulic ram (9820) continually mate with surfaces associated with the concrete pump. This permits the TSSP and TSCR surfaces to be mated as they slide across one another. As hydraulic pressure is provided through the input coupling (9811), the hydraulic ram (9820) is extended to offset forces of material pressure pushing the TSCR away from the TSSP, thus ensuring a that the TSCR and TSSP form a positive seal with only the amount of pressure required to ensure that no concrete escapes the TSCR/TSSP interface. The required hydraulic pressure needed to ensure a positive seal will vary with pumping material, slump, distances, obstructions, etc., being pumped and may vary with each discharge stroke of the pumping rams.

Figure 99:
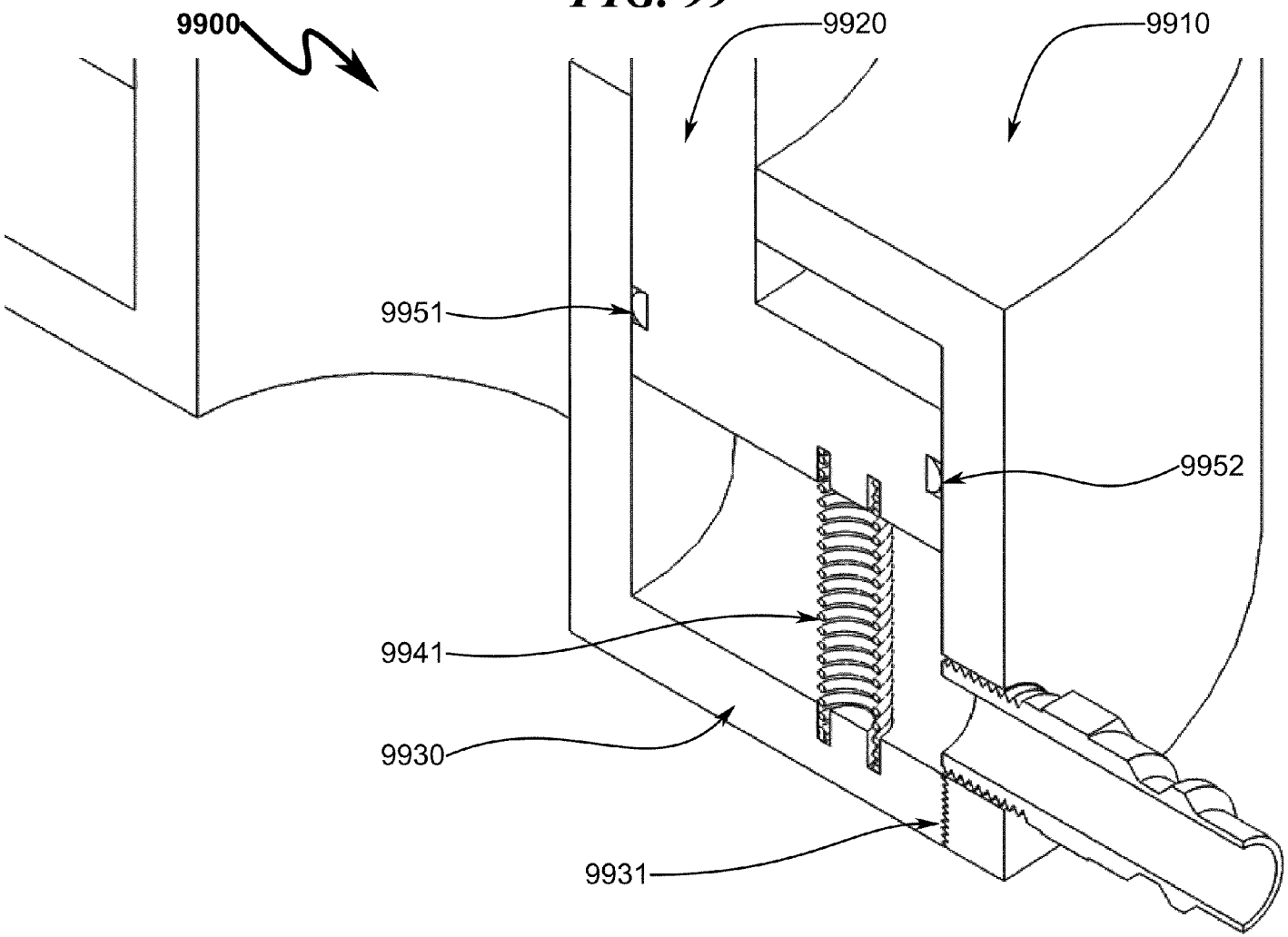
FIG. 99 illustrates a top perspective sectional detail view of an exemplary thru-hole hydraulic tensioner useful in some preferred invention embodiments.
Figure 100:
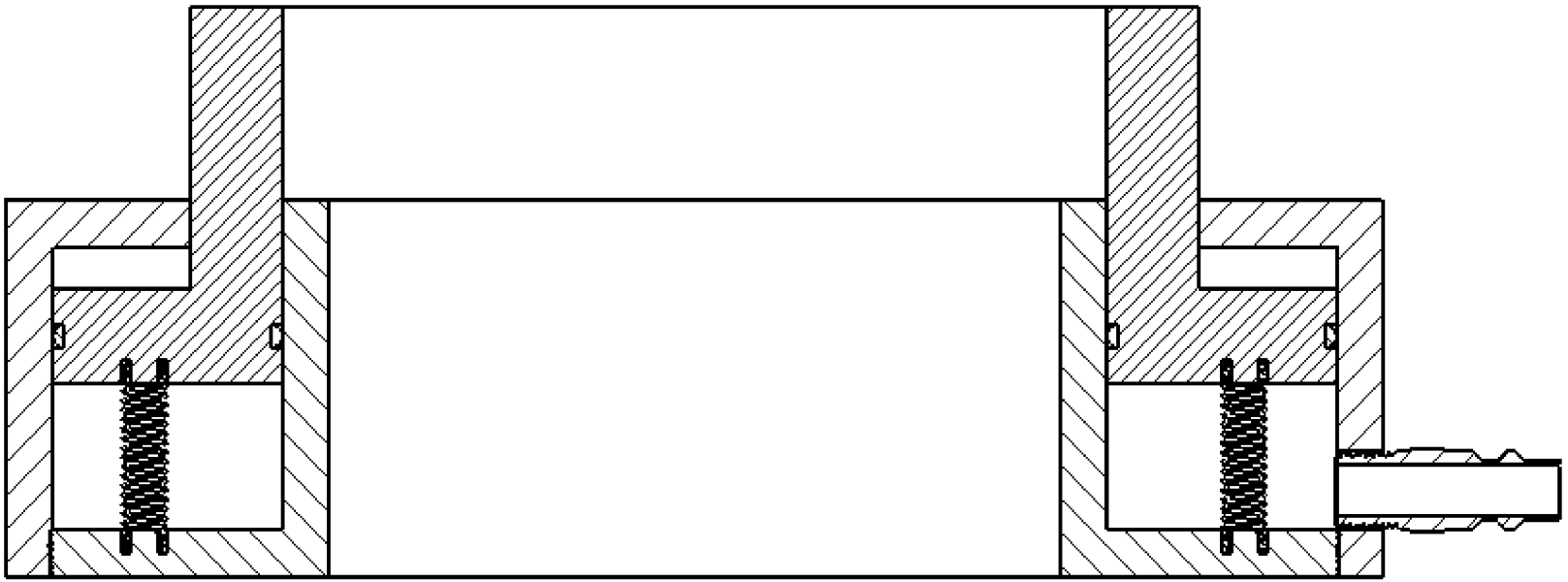
FIG. 100 illustrates a side sectional view of an exemplary thru-hole hydraulic tensioner useful in some preferred invention embodiments.

FIG. 99 (9900) provides additional detail as to a preferred exemplary construction of the hydraulic ram (9920) and hydraulic core base (9930). Here depicted are the hydraulic seals (9951, 9952) associated with the hydraulic ram (9920) and detail on the threaded interface (9931) between the support shell (9910) and hydraulic core base (9930). FIG. 100 (10000) provides a side sectional view that depicts spring placement and positioning of the hydraulic input port.

Figure 101:
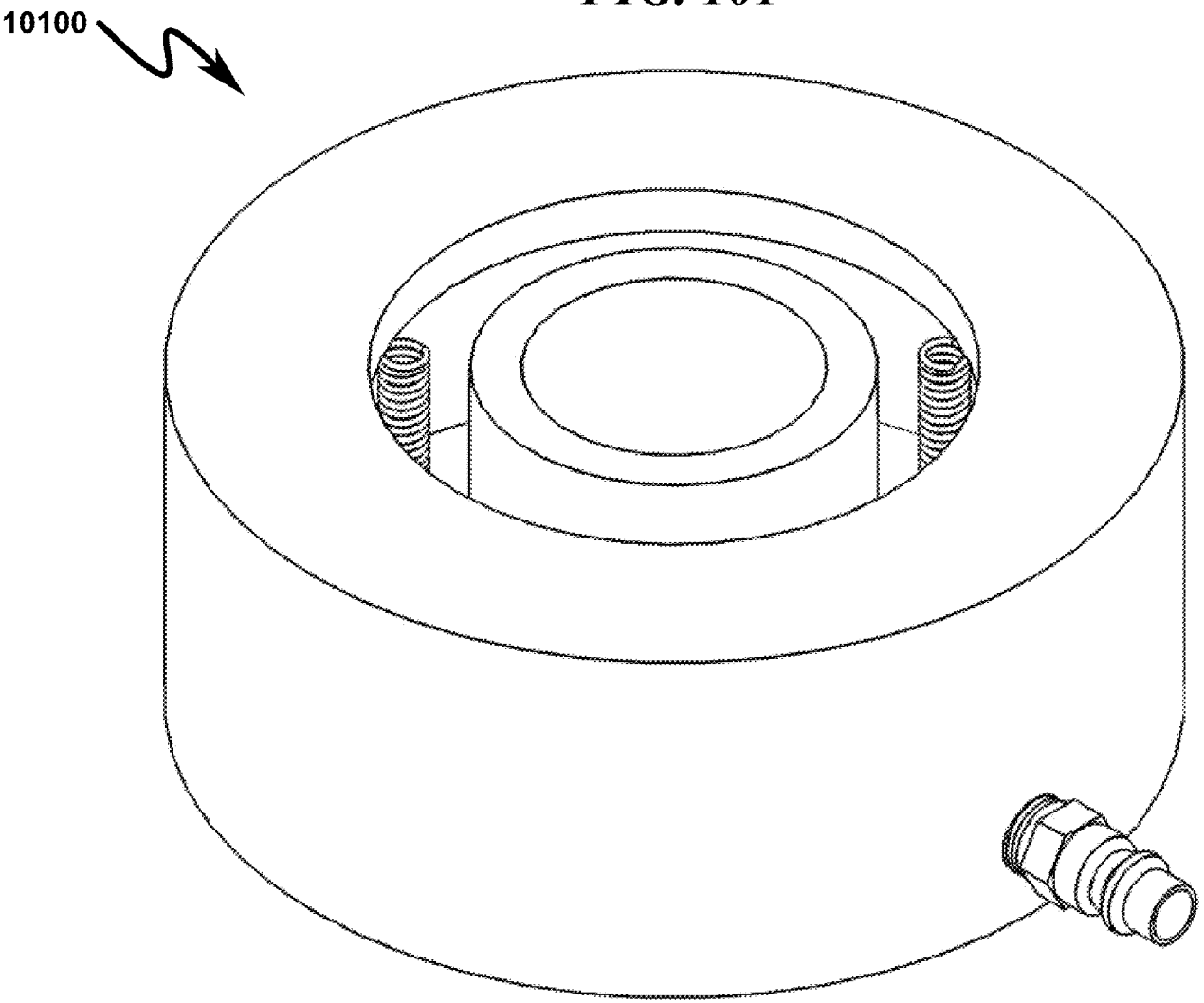
FIG. 101 illustrates a top perspective view of an exemplary thru-hole hydraulic tensioner useful in some preferred invention embodiments with hydraulic ram removed.
Figure 102:
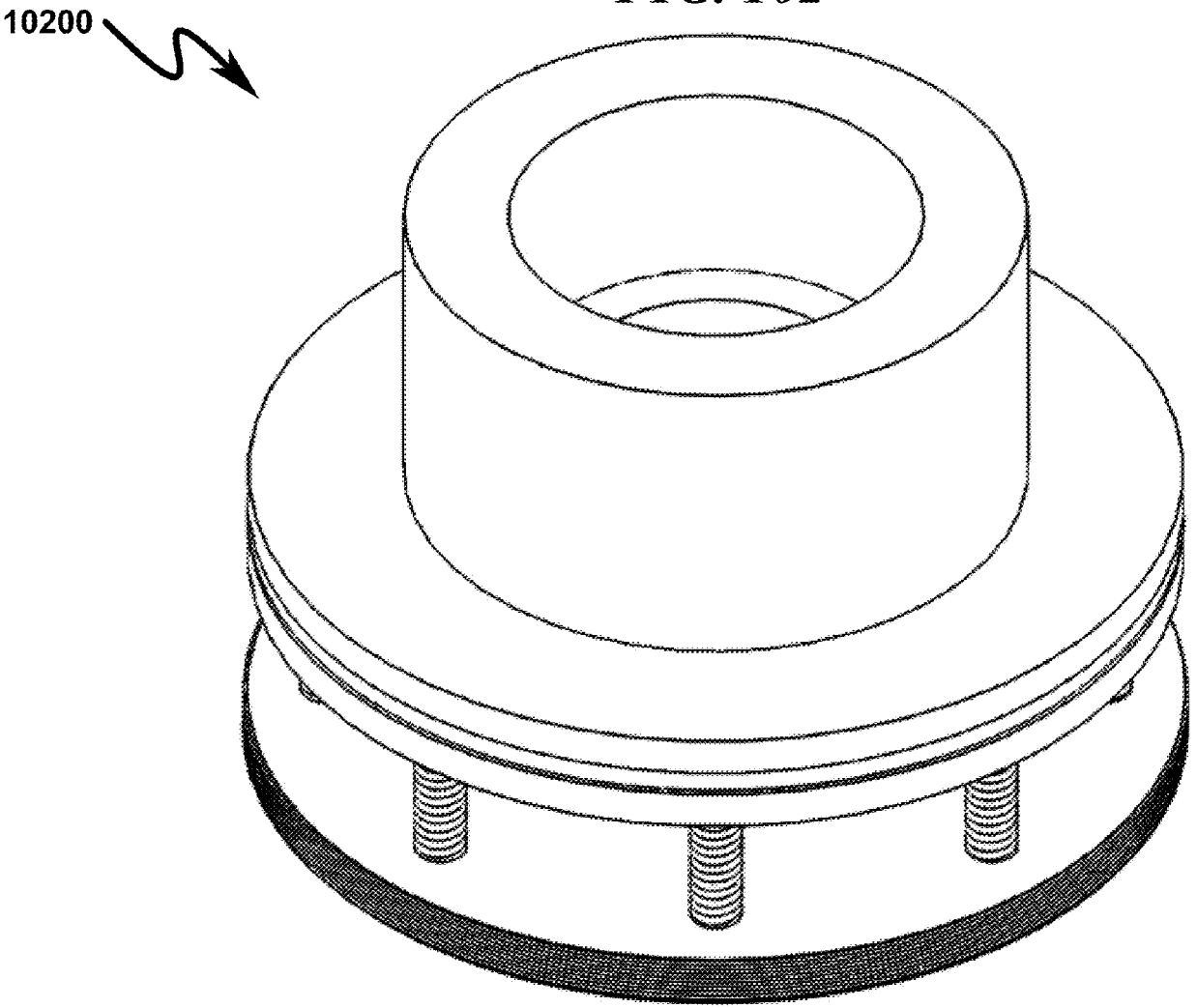
FIG. 102 illustrates a top perspective view of an exemplary thru-hole hydraulic tensioner useful in some preferred invention embodiments with outer housing shell and hydraulic input removed.
Figure 103:
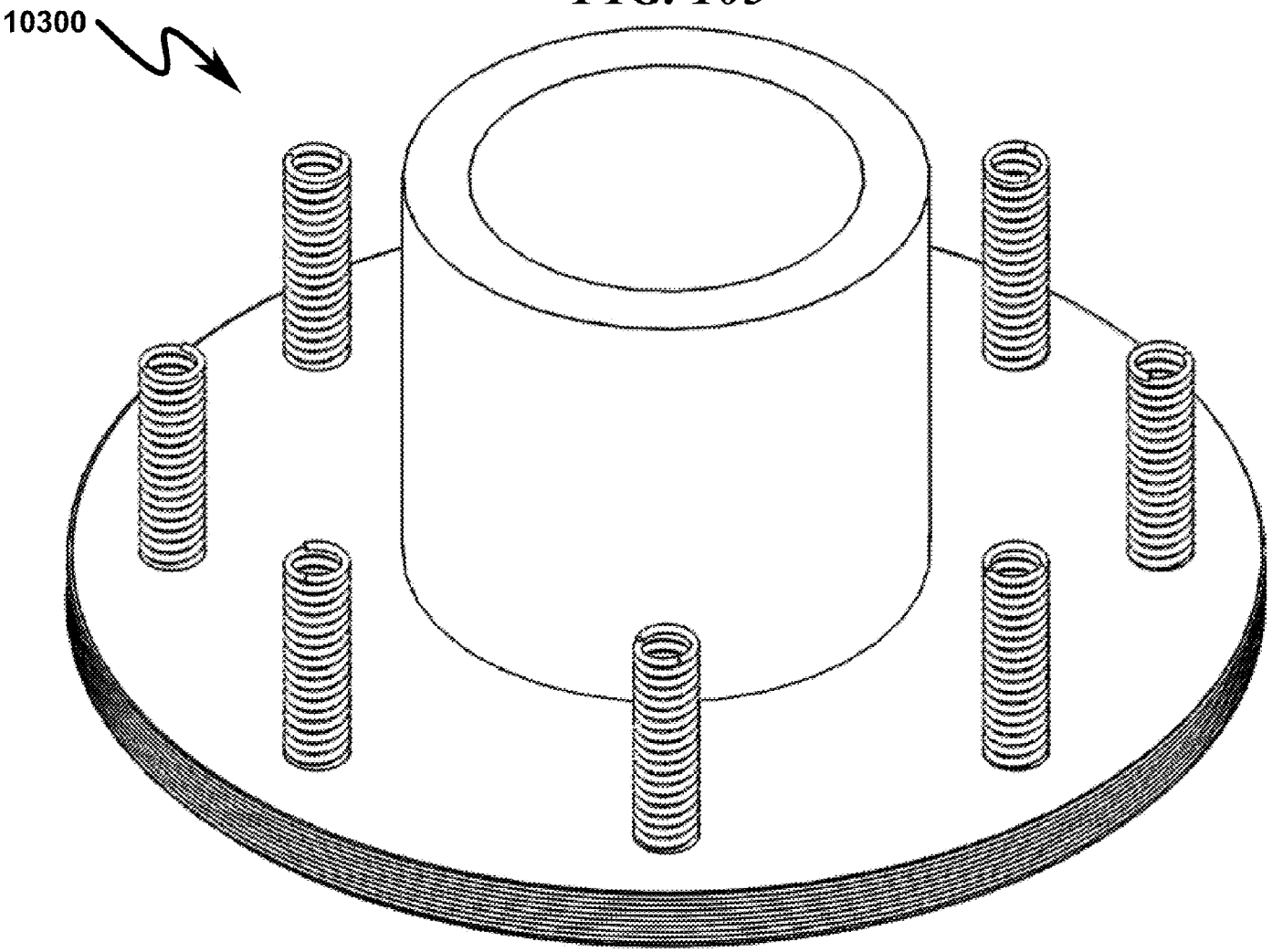
FIG. 103 illustrates a top perspective view of an exemplary thru-hole hydraulic tensioner useful in some preferred invention embodiments with hydraulic ram and outer housing shell removed.
Figure 104:
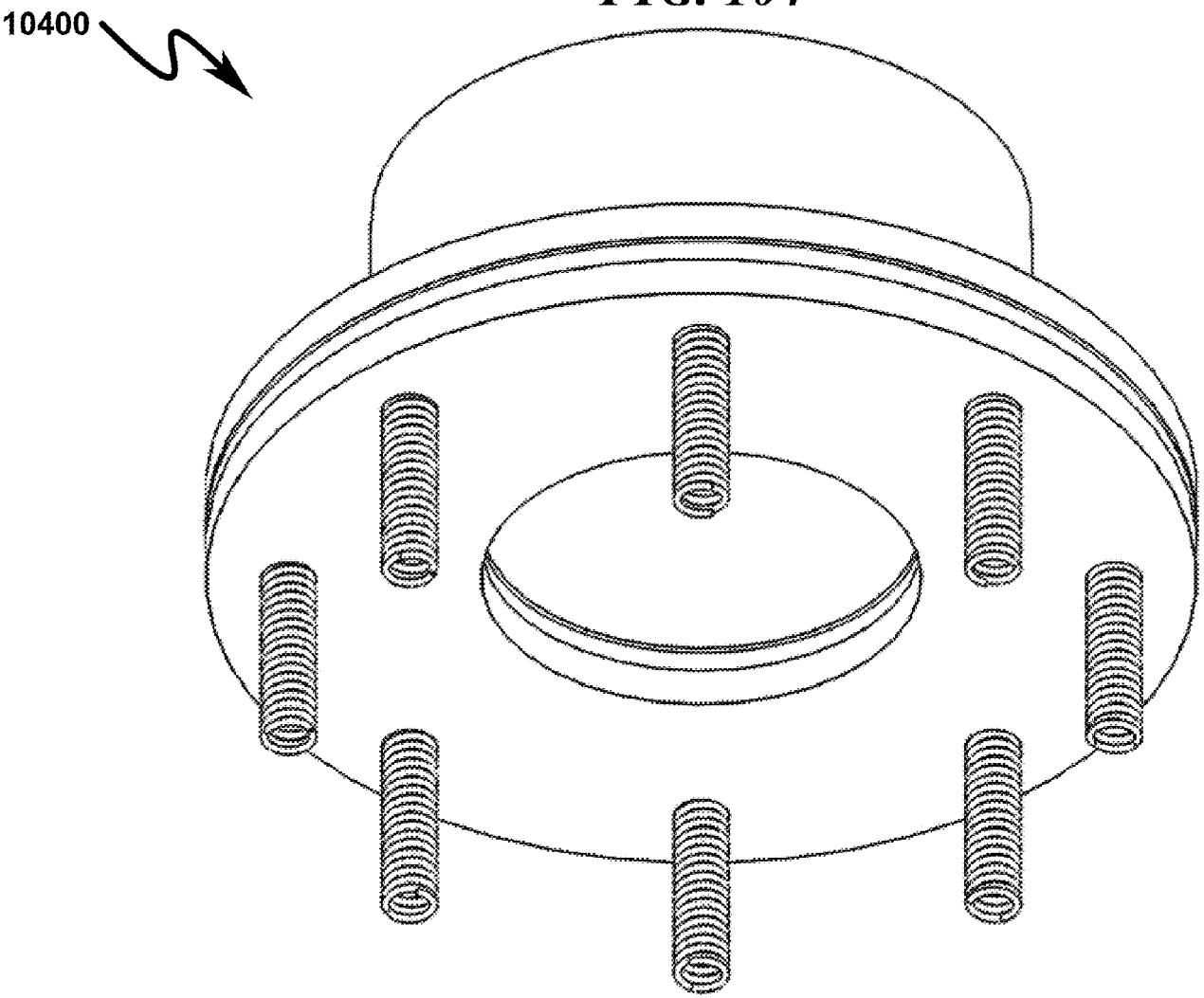
FIG. 104 illustrates a bottom perspective view of an exemplary thru-hole hydraulic tensioner useful in some preferred invention embodiments with outer housing shell and bottom core support removed.

FIG. 101 (10100)-FIG. 104 (10400) depict various perspective assembly views having variations wherein the hydraulic ram is removed (FIG. 101 (10100)), the support shell is removed (FIG. 102 (10200)), the hydraulic core base and springs are isolated (FIG. 103 (10300)), and the hydraulic ram and springs are isolated (FIG. 104 (10400)).

This hydraulic tensioner arrangement may be hydraulically activated as the TSCR is positioned at certain rotational positions such that when the hydraulic pump rams are activated (and pumping concrete through the output port) the seal between the TSCR and TSSP is maintained and thus prevents concrete from being ejected back into the material hopper. Various alternate preferred embodiments of the invention depicted in FIG. 105 (10500)-FIG. 192 (19200) depict the use of this hydraulic tensioner in use.

Alternate Preferred Embodiment—YE Tube (10500)-(12800)

Figure 105:
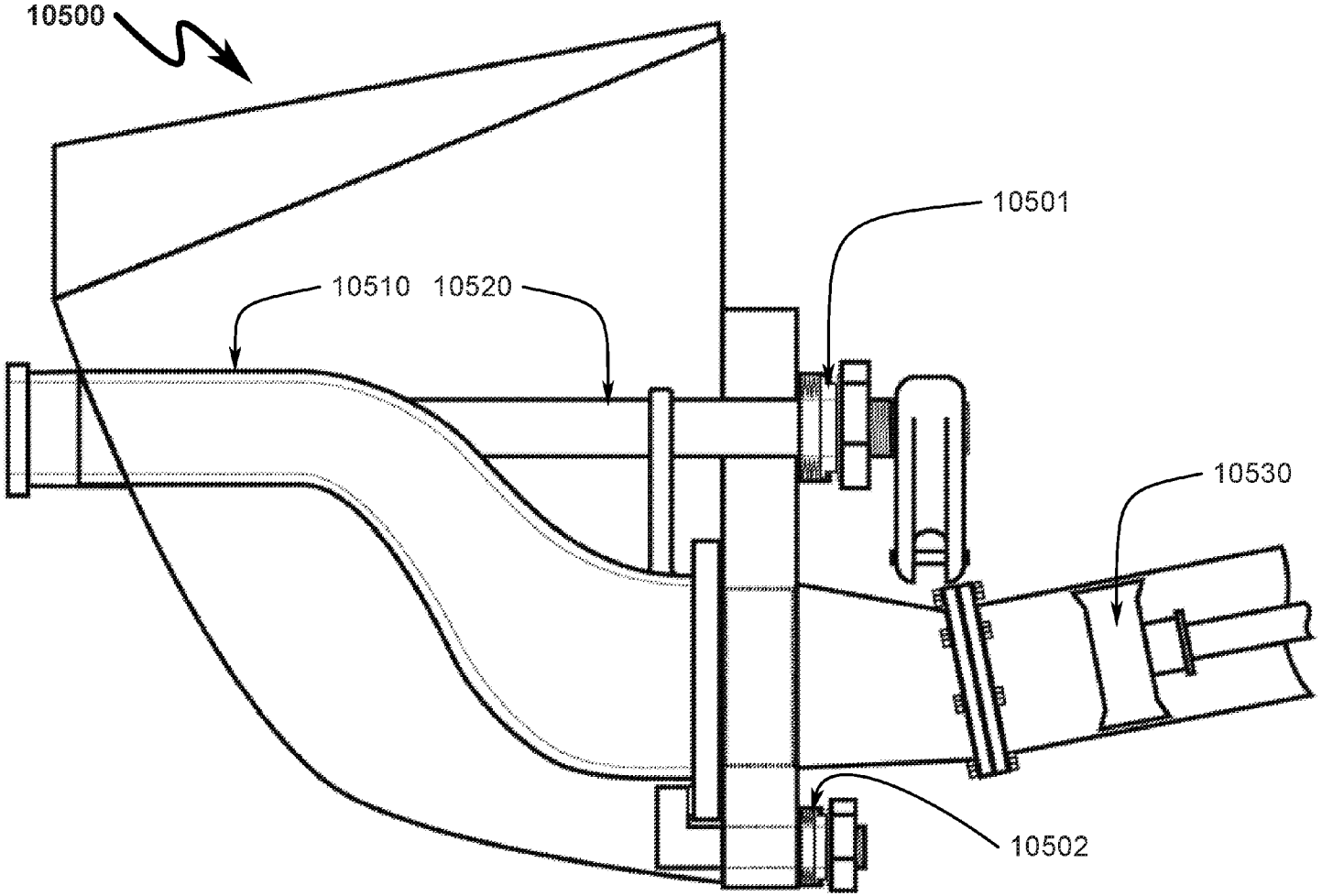
FIG. 105 illustrates a general side sectional view of a preferred exemplary embodiment of the present invention incorporating a YS tube and hopper with auto compensating cutting ring hydraulic tensioning.

The present invention also anticipates that the output ejection port may have a variety of configurations. One alternative preferred output port configuration is generally illustrated in FIG. 105 (10500)-FIG. 128 (12800) and termed a 'YS-tube' configuration in that the output ejection port (10510) is generally straight and pivots around the driveshaft (10520) above the material hopper and inlet port hydraulic rams (10530). This configuration as generally depicted in the side sectional view of FIG. 105 (10500) can be mated with the trapezoidal injection port and hydraulic pump ram synchronization described herein to affect an efficient retrofit to existing concrete pump systems using this configuration or intergrated into newly manufactured units. One skilled in the art will recognize that this configuration differs from that previously described in that the articulation point for the ejection port may be driven from a coupling attached in front of the material hopper (on the same side of the material hopper as the hydraulic pump rams) and above the input port inlet pump rams.

Generally, the "YS Tube" has three operating positions. The center position allows both pumping pistons to begin its discharge stroke simultaneously prior to the other piston finishing a discharge stroke. With only one piston discharging (pumping material), it is at full desired rate of speed. When both pistons are discharging (pumping) simultaneously, they do so at half rate of speed of when discharging singularly. That results in the same rate of material being discharged (pumped) at the outlet continuously. This requires the piston retracting (loading material) at a faster rate of twice than the piston discharging (pumping concrete) singularly. One piston must fully retract (load material) a full stroke length in the same time as the opposite piston discharges (pumps material) in half of the corresponding stroke length. In contrast, prior art twin piston pumps reciprocate simultaneously at the same retracting (loading) rate as discharging (pumping) rate.

Figure 106:
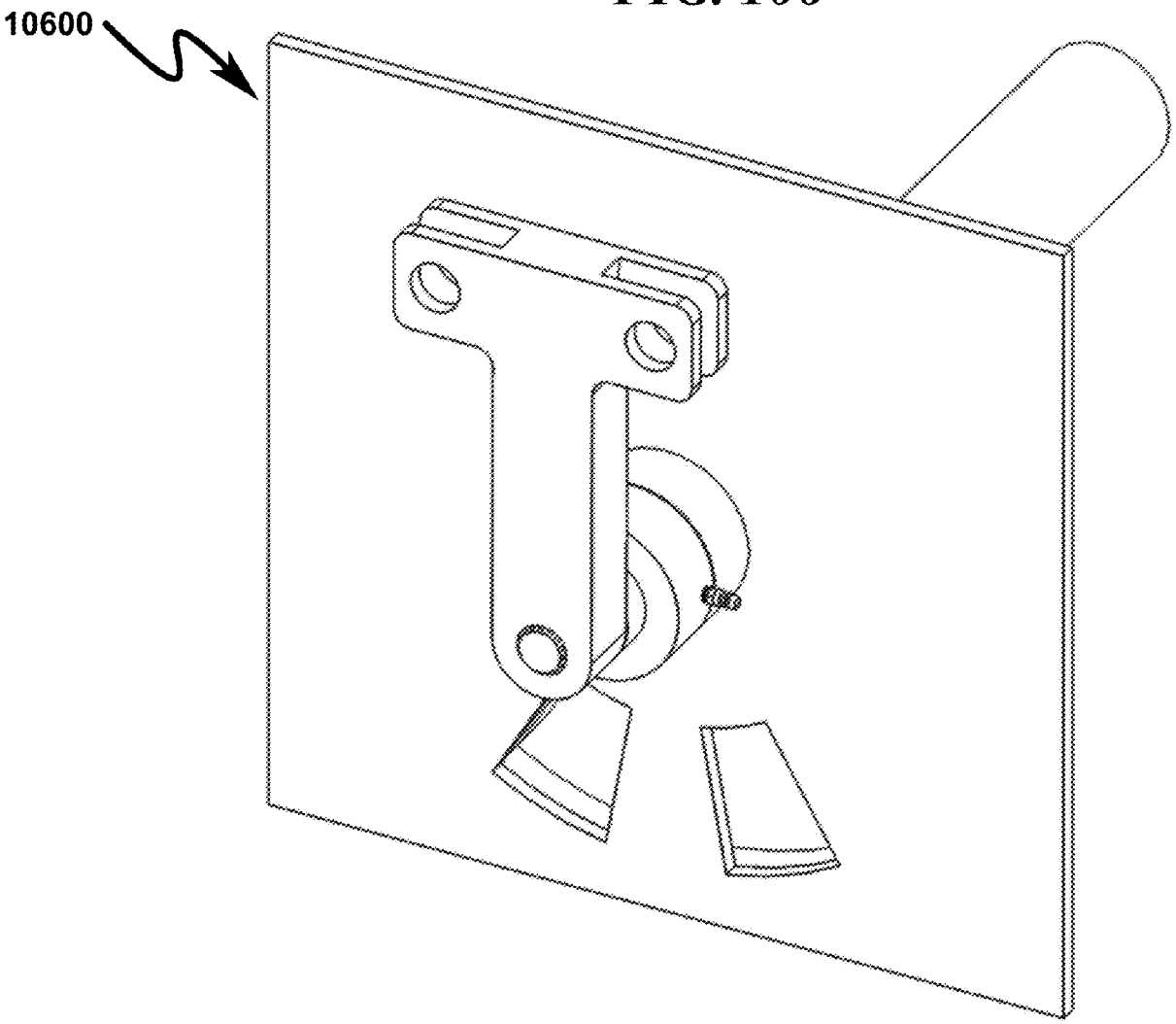
FIG. 106 illustrates a right front perspective view of an alternate preferred exemplary embodiment of the present invention with TSCR positioned to cover both hydraulic ram input ports incorporating a YS tube and hopper with auto compensating cutting ring hydraulic tensioning.
Figure 107:
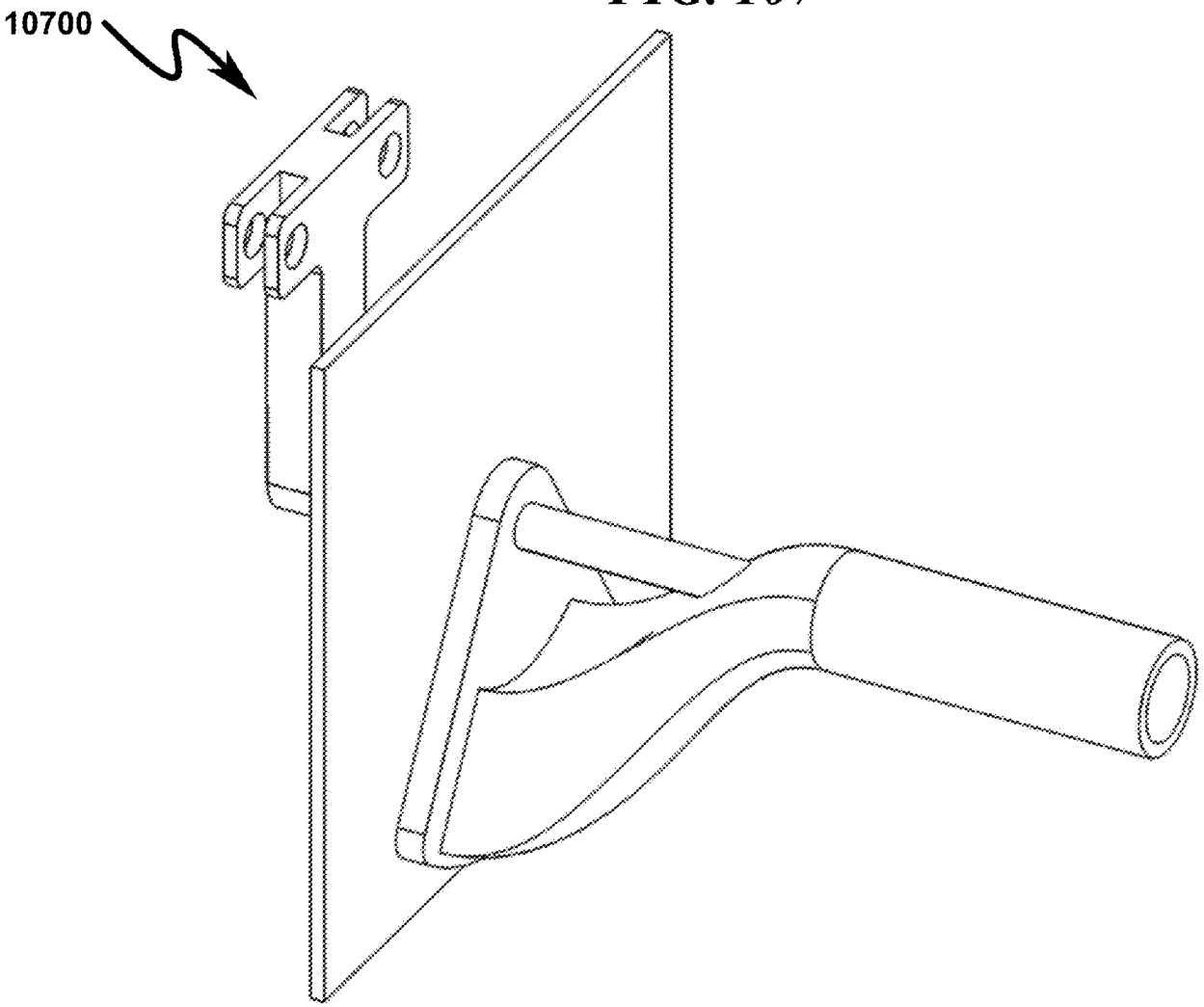
FIG. 107 illustrates a right rear perspective view of an alternate preferred exemplary embodiment of the present invention with TSCR positioned to cover both hydraulic ram input ports incorporating a YS tube and hopper with auto compensating cutting ring hydraulic tensioning.
Figure 108:
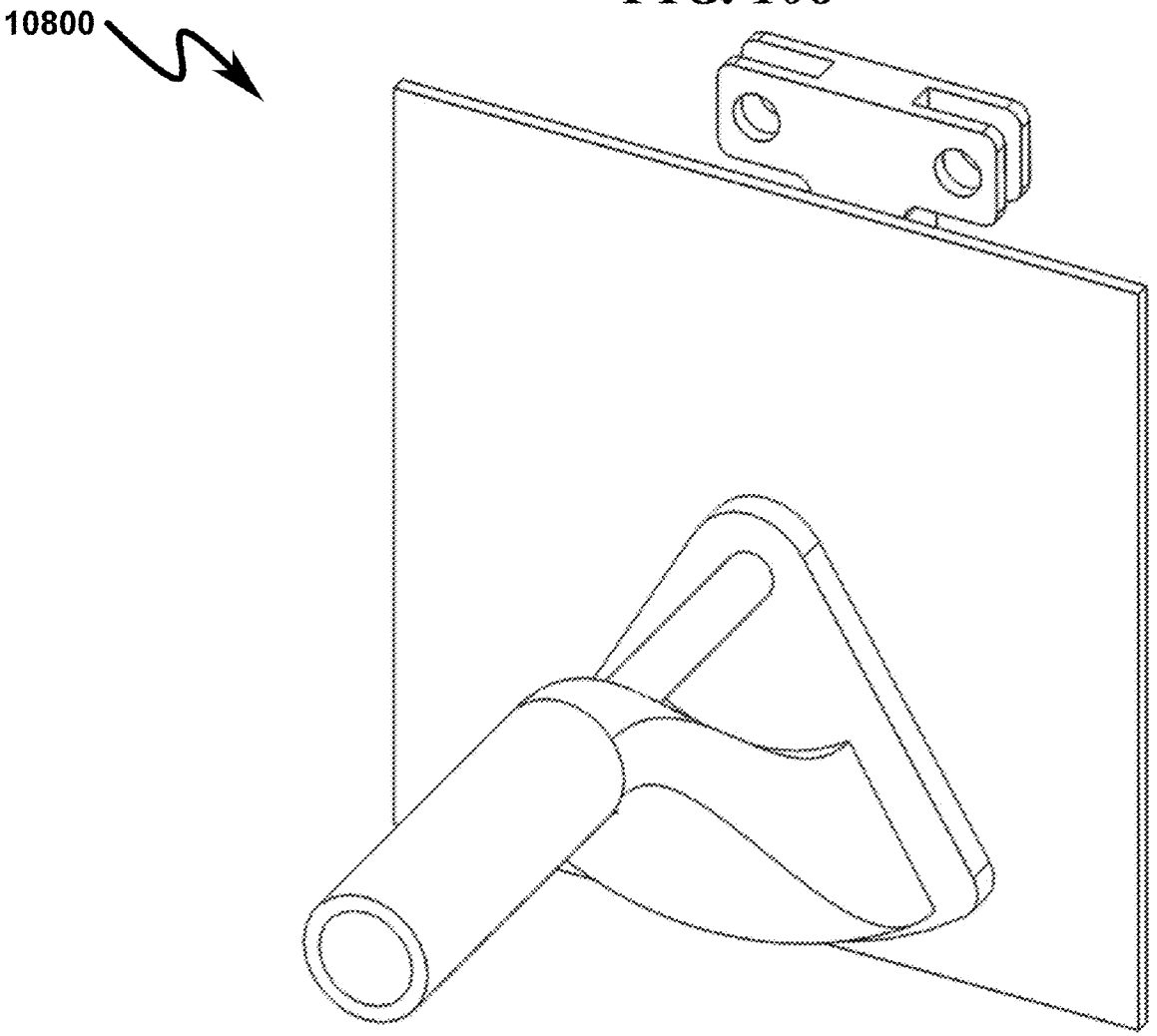
FIG. 108 illustrates a left rear perspective view of an alternate preferred exemplary embodiment of the present invention with TSCR positioned to cover both hydraulic ram input ports incorporating a YS tube and hopper with auto compensating cutting ring hydraulic tensioning.
Figure 109:
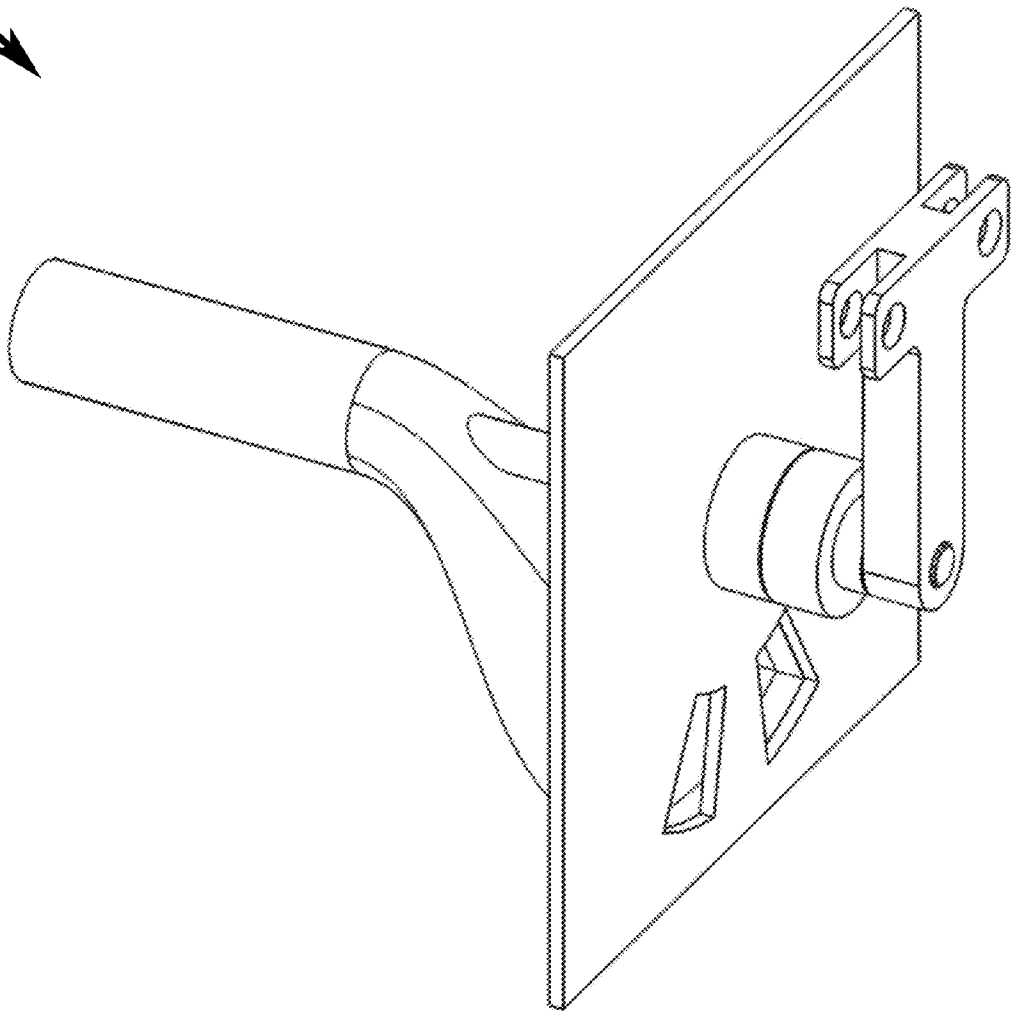
FIG. 109 illustrates a left front perspective view of an alternate preferred exemplary embodiment of the present invention with TSCR positioned to cover both hydraulic ram input ports incorporating a YS tube and hopper with auto compensating cutting ring hydraulic tensioning.
Figure 110:
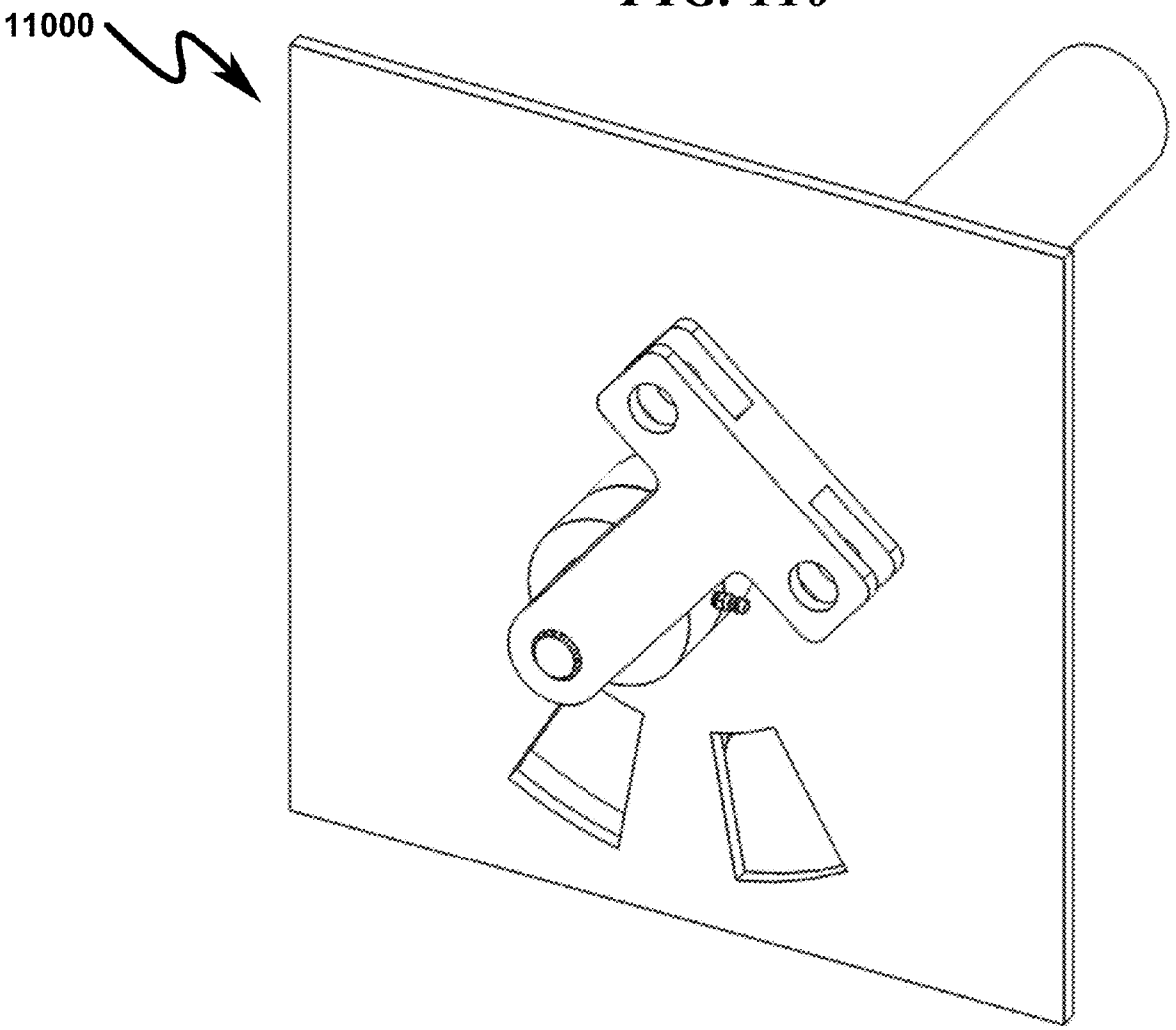
FIG. 110 illustrates a right front perspective view of an alternate preferred exemplary embodiment of the present invention with TSCR positioned to cover one hydraulic ram input port incorporating a YS tube and hopper with auto compensating cutting ring hydraulic tensioning.
Figure 111:
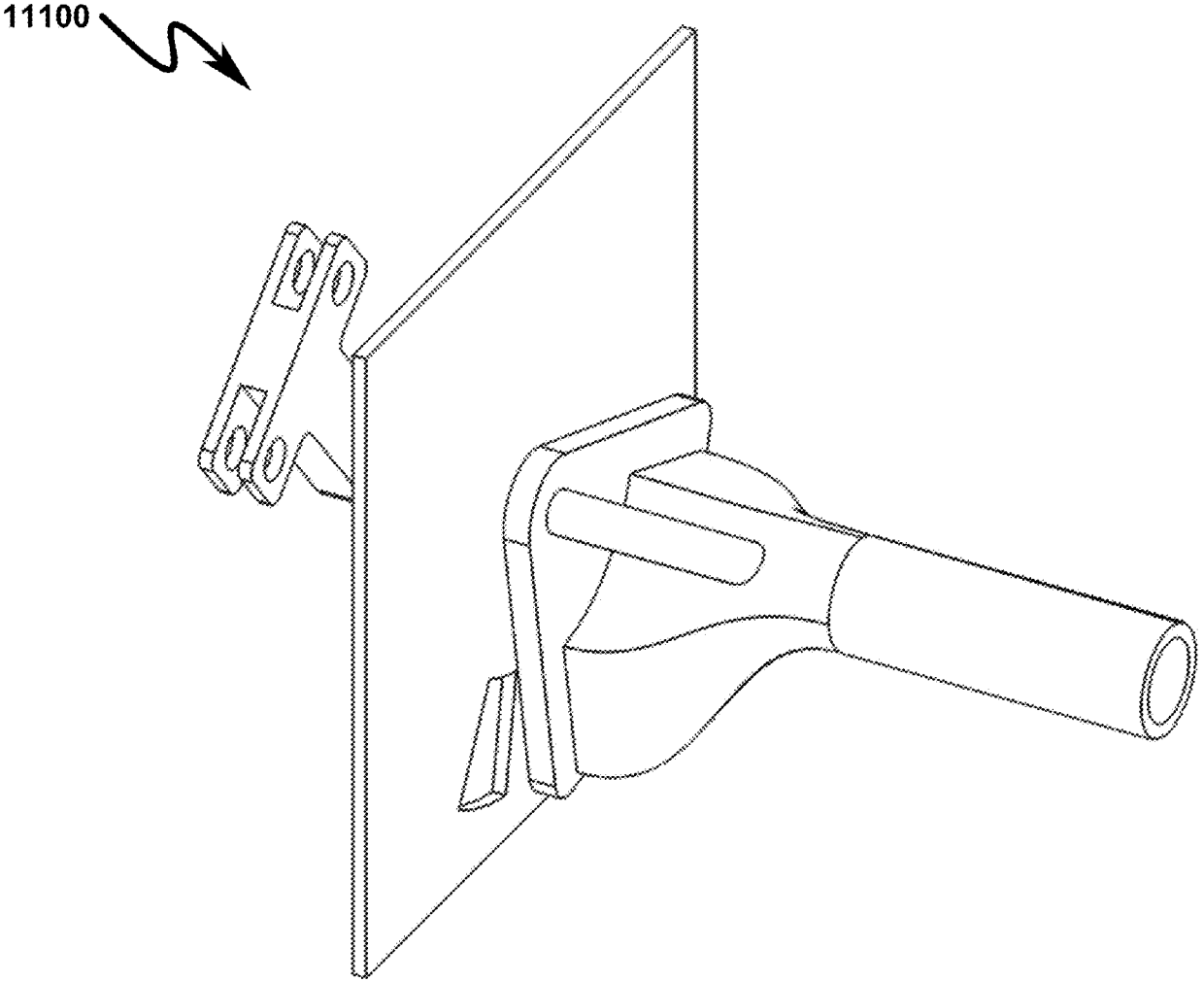
FIG. 111 illustrates a right rear perspective view of an alternate preferred exemplary embodiment of the present invention with TSCR positioned to cover one hydraulic ram input port incorporating a YS tube and hopper with auto compensating cutting ring hydraulic tensioning.
Figure 112:
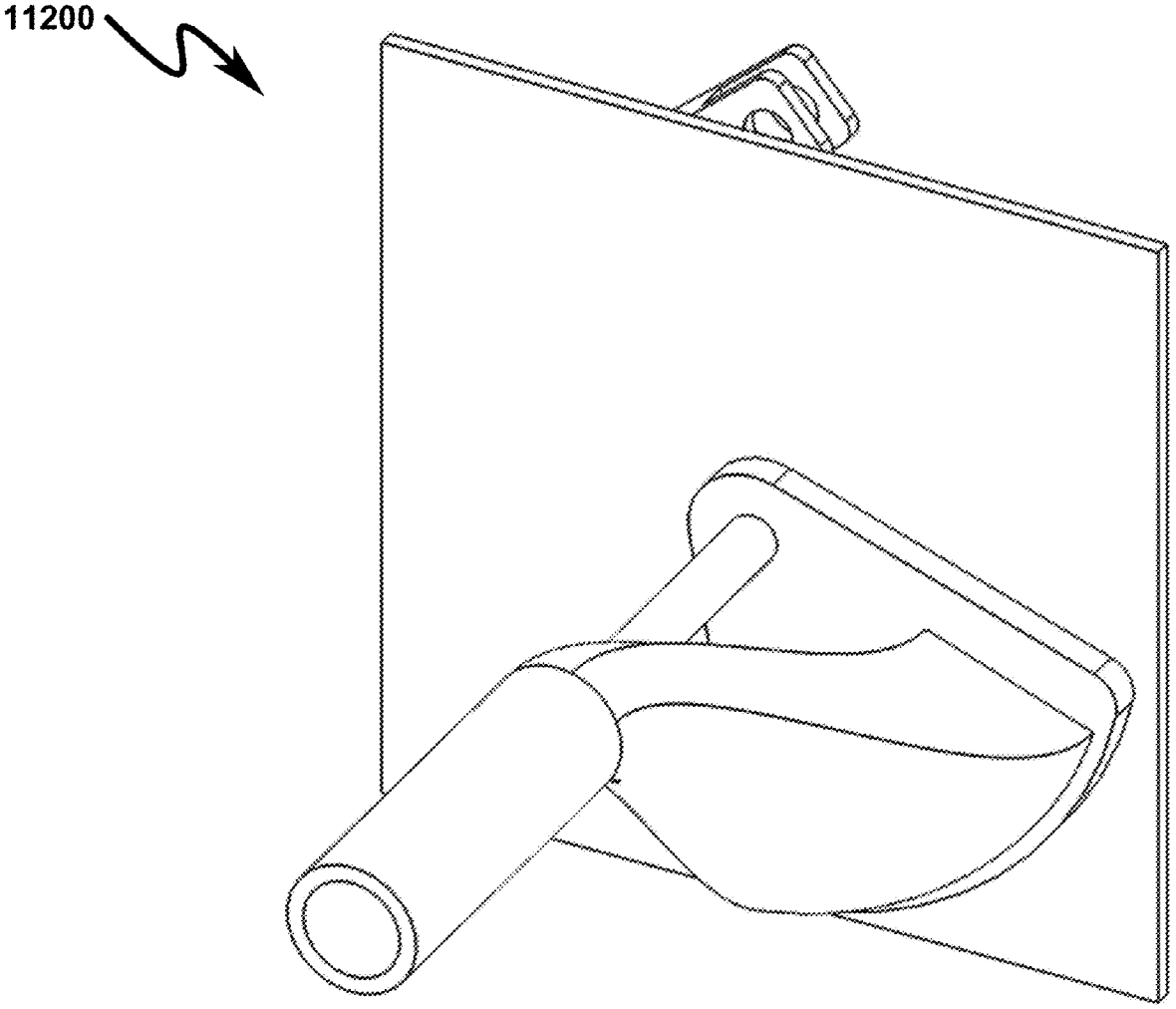
FIG. 112 illustrates a left rear perspective view of an alternate preferred exemplary embodiment of the present invention with TSCR positioned to cover one hydraulic ram input port incorporating a YS tube and hopper with auto compensating cutting ring hydraulic tensioning.
Figure 113:
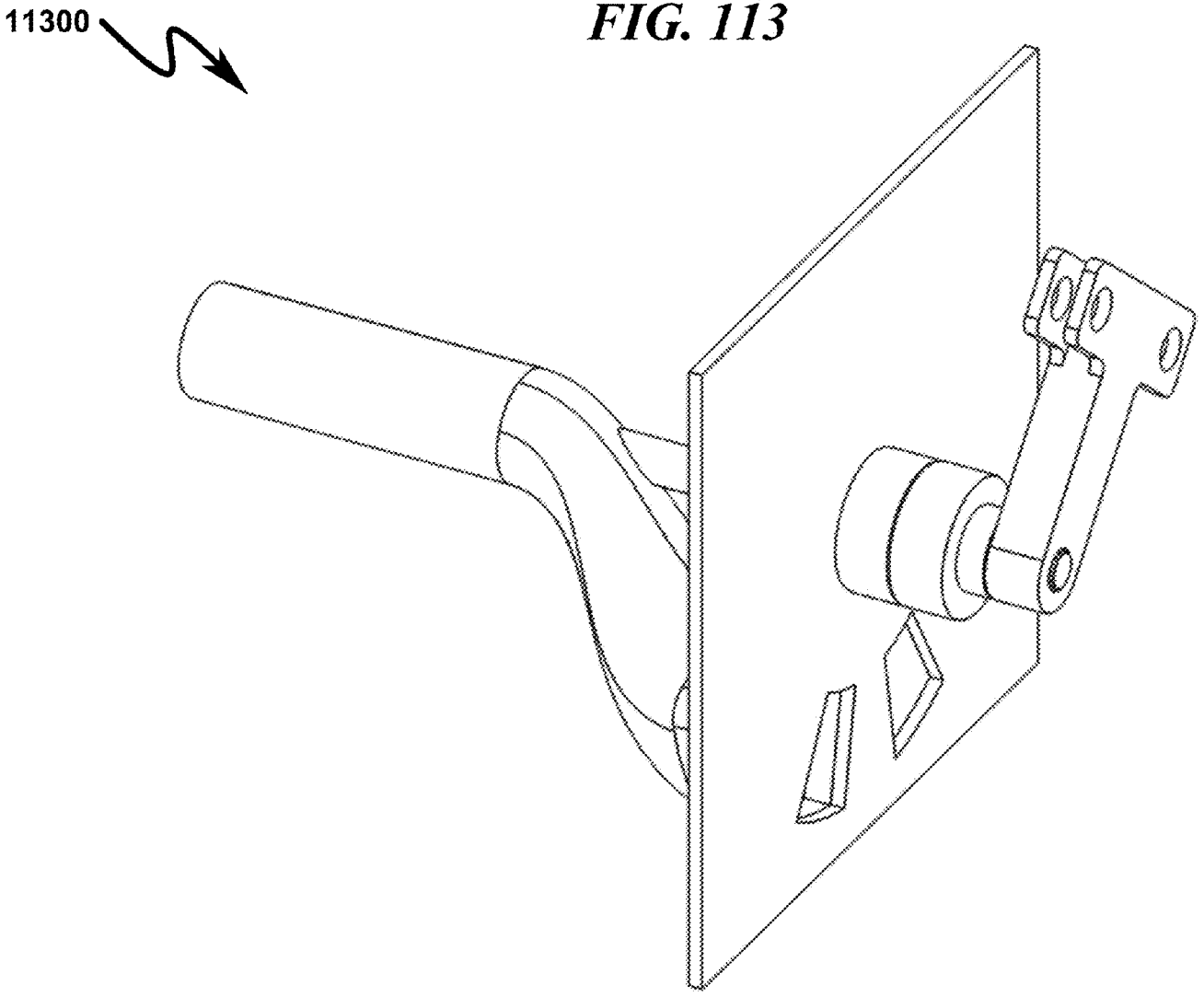
FIG. 113 illustrates a left front perspective view of an alternate preferred exemplary embodiment of the present invention with TSCR positioned to cover one hydraulic ram input port incorporating a YS tube and hopper with auto compensating cutting ring hydraulic tensioning.
Figure 114:
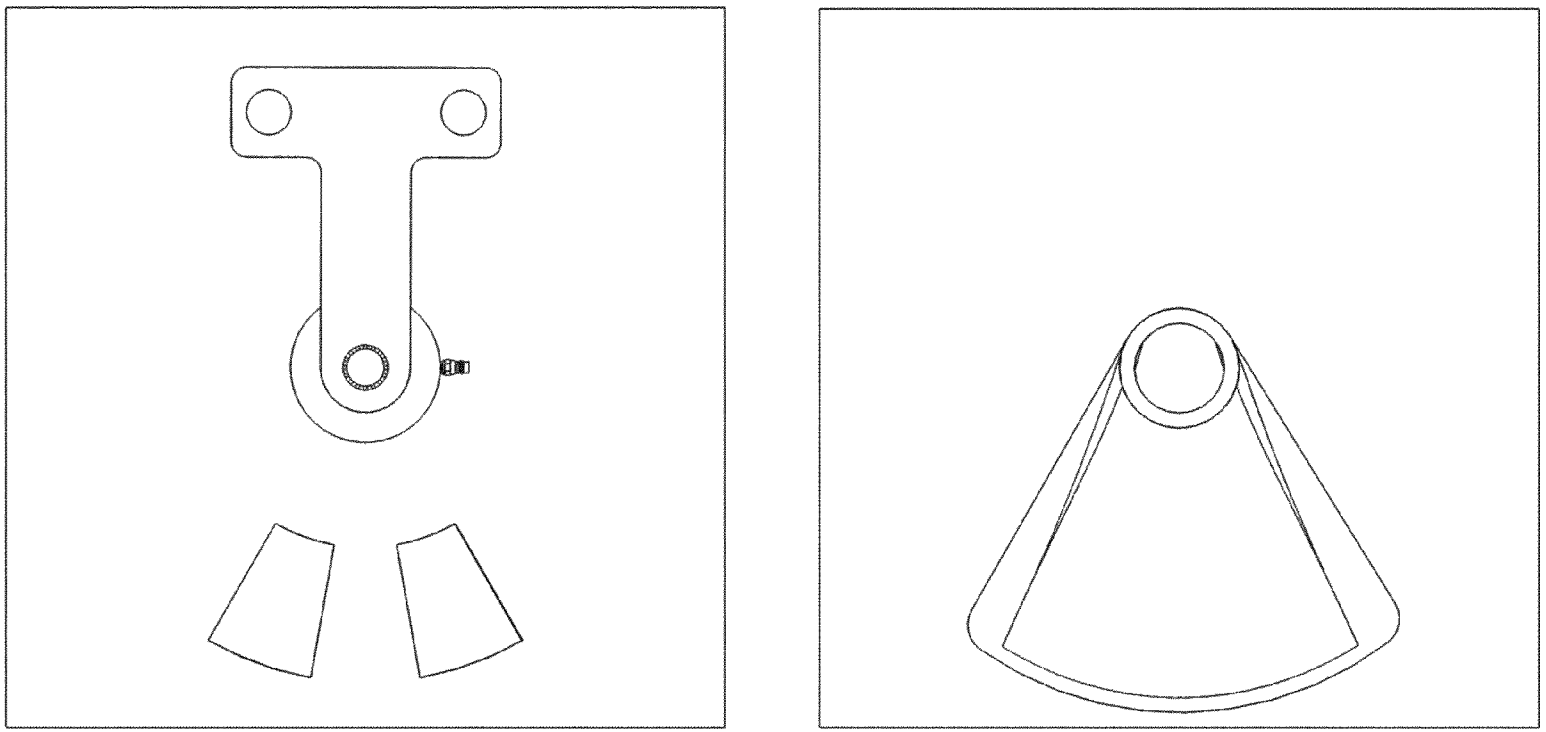
FIG. 114 illustrates front and rear views of an alternate preferred exemplary embodiment of the present invention with TSCR positioned to cover both hydraulic ram input ports incorporating a YS tube and hopper with auto compensating cutting ring hydraulic tensioning.
Figure 115:
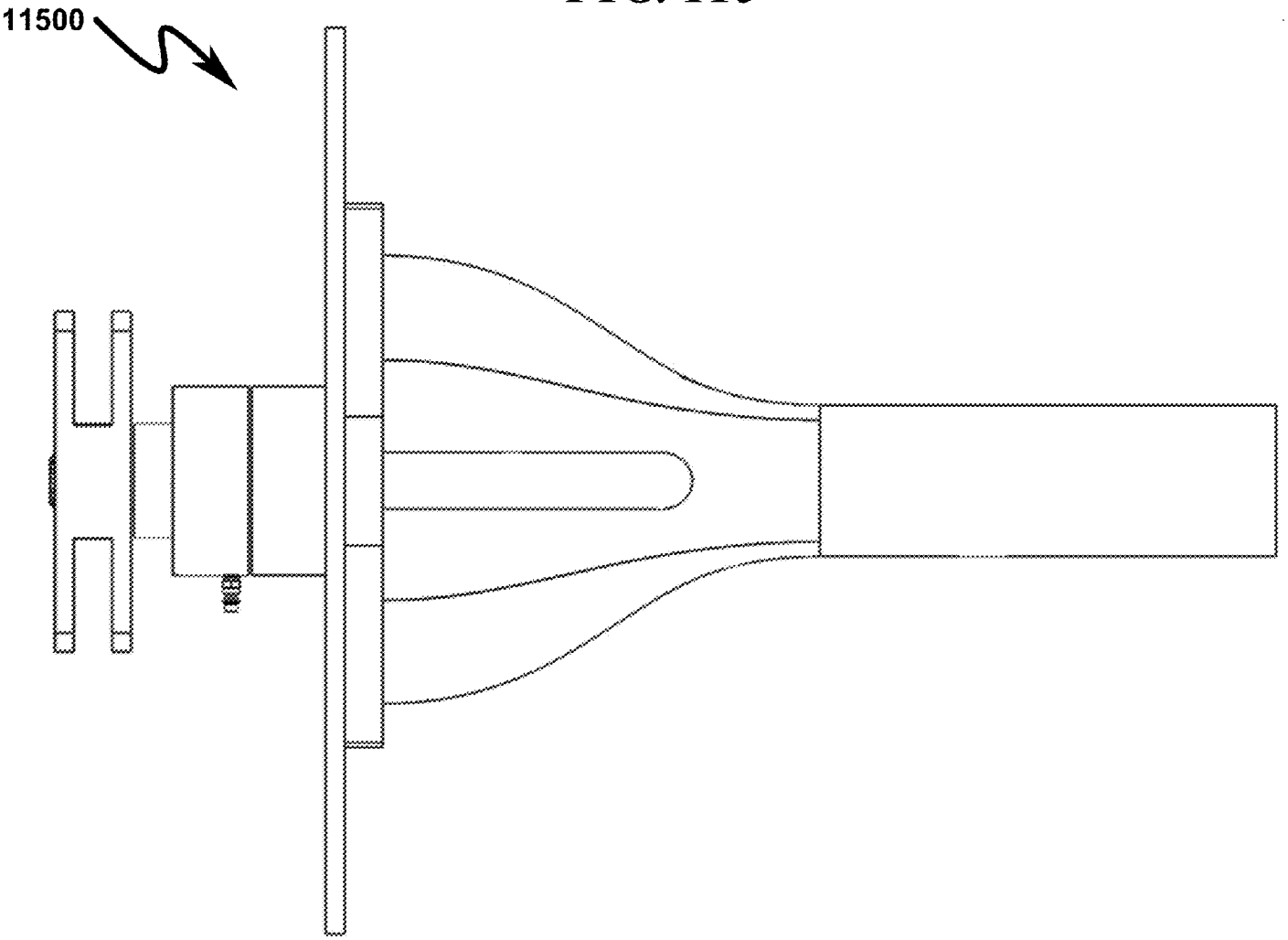
FIG. 115 illustrates a top view of an alternate preferred exemplary embodiment of the present invention with TSCR positioned to cover both hydraulic ram input ports incorporating a YS tube and hopper with auto compensating cutting ring hydraulic tensioning.
Figure 116:
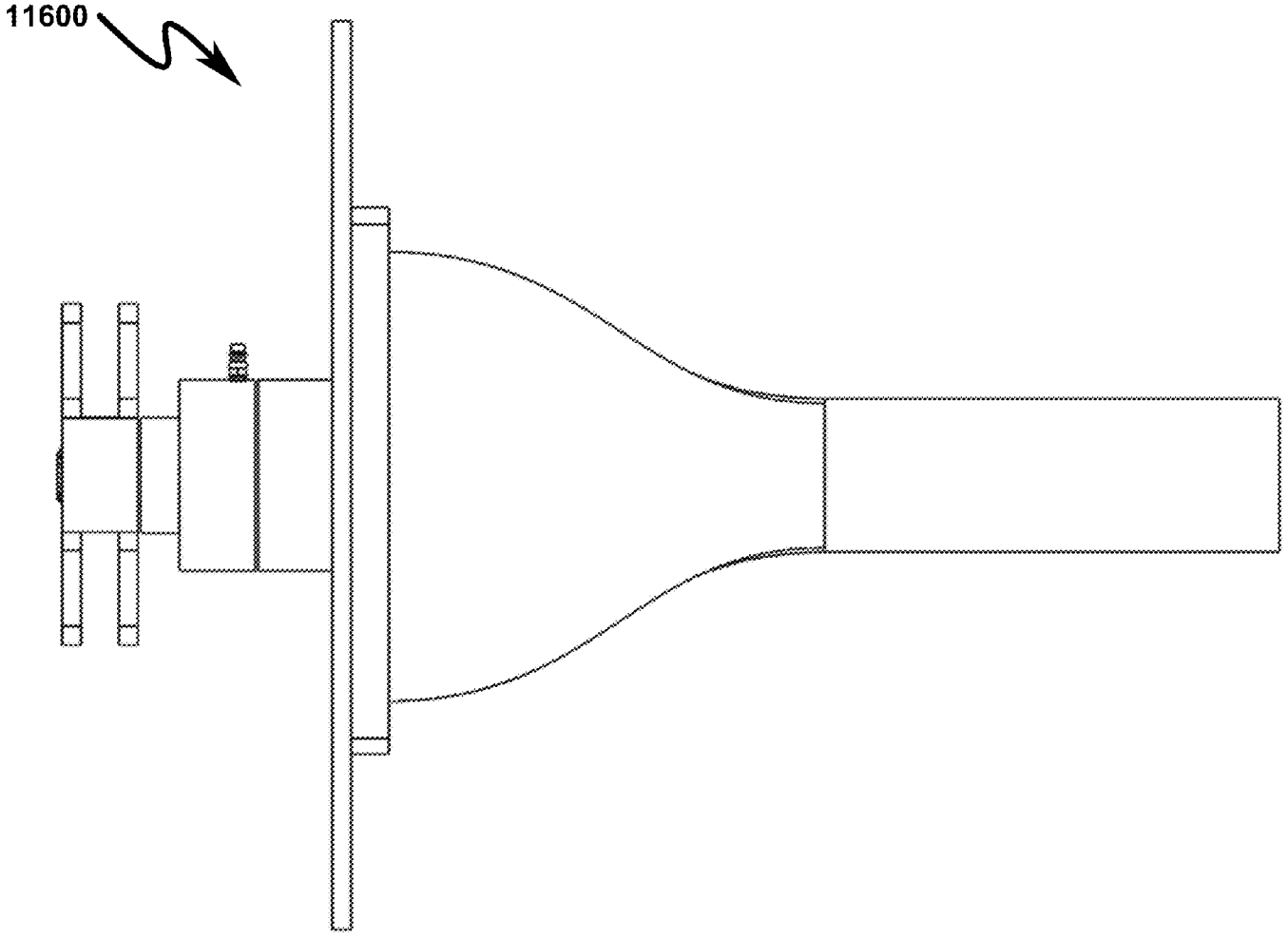
FIG. 116 illustrates a bottom view of an alternate preferred exemplary embodiment of the present invention with TSCR positioned to cover both hydraulic ram input ports incorporating a YS tube and hopper with auto compensating cutting ring hydraulic tensioning.
Figure 117:
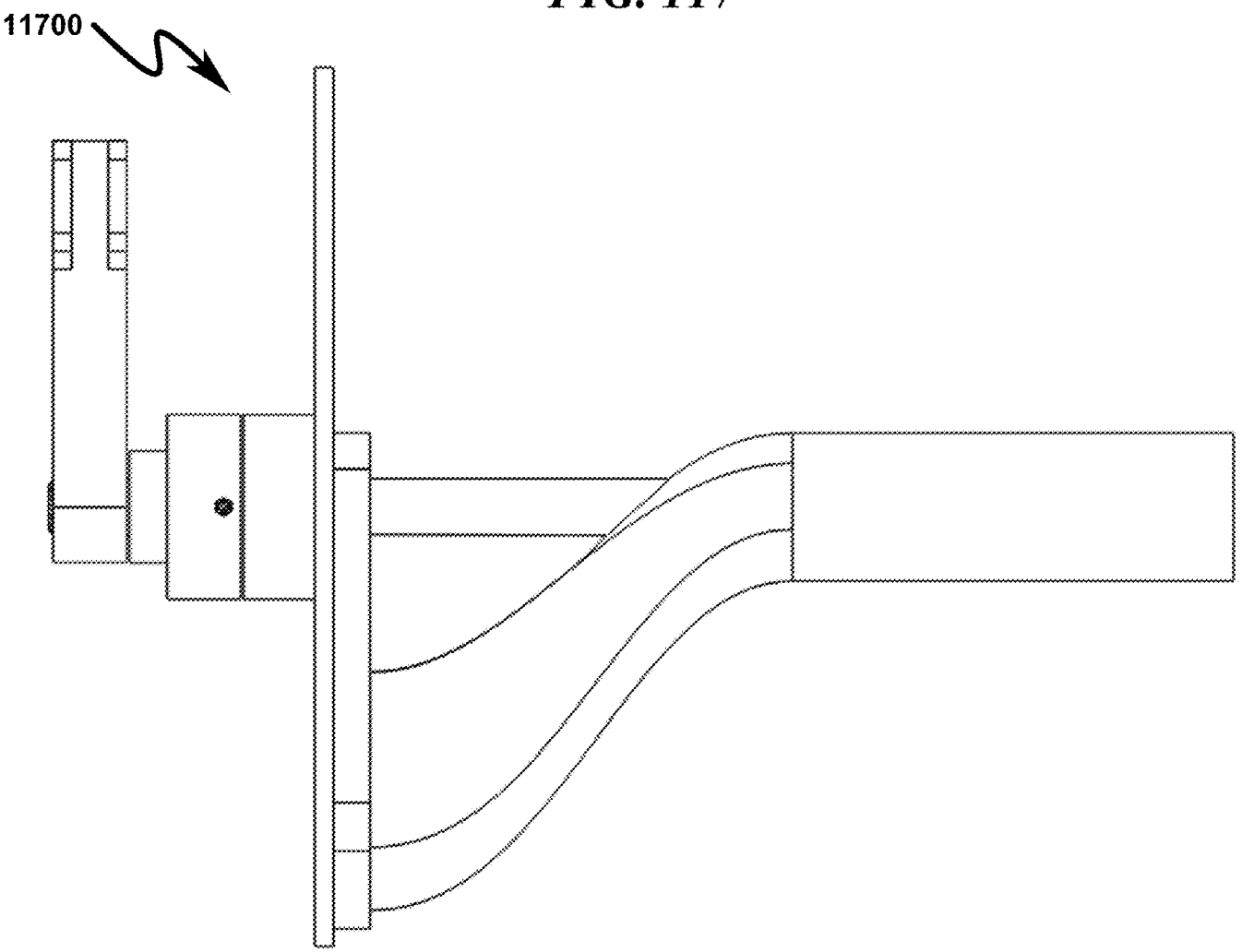
FIG. 117 illustrates a side view of an alternate preferred exemplary embodiment of the present invention with TSCR positioned to cover both hydraulic ram input ports incorporating a YS tube and hopper with auto compensating cutting ring hydraulic tensioning.
Figure 118:
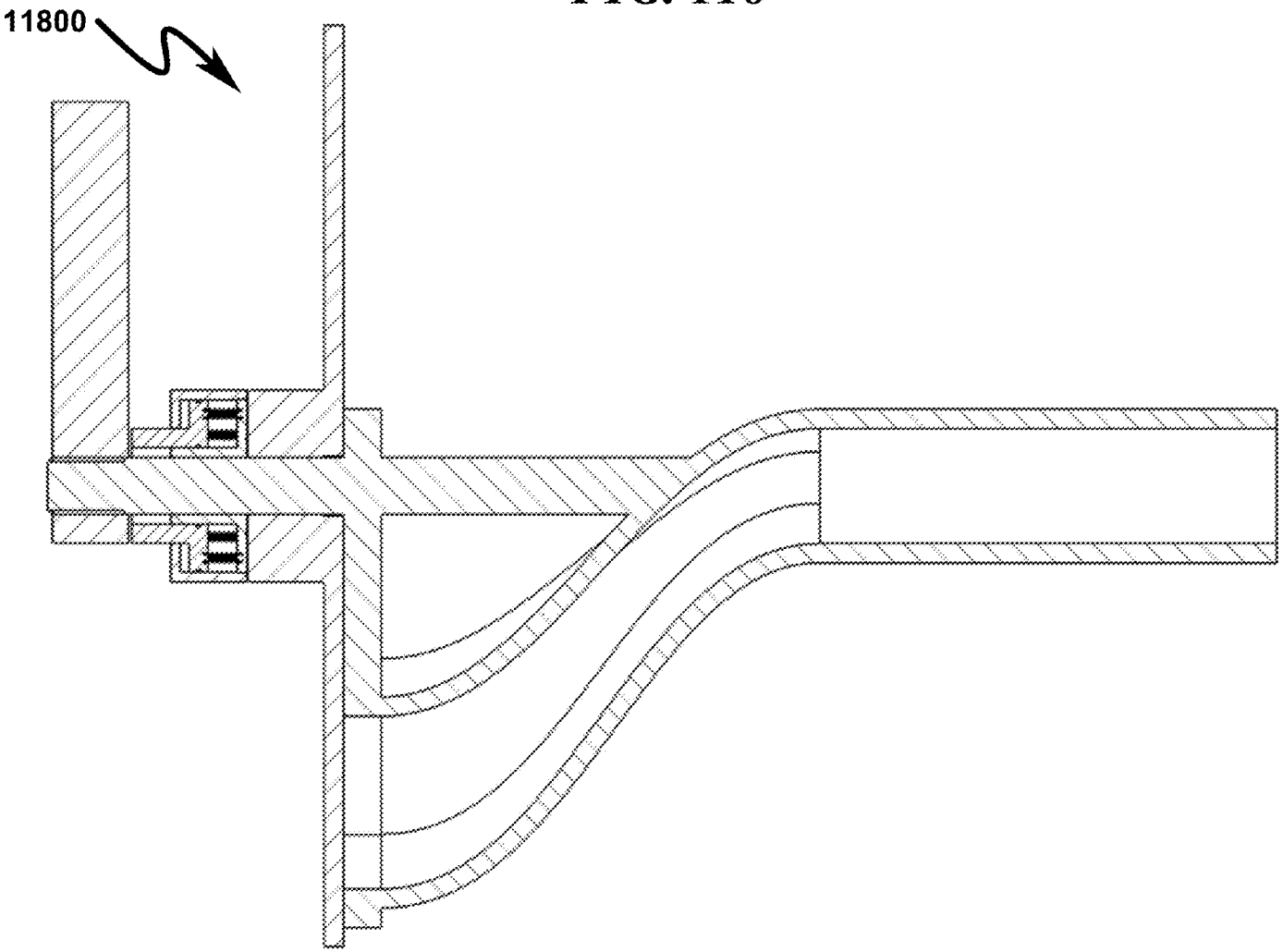
FIG. 118 illustrates a side sectional view of an alternate preferred exemplary embodiment of the present invention with TSCR positioned to cover both hydraulic ram input ports incorporating a YS tube and hopper with auto compensating cutting ring hydraulic tensioning.
Figure 119:
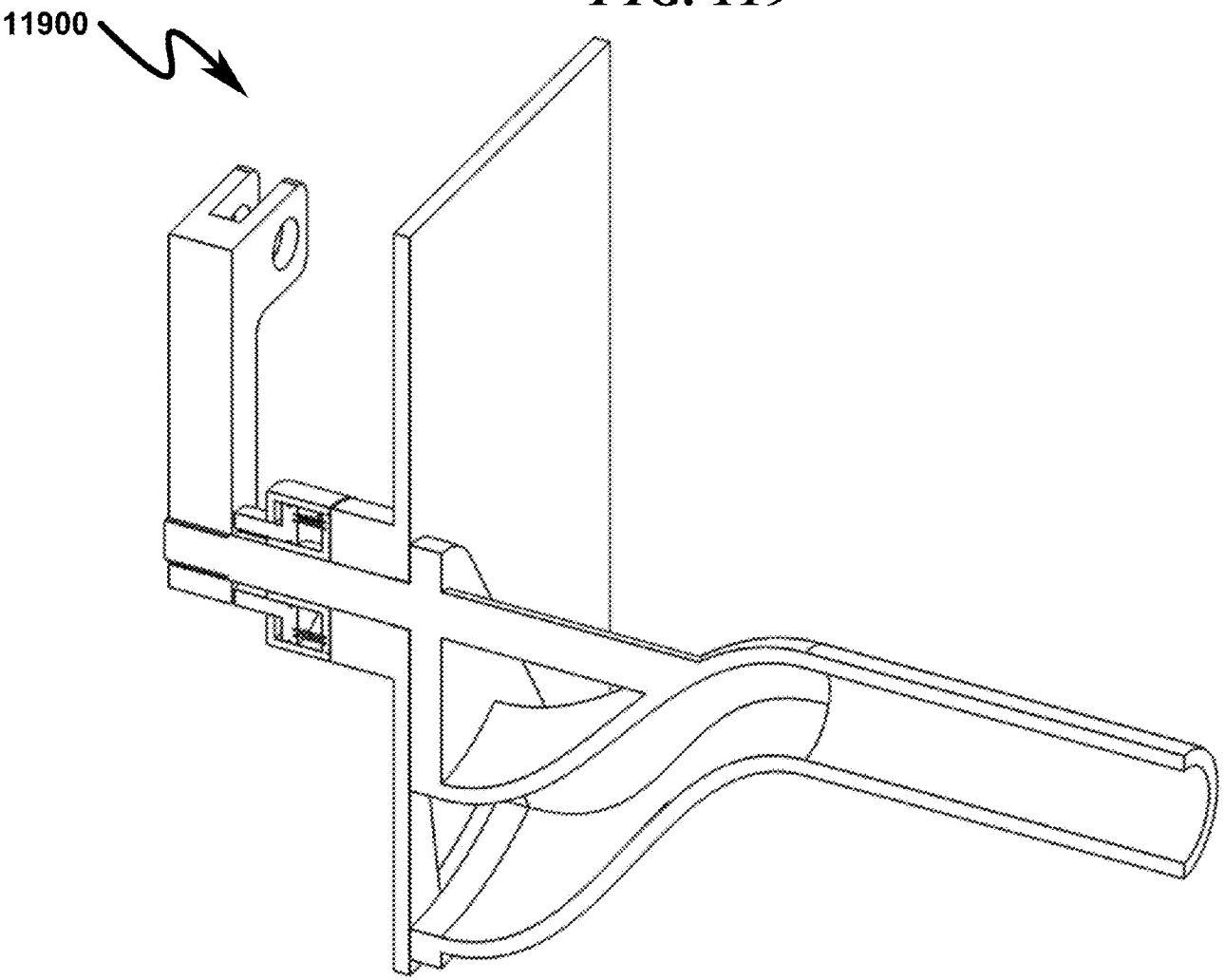
Figure 120:
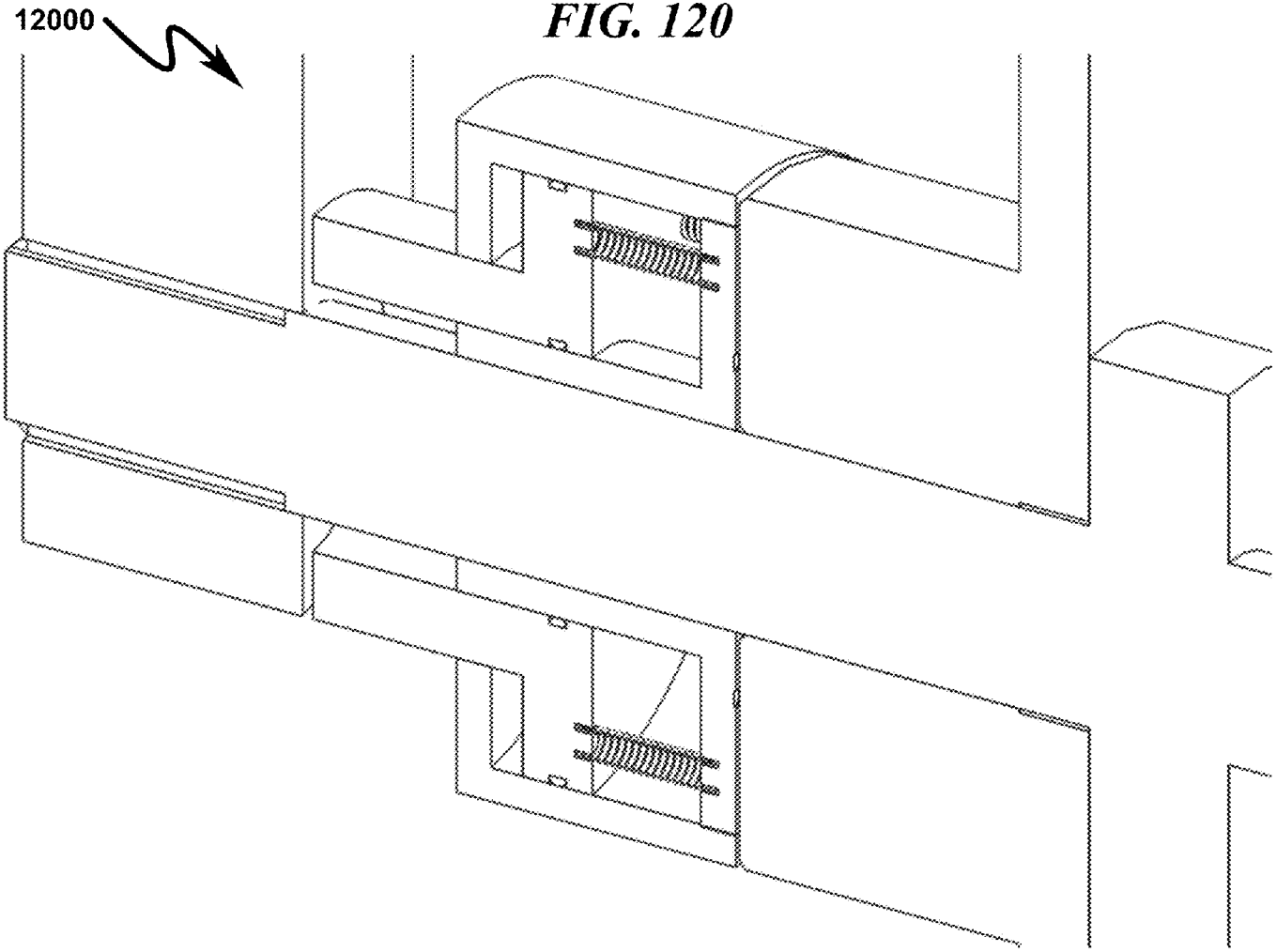
Figure 121:
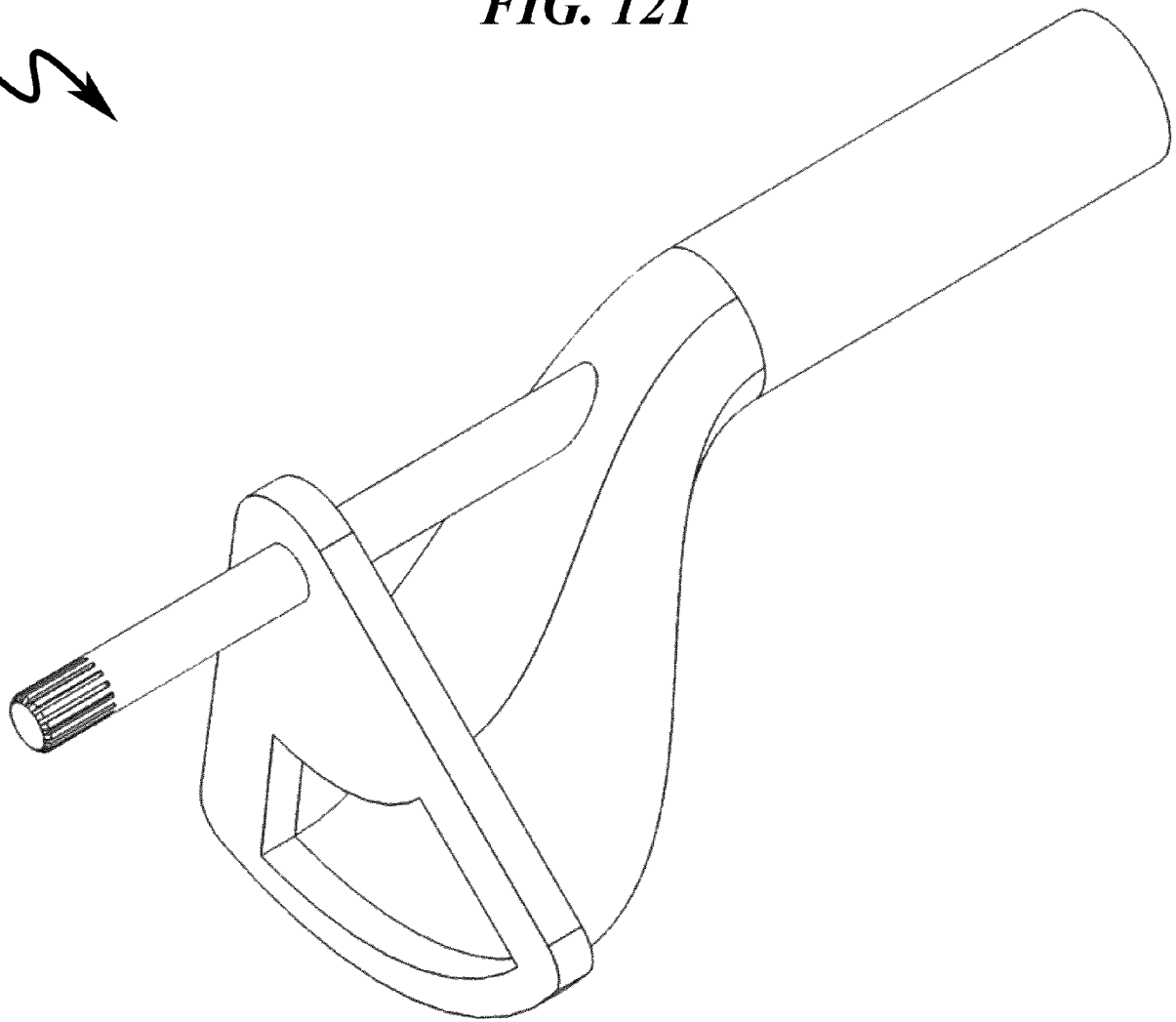
Figure 122:
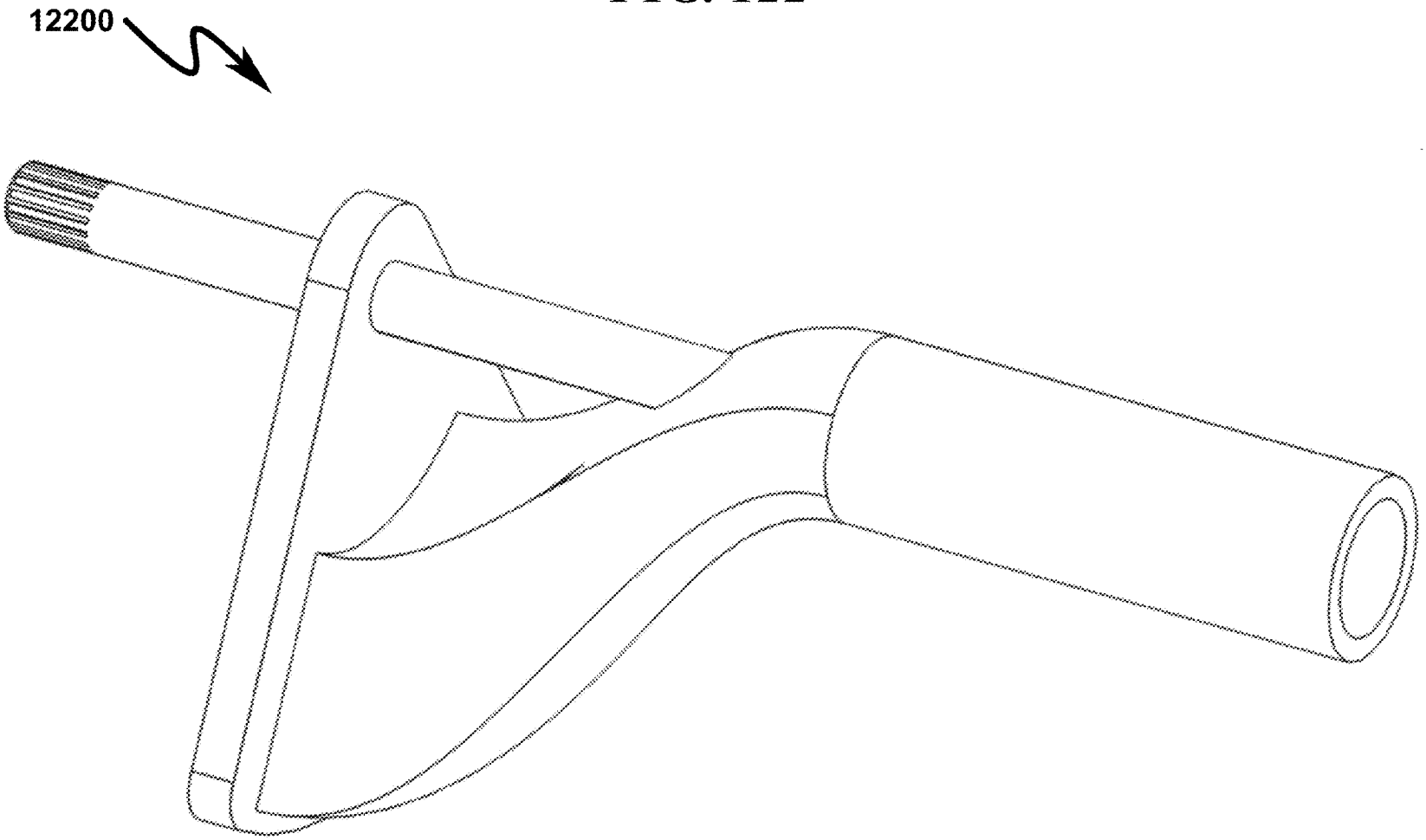
Figure 123:
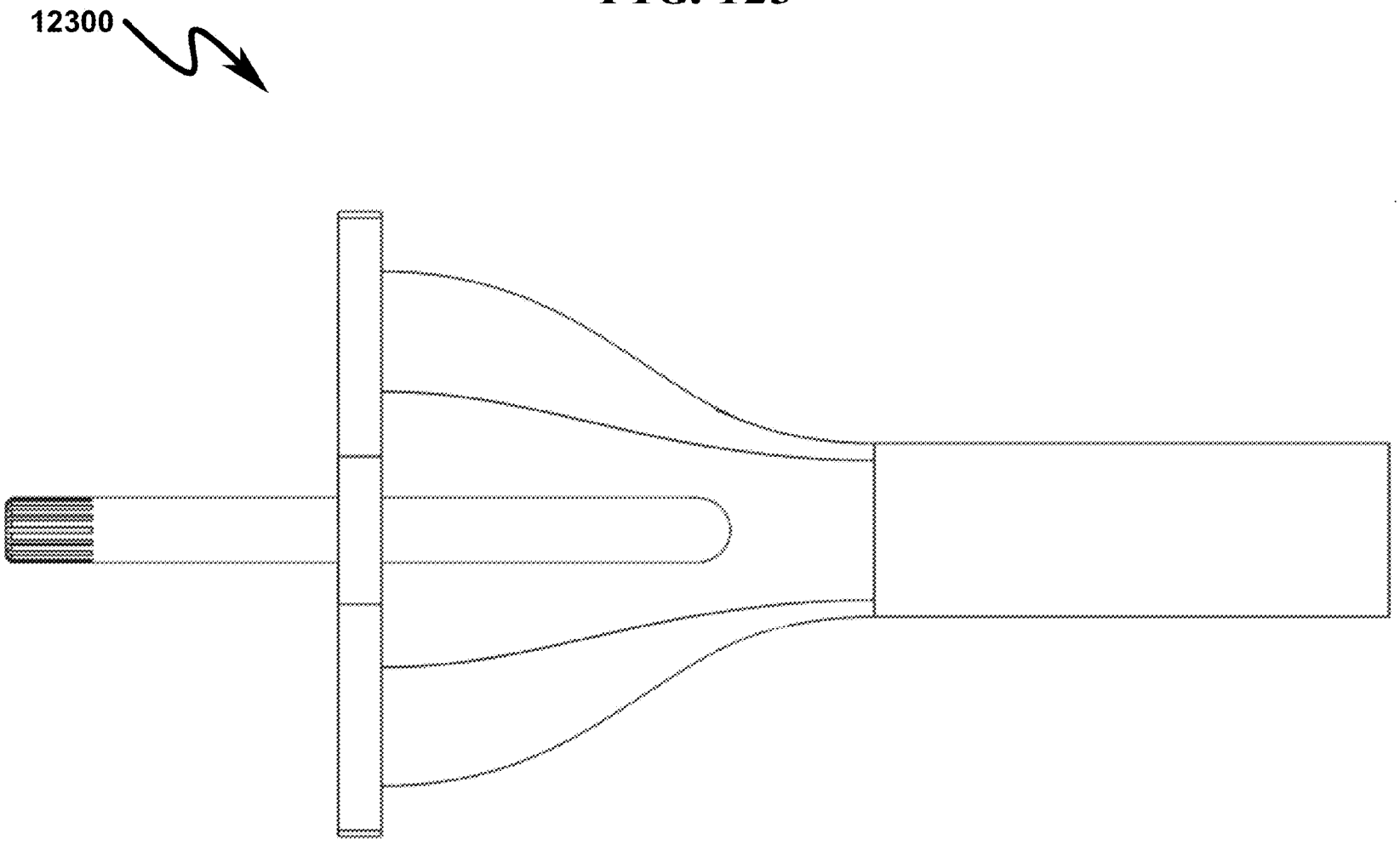
Figure 124:
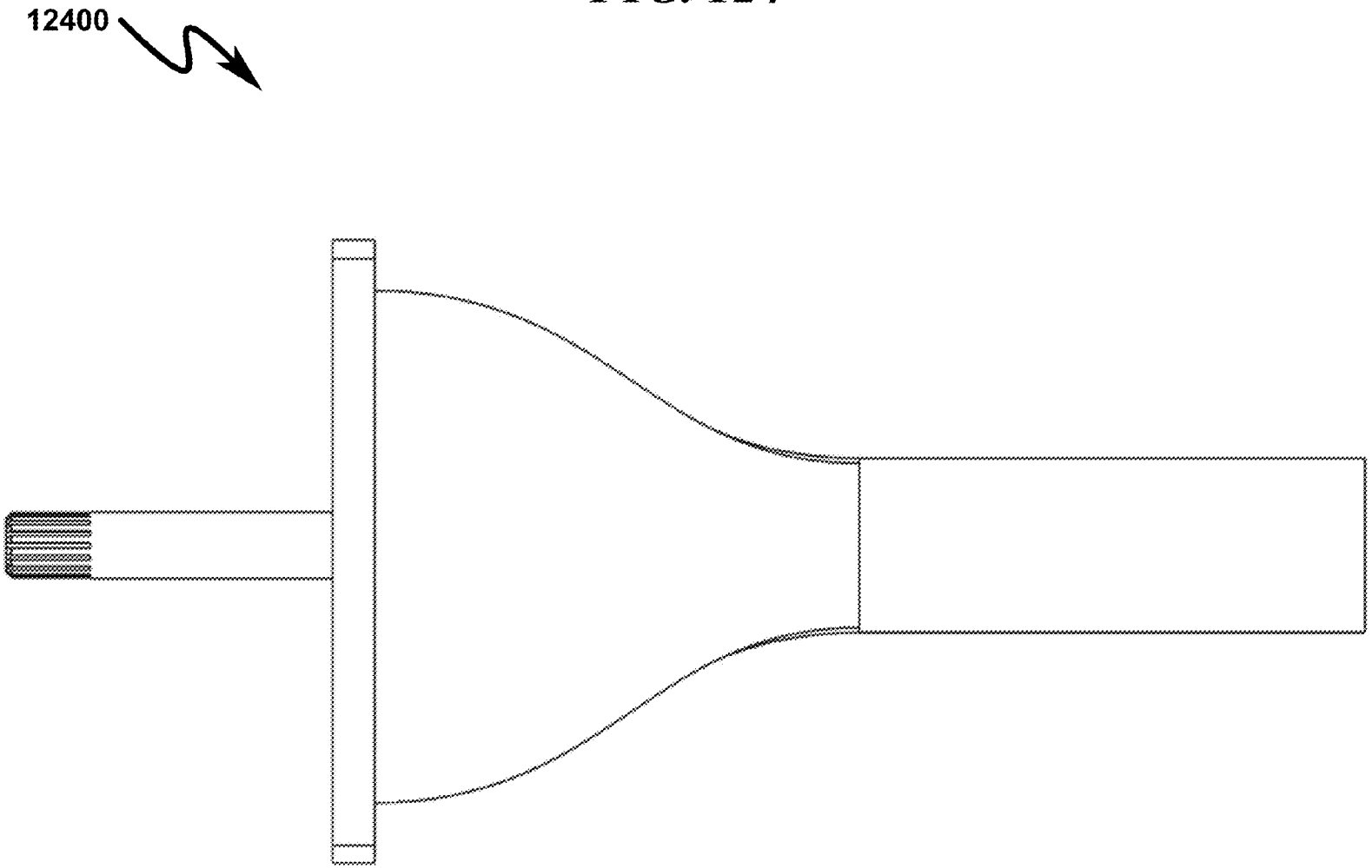
Figure 125:
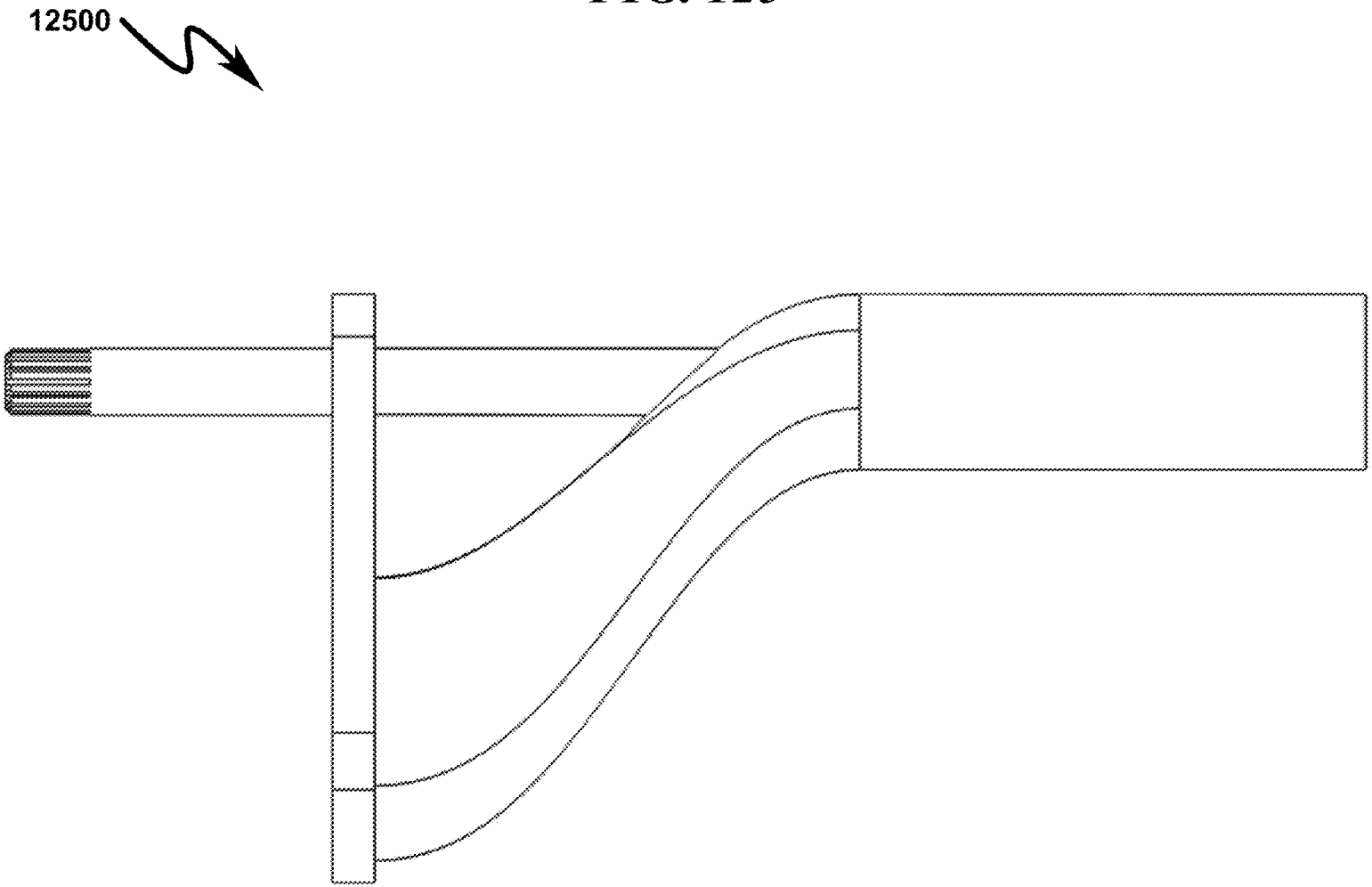
Figure 126:
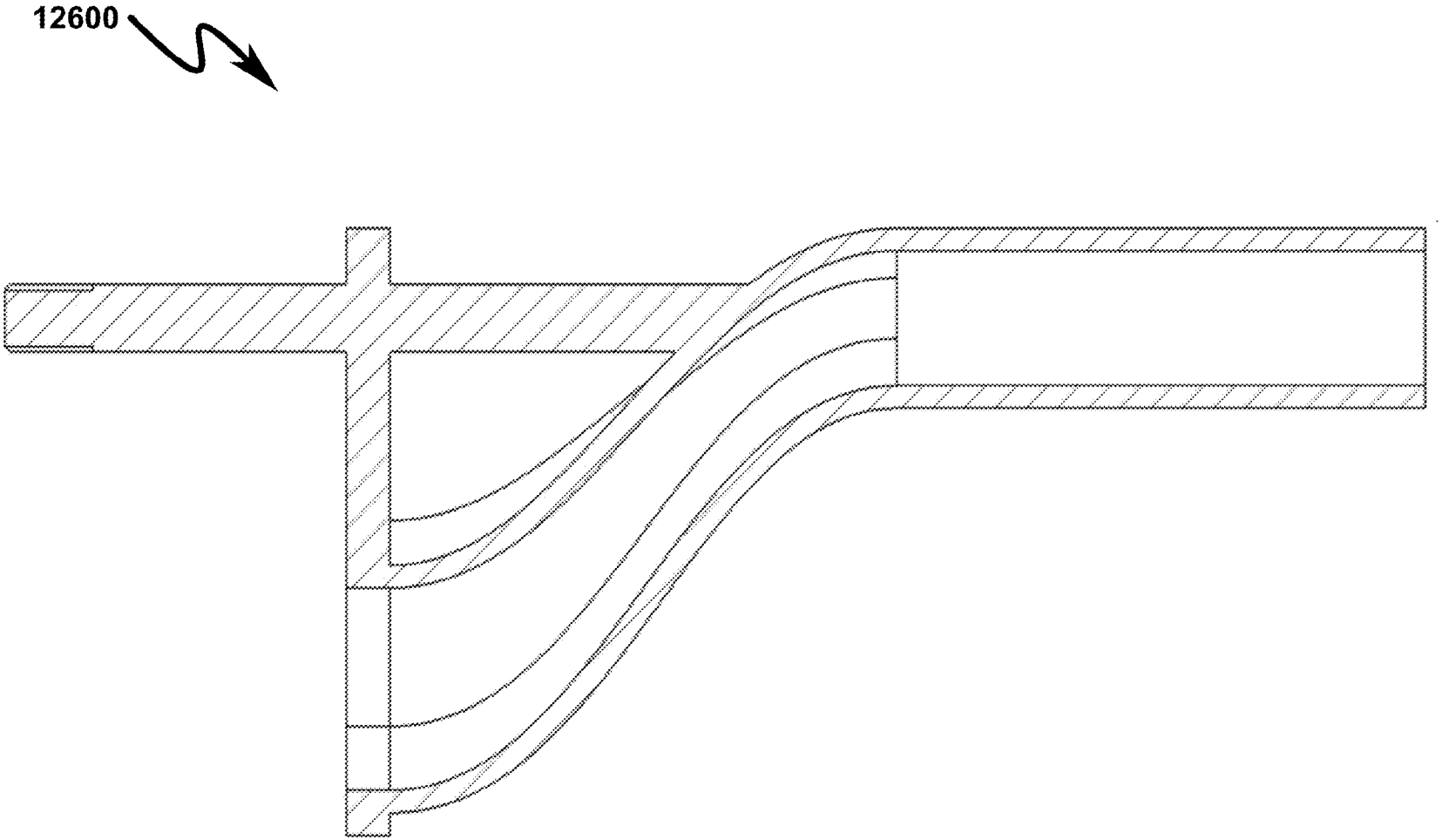
Figure 127:
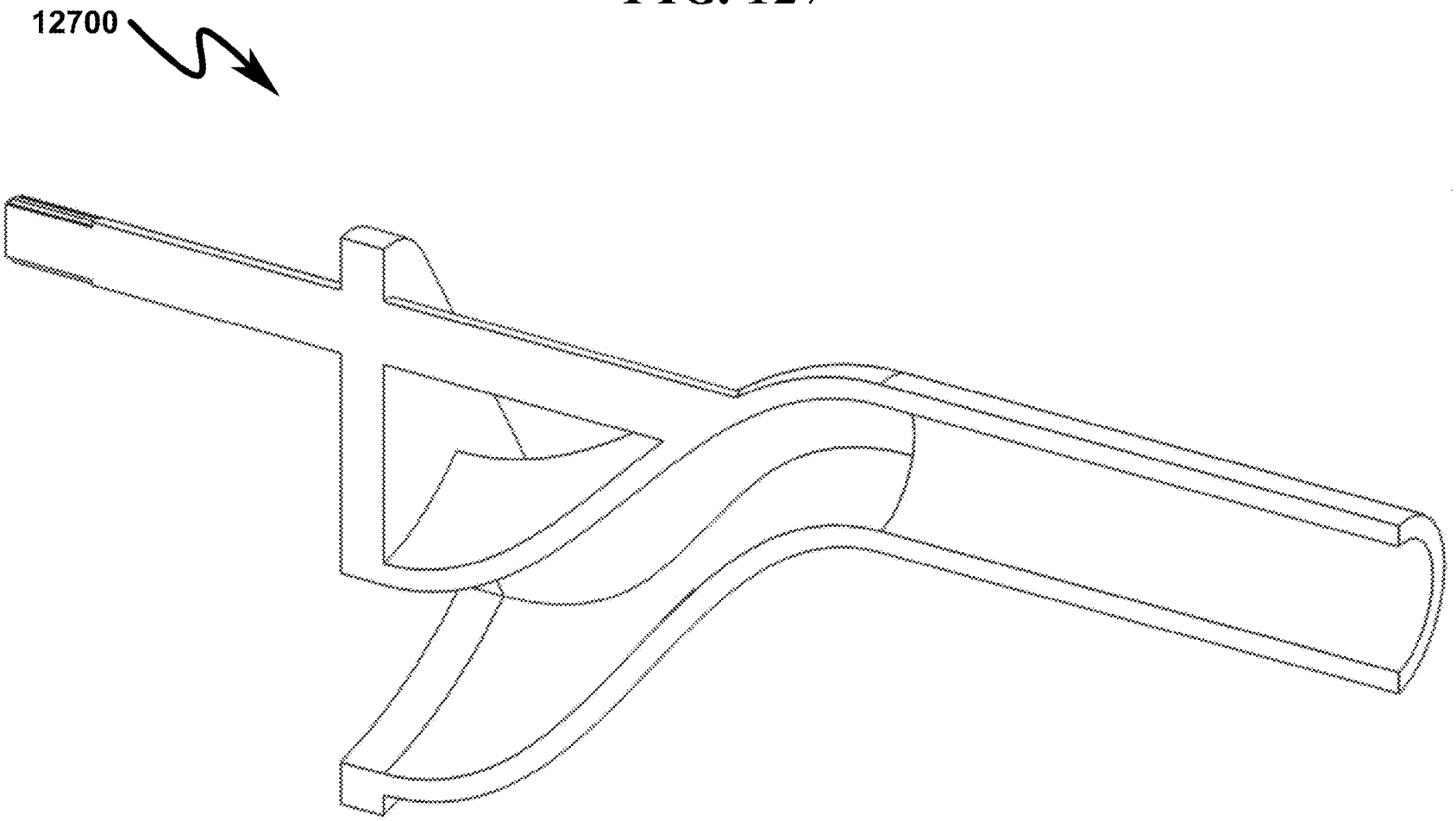
Figure 128:
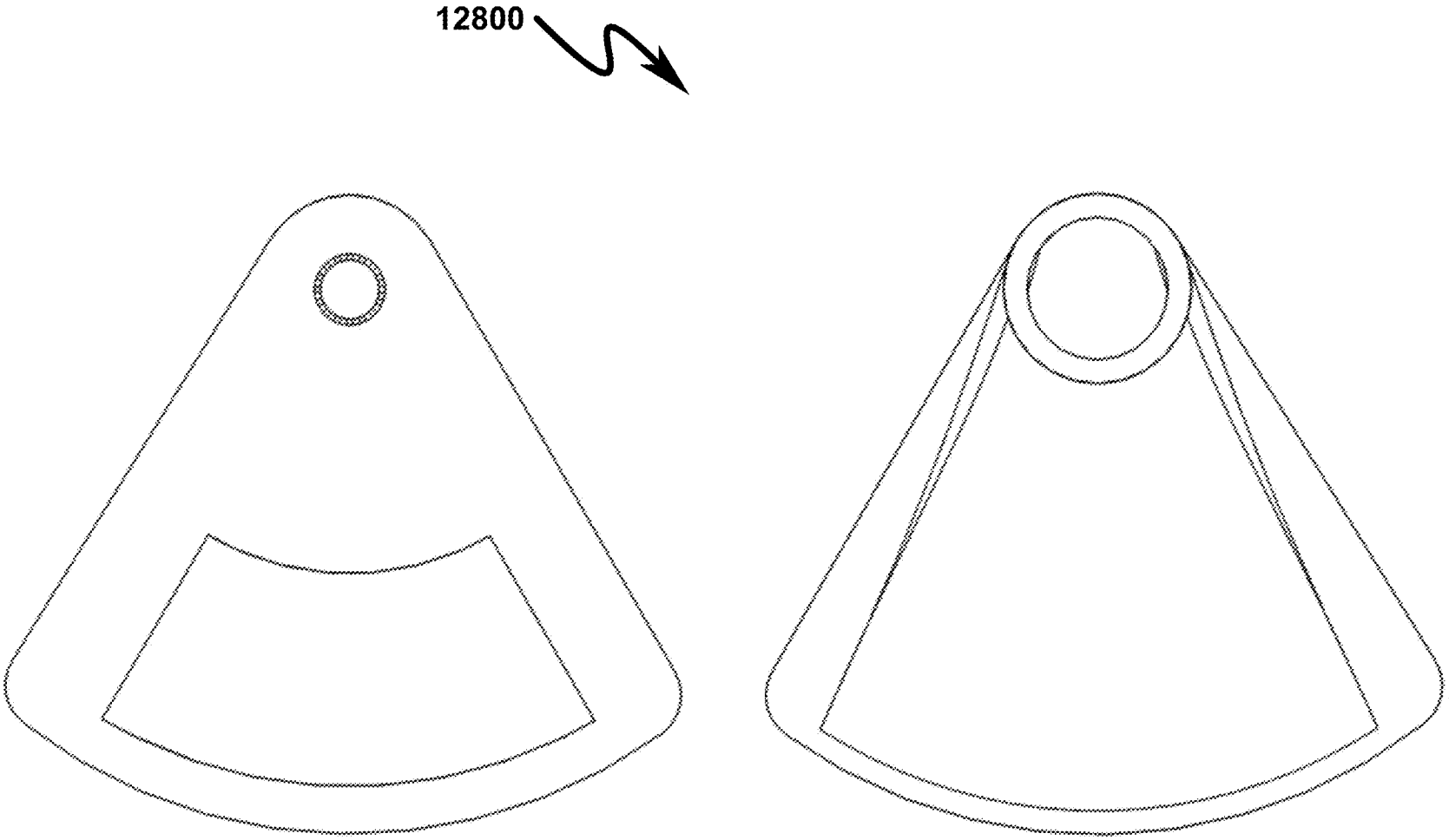

As depicted in the different alternate embodiments of FIG. 105 (10500)-FIG. 128 (12800), these YS embodiments may employ a single hydraulic tensioner as depicted in FIG. 106 (10600)-FIG. 128 (12800), or alternatively provide for multiple hydraulic tensioners (10501, 10502) as depicted in FIG. 105 (10500). One skilled in the art will recognize that the use of single or multiple tensioners will be application specific.

Alternate Preferred Embodiment—YE Tube (12900)-(15200)

Figure 129:
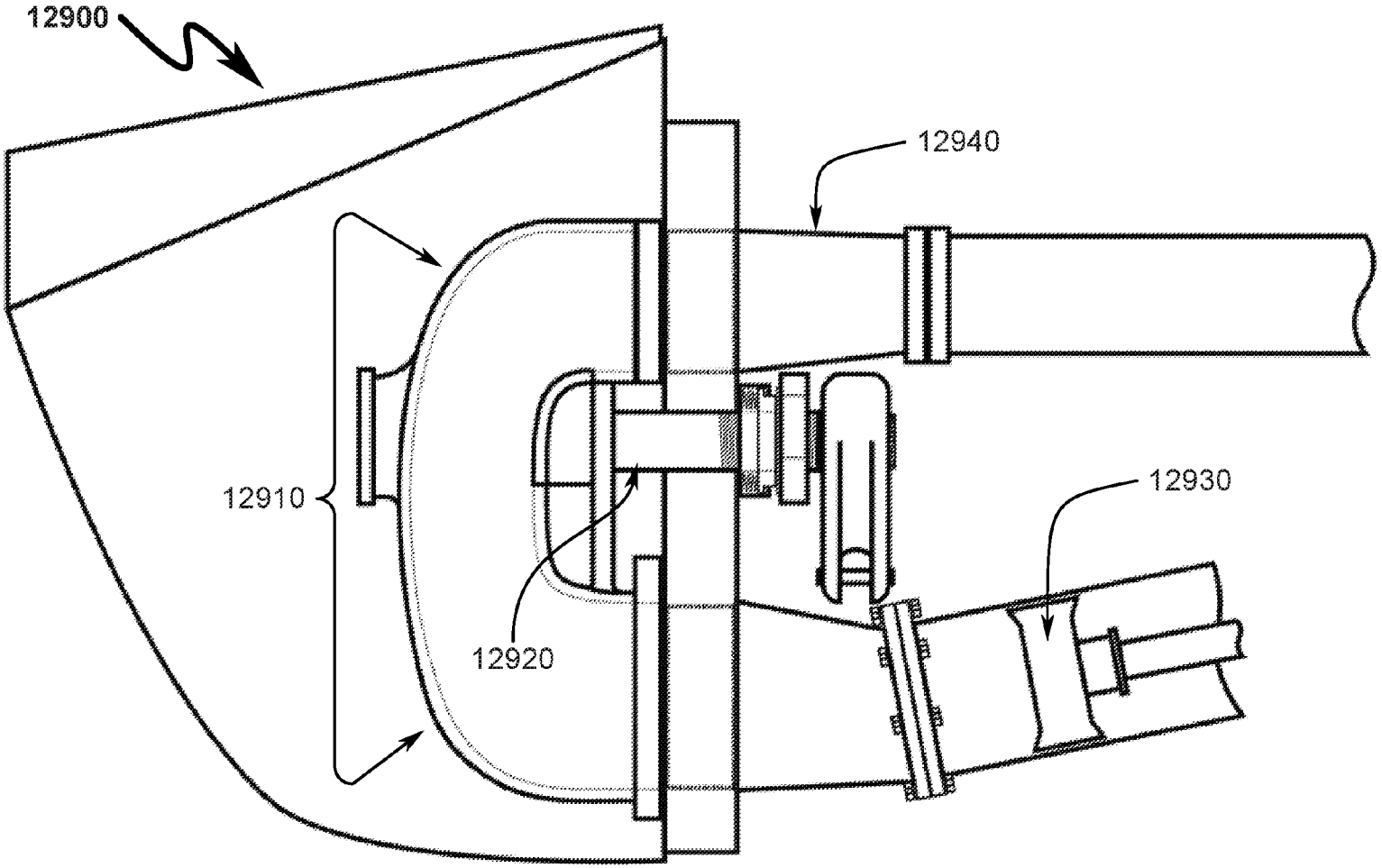
Figure 130:
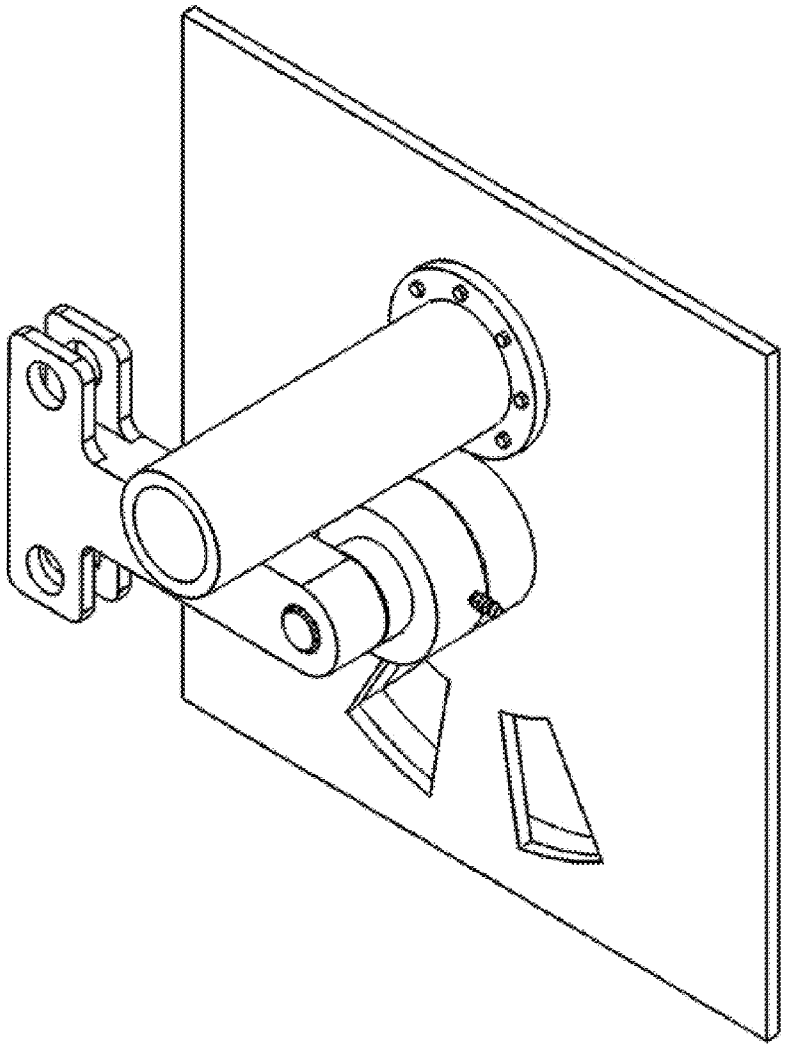

The present invention also anticipates that the output ejection port may have a variety of configurations. One alternative preferred output port configuration is generally illustrated in FIG. 129 (12900)-FIG. 152 (15200) and termed a 'YE-tube' configuration in that the output ejection port (12910) makes a U-turn and pivots around the driveshaft (12920) located between the material hopper output plumbing (12940) and inlet port hydraulic rams (12930) with the driveshaft (12920) positioned between the material input ports and the main ejection port which comprises a "kidney shaped" output seal. This configuration as shown generally in FIG. 129 (12900) can be mated with the trapezoidal injection port and hydraulic pump ram synchronization described to affect an efficient retrofit to existing concrete pump systems this configuration or integrated into newly manufactured units. One skilled in the art will recognise that this configuration differs from that previously described in that the articulation point for the ejection port may be driven from a coupling attached in front of the material hopper (on the same side of the material hopper as the hydraulic input pump rams) and between the input port inlet pump rams and the ejection port that feeds the concrete transportation boom plumbing.

The YE-tube configuration utilizes the trapezoid cutting ring and then makes a U-turn above the pivoting drive shaft to the outlet via a "kidney shaped" seal. This kidney-shaped type seal is utilized on prior art SCHWING® brand "Rock Valve" model concrete pumps but in contrast to the present invention embodiment it is configured to exit straight through towards the rear of the truck and then has to be plumbed back around towards the concrete transportation boom. Due to the use of trapezoid transitions utilized in the depicted exemplary invention embodiment (incorporating a longer slewing radius with the lever pointing down from the shaft towards the trapezoid transitions), the outlet utilizing a "kidney shaped" seal can be positioned above the slewing shaft in the direction of the concrete transportation boom thus greatly simplifying the plumbing associated with the concrete transportation boom. There also exists a huge offsetting structural load benefit within the YE-tube embodiment by having the kidney-shaped seal area force balance the opposing trapezoid seal area force with their combined forces working against the driveshaft thrust nut. This essentially balances the load presented to the driveshaft articulation axis and results in less power required to operate the concrete pumping system as well as reduced wear on driveshaft support components.

Alternate Preferred Embodiment—YU Tube (15300)-(19200)

The present invention also anticipates the output ejection port may have a variety of configurations. One alternative preferred output configuration is generally illustrated in FIG. 153 (15300)-FIG. 192 (19200) and termed a "YU-tube" configuration in that the output ejection port (15310) makes a U-turn and pivots around the driveshaft (15320) above the material hopper and inlet port hydraulic rams (15330). This configuration can be mated with the trapezoidal injection port and hydraulic pump ram synchronization described herein to affect an efficient retrofit to existing concrete pump systems using this configuration or integrated into newly manufactured units. One skilled in the art will recognize that this configuration differs from that previously described in that the articulation point for the ejection port may be driven from a coupling attached in front of the material hopper (on the same side of the material hopper as the hydraulic pump rams) and above the input port inlet pump rams.

The U-shaped output transition depicted in FIG. 161 (15300)-FIG. 192 (19200) is similar to prior art PUTZMEISTER® brand concrete pumps and is generally termed an "Elephant Trunk" or "C-Valve" and has the benefit of being directed towards the concrete transportation boom thus eliminating additional plumbing to implement this configuration. The combination of the U-shaped output valve and trapezoidal shaped spectacle plate in conjunction with phased hydraulics can transform traditional C-valve systems into continuous flow concrete pumps with minimal changes to the overall design of the system.

Alternative U-Shaped Transition (17700)-(19200)

The YU configuration depicted in FIG. 153 (15300)-FIG. 176 (17600) may have a variety of chambering/routing methodologies to connect the pump output port to the TSCR interface. While two variations are depicted in FIG. 177 (17700)-FIG. 184 (18400) (a fabricated assembly) and FIG.

185 (18500)-FIG. 192 (19200) (a cast assembly), the present invention does not make any limitations on the exact nature of this transition.

Preferred Embodiment System Summary

The present invention preferred exemplary system embodiment anticipates a wide variety of variations in the basic theme of construction, but can be generalized as a pump system comprising:

(a) material hopper (MHOP);
(b) trapezoidal-shaped spectacle plate (TSSP);
(c) hydraulic pump;
(d) trapezoidal-shaped cutting ring (TSCR); and
(e) ejection port;

wherein the TSSP comprises a first trapezoidal inlet port (FTIP) and a second trapezoidal inlet port (STIP);
the TSSP is attached to the MHOP and configured to supply material from the MHOP to the hydraulic pump through the FTIP and the STIP;
the hydraulic pump comprises a first hydraulic pump ram (FHPR) and a second hydraulic pump ram (SHPR);
the FHPR is configured to accept material via the FTIP;
the SHPR is configured to accept material via the STIP;
the TSCR comprises a trapezoidal receiver output port (TROP) configured to alternately traverse between positions that cover the FTIP and the STIP;
the TROP is configured to completely cover the FTIP and the STIP during the alternating traversal between the positions that cover the FTIP and the STIP;
the TROP is configured to direct material from the FTIP and the STIP to the ejection port;
the hydraulic pump is configured to eject material from the FHPR into the TROP when the TROP is positioned to cover the FTIP;
the hydraulic pump is configured to inject material from the MHOP into the SHPR when the TROP is positioned to cover the FTIP;
the hydraulic pump is configured to eject material from the SHPR into the TROP when the TROP is positioned to cover the STIP; and
the hydraulic pump is configured to inject material from the MHOP into the FHPR when the TROP is positioned to cover the STIP;
the TSCR comprises a transfer cavity having a geometric perimeter shape comprising an annular sector that approximates an isosceles trapezoid;
the TSSP comprises a transfer cavity having a geometric perimeter shape comprising an annular sector that approximates an isosceles trapezoid; and
the TSCR geometric perimeter shape and the TSSP geometric perimeter shape are not identical.

This general system summary may be augmented by the various elements described herein to produce a wide variety of invention embodiments consistent with this overall design description.

Preferred Embodiment Method Summary

The present invention preferred exemplary method embodiment anticipates a wide variety of variations in the basic theme of implementation, but can be generalized as a pump method, the method operating in conjunction with a pump system comprising:

(a) material hopper (MHOP);
(b) trapezoidal-shaped spectacle plate (TSSP);
(c) hydraulic pump;
(d) trapezoidal-shaped cutting ring (TSCR); and
(e) ejection port;

wherein the TSSP comprises a first trapezoidal inlet port (FTIP) and a second trapezoidal inlet port (STIP);
the TSSP is attached to the MHOP and configured to supply material from the MHOP to the hydraulic pump through the FTIP and the STIP;
the hydraulic pump comprises a first hydraulic pump ram (FHPR) and a second hydraulic pump ram (SHPR);
the FHPR is configured to accept material via the FTIP;
the SHPR is configured to accept material via the STIP;
the TSCR comprises a trapezoidal receiver output port (TROP) configured to alternately traverse between positions that cover the FTIP and the STIP;
the TROP is configured to completely cover the FTIP and the STIP during the alternating traversal between the positions that cover the FTIP and the STIP;
the TROP is configured to direct material from the FTIP and the STIP to the ejection port;
the hydraulic pump is configured to eject material from the FHPR into the TROP when the TROP is positioned to cover the FTIP;
the hydraulic pump is configured to inject material from the MHOP into the SHPR when the TROP is positioned to cover the FTIP;
the hydraulic pump is configured to eject material from the SHPR into the TROP when the TROP is positioned to cover the STIP; and
the hydraulic pump is configured to inject material from the MHOP into the FHPR when the TROP is positioned to cover the STIP;
the TSCR comprises a transfer cavity having a geometric perimeter shape comprising an annular sector that approximates an isosceles trapezoid;
the TSSP comprises a transfer cavity having a geometric perimeter shape comprising an annular sector that approximates an isosceles trapezoid; and
the TSCR geometric perimeter shape and the TSSP geometric perimeter shape are not identical;

wherein the method comprises the steps of:

(1) Centering the TROP over the TSSP to open the TROP to the FHPR and the SHPR;
(2) Ejecting material using the FHPR and the SHPR into the TROP;
(3) Shifting the TROP over the FHPR and sealing off the SHPR;
(4) Ejecting material into the TROP using the FHPR;
(5) Shifting the TROP over the FHPR and opening the SHPR to the MHOP;
(6) Ejecting material into the TROP using the FHPR and injecting material from the MHOP using the SHPR;
(7) Shifting the TROP over the FHPR and opening the SHPR to the MHOP;
(8) Ejecting material into the TROP using the FHPR and injecting material from the MHOP using the SHPR (optionally at twice the ejection rate of the FHPR);
(9) Shifting the TROP over the FHPR and sealing off the SHPR;
(10) Ejecting material into the TROP using the FHPR and stopping the SHPR when fully loaded;
(11) Centering the TROP over the TSSP to open the TROP to the FHPR and the SHPR;
(12) Ejecting material into the TROP using the FHPR and the SHPR;

(13) Shifting the TROP over the SHPR and sealing off the FHPR;

(14) Ejecting material into the TROP using the SHPR and stopping the FHPR when fully ejected;

(15) Shifting the TROP over the SHPR and opening the FHPR to the MHOP;

(16) Ejecting material into the TROP using the SHPR and injecting material from the MHOP using the FHPR (optionally at twice the ejection rate of the SHPR);

(17) Shifting the TROP over the SHPR and sealing off the FHPR;

(18) Ejecting material into the TROP using the SHPR and stopping the FHPR when fully loaded; and

(19) Proceeding to step (1) to repeat material pumping operations.

One skilled in the art will recognize that these method steps may be augmented or rearranged without limiting the teachings of the present invention. This general method summary may be augmented by the various elements described herein to produce a wide variety of invention embodiments consistent with this overall design description.

System/Method Variations

The present invention anticipates a wide variety of variations in the basic theme of construction. The examples presented previously do not represent the entire scope of possible usages. They are meant to cite a few of the almost limitless possibilities.

This basic system and method may be augmented with a variety of ancillary embodiments, including but not limited to:

An embodiment wherein the ejection port forms a YS configuration wherein:

the ejection port is configured to rotate about an axis coincident with material transportation plumbing located above the hydraulic pump; and the material transportation plumbing couples to the ejection port on the opposite side of the material hopper as the hydraulic pump.

An embodiment wherein the ejection port forms a YE configuration wherein:

the ejection port is configured to form a U-shaped member that rotates about an axis located between material transportation plumbing and the hydraulic pump;

the material transportation plumbing is coupled to the U-shaped member via a kidney-shaped output port; and the material transportation plumbing intersects the U-shaped member on the same side of the material hopper as the hydraulic pump.

An embodiment wherein the ejection port forms a YU configuration wherein:

the ejection port is configured to form a U-shaped member that rotates about an axis coincident with material transportation plumbing that is concentric with the axis;

the material transportation plumbing is coupled to the U-shaped member along the axis; and the material transportation plumbing intersects the U-shaped member on the same side of the material hopper as the hydraulic pump.

An embodiment wherein the TSCR comprises a side edge that intersects a shearing offset axis (SOA) that is below an axis of rotation (AOR) about which the TSCR rotates.

An embodiment wherein the TSCR comprises a side edge that intersects a shearing offset axis (SOA) that is above an axis of rotation (AOR) about which the TSCR rotates.

An embodiment wherein the TSSP comprises a side edge that intersects a shearing offset axis (SOA) that is below an axis of rotation (AOR) about which the TSCR rotates.

An embodiment wherein the TSSP comprises a side edge that intersects a shearing offset axis (SOA) that is above an axis of rotation (AOR) about which the TSCR rotates.

An embodiment wherein the TSCR comprises a side edge that intersects a shearing offset axis (SOA) that is below an axis of rotation (AOR) about which the TSCR rotates and the TSSP comprises a side edge that intersects a shearing offset axis (SOA) that is above an axis of rotation (AOR) about which the TSCR rotates.

An embodiment wherein the TSCR comprises a side edge that intersects a shearing offset axis (SOA) that is above an axis of rotation (AOR) about which the TSCR rotates and the TSSP comprises a side edge that intersects a shearing offset axis (SOA) that is below an axis of rotation (AOR) about which the TSCR rotates.

An embodiment wherein the FHPR and the SHPR are configured to operate at different speeds and configured to coordinate their operation to provide for uniform material flow through said ejection port.

One skilled in the art will recognize that other embodiments are possible based on combinations of elements taught within the above invention description.

CONCLUSION

A pump system/method configured to provide substantially constant flow of concrete, cement, or other material has been disclosed. The system integrates a trapezoidal cutting ring and spectacle plate in conjunction with lofted transitional interfaces to the hydraulic pump cylinder rams and output ejection port to ensure that pressurized discharge concrete material is not allowed to be relaxed nor backflow into the material sourcing hopper. The trapezoidal cutting ring is configured to completely seal off the trapezoidal spectacle ports as it smoothly transitions between the hydraulic pump input ports during cycle changes thus generating a more uniform output flow of concrete while eliminating hopper backflow and hydraulic fluid shock. A control system is configured to coordinate operation of the hydraulic pump cylinder rams and cutting ring to ensure that output ejection port pressure and material flow is maintained at a relatively constant level throughout all portions of the pumping cycle.

What is claimed is:

1. A pump system comprising:

(a) a material hopper (MHOP);

(b) a trapezoidal-shaped spectacle plate (TSSP);

(c) a hydraulic pump;

(d) a trapezoidal-shaped cutting ring (TSCR); and (e) an ejection port;

wherein:

said TSSP comprises a first trapezoidal inlet port (FTIP) and a second trapezoidal inlet port (STIP);

said TSSP is attached to said MHOP and configured to supply material from said MHOP to said hydraulic pump through said FTIP and said STIP;

said hydraulic pump comprises a first hydraulic pump ram (FHPR) and a second hydraulic pump ram (SHPR);

said FHPR is configured to accept material via said FTIP;

said SHPR is configured to accept material via said STIP;

said TSCR comprises a trapezoidal receiver output port (TROP) configured to alternately traverse between positions that cover said FTIP and said STIP;

said TROP is configured to completely cover said FTIP and said STIP during said alternating traversal between said positions that cover said FTIP and said STIP;

said TROP is configured to direct material from said FTIP and said STIP to said ejection port;

said hydraulic pump is configured to eject material from said FHPR into said TROP when said TROP is positioned to cover said FTIP;

said hydraulic pump is configure to inject material from said MHOP into said SHPR when said TROP is positioned to cover said FTIP;

said hydraulic pump is configured to eject material from said SHPR into said TROP when said TROP is positioned to cover said STIP; and said hydraulic pump is configured to inject material from said MHOP into said FHPR when said TROP is positioned to cover said STIP;

said TSCR comprises a transfer cavity having a geometric perimeter shape comprising an annular sector that approximates an isosceles trapezoid;

said TSSP comprises a transfer cavity having a geometric perimeter shape comprising an annular sector that approximates an isosceles trapezoid; and said TSCR geometric perimeter shape and said TSSP geometric perimeter shape are not identical.

2. The pump system of claim 1 wherein said ejection port forms a YS configuration wherein:

said ejection port is configured to rotate about an axis coincident with material transportation plumbing located above said hydraulic pump; and said material transportation plumbing couples to said ejection port on the opposite side of said material hopper as said hydraulic pump.

3. The pump system of claim 1 wherein said ejection port forms a YE configuration wherein:

said ejection port is configured to form a U-shaped member that rotates about an axis located between material transportation plumbing and said hydraulic pump;

said material transportation plumbing is coupled to said U-shaped member via a kidney-shaped output port; and said material transportation plumbing intersects said U-shaped member on the same side of said material hopper as said hydraulic pump.

4. The pump system of claim 1 wherein said ejection port forms a YU configuration wherein:

said ejection port is configured to form a U-shaped member that rotates about an axis coincident with material transportation plumbing that is concentric with said axis;

said material transportation plumbing is coupled to said U-shaped member along said axis; and said material transportation plumbing intersects said U-shaped member on the same side of said material hopper as said hydraulic pump.

5. The pump system of claim 1 wherein said TSCR comprises a side edge that intersects a shearing offset axis (SOA) that is below an axis of rotation (AOR) about which said TSCR rotates.

6. The pump system of claim 1 wherein said TSCR comprises a side edge that intersects shearing offset axis (SOA) that is above an axis of rotation (AOR) about which said TSCR rotates.

7. The pump system of claim 1 wherein said TSSP comprises a side edge that intersects a shearing offset axis (SOA) that is below an axis of rotation (AOR) about which said TSCR rotates.

8. The pump system of claim 1 wherein said TSSP comprises a side edge that intersects a shearing offset axis (SOA) that is above an axis of rotation (AOR) about which said TSCR rotates.

9. The pump system of claim 1 wherein said TSCR comprises a side edge that intersects a shearing offset axis (SOA) that is below an axis of rotation (AOR) about which said TSCR rotates and said TSSP comprises a side edge that intersects a shearing offset axis (SOA) that is above an axis of rotation (AOR) about which said TSCR rotates.

10. The pump system of claim 1 wherein said TSCR comprises a side edge that intersects a shearing offset axis (SOA) that is above an axis of rotation (AOR) about which said TSCR rotates and said TSSP comprises a side edge that intersects a shearing offset axis (SOA) that is below an axis of rotation (AOR) about which said TSCR rotates.

* * * * *